US008196652B2

(12) United States Patent
Brisco et al.

(10) Patent No.: US 8,196,652 B2
(45) Date of Patent: Jun. 12, 2012

(54) RADIAL EXPANSION SYSTEM

(75) Inventors: David Paul Brisco, Duncan, OK (US); Brock Wayne Watson, Carrollton, TX (US); Mark Shuster, Rozeuseomlaan (NL); Malcolm Gray, Houston, TX (US); Grigoriy Grinberg, Sylvania, OH (US); Scott Costa, Katy, TX (US); Russell Wasson, Houston, TX (US)

(73) Assignee: Enventure Global Technology, LLC, Houston, TX (US)

( * ) Notice: Subject to any disclaimer, the term of this patent is extended or adjusted under 35 U.S.C. 154(b) by 854 days.

(21) Appl. No.: 11/573,482

(22) PCT Filed: Aug. 11, 2005

(86) PCT No.: PCT/US2005/028446

§ 371 (c)(1),
(2), (4) Date: Dec. 9, 2008

(87) PCT Pub. No.: WO2006/020723

PCT Pub. Date: Feb. 23, 2006

(65) Prior Publication Data

US 2009/0193871 A1 Aug. 6, 2009

Related U.S. Application Data

(60) Provisional application No. 60/600,679, filed on Aug. 11, 2004.

(51) Int. Cl.
*E21B 23/00* (2006.01)

(52) U.S. Cl. ..... 166/207; 166/242.6

(58) Field of Classification Search ..... 166/380, 166/382, 207, 242.1, 242.6, 206; 72/56–58, 72/370.6–370.8, 393
See application file for complete search history.

(56) References Cited

U.S. PATENT DOCUMENTS

| | | | | |
|---|---|---|---|---|
| 2,748,039 | A | 5/1956 | Adams et al. | |
| 3,746,091 | A * | 7/1973 | Owen et al. | 166/107 |
| 3,785,193 | A | 1/1974 | Kinley et al. | |
| 5,667,011 | A * | 9/1997 | Gill et al. | 166/295 |
| 6,263,968 | B1 | 7/2001 | Freeman et al. | |
| 6,543,552 | B1 | 4/2003 | Metcalfe et al. | |
| 6,634,431 | B2 | 10/2003 | Cook | |
| 7,011,161 | B2 | 3/2006 | Ring et al. | |
| 7,048,062 | B2 | 5/2006 | Ring et al. | |
| 7,169,239 | B2 * | 1/2007 | Reavis et al. | 148/320 |
| 7,404,438 | B2 | 7/2008 | Reavis et al. | |
| 2002/0117538 | A1 | 8/2002 | Hohl et al. | |
| 2003/0008171 | A1 | 1/2003 | Toyooka et al. | |
| 2003/0062402 | A1 | 4/2003 | Takahashi et al. | |
| 2003/0121558 | A1 * | 7/2003 | Cook et al. | 138/98 |

(Continued)

FOREIGN PATENT DOCUMENTS

GB 2420811 6/2006

(Continued)

OTHER PUBLICATIONS

Non-Final Office Action for U.S. Appl. No. 11/573,485 issued Jul. 25, 2011, 11 pages.

*Primary Examiner* — Hoang Dang
(74) *Attorney, Agent, or Firm* — Edmonds & Nolte, PC; Derek V. Forinash

(57) ABSTRACT

A radial expansion system.

16 Claims, 87 Drawing Sheets

U.S. PATENT DOCUMENTS

| | | | | |
|---|---|---|---|---|
| 2005/0217768 | A1 | 10/2005 | Asahi et al. | |
| 2005/0236159 | A1 | 10/2005 | Costa et al. | |
| 2006/0048948 | A1 | 3/2006 | Noel | |
| 2006/0112768 | A1 | 6/2006 | Shuster et al. | |
| 2006/0162938 | A1* | 7/2006 | Lohbeck et al. | 166/380 |
| 2006/0243452 | A1* | 11/2006 | Eckerlin | 166/380 |
| 2006/0283603 | A1 | 12/2006 | Shuster et al. | |
| 2007/0116975 | A1 | 5/2007 | Yamazaki et al. | |
| 2007/0163785 | A1 | 7/2007 | Shuster et al. | |
| 2007/0205001 | A1 | 9/2007 | Shuster et al. | |
| 2007/0215360 | A1 | 9/2007 | Shuster et al. | |
| 2007/0266756 | A1 | 11/2007 | Shuster et al. | |
| 2008/0000645 | A1 | 1/2008 | Brisco | |
| 2008/0104823 | A1 | 5/2008 | Shuster et al. | |
| 2008/0257542 | A1 | 10/2008 | Brisco | |
| 2008/0286504 | A1 | 11/2008 | Asahi et al. | |
| 2009/0193871 | A1 | 8/2009 | Brisco et al. | |
| 2009/0301733 | A1 | 12/2009 | Zwald, Jr. | |
| 2010/0024348 | A1 | 2/2010 | Brisco | |

FOREIGN PATENT DOCUMENTS

| | | | |
|---|---|---|---|
| WO | 2006014333 | A2 | 2/2006 |
| WO | 2006017459 | A2 | 2/2006 |
| WO | WO2006020809 | | 2/2006 |
| WO | WO2006102556 | | 9/2006 |
| WO | WO2006/020726 | | 1/2008 |

* cited by examiner

RADIAL EXPANSION SYSTEM

CROSS REFERENCE TO RELATED APPLICATIONS

This application is a continuation-in-part of one or more of the following: (1) PCT application US02/04353, filed on Feb. 14, 2002, which claims priority from U.S. provisional patent application Ser. No. 60/270,007, filed on Feb. 20, 2001; (2) PCT application US03/00609, filed on Jan. 9, 2003, which claims priority from U.S. provisional patent application Ser. No. 60/357,372, filed on Feb. 15, 2002; and (3) U.S. provisional patent application Ser. No. 60/585,370, filed on Jul. 2, 2004, the disclosures of which are incorporated herein by reference.

This application is related to the following applications: (1) U.S. Pat. No. 6,497,289, which was filed as U.S. patent application Ser. No. 09/454,139, filed on Dec. 3, 1999, which claims priority from provisional application 60/111,293, filed on Dec. 7, 1998, (2) U.S. patent application Ser. No. 09/510,913, filed on Feb. 23, 2000, which claims priority from provisional application 60/121,702, filed on Feb. 25, 1999, (3) U.S. patent application Ser. No. 09/502,350, filed on Feb. 10, 2000, which claims priority from provisional application 60/119,611, filed on Feb. 11, 1999, (4) U.S. Pat. No. 6,328,113, which was filed as U.S. patent application Ser. No. 09/440,338, filed on Nov. 15, 1999, which claims priority from provisional application 60/108,558, filed on Nov. 16, 1998, (5) U.S. patent application Ser. No. 10/169,434, filed on Jul. 1, 2002, which claims priority from provisional application 60/183,546, filed on Feb. 18, 2000, (6) U.S. patent application Ser. No. 09/523,468, filed on Mar. 10, 2000, which claims priority from provisional application 60/124,042, filed on Mar. 11, 1999, (7) U.S. Pat. No. 6,568,471, which was filed as patent application Ser. No. 09/512,895, filed on Feb. 24, 2000, which claims priority from provisional application 60/121,841, filed on Feb. 26, 1999, (8) U.S. Pat. No. 6,575,240, which was filed as patent application Ser. No. 09/511,941, filed on Feb. 24, 2000, which claims priority from provisional application 60/121,907, filed on Feb. 26, 1999, (9) U.S. Pat. No. 6,557,640, which was filed as patent application Ser. No. 09/588,946, filed on Jun. 7, 2000, which claims priority from provisional application 60/137,998, filed on Jun. 7, 1999, (10) U.S. patent application Ser. No. 09/981,916, filed on Oct. 18, 2001 as a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (11) U.S. Pat. No. 6,604,763, which was filed as application Ser. No. 09/559,122, filed on Apr. 26, 2000, which claims priority from provisional application 60/131,106, filed on Apr. 26, 1999, (12) U.S. patent application Ser. No. 10/030,593, filed on Jan. 8, 2002, which claims priority from provisional application 60/146,203, filed on Jul. 29, 1999, (13) U.S. provisional patent application Ser. No. 60/143,039, filed on Jul. 9, 1999, (14) U.S. patent application Ser. No. 10/111,982, filed on Apr. 30, 2002, which claims priority from provisional patent application Ser. No. 60/162,671, filed on Nov. 1, 1999, (15) U.S. provisional patent application Ser. No. 60/154,047, filed on Sep. 16, 1999, (16) U.S. provisional patent application Ser. No. 60/438,828, filed on Jan. 9, 2003, (17) U.S. Pat. No. 6,564,875, which was filed as application Ser. No. 09/679,907, on Oct. 5, 2000, which claims priority from provisional patent application Ser. No. 60/159,082, filed on Oct. 12, 1999, (18) U.S. patent application Ser. No. 10/089,419, filed on Mar. 27, 2002, which claims priority from provisional patent application Ser. No. 60/159,039, filed on Oct. 12, 1999, (19) U.S. patent application Ser. No. 09/679,906, filed on Oct. 5, 2000, which claims priority from provisional patent application Ser. No. 60/159,033, filed on Oct. 12, 1999, (20) U.S. patent application Ser. No. 10/303,992, filed on Nov. 22, 2002, which claims priority from provisional patent application Ser. No. 60/212,359, filed on Jun. 19, 2000, (21) U.S. provisional patent application Ser. No. 60/165,228, filed on Nov. 12, 1999, (22) U.S. provisional patent application Ser. No. 60/455,051, filed on Mar. 14, 2003, (23) PCT application US02/2477, filed on Jun. 26, 2002, which claims priority from U.S. provisional patent application Ser. No. 60/303,711, filed on Jul. 6, 2001, (24) U.S. patent application Ser. No. 10/311,412, filed on Dec. 12, 2002, which claims priority from provisional patent application Ser. No. 60/221,443, filed on Jul. 28, 2000, (25) U.S. patent application Ser. No. 10/, filed on Dec. 18, 2002, which claims priority from provisional patent application Ser. No. 60/221,645, filed on Jul. 28, 2000, (26) U.S. patent application Ser. No. 10/322,947, filed on Jan. 22, 2003, which claims priority from provisional patent application Ser. No. 60/233,638, filed on Sep. 18, 2000, (27) U.S. patent application Ser. No. 10/406,648, filed on Mar. 31, 2003, which claims priority from provisional patent application Ser. No. 60/237,334, filed on Oct. 2, 2000, (28) PCT application US02/04353, filed on Feb. 14, 2002,which claims priority from U.S. provisional patent application Ser. No. 60/270,007, filed on Feb. 20, 2001, (29) U.S. patent application Ser. No. 10/465,835, filed on Jun. 13, 2003, which claims priority from provisional patent application Ser. No. 60/262,434, filed on Jan. 17, 2001, (30) U.S. patent application Ser. No. 10/465,831, filed on Jun. 13, 2003, 25791.52.06, which claims priority from U.S. provisional patent application Ser. No. 60/259,486, filed on Jan. 3, 2001, (31) U.S. provisional patent application Ser. No. 60/452,303, filed on Mar. 5, 2003, U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (33) U.S. Pat. No. 6,561,227, which was filed as patent application Ser. No. 09/852,026, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (34) U.S. patent application Ser. No. 09/852,027, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (35) PCT Application US02/25608, filed on Aug. 13, 2002, which claims priority from provisional application 60/318,021, filed on Sep. 7, 2001, PCT Application US02/24399, filed on Aug. 1, 2002, which claims priority from U.S. provisional patent application Ser. No. 60/313,453, filed on Aug. 20, 2001, (37) PCT Application US02/29856, filed on Sep. 19, 2002, which claims priority from U.S. provisional patent application Ser. No. 60/326,886, filed on Oct. 3, 2001, (38) PCT Application US02/20256, filed on Jun. 26, 2002, which claims priority from U.S. provisional patent application Ser. No. 60/303,740, filed on Jul. 6, 2001, (39) U.S. patent application Ser. No. 09/962,469, filed on Sep. 25, 2001, which is a divisional of U.S. patent application Ser. No. 09/523,468, filed on Mar. 10, 2000, which claims priority from provisional application 60/124,042, filed on Mar. 11, 1999, (40) U.S. patent application Ser. No. 09/962,470, filed on Sep. 25, 2001, which is a divisional of U.S. patent application Ser. No. 09/523,468, filed on Mar. 10, 2000, which claims priority from provisional application 60/124,042, filed on Mar. 11, 1999, (41) U.S. patent application Ser. No. 09/962,471, filed on Sep. 25, 2001, which is a divisional of U.S. patent application Ser. No. 09/523,468, filed on Mar. 10, 2000, which claims priority from provisional application 60/124,042, filed on Mar. 11, 1999, (42) U.S. patent application Ser. No. 09/962,467, filed on Sep. 25, 2001, which is a divisional of U.S. patent application Ser. No. 09/523,468, filed on Mar. 10, 2000, which claims priority from provisional application 60/124,042, filed on Mar. 11, 1999, (43) U.S. patent application Ser. No. 09/962,468, filed on Sep. 25, 2001, which is a divisional of U.S. patent application Ser. No. 09/523,468, filed on Mar. 10, 2000, which claims priority from provisional application 60/124,042, filed on Mar. 11, 1999, (44) PCT application US02/25727, filed on Aug. 14, 2002, which claims priority from U.S. provisional patent application Ser. No. 60/317,985, filed on Sep. 6, 2001, and U.S. provisional patent application Ser. No. 60/318,386, filed on Sep. 10, 2001, (45) PCT application US02/39425, filed on Dec. 10, 2002, which claims priority from U.S. provisional patent application Ser. No. 60/343,674, filed on Dec. 27, 2001, (46) U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (47) U.S. utility patent application Ser. No. 10/516,467, filed on Dec. 10, 2001, which is a continuation application of U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (48) PCT application US03/00609, filed on Jan. 9, 2003, which claims priority from U.S. provisional patent application Ser. No. 60/357,372, filed on Feb. 15, 2002, (49) U.S. patent application Ser. No. 10/074,703, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (50) U.S. patent application Ser. No. 10/074,244, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (51) U.S. patent application Ser. No. 10/076,660, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (52) U.S. patent application Ser. No. 10/076,661, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (53) U.S. patent application Ser. No. 10/076,659, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (54) U.S. patent application Ser. No. 10/078,928, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (55) U.S. patent application Ser. No. 10/078,922, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (56) U.S. patent application Ser. No. 10/078,921, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (57) U.S. patent application Ser. No. 10/261,928, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (58) U.S. patent application Ser. No. 10/079,276, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (59) U.S. patent application Ser. No. 10/262,009, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (60) U.S. patent application Ser. No. 10/092,481, filed on Mar. 7, 2002, which is a divisional of U.S. Pat. No. 6,568,471, which was filed as patent application Ser. No. 09/512,895,filed on Feb. 24, 2000, which claims priority from provisional application 60/121,841, filed on Feb. 26, 1999, (61) U.S. patent application Ser. No. 10/261,926, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (62) PCT application US02/36157, filed on Nov. 12, 2002, which claims priority from U.S. provisional patent application Ser. No. 60/338,996, filed on Nov. 12, 2001, (63) PCT application US02/36267, filed on Nov. 12, 2002, which claims priority from U.S. provisional patent application Ser. No. 60/339,013, filed on Nov. 12, 2001, (64) PCT application US03/11765, filed on Apr. 16, 2003, which claims priority from U.S. provisional patent application Ser. No. 60/383,917, filed on May 29, 2002, (65) PCT application US03/15020, filed on May 12, 2003, which claims priority from U.S. provisional patent application Ser. No. 60/391,703, filed on Jun. 26, 2002, (66) PCT application US02/39418, filed on Dec. 10, 2002, which claims priority from U.S. provisional patent application Ser. No. 60/346,309, filed on Jan. 7, 2002, (67) PCT application US03/06544, filed on Mar. 4, 2003, which claims priority from U.S. provisional patent application Ser. No. 60/372,048, filed on Apr. 12, 2002, (68) U.S. patent application Ser. No. 10/331,718, filed on Dec. 30, 2002, which is a divisional U.S. patent application Ser. No. 09/679,906, filed on Oct. 5, 2000, which claims priority from provisional patent application Ser. No. 60/159,033, filed on Oct. 12, 1999, (69) PCT application US03/04837, filed on Feb. 29, 2003, which claims priority from U.S. provisional patent application Ser. No. 60/363,829, filed on Mar. 13, 2002, (70) U.S. patent application Ser. No. 10/261,927, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (71) U.S. patent application Ser. No. 10/262,008, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (72) U.S.

patent application Ser. No. 10/261,925, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (73) U.S. patent application Ser. No. 10/199,524, filed on Jul. 19, 2002, which is a continuation of U.S. Pat. No. 6,497,289, which was filed as U.S. patent application Ser. No. 09/454,139, filed on Dec. 3, 1999, which claims priority from provisional application 60/111,293, filed on Dec. 7, 1998, (74) PCT application US03/10144, filed on Mar. 28, 2003, which claims priority from U.S. provisional patent application Ser. No. 60/372,632, filed on Apr. 15, 2002, (75) U.S. provisional patent application Ser. No. 60/412,542, filed on Sep. 20, 2002, (76) PCT application US03/14153, filed on May 6, 2003, which claims priority from U.S. provisional patent application Ser. No. 60/380,147, filed on May 6, 2002, (77) PCT application US03/19993, filed on Jun. 24, 2003, which claims priority from U.S. provisional patent application Ser. No. 60/397,284, filed on Jul. 19, 2002, (78) PCT application US03/13787, filed on May 5, 2003, which claims priority from U.S. provisional patent application Ser. No. 60/387,486, filed on Jun. 10, 2002, (79) PCT application US03/18530, filed on Jun. 11, 2003, which claims priority from U.S. provisional patent application Ser. No. 60/387,961, filed on Jun. 12, 2002, (80) PCT application US03/20694, filed on Jul. 1, 2003, which claims priority from U.S. provisional patent application Ser. No. 60/398,061, filed on Jul. 24, 2002, (81) PCT application US03/20870, filed on Jul. 2, 2003, which claims priority from U.S. provisional patent application Ser. No. 60/399,240, filed on Jul. 29, 2002, (82) U.S. provisional patent application Ser. No. 60/412,487, filed on Sep. 20, 2002, (83) U.S. provisional patent application Ser. No. 60/412,488, filed on Sep. 20, 2002, (84) U.S. patent application Ser. No. 10/280,356, filed on Oct. 25, 2002, which is a continuation of U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (85) U.S. provisional patent application Ser. No. 60/412,177, filed on Sep. 20, 2002, (86) U.S. provisional patent application Ser. No. 60/412,653, filed on Sep. 20, 2002, (87) U.S. provisional patent application Ser. No. 60/405,610, filed on Aug. 23, 2002, (88) U.S. provisional patent application Ser. No. 60/405,394, filed on Aug. 23, 2002, (89) U.S. provisional patent application Ser. No. 60/412,544, filed on Sep. 20, 2002, (90) PCT application US03/24779, filed on Aug. 8, 2003, which claims priority from U.S. provisional patent application Ser. No. 60/407,442, filed on Aug. 30, 2002, (91) U.S. provisional patent application Ser. No. 60/423,363, filed on Dec. 10, 2002, (92) U.S. provisional patent application Ser. No. 60/412,196, filed on Sep. 20, 2002, (93) U.S. provisional patent application Ser. No. 60/412,187, filed on Sep. 20, 2002, (94) U.S. provisional patent application Ser. No. 60/412,371, filed on Sep. 20, 2002, (95) U.S. patent application Ser. No. 10/382,325, filed on Mar. 5, 2003, which is a continuation of U.S. Pat. No. 6,557,640, which was filed as patent application Ser. No. 09/588,946, filed on Jun. 7, 2000, which claims priority from provisional application 60/137,998, filed on Jun. 7, 1999, (96) U.S. patent application Ser. No. 10/624,842, filed on Jul. 22, 2003, which is a divisional of U.S. patent application Ser. No. 09/502,350, filed on Feb. 10, 2000, which claims priority from provisional application 60/119,611, filed on Feb. 11, 1999, (97) U.S. provisional patent application Ser. No. 60/431,184, filed on Dec. 5, 2002, (98) U.S. provisional patent application Ser. No. 60/448,526, filed on Feb. 18, 2003, (99) U.S. provisional patent application Ser. No. 60/461,539, filed on Apr. 9, 2003, (100) U.S. provisional patent application Ser. No. 60/462,750, filed on Apr. 14, 2003, (101) U.S. provisional patent application Ser. No. 60/436,106, filed on Dec. 23, 2002, (102) U.S. provisional patent application Ser. No. 60/442,942, filed on Jan. 27, 2003, (103) U.S. provisional patent application Ser. No. 60/442,938, filed on Jan. 27, 2003, (104) U.S. provisional patent application Ser. No. 60/418,687, filed on Apr. 18, 2003, (105) U.S. provisional patent application Ser. No. 60/454,896, filed on Mar. 14, 2003, (106) U.S. provisional patent application Ser. No. 60/450,504, filed on Feb. 26, 2003, (107) U.S. provisional patent application Ser. No. 60/451,152, filed on Mar. 9, 2003, (108) U.S. provisional patent application Ser. No. 60/455,124, filed on Mar. 17, 2003, (109) U.S. provisional patent application Ser. No. 60/453,678, filed on Mar. 11, 2003, (110) U.S. patent application Ser. No. 10/421,682, filed on Apr. 23, 2003, which is a continuation of U.S. patent application Ser. No. 09/523,468, filed on Mar. 10, 2000, which claims priority from provisional application 60/124,042, filed on Mar. 11, 1999, (111) U.S. provisional patent application Ser. No. 60/457,965, filed on Mar. 27, 2003, (112) U.S. provisional patent application Ser. No. 60/455,718, filed on Mar. 18, 2003, (113) U.S. Pat. No. 6,550,821, which was filed as patent application Ser. No. 09/811,734, filed on Mar. 19, 2001, (114) U.S. patent application Ser. No. 10/436,467, filed on May 12, 2003, which is a continuation of U.S. Pat. No. 6,604,763, which was filed as application Ser. No. 09/559,122, filed on Apr. 26, 2000, which claims priority from provisional application 60/131,106, filed on Apr. 26, 1999, (115) U.S. provisional patent application Ser. No. 60/459,776, filed on Apr. 2, 2003, (116) U.S. provisional patent application Ser. No. 60/461,094, filed on Apr. 8, 2003, (117) U.S. provisional patent application Ser. No. 60/461,038, filed on Apr. 17, 2003, (118) U.S. provisional patent application Ser. No. 60/463,586, filed on Apr. 17, 2003, (119) U.S. provisional patent application Ser. No. 60/472,240, filed on May 20, 2003, (120) U.S. patent application Ser. No. 10/619,285, filed on Jul. 14, 2003, which is a continuation-in-part of U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (121) U.S. utility patent application Ser. No. 10/418,688, which was filed on Apr. 18, 2003, as a division of U.S. utility patent application Ser. No. 09/523,468, filed on Mar. 10, 2000, which claims priority from provisional application 60/124,042, filed on Mar. 11, 1999, (122) PCT patent application serial no. PCT/US04/06246, filed on Feb. 26, 2004, (123) PCT patent application serial number PCT/US04/08170, filed on Mar. 15, 2004, (124) PCT patent application serial number PCT/US04/08171, filed on Mar. 15, 2004, (125) PCT patent application serial number PCT/US04/08073, filed on Mar. 18, 2004, (126) PCT patent application serial number PCT/US04/07711, filed on Mar. 11, 2004, (127) PCT patent application serial number PCT/US2004/009434, filed on Mar. 26, 2004, (128) PCT patent application serial number PCT/US2004/010317, filed on Apr. 2, 2004, (129) PCT patent application serial number PCT/US2004/010712, filed on Apr. 6, 2004, (130) PCT patent application serial number PCT/US2004/010762, filed on Apr. 6, 2004, (131) PCT patent application serial number PCT/2004/011973, filed on Apr. 15, 2004, (132) U.S. provisional patent application Ser. No. 60/495,056, filed on Aug. 14, 2003, and (133) U.S. provisional patent application Ser. No. 60/585,370, filed on Jul. 2, 2004, the disclosures of which are incorporated herein by reference.

BACKGROUND OF THE INVENTION

This invention relates generally to oil and gas exploration, and in particular to forming and repairing wellbore casings to facilitate oil and gas exploration.

SUMMARY OF THE INVENTION

According to one aspect of the present invention, a method of forming a tubular liner within a preexisting structure is provided that includes positioning a tubular assembly within the preexisting structure; and radially expanding and plastically deforming the tubular assembly within the preexisting structure, wherein, prior to the radial expansion and plastic deformation of the tubular assembly, a predetermined portion of the tubular assembly has a lower yield point than another portion of the tubular assembly.

According to another aspect of the present invention, an expandable tubular member is provided that includes a steel alloy including: 0.065% C, 1.44% Mn, 0.01% P, 0.002% S, 0.24% Si, 0.01% Cu, 0.01% Ni, and 0.02% Cr.

According to another aspect of the present invention, an expandable tubular member is provided that includes a steel alloy including: 0.18% C, 1.28% Mn, 0.017% P, 0.004% S, 0.29% Si, 0.01% Cu, 0.01% Ni, and 0.03% Cr.

According to another aspect of the present invention, an expandable tubular member is provided that includes a steel alloy including: 0.08% C, 0.82% Mn, 0.006% P, 0.003% S, 0.30% Si, 0.16% Cu, 0.05% Ni, and 0.05% Cr.

According to another aspect of the present invention, an expandable tubular member is provided that includes a steel alloy including: 0.02% C, 1.31% Mn, 0.02% P, 0.001% S, 0.45% Si, 9.1% Ni, and 18.7% Cr.

According to another aspect of the present invention, an expandable tubular member is provided, wherein the yield point of the expandable tubular member is at most about 46.9 ksi prior to a radial expansion and plastic deformation; and wherein the yield point of the expandable tubular member is at least about 65.9 ksi after the radial expansion and plastic deformation.

According to another aspect of the present invention, an expandable tubular member is provided, wherein a yield point of the expandable tubular member after a radial expansion and plastic deformation is at least about 40% greater than the yield point of the expandable tubular member prior to the radial expansion and plastic deformation.

According to another aspect of the present invention, an expandable tubular member is provided, wherein the anisotropy of the expandable tubular member, prior to the radial expansion and plastic deformation, is at least about 1.48.

According to another aspect of the present invention, an expandable tubular member is provided, wherein the yield point of the expandable tubular member is at most about 57.8 ksi prior to the radial expansion and plastic deformation; and wherein the yield point of the expandable tubular member is at least about 74.4 ksi after the radial expansion and plastic deformation.

According to another aspect of the present invention, an expandable tubular member is provided, wherein the yield point of the expandable tubular member after a radial expansion and plastic deformation is at least about 28% greater than the yield point of the expandable tubular member prior to the radial expansion and plastic deformation.

According to another aspect of the present invention, an expandable tubular member is provided, wherein the anisotropy of the expandable tubular member, prior to the radial expansion and plastic deformation, is at least about 1.04.

According to another aspect of the present invention, an expandable tubular member is provided, wherein the anisotropy of the expandable tubular member, prior to the radial expansion and plastic deformation, is at least about 1.92.

According to another aspect of the present invention, an expandable tubular member is provided, wherein the anisotropy of the expandable tubular member, prior to the radial expansion and plastic deformation, is at least about 1.34.

According to another aspect of the present invention, an expandable tubular member is provided, wherein the anisotropy of the expandable tubular member, prior to the radial expansion and plastic deformation, ranges from about 1.04 to about 1.92.

According to another aspect of the present invention, an expandable tubular member is provided, wherein the yield point of the expandable tubular member, prior to the radial expansion and plastic deformation, ranges from about 47.6 ksi to about 61.7 ksi.

According to another aspect of the present invention, an expandable tubular member is provided, wherein the expandability coefficient of the expandable tubular member, prior to the radial expansion and plastic deformation, is greater than 0.12.

According to another aspect of the present invention, an expandable tubular member is provided, wherein the expandability coefficient of the expandable tubular member is greater than the expandability coefficient of another portion of the expandable tubular member.

According to another aspect of the present invention, an expandable tubular member is provided, wherein the tubular member has a higher ductility and a lower yield point prior to a radial expansion and plastic deformation than after the radial expansion and plastic deformation.

According to another aspect of the present invention, a method of radially expanding and plastically deforming a tubular assembly including a first tubular member coupled to a second tubular member is provided that includes radially expanding and plastically deforming the tubular assembly within a preexisting structure; and using less power to radially expand each unit length of the first tubular member than to radially expand each unit length of the second tubular member.

According to another aspect of the present invention, a system for radially expanding and plastically deforming a tubular assembly including a first tubular member coupled to a second tubular member is provided that includes means for radially expanding the tubular assembly within a preexisting structure; and means for using less power to radially expand each unit length of the first tubular member than required to radially expand each unit length of the second tubular member.

According to another aspect of the present invention, a method of manufacturing a tubular member is provided that includes processing a tubular member until the tubular member is characterized by one or more intermediate characteristics; positioning the tubular member within a preexisting structure; and processing the tubular member within the preexisting structure until the tubular member is characterized one or more final characteristics.

According to another aspect of the present invention, an apparatus is provided that includes an expandable tubular assembly; and an expansion device coupled to the expandable tubular assembly; wherein a predetermined portion of the expandable tubular assembly has a lower yield point than another portion of the expandable tubular assembly.

According to another aspect of the present invention, an expandable tubular member is provided, wherein a yield point of the expandable tubular member after a radial expansion and plastic deformation is at least about 5.8% greater than the yield point of the expandable tubular member prior to the radial expansion and plastic deformation.

According to another aspect of the present invention, a method of determining the expandability of a selected tubular member is provided that includes determining an anisotropy value for the selected tubular member, determining a strain hardening value for the selected tubular member; and multiplying the anisotropy value times the strain hardening value to generate an expandability value for the selected tubular member.

According to another aspect of the present invention, a method of radially expanding and plastically deforming tubular members is provided that includes selecting a tubular member; determining an anisotropy value for the selected tubular member; determining a strain hardening value for the selected tubular member; multiplying the anisotropy value times the strain hardening value to generate an expandability value for the selected tubular member; and if the anisotropy value is greater than 0.12, then radially expanding and plastically deforming the selected tubular member.

According to another aspect of the present invention, a radially expandable tubular member apparatus is provided that includes a first tubular member; a second tubular member engaged with the first tubular member forming a joint; and a sleeve overlapping and coupling the first and second tubular members at the joint; wherein, prior to a radial expansion and plastic deformation of the apparatus, a predetermined portion of the apparatus has a lower yield point than another portion of the apparatus.

According to another aspect of the present invention, a radially expandable tubular member apparatus is provided that includes: a first tubular member; a second tubular member engaged with the first tubular member forming a joint; a sleeve overlapping and coupling the first and second tubular members at the joint; the sleeve having opposite tapered ends and a flange engaged in a recess formed in an adjacent tubular member; and one of the tapered ends being a surface formed on the flange; wherein, prior to a radial expansion and plastic deformation of the apparatus, a predetermined portion of the apparatus has a lower yield point than another portion of the apparatus.

According to another aspect of the present invention, a method of joining radially expandable tubular members is provided that includes: providing a first tubular member; engaging a second tubular member with the first tubular member to form a joint; providing a sleeve; mounting the sleeve for overlapping and coupling the first and second tubular members at the joint; wherein the first tubular member, the second tubular member, and the sleeve define a tubular assembly; and radially expanding and plastically deforming the tubular assembly; wherein, prior to the radial expansion and plastic deformation, a predetermined portion of the tubular assembly has a lower yield point than another portion of the tubular assembly.

According to another aspect of the present invention, a method of joining radially expandable tubular members is provided that includes providing a first tubular member; engaging a second tubular member with the first tubular member to form a joint; providing a sleeve having opposite tapered ends and a flange, one of the tapered ends being a surface formed on the flange; mounting the sleeve for overlapping and coupling the first and second tubular members at the joint, wherein the flange is engaged in a recess formed in an adjacent one of the tubular members; wherein the first tubular member, the second tubular member, and the sleeve define a tubular assembly; and radially expanding and plastically deforming the tubular assembly; wherein, prior to the radial expansion and plastic deformation, a predetermined portion of the tubular assembly has a lower yield point than another portion of the tubular assembly.

According to another aspect of the present invention, an expandable tubular assembly is provided that includes a first tubular member; a second tubular member coupled to the first tubular member; a first threaded connection for coupling a portion of the first and second tubular members; a second threaded connection spaced apart from the first threaded connection for coupling another portion of the first and second tubular members; a tubular sleeve coupled to and receiving end portions of the first and second tubular members; and a sealing element positioned between the first and second spaced apart threaded connections for sealing an interface between the first and second tubular member; wherein the sealing element is positioned within an annulus defined between the first and second tubular members; and wherein, prior to a radial expansion and plastic deformation of the assembly, a predetermined portion of the assembly has a lower yield point than another portion of the apparatus.

According to another aspect of the present invention, a method of joining radially expandable tubular members is provided that includes: providing a first tubular member; providing a second tubular member; providing a sleeve; mounting the sleeve for overlapping and coupling the first and second tubular members; threadably coupling the first and second tubular members at a first location; threadably coupling the first and second tubular members at a second location spaced apart from the first location; sealing an interface between the first and second tubular members between the first and second locations using a compressible sealing element, wherein the first tubular member, second tubular member, sleeve, and the sealing element define a tubular assembly; and radially expanding and plastically deforming the tubular assembly; wherein, prior to the radial expansion and plastic deformation, a predetermined portion of the tubular assembly has a lower yield point than another portion of the tubular assembly.

According to another aspect of the present invention, an expandable tubular member is provided, wherein the carbon content of the tubular member is less than or equal to 0.12 percent; and wherein the carbon equivalent value for the tubular member is less than 0.21.

According to another aspect of the present invention, an expandable tubular member is provided, wherein the carbon content of the tubular member is greater than 0.12 percent; and wherein the carbon equivalent value for the tubular member is less than 0.36.

According to another aspect of the present invention, a method of selecting tubular members for radial expansion and plastic deformation is provided that includes selecting a tubular member from a collection of tubular member; determining a carbon content of the selected tubular member; determining a carbon equivalent value for the selected tubular member; and if the carbon content of the selected tubular member is less than or equal to 0.12 percent and the carbon equivalent value for the selected tubular member is less than 0.21, then determining that the selected tubular member is suitable for radial expansion and plastic deformation.

According to another aspect of the present invention, a method of selecting tubular members for radial expansion and plastic deformation is provided that includes selecting a tubular member from a collection of tubular member; determining a carbon content of the selected tubular member; determining a carbon equivalent value for the selected tubular member; and if the carbon content of the selected tubular member is greater than 0.12 percent and the carbon equivalent value for the selected tubular member is less than 0.36, then determining that the selected tubular member is suitable for radial expansion and plastic deformation.

According to another aspect of the present invention, an expandable tubular member is provided that includes a tubular body; wherein a yield point of an inner tubular portion of the tubular body is less than a yield point of an outer tubular portion of the tubular body.

According to another aspect of the present invention, a method of manufacturing an expandable tubular member has been provided that includes: providing a tubular member; heat treating the tubular member; and quenching the tubular member; wherein following the quenching, the tubular member comprises a microstructure comprising a hard phase structure and a soft phase structure.

According to another aspect of the present invention, a method of radially expanding a tubular assembly is provided that includes radially expanding and plastically deforming a lower portion of the tubular assembly by pressurizing the interior of the lower portion of the tubular assembly; and then, radially expanding and plastically deforming the remaining portion of the tubular assembly by contacting the interior of the tubular assembly with an expansion device.

According to another aspect of the present invention, a system for radially expanding a tubular assembly is provided that includes means for radially expanding and plastically deforming a lower portion of the tubular assembly by pressurizing the interior of the lower portion of the tubular assembly; and then, means for radially expanding and plastically deforming the remaining portion of the tubular assembly by contacting the interior of the tubular assembly with an expansion device.

According to another aspect of the present invention, a method of repairing a tubular assembly is provided that includes positioning a tubular patch within the tubular assembly; and radially expanding and plastically deforming a tubular patch into engagement with the tubular assembly by pressurizing the interior of the tubular patch.

According to another aspect of the present invention, a system for repairing a tubular assembly is provided that includes means for positioning a tubular patch within the tubular assembly; and means for radially expanding and plastically deforming a tubular patch into engagement with the tubular assembly by pressurizing the interior of the tubular patch.

According to another aspect of the present invention, a method of radially expanding a tubular member is provided that includes accumulating a supply of pressurized fluid; and controllably injecting the pressurized fluid into the interior of the tubular member.

According to another aspect of the present invention, a system for radially expanding a tubular member is provided that includes means for accumulating a supply of pressurized fluid; and means for controllably injecting the pressurized fluid into the interior of the tubular member.

According to another aspect of the present invention, an apparatus for radially expanding a tubular member is provided that includes a fluid reservoir; a pump for pumping fluids out of the fluid reservoir; an accumulator for receiving and accumulating the fluids pumped from the reservoir; a flow control valve for controllably releasing the fluids accumulated within the reservoir; and an expansion element for engaging the interior of the tubular member to define a pressure chamber within the tubular member and receiving the released accumulated fluids into the pressure chamber.

According to another aspect of the present invention, an apparatus for radially expanding a tubular member is provided that includes an expandable tubular member; a locking device positioned within the expandable tubular member releasably coupled to the expandable tubular member; a tubular support member positioned within the expandable tubular member coupled to the locking device; and an adjustable expansion device positioned within the expandable tubular member coupled to the tubular support member; wherein at least a portion of the expandable tubular member has a higher ductility and a lower yield point prior to the radial expansion and plastic deformation than after the radial expansion and plastic deformation.

According to another aspect of the present invention, an apparatus for radially expanding a tubular member is provided that includes: an expandable tubular member; a locking device positioned within the expandable tubular member releasably coupled to the expandable tubular member; a tubular support member positioned within the expandable tubular member coupled to the locking device; an adjustable expansion device positioned within the expandable tubular member coupled to the tubular support member; means for transmitting torque between the expandable tubular member and the tubular support member; means for sealing the interface between the expandable tubular member and the tubular support member; another tubular support member received within the tubular support member releasably coupled to the expandable tubular member; means for transmitting torque between the expandable tubular member and the other tubular support member; means for transmitting torque between the other tubular support member and the tubular support member; means for sealing the interface between the other tubular support member and the tubular support member; means for sealing the interface between the expandable tubular member and the tubular support member; means for sensing the operating pressure within the other tubular support member; means for pressurizing the interior of the other tubular support member; means for limiting axial displacement of the other tubular support member relative to the tubular support member; and a tubular liner coupled to an end of the expandable tubular member; wherein at least a portion of the expandable tubular member has a higher ductility and a lower yield point prior to the radial expansion and plastic deformation than after the radial expansion and plastic deformation.

According to another aspect of the present invention, a method for radially expanding a tubular member is provided that includes positioning a tubular member and an adjustable expansion device within a preexisting structure; radially expanding and plastically deforming at least a portion of the tubular member by pressurizing an interior portion of the tubular member; increasing the size of the adjustable expansion device; and radially expanding and plastically deforming another portion of the tubular member by displacing the adjustable expansion device relative to the tubular member.

According to another aspect of the present invention, a system for radially expanding a tubular member is provided that includes means for positioning a tubular member and an adjustable expansion device within a preexisting structure; means for radially expanding and plastically deforming at least a portion of the tubular member by pressurizing an interior portion of the tubular member; means for increasing the size of the adjustable expansion device; and means for radially expanding and plastically deforming another portion of the tubular member by displacing the adjustable expansion device relative to the tubular member.

According to another aspect of the present invention, a method of radially expanding and plastically deforming an expandable tubular member is provided that includes limiting the amount of radial expansion of the expandable tubular member.

According to another aspect of the present invention, an apparatus for radially expanding a tubular member is provided that includes an expandable tubular member; an expansion device coupled to the expandable tubular member for radially expanding and plastically deforming the expandable tubular member; and an tubular expansion limiter coupled to the expandable tubular member for limiting the degree to which the expandable tubular member may be radially expanded and plastically deformed.

According to another aspect of the present invention, an apparatus for radially expanding a tubular member is provided that includes: an expandable tubular member; an expansion device coupled to the expandable tubular member for radially expanding and plastically deforming the expandable tubular member; an tubular expansion limiter coupled to the expandable tubular member for limiting the degree to which the expandable tubular member may be radially expanded and plastically deformed; a locking device positioned within the expandable tubular member releasably coupled to the expandable tubular member; a tubular support member positioned within the expandable tubular member coupled to the locking device and the expansion device; means for transmitting torque between the expandable tubular member and the tubular support member; means for sealing the interface between the expandable tubular member and the tubular support member; means for sensing the operating pressure within the tubular support member; and means for pressurizing the interior of the tubular support member; wherein at least a portion of the expandable tubular member has a higher ductility and a lower yield point prior to the radial expansion and plastic deformation than after the radial expansion and plastic deformation.

According to another aspect of the present invention, a method for radially expanding a tubular member is provided that includes positioning a tubular member and an adjustable expansion device within a preexisting structure; radially expanding and plastically deforming at least a portion of the tubular member by pressurizing an interior portion of the tubular member; limiting the extent to which the portion of the tubular member is radially expanded and plastically deformed by pressurizing the interior of the tubular member; increasing the size of the adjustable expansion device; and radially expanding and plastically deforming another portion of the tubular member by displacing the adjustable expansion device relative to the tubular member.

According to another aspect of the present invention, a system for radially expanding a tubular member is provided that includes means for positioning a tubular member and an adjustable expansion device within a preexisting structure; means for radially expanding and plastically deforming at least a portion of the tubular member by pressurizing an interior portion of the tubular member; means for limiting the extent to which the portion of the tubular member is radially expanded and plastically deformed by pressurizing the interior of the tubular member; means for increasing the size of the adjustable expansion device; and means for radially expanding and plastically deforming another portion of the tubular member by displacing the adjustable expansion device relative to the tubular member.

BRIEF DESCRIPTION OF THE DRAWINGS

FIG. 36*c* is an illustration of the microstructure of an exemplary embodiment of a tubular member after thermal processing.

FIG. 46*ia* is a fragmentary cross sectional view of the expansion limiter sleeve of FIG. 46*i*.

DETAILED DESCRIPTION OF THE ILLUSTRATIVE EMBODIMENTS

Figure 1:
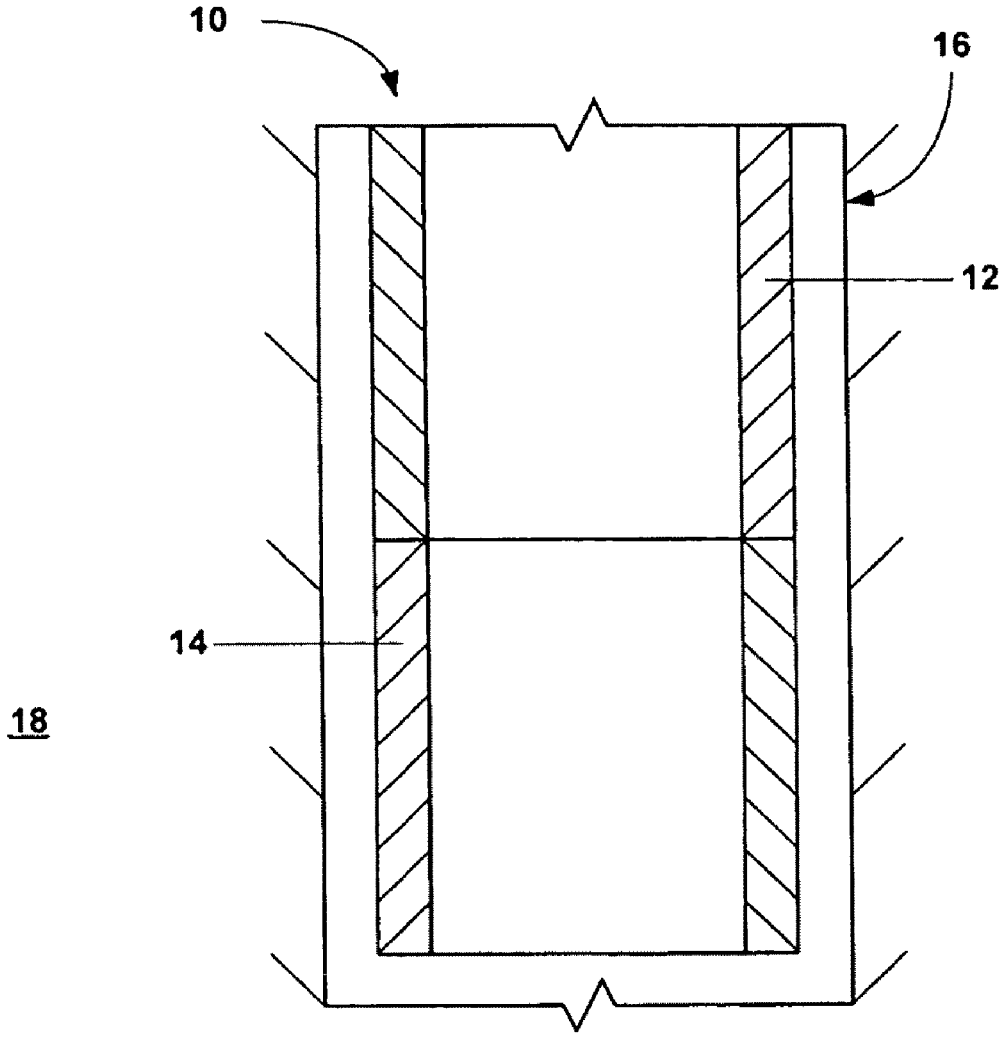
FIG. 1 is a fragmentary cross sectional view of an exemplary embodiment of an expandable tubular member positioned within a preexisting structure.

Referring initially to FIG. 1, an exemplary embodiment of an expandable tubular assembly 10 includes a first expandable tubular member 12 coupled to a second expandable tubular member 14. In several exemplary embodiments, the ends of the first and second expandable tubular members, 12 and 14, are coupled using, for example, a conventional mechanical coupling, a welded connection, a brazed connection, a threaded connection, and/or an interference fit connection. In an exemplary embodiment, the first expandable tubular member 12 has a plastic yield point $YP_1$, and the second expandable tubular member 14 has a plastic yield point $YP_2$. In an exemplary embodiment, the expandable tubular assembly 10 is positioned within a preexisting structure such as, for example, a wellbore 16 that traverses a subterranean formation 18.

Figure 2:
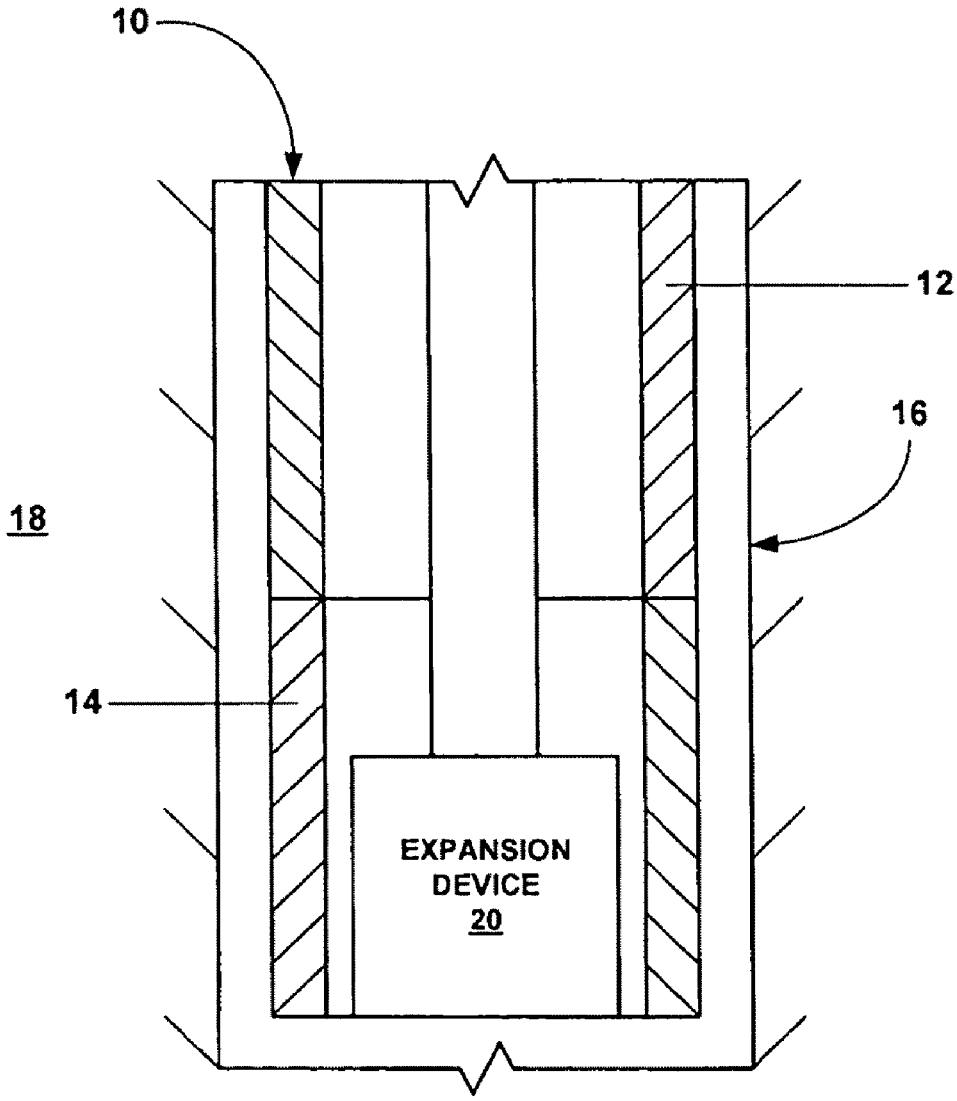
FIG. 2 is a fragmentary cross sectional view of the expandable tubular member of FIG. 1 after positioning an expansion device within the expandable tubular member.

As illustrated in FIG. 2, an expansion device 20 may then be positioned within the second expandable tubular member 14. In several exemplary embodiments, the expansion device 20 may include, for example, one or more of the following conventional expansion devices: a) an expansion cone; b) a rotary expansion device; c) a hydroforming expansion device; d) an impulsive force expansion device; d) any one of the expansion devices commercially available from, or disclosed in any of the published patent applications or issued patents, of Weatherford International, Baker Hughes, Halliburton Energy Services, Shell Oil Co., Schlumberger, and/or Enventure Global Technology L.L.C. In several exemplary embodiments, the expansion device 20 is positioned within the second expandable tubular member 14 before, during, or after the placement of the expandable tubular assembly 10 within the preexisting structure 16.

Figure 3:
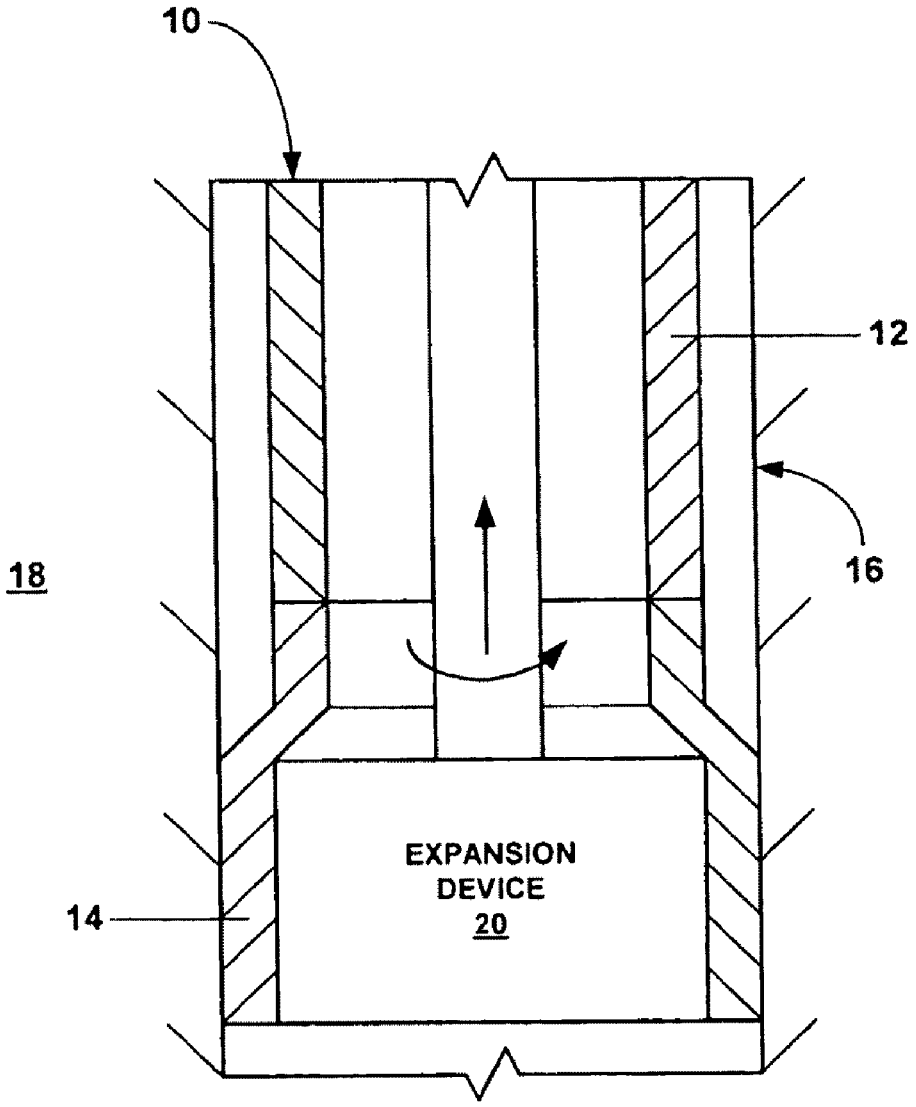
FIG. 3 is a fragmentary cross sectional view of the expandable tubular member of FIG. 2 after operating the expansion device within the expandable tubular member to radially expand and plastically deform a portion of the expandable tubular member.

As illustrated in FIG. 3, the expansion device 20 may then be operated to radially expand and plastically deform at least a portion of the second expandable tubular member 14 to form a bell-shaped section.

Figure 4:
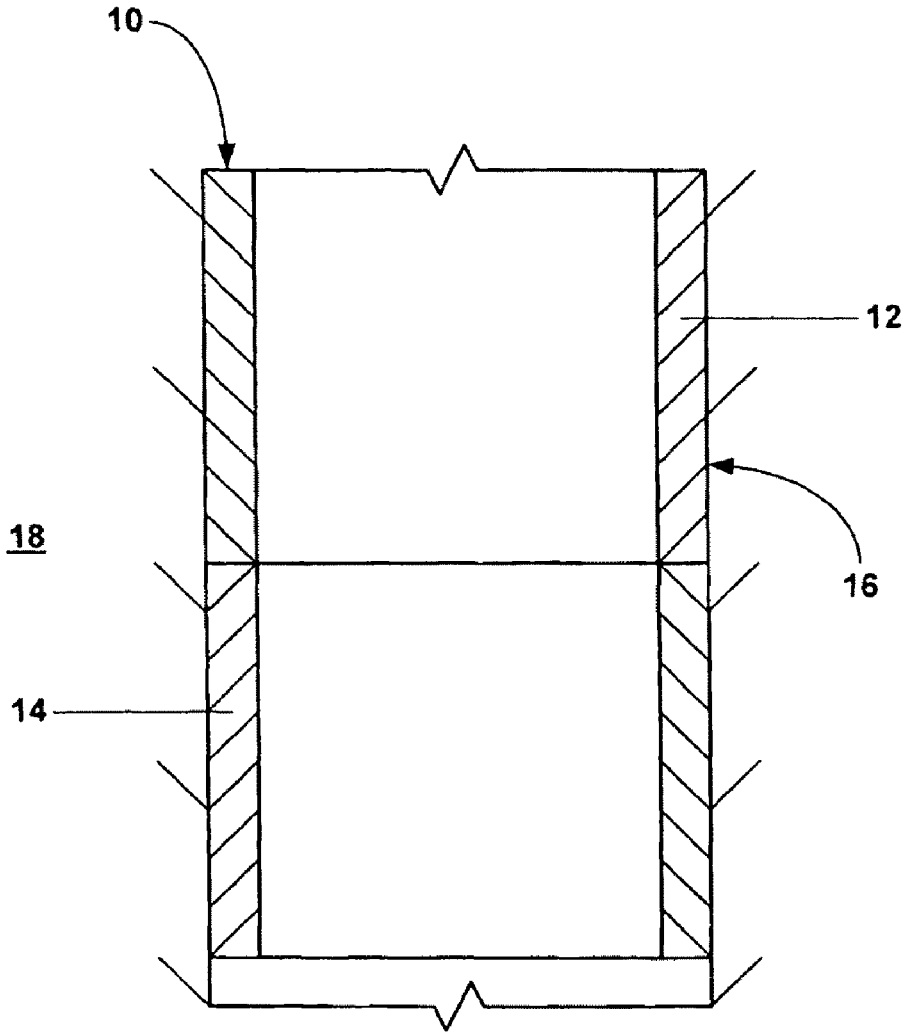
FIG. 4 is a fragmentary cross sectional view of the expandable tubular member of FIG. 3 after operating the expansion device within the expandable tubular member to radially expand and plastically deform another portion of the expandable tubular member.

As illustrated in FIG. 4, the expansion device 20 may then be operated to radially expand and plastically deform the remaining portion of the second expandable tubular member 14 and at least a portion of the first expandable tubular member 12.

In an exemplary embodiment, at least a portion of at least a portion of at least one of the first and second expandable tubular members, 12 and 14, are radially expanded into intimate contact with the interior surface of the preexisting structure 16.

Figure 5:
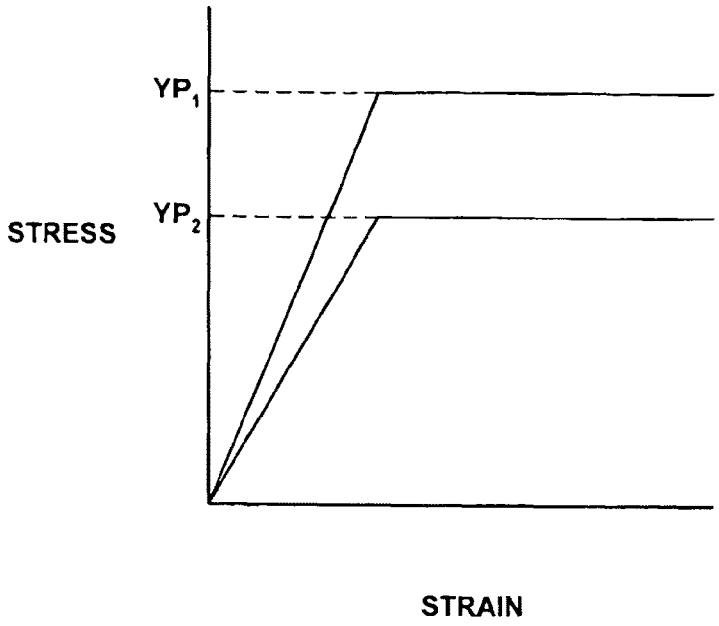
FIG. 5 is a graphical illustration of exemplary embodiments of the stress/strain curves for several portions of the expandable tubular member of FIGS. 1-4.

In an exemplary embodiment, as illustrated in FIG. 5, the plastic yield point $YP_1$ is greater than the plastic yield point $YP_2$. In this manner, in an exemplary embodiment, the amount of power and/or energy required to radially expand the second expandable tubular member 14 is less than the amount of power and/or energy required to radially expand the first expandable tubular member 12.

Figure 6:
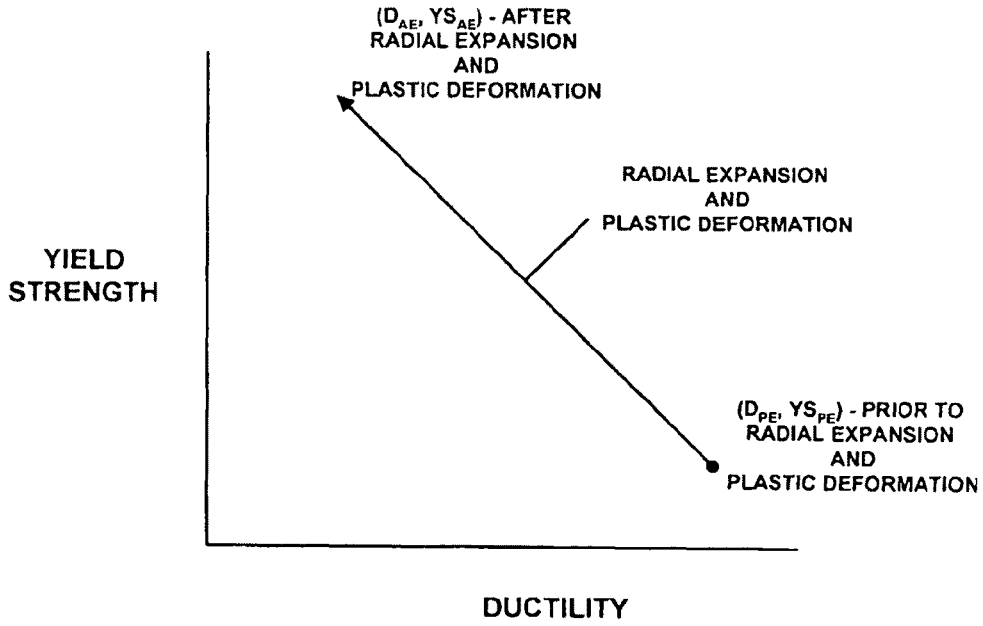
FIG. 6 is a graphical illustration of the an exemplary embodiment of the yield strength vs. ductility curve for at least a portion of the expandable tubular member of FIGS. 1-4.

In an exemplary embodiment, as illustrated in FIG. 6, the first expandable tubular member 12 and/or the second expandable tubular member 14 have a ductility $D_{PE}$ and a yield strength $YS_{PE}$ prior to radial expansion and plastic deformation, and a ductility $D_{PE}$ and a yield strength $YS_{AE}$ after radial expansion and plastic deformation. In an exemplary embodiment, $D_{PE}$ is greater than $D_{AE}$, and $YS_{AE}$ is greater than $YS_{PE}$. In this manner, the first expandable tubular member 12 and/or the second expandable tubular member 14 are transformed during the radial expansion and plastic deformation process. Furthermore, in this manner, in an exemplary embodiment, the amount of power and/or energy required to radially expand each unit length of the first and/or second expandable tubular members, 12 and 14, is reduced. Furthermore, because the $YS_{AE}$ is greater than $YS_{PE}$, the collapse strength of the first expandable tubular member 12 and/or the second expandable tubular member 14 is increased after the radial expansion and plastic deformation process.

Figure 7:
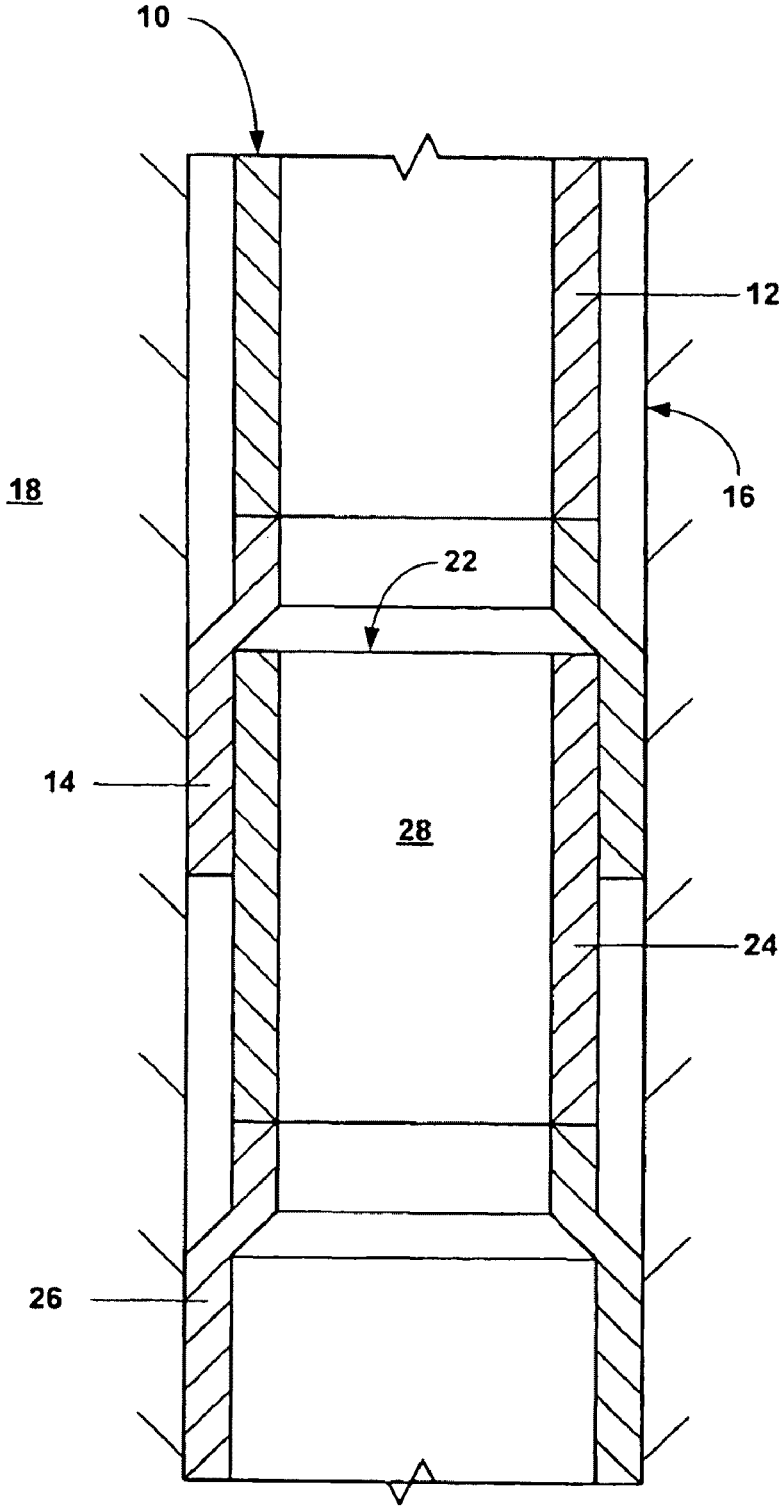
FIG. 7 is a fragmentary cross sectional illustration of an embodiment of a series of overlapping expandable tubular members.

In an exemplary embodiment, as illustrated in FIG. 7, following the completion of the radial expansion and plastic deformation of the expandable tubular assembly 10 described above with reference to FIGS. 1-4, at least a portion of the second expandable tubular member 14 has an inside diameter that is greater than at least the inside diameter of the first expandable tubular member 12. In this manner a bell-shaped section is formed using at least a portion of the second expandable tubular member 14. Another expandable tubular assembly 22 that includes a first expandable tubular member 24 and a second expandable tubular member 26 may then be positioned in overlapping relation to the first expandable tubular assembly 10 and radially expanded and plastically deformed using the methods described above with reference to FIGS. 1-4. Furthermore, following the completion of the radial expansion and plastic deformation of the expandable tubular assembly 20, in an exemplary embodiment, at least a portion of the second expandable tubular member 26 has an inside diameter that is greater than at least the inside diameter of the first expandable tubular member 24. In this manner a bell-shaped section is formed using at least a portion of the second expandable tubular member 26. Furthermore, in this manner, a mono-diameter tubular assembly is formed that defines an internal passage 28 having a substantially constant cross-sectional area and/or inside diameter.

Figure 8:
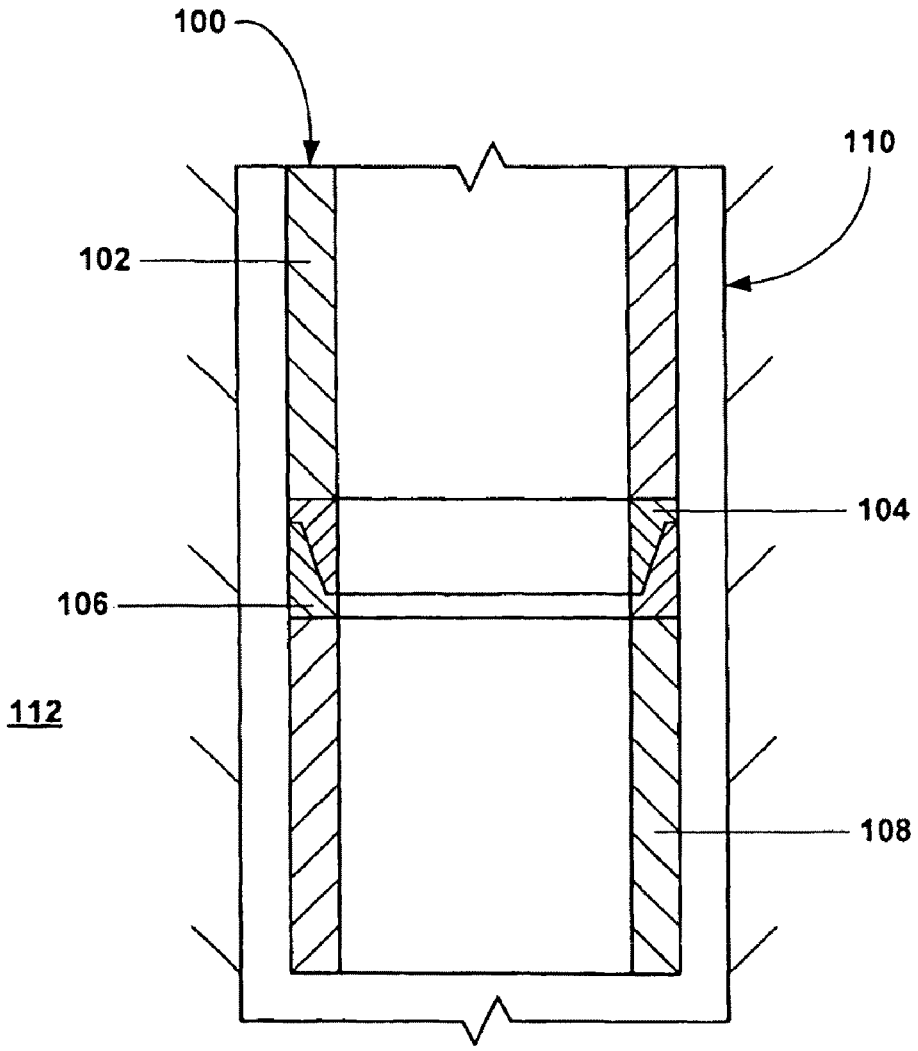
FIG. 8 is a fragmentary cross sectional view of an exemplary embodiment of an expandable tubular member positioned within a preexisting structure.

Referring to FIG. 8, an exemplary embodiment of an expandable tubular assembly 100 includes a first expandable tubular member 102 coupled to a tubular coupling 104. The tubular coupling 104 is coupled to a tubular coupling 106. The tubular coupling 106 is coupled to a second expandable tubular member 108. In several exemplary embodiments, the tubular couplings, 104 and 106, provide a tubular coupling assembly for coupling the first and second expandable tubular members, 102 and 108, together that may include, for example, a conventional mechanical coupling, a welded connection, a brazed connection, a threaded connection, and/or an interference fit connection. In an exemplary embodiment, the first and second expandable tubular members 12 have a plastic yield point $YP_1$, and the tubular couplings, 104 and 106, have a plastic yield point $YP_2$. In an exemplary embodiment, the expandable tubular assembly 100 is positioned within a preexisting structure such as, for example, a wellbore 110 that traverses a subterranean formation 112.

Figure 9:
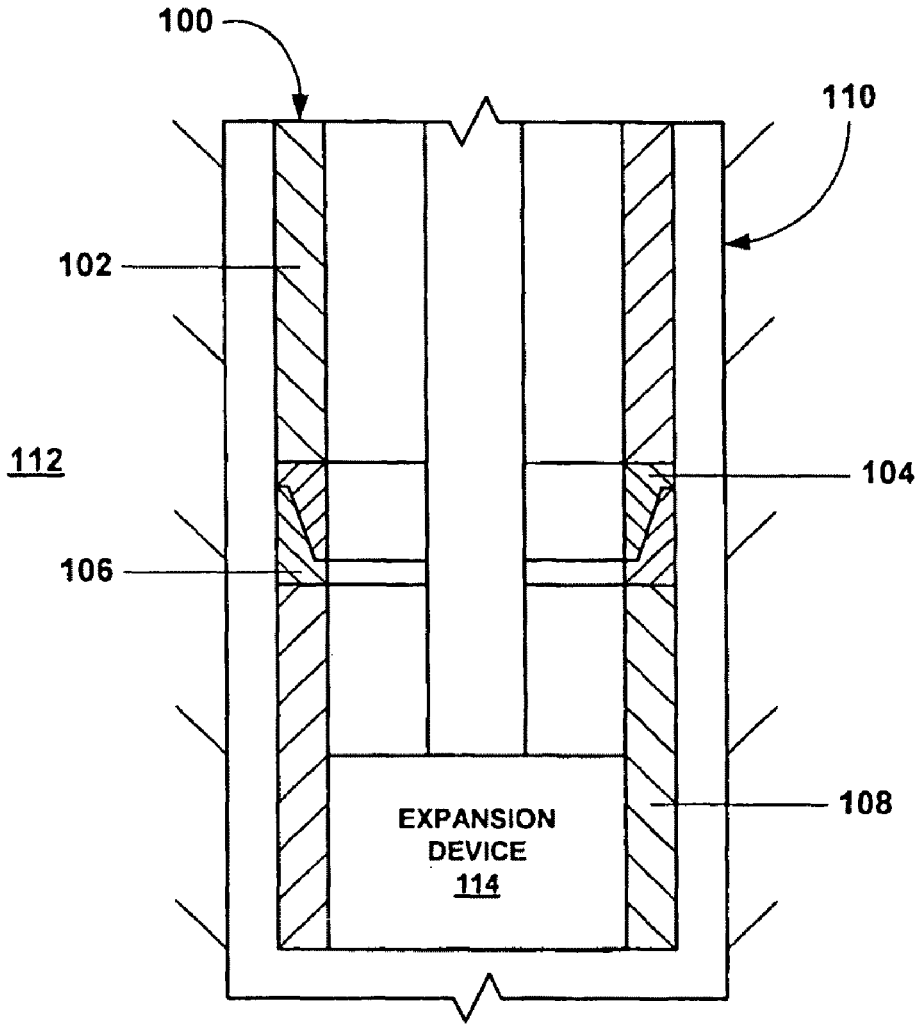
FIG. 9 is a fragmentary cross sectional view of the expandable tubular member of FIG. 8 after positioning an expansion device within the expandable tubular member.

As illustrated in FIG. 9, an expansion device 114 may then be positioned within the second expandable tubular member 108. In several exemplary embodiments, the expansion device 114 may include, for example, one or more of the following conventional expansion devices: a) an expansion cone; b) a rotary expansion device; c) a hydroforming expansion device; d) an impulsive force expansion device; d) any one of the expansion devices commercially available from, or disclosed in any of the published patent applications or issued patents, of Weatherford International, Baker Hughes, Halliburton Energy Services, Shell Oil Co., Schlumberger, and/or Enventure Global Technology L.L.C. In several exemplary embodiments, the expansion device 114 is positioned within the second expandable tubular member 108 before, during, or after the placement of the expandable tubular assembly 100 within the preexisting structure 110.

Figure 10:
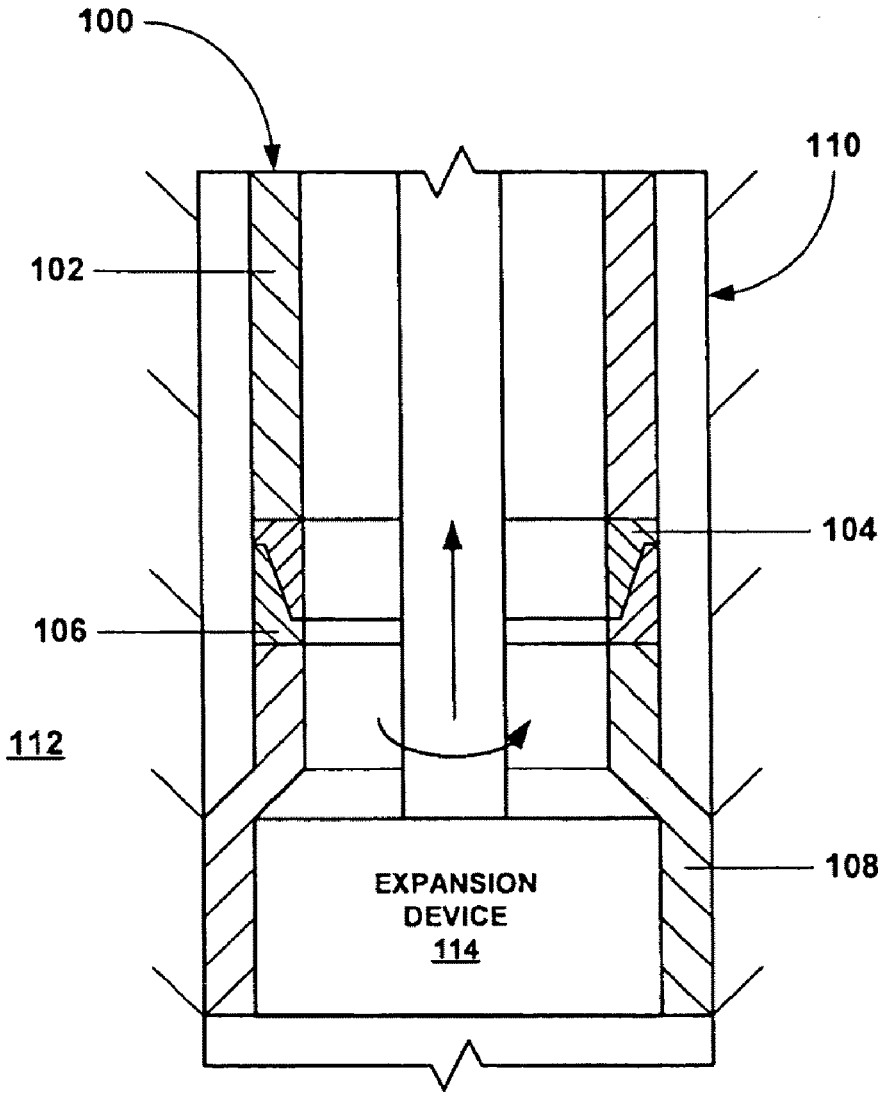
FIG. 10 is a fragmentary cross sectional view of the expandable tubular member of FIG. 9 after operating the expansion device within the expandable tubular member to radially expand and plastically deform a portion of the expandable tubular member.

As illustrated in FIG. 10, the expansion device 114 may then be operated to radially expand and plastically deform at least a portion of the second expandable tubular member 108 to form a bell-shaped section.

Figure 11:
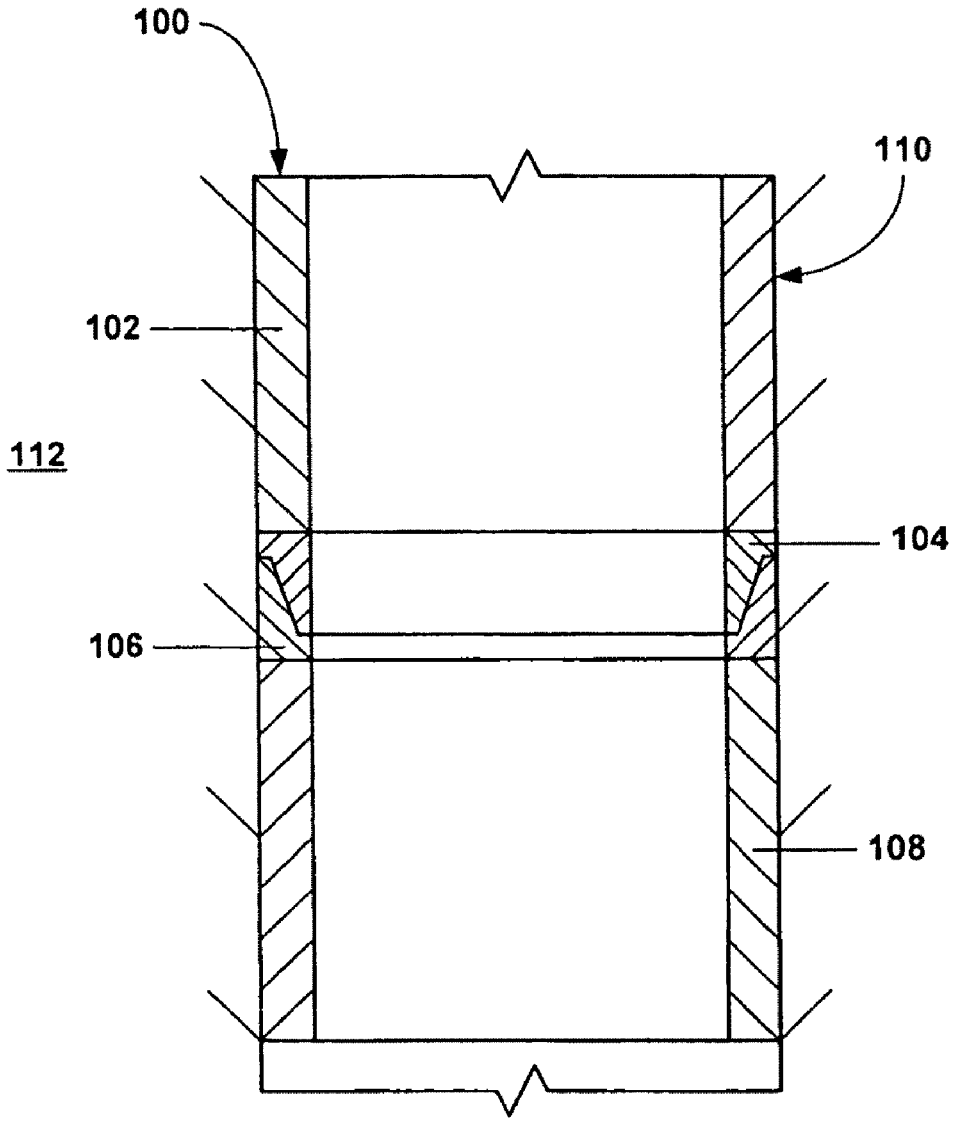
FIG. 11 is a fragmentary cross sectional view of the expandable tubular member of FIG. 10 after operating the expansion device within the expandable tubular member to radially expand and plastically deform another portion of the expandable tubular member.

As illustrated in FIG. 11, the expansion device 114 may then be operated to radially expand and plastically deform the remaining portion of the second expandable tubular member 108, the tubular couplings, 104 and 106, and at least a portion of the first expandable tubular member 102.

In an exemplary embodiment, at least a portion of at least a portion of at least one of the first and second expandable tubular members, 102 and 108, are radially expanded into intimate contact with the interior surface of the preexisting structure 110.

Figure 12:
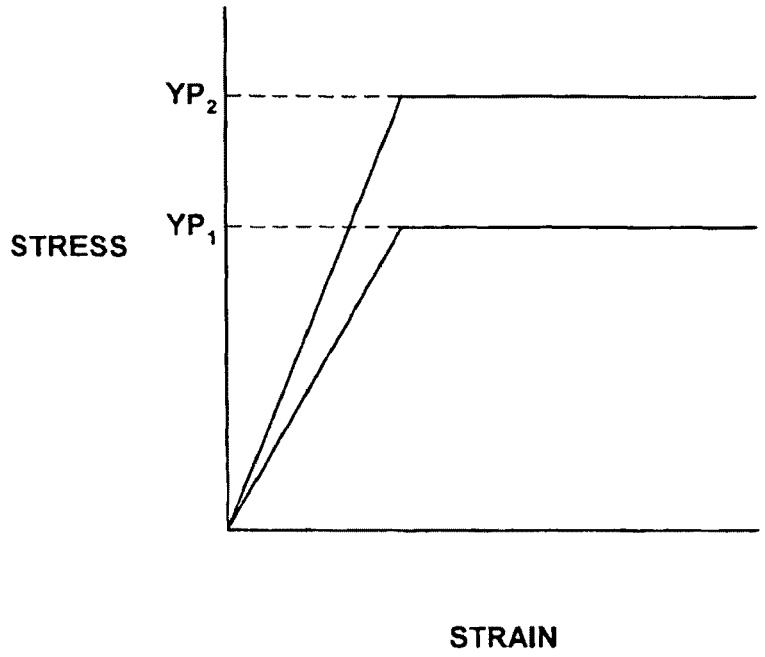
FIG. 12 is a graphical illustration of exemplary embodiments of the stress/strain curves for several portions of the expandable tubular member of FIGS. 8-11.

In an exemplary embodiment, as illustrated in FIG. 12, the plastic yield point $YP_1$ is less than the plastic yield point $YP_2$. In this manner, in an exemplary embodiment, the amount of power and/or energy required to radially expand each unit length of the first and second expandable tubular members, 102 and 108, is less than the amount of power and/or energy required to radially expand each unit length of the tubular couplings, 104 and 106.

Figure 13:
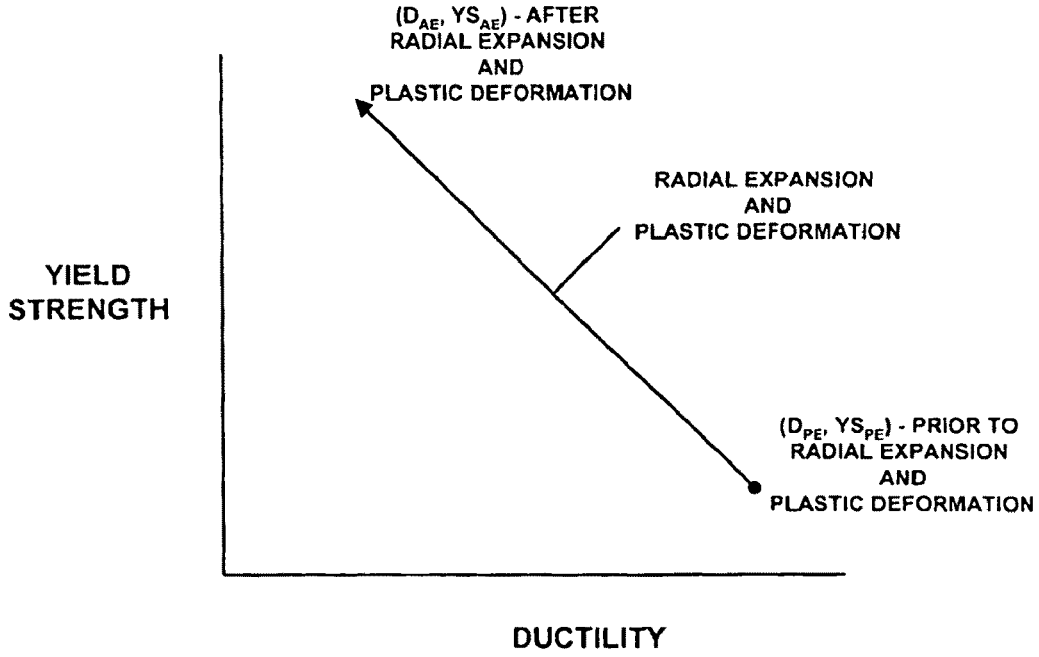
FIG. 13 is a graphical illustration of an exemplary embodiment of the yield strength vs. ductility curve for at least a portion of the expandable tubular member of FIGS. 8-11.

In an exemplary embodiment, as illustrated in FIG. 13, the first expandable tubular member 12 and/or the second expandable tubular member 14 have a ductility $D_{PE}$ and a yield strength $YS_{PE}$ prior to radial expansion and plastic deformation, and a ductility $D_{AE}$ and a yield strength $YS_{AE}$ after radial expansion and plastic deformation. In an exemplary embodiment, $D_{PE}$ is greater than $D_{AE}$, and $YS_{AE}$ is greater than $YS_{PE}$. In this manner, the first expandable tubular member 12 and/or the second expandable tubular member 14 are transformed during the radial expansion and plastic deformation process. Furthermore, in this manner, in an exemplary embodiment, the amount of power and/or energy required to radially expand each unit length of the first and/or second expandable tubular members, 12 and 14, is reduced. Furthermore, because the $YS_{AE}$ is greater than $YS_{PE}$, the collapse strength of the first expandable tubular member 12 and/or the second expandable tubular member 14 is increased after the radial expansion and plastic deformation process.

Figure 14:
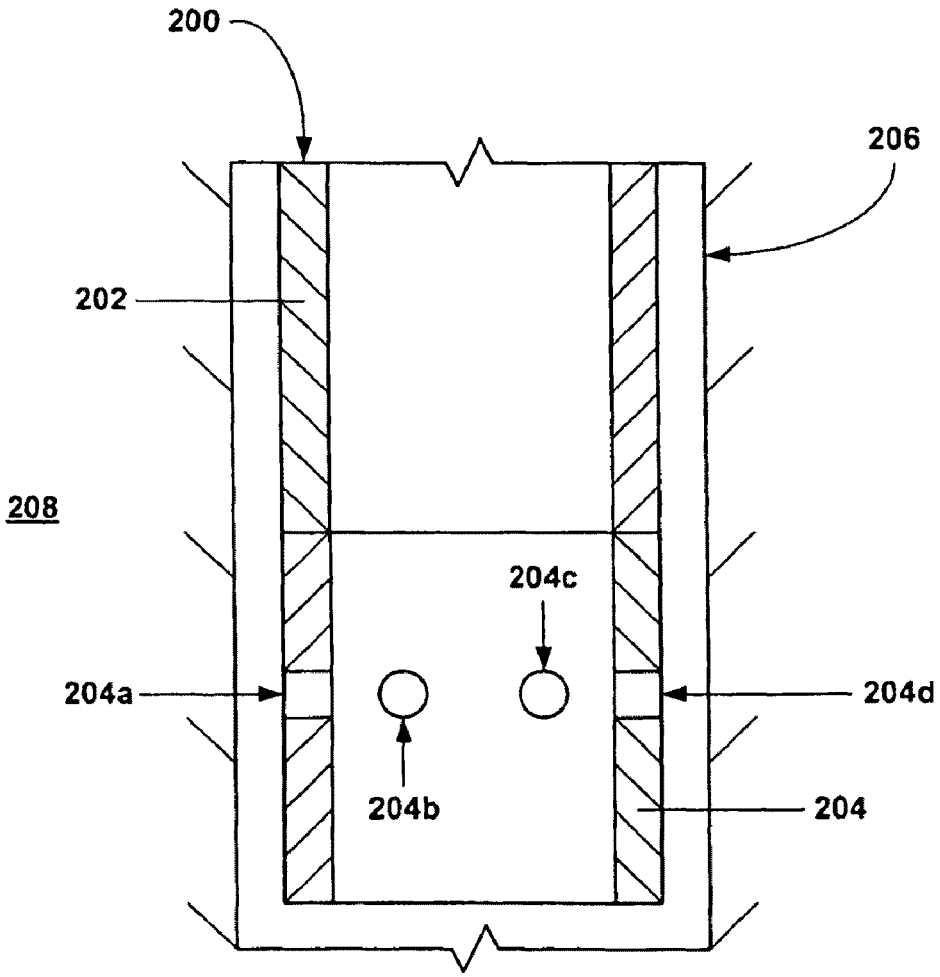
FIG. 14 is a fragmentary cross sectional view of an exemplary embodiment of an expandable tubular member positioned within a preexisting structure.

Referring to FIG. 14, an exemplary embodiment of an expandable tubular assembly 200 includes a first expandable tubular member 202 coupled to a second expandable tubular member 204 that defines radial openings 204*a*, 204*b*, 204*c*, and 204*d*. In several exemplary embodiments, the ends of the first and second expandable tubular members, 202 and 204, are coupled using, for example, a conventional mechanical coupling, a welded connection, a brazed connection, a threaded connection, and/or an interference fit connection. In an exemplary embodiment, one or more of the radial openings, 204*a*, 204*b*, 204*c*, and 204*d*, have circular, oval, square, and/or irregular cross sections and/or include portions that extend to and interrupt either end of the second expandable tubular member 204. In an exemplary embodiment, the expandable tubular assembly 200 is positioned within a preexisting structure such as, for example, a wellbore 206 that traverses a subterranean formation 208.

Figure 15:
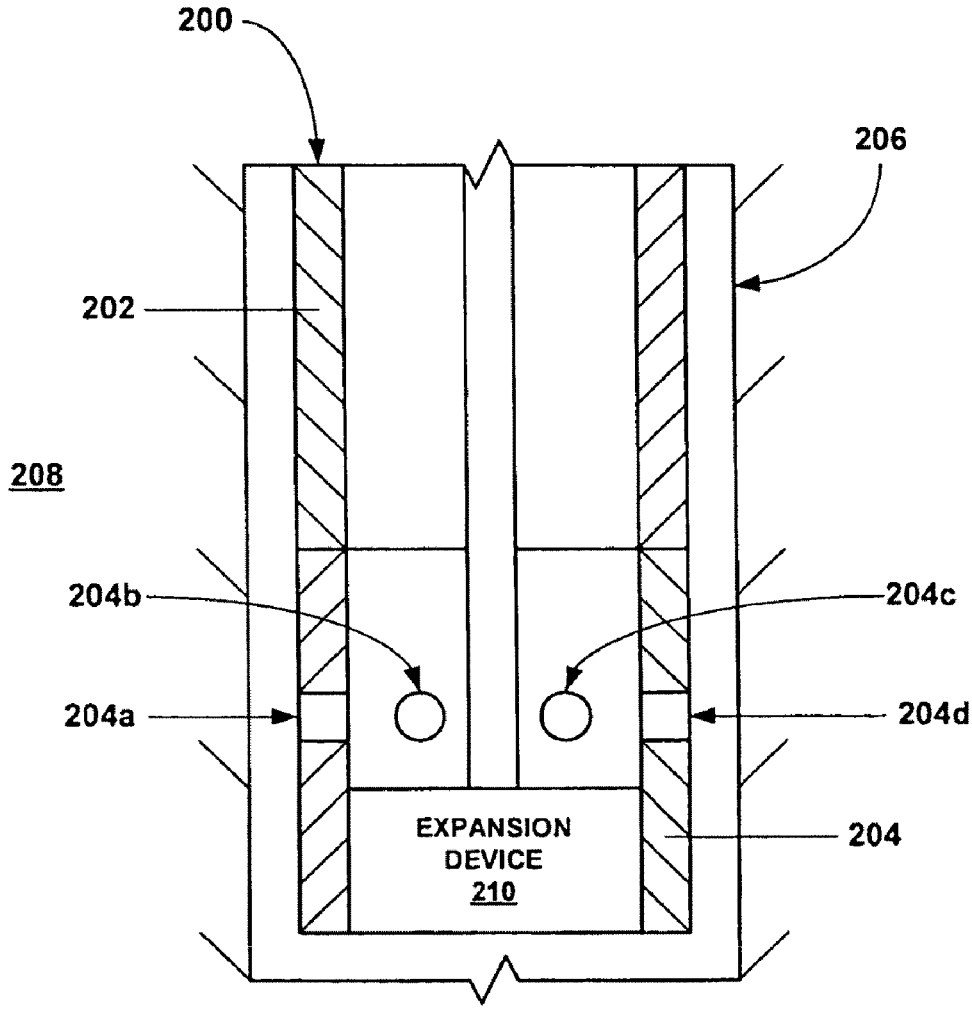
FIG. 15 is a fragmentary cross sectional view of the expandable tubular member of FIG. 14 after positioning an expansion device within the expandable tubular member.

As illustrated in FIG. 15, an expansion device 210 may then be positioned within the second expandable tubular member 204. In several exemplary embodiments, the expansion device 210 may include, for example, one or more of the following conventional expansion devices: a) an expansion cone; b) a rotary expansion device; c) a hydroforming expansion device; d) an impulsive force expansion device; d) any one of the expansion devices commercially available from, or disclosed in any of the published patent applications or issued patents, of Weatherford International, Baker Hughes, Halliburton Energy Services, Shell Oil Co., Schlumberger, and/or Enventure Global Technology L.L.C. In several exemplary embodiments, the expansion device 210 is positioned within the second expandable tubular member 204 before, during, or after the placement of the expandable tubular assembly 200 within the preexisting structure 206.

Figure 16:
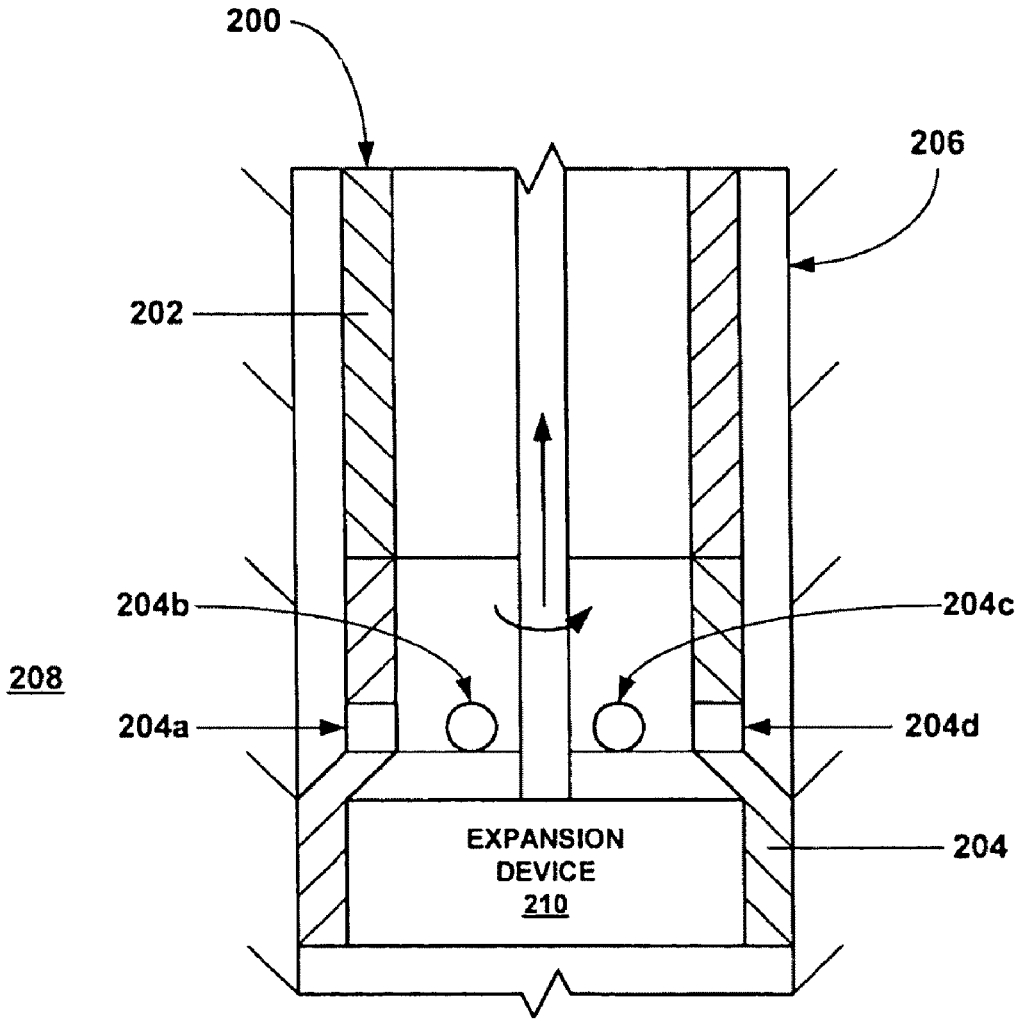
FIG. 16 is a fragmentary cross sectional view of the expandable tubular member of FIG. 15 after operating the expansion device within the expandable tubular member to radially expand and plastically deform a portion of the expandable tubular member.
Figure 17:
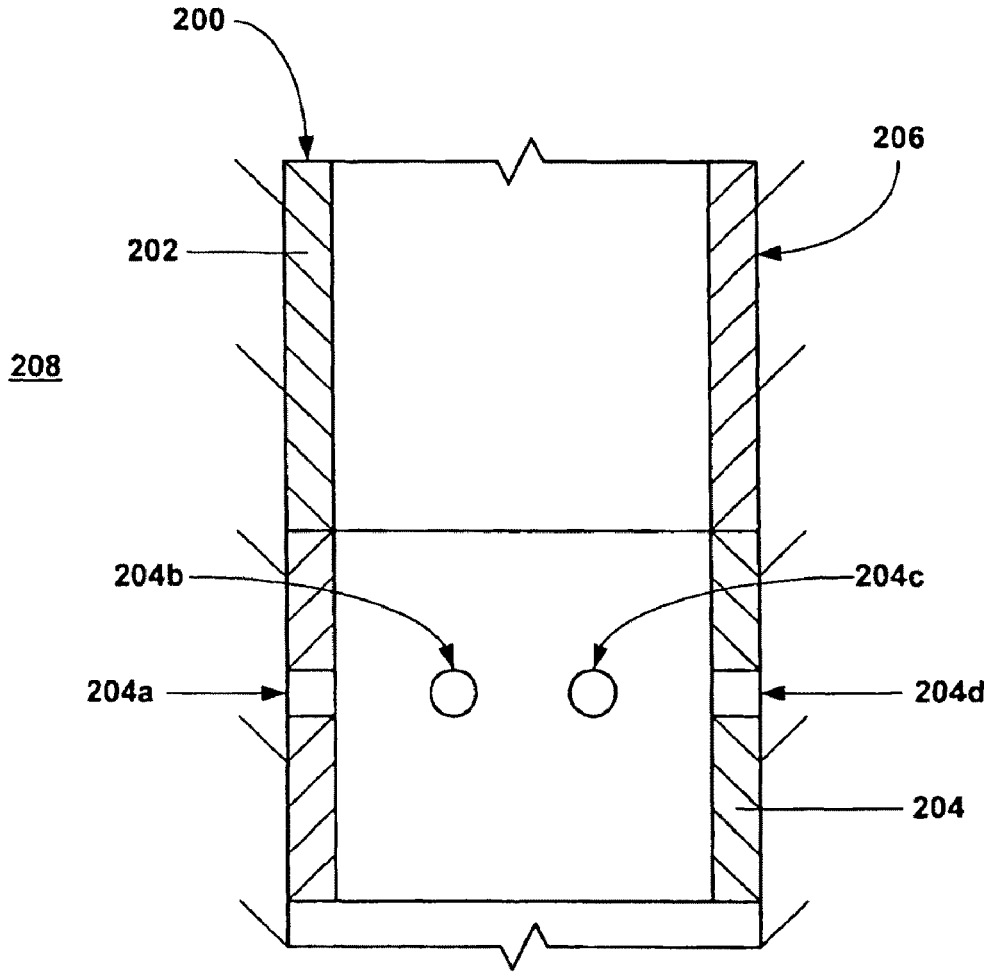
FIG. 17 is a fragmentary cross sectional view of the expandable tubular member of FIG. 16 after operating the expansion device within the expandable tubular member to radially expand and plastically deform another portion of the expandable tubular member.

As illustrated in FIG. 16, the expansion device 210 may then be operated to radially expand and plastically deform at least a portion of the second expandable tubular member 204 to form a bell-shaped section.

As illustrated in FIG. 16, the expansion device 20 may then be operated to radially expand and plastically deform the remaining portion of the second expandable tubular member 204 and at least a portion of the first expandable tubular member 202.

In an exemplary embodiment, the anisotropy ratio AR for the first and second expandable tubular members is defined by the following equation:

$$AR = In(WT_f/WT_o)/In(D_f/D_o);$$

where AR=anisotropy ratio;

where $WT_f$=final wall thickness of the expandable tubular member following the radial expansion and plastic deformation of the expandable tubular member;

where $WT_i$=initial wall thickness of the expandable tubular member prior to the radial expansion and plastic deformation of the expandable tubular member;

where $D_f$=final inside diameter of the expandable tubular member following the radial expansion and plastic deformation of the expandable tubular member; and where $D_i$=initial inside diameter of the expandable tubular member prior to the radial expansion and plastic deformation of the expandable tubular member.

In an exemplary embodiment, the anisotropy ratio AR for the first and/or second expandable tubular members, 204 and 204, is greater than 1.

In an exemplary experimental embodiment, the second expandable tubular member 204 had an anisotropy ratio AR greater than 1, and the radial expansion and plastic deformation of the second expandable tubular member did not result in any of the openings, 204*a*, 204*b*, 204*c*, and 204*d*, splitting or otherwise fracturing the remaining portions of the second expandable tubular member. This was an unexpected result.

Figure 18:
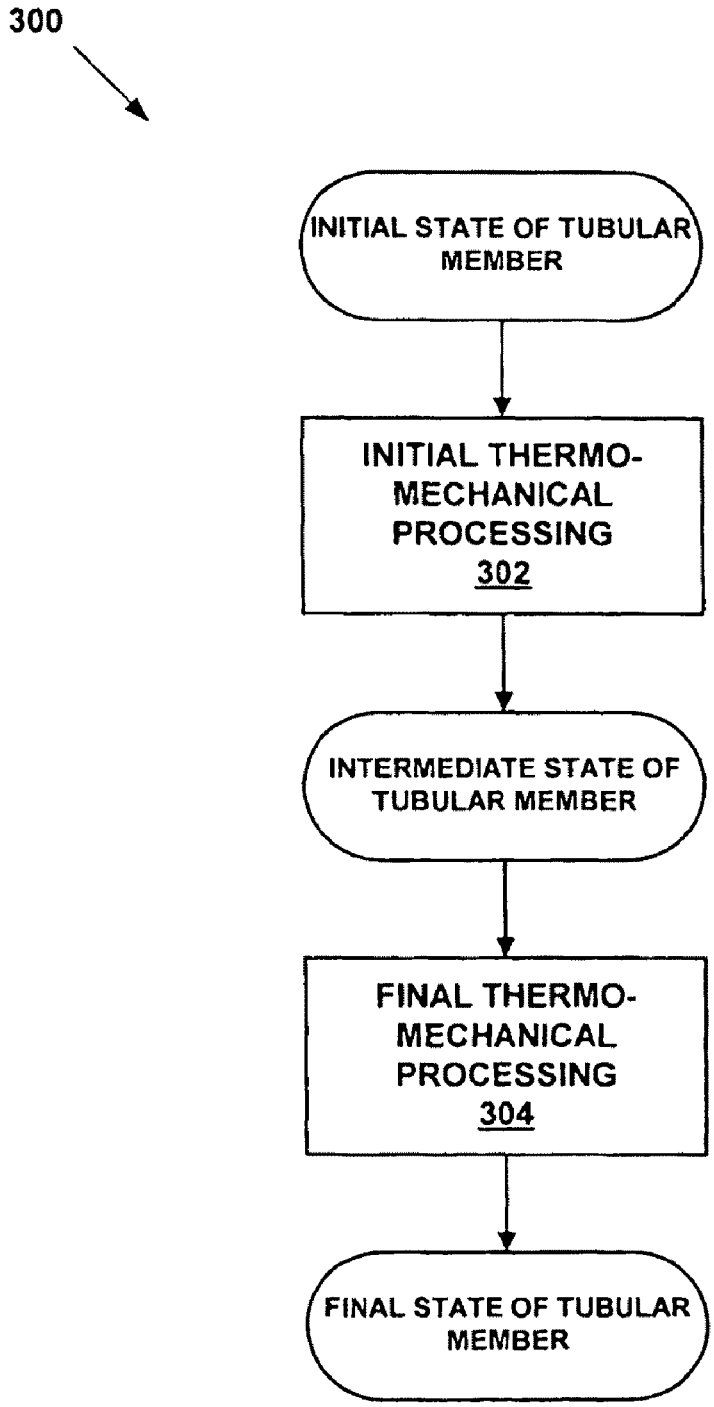
FIG. 18 is a flow chart illustration of an exemplary embodiment of a method of processing an expandable tubular member.

Referring to FIG. 18, in an exemplary embodiment, one or more of the expandable tubular members, 12, 14, 24, 26, 102, 104, 106, 108, 202 and/or 204 are processed using a method 300 in which a tubular member in an initial state is thermo-mechanically processed in step 302. In an exemplary embodiment, the thermo-mechanical processing 302 includes one or more heat treating and/or mechanical forming processes. As a result, of the thermo-mechanical processing 302, the tubular member is transformed to an intermediate state. The tubular member is then further thermo-mechanically processed in step 304. In an exemplary embodiment, the thermo-mechanical processing 304 includes one or more heat treating and/or mechanical forming processes. As a result, of the thermo-mechanical processing 304, the tubular member is transformed to a final state.

Figure 19:
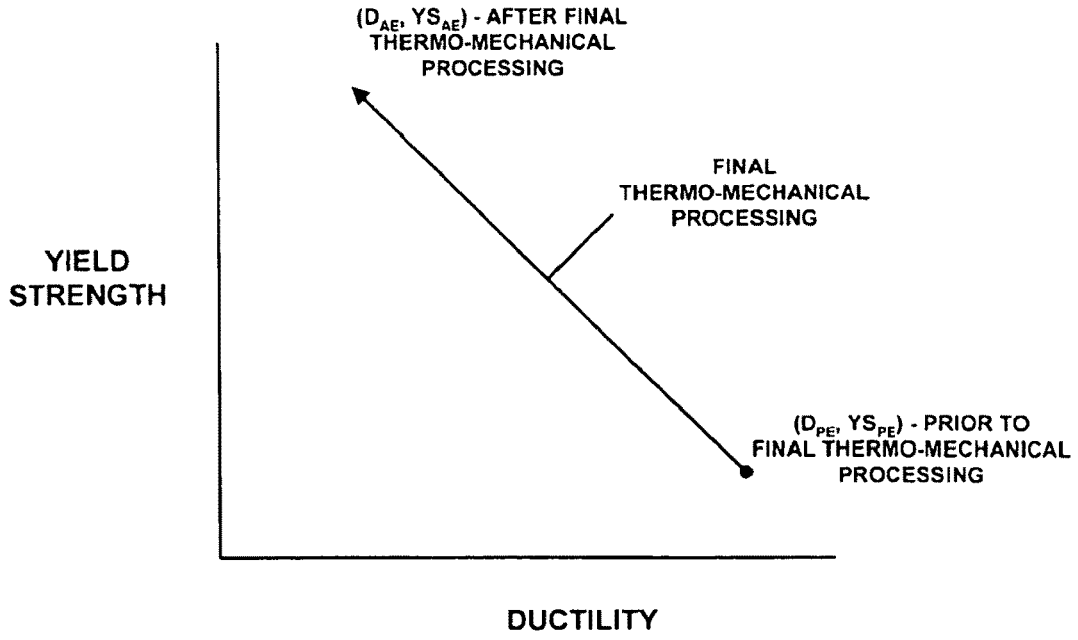
FIG. 19 is a graphical illustration of the an exemplary embodiment of the yield strength vs. ductility curve for at least a portion of the expandable tubular member during the operation of the method of FIG. 18.

In an exemplary embodiment, as illustrated in FIG. 19, during the operation of the method 300, the tubular member has a ductility $D_{PE}$ and a yield strength $YS_{PE}$ prior to the final thermo-mechanical processing in step 304, and a ductility $D_{AE}$ and a yield strength $YS_{AE}$ after final thermo-mechanical processing. In an exemplary embodiment, $D_{PE}$ is greater than $D_{AE}$, and $YS_{AE}$ is greater than $YS_{PE}$. In this manner, the amount of energy and/or power required to transform the tubular member, using mechanical forming processes, during the final thermo-mechanical processing in step 304 is reduced. Furthermore, in this manner, because the $YS_{AE}$ is greater than $YS_{PE}$, the collapse strength of the tubular member is increased after the final thermo-mechanical processing in step 304.

In an exemplary embodiment, one or more of the expandable tubular members, 12, 14, 24, 26, 102, 104, 106, 108, 202 and/or 204, have the following characteristics:

| Characteristic | Value |
|---|---|
| Tensile Strength | 60 to 120 ksi |
| Yield Strength | 50 to 100 ksi |
| Y/T Ratio | Maximum of 50/85% |
| Elongation During Radial Expansion and Plastic Deformation | Minimum of 35% |
| Width Reduction During Radial Expansion and Plastic Deformation | Minimum of 40% |
| Wall Thickness Reduction During Radial Expansion and Plastic Deformation | Minimum of 30% |
| Anisotropy | Minimum of 1.5 |
| Minimum Absorbed Energy at −4 F. (−20 C.) in the Longitudinal Direction | 80 ft-lb |
| Minimum Absorbed Energy at −4 F. (−20 C.) in the Transverse Direction | 60 ft-lb |
| Minimum Absorbed Energy at −4 F. (−20 C.) Transverse To A Weld Area | 60 ft-lb |
| Flare Expansion Testing | Minimum of 75% Without A Failure |
| Increase in Yield Strength Due To Radial Expansion and Plastic Deformation | Greater than 5.4% |

In an exemplary embodiment, one or more of the expandable tubular members, 12, 14, 24, 26, 102, 104, 106, 108, 202 and/or 204, are characterized by an expandability coefficient f:

i. f=r×n ii. where f=expandability coefficient;

1. r=anisotropy coefficient; and 2. n=strain hardening exponent.

In an exemplary embodiment, the anisotropy coefficient for one or more of the expandable tubular members, 12, 14, 24, 26, 102, 104, 106, 108, 202 and/or 204 is greater than 1. In an exemplary embodiment, the strain hardening exponent for one or more of the expandable tubular members, 12, 14, 24, 26, 102, 104, 106, 108, 202 and/or 204 is greater than 0.12. In an exemplary embodiment, the expandability coefficient for one or more of the expandable tubular members, 12, 14, 24, 26, 102, 104, 106, 108, 202 and/or 204 is greater than 0.12.

In an exemplary embodiment, a tubular member having a higher expandability coefficient requires less power and/or energy to radially expand and plastically deform each unit length than a tubular member having a lower expandability coefficient. In an exemplary embodiment, a tubular member having a higher expandability coefficient requires less power and/or energy per unit length to radially expand and plastically deform than a tubular member having a lower expandability coefficient.

In several exemplary experimental embodiments, one or more of the expandable tubular members, 12, 14, 24, 26, 102, 104, 106, 108, 202 and/or 204, are steel alloys having one of the following compositions:

| Steel | Element and Percentage By Weight | | | | | | | |
|---|---|---|---|---|---|---|---|---|
| Alloy | C | Mn | P | S | Si | Cu | Ni | Cr |
| A | 0.065 | 1.44 | 0.01 | 0.002 | 0.24 | 0.01 | 0.01 | 0.02 |
| B | 0.18 | 1.28 | 0.017 | 0.004 | 0.29 | 0.01 | 0.01 | 0.03 |
| C | 0.08 | 0.82 | 0.006 | 0.003 | 0.30 | 0.16 | 0.05 | 0.05 |
| D | 0.02 | 1.31 | 0.02 | 0.001 | 0.45 | — | 9.1 | 18.7 |

Figure 20:
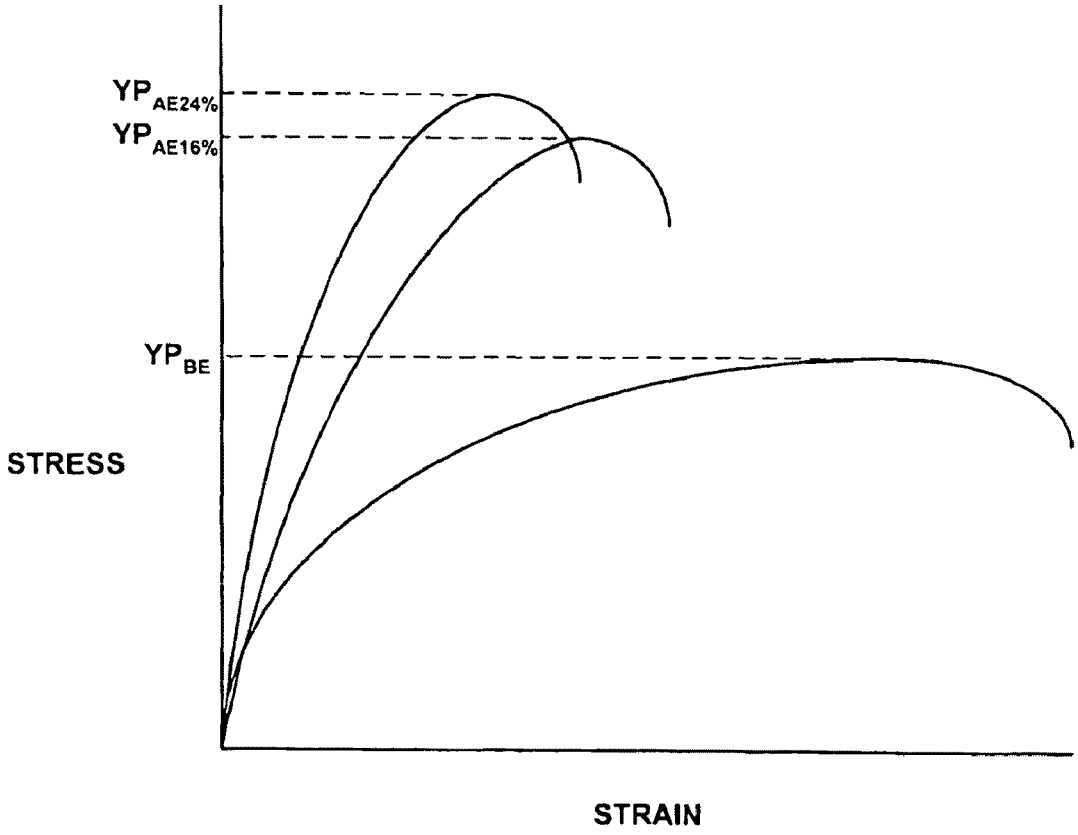
FIG. 20 is a graphical illustration of stress/strain curves for an exemplary embodiment of an expandable tubular member.

In exemplary experimental embodiment, as illustrated in FIG. 20, a sample of an expandable tubular member composed of Alloy A exhibited a yield point before radial expansion and plastic deformation $YP_{BE}$, a yield point after radial expansion and plastic deformation of about 16% $YP_{AE16\%}$, and a yield point after radial expansion and plastic deformation of about 24% $YP_{AE24\%}$. In an exemplary experimental embodiment, $YP_{AE24\%}>YP_{AE16\%}>YP_{BE}$. Furthermore, in an exemplary experimental embodiment, the ductility of the sample of the expandable tubular member composed of Alloy A also exhibited a higher ductility prior to radial expansion and plastic deformation than after radial expansion and plastic deformation. These were unexpected results.

In an exemplary experimental embodiment, a sample of an expandable tubular member composed of Alloy A exhibited the following tensile characteristics before and after radial expansion and plastic deformation:

| | Yield Point ksi | Yield Ratio | Elongation % | Width Reduction % | Wall Thickness Reduction % | Anisotropy |
|---|---|---|---|---|---|---|
| Before Radial Expansion and Plastic Deformation | 46.9 | 0.69 | 53 | −52 | 55 | 0.93 |
| After 16% Radial Expansion | 65.9 | 0.83 | 17 | 42 | 51 | 0.78 |
| After 24% | 68.5 | 0.83 | 5 | 44 | 54 | 0.76 |

-continued

| | Yield Point ksi | Yield Ratio | Elongation % | Width Reduction % | Wall Thickness Reduction % | Anisotropy |
|---|---|---|---|---|---|---|
| Radial Expansion % Increase | 40% for 16% radial expansion 46% for 24% radial expansion | | | | | |

Figure 21:
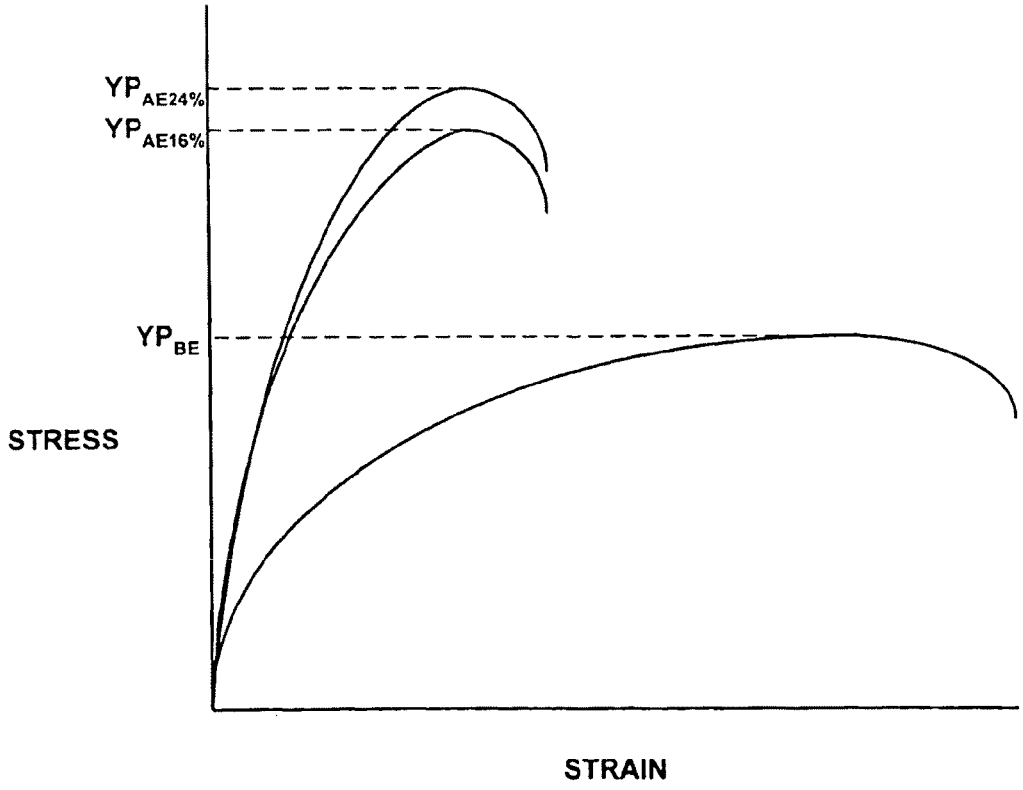
FIG. 21 is a graphical illustration of stress/strain curves for an exemplary embodiment of an expandable tubular member.

In exemplary experimental embodiment, as illustrated in FIG. 21, a sample of an expandable tubular member composed of Alloy B exhibited a yield point before radial expansion and plastic deformation $YP_{BE}$, a yield point after radial expansion and plastic deformation of about 16% $YP_{AE16\%}$, and a yield point after radial expansion and plastic deformation of about 24% $YP_{AE24\%}$. In an exemplary embodiment, $YP_{AE24\%}>YP_{AE16\%}>YP_{BE}$. Furthermore, in an exemplary experimental embodiment, the ductility of the sample of the expandable tubular member composed of Alloy B also exhibited a higher ductility prior to radial expansion and plastic deformation than after radial expansion and plastic deformation. These were unexpected results.

In an exemplary experimental embodiment, a sample of an expandable tubular member composed of Alloy B exhibited the following tensile characteristics before and after radial expansion and plastic deformation:

| | Yield Point ksi | Yield Ratio | Elongation % | Width Reduction % | Wall Thickness Reduction % | Anisotropy |
|---|---|---|---|---|---|---|
| Before Radial Expansion and Plastic Deformation | 57.8 | 0.71 | 44 | 43 | 46 | 0.93 |
| After 16% Radial Expansion | 74.4 | 0.84 | 16 | 38 | 42 | 0.87 |
| After 24% Radial Expansion | 79.8 | 0.86 | 20 | 36 | 42 | 0.81 |
| % Increase | 28.7% increase for 16% radial expansion 38% increase for 24% radial expansion | | | | | |

In an exemplary experimental embodiment, samples of expandable tubulars composed of Alloys A, B, C, and D exhibited the following tensile characteristics prior to radial expansion and plastic deformation:

| Steel Alloy | Yield ksi | Yield Ratio | Elongation % | Anisotropy | Absorbed Energy ft-lb | Expandability Coefficient |
|---|---|---|---|---|---|---|
| A | 47.6 | 0.71 | 44 | 1.48 | 145 | |
| B | 57.8 | 0.71 | 44 | 1.04 | 62.2 | |
| C | 61.7 | 0.80 | 39 | 1.92 | 268 | |
| D | 48 | 0.55 | 56 | 1.34 | — | |

In an exemplary embodiment, one or more of the expandable tubular members, 12, 14, 24, 26, 102, 104, 106, 108, 202 and/or 204 have a strain hardening exponent greater than 0.12, and a yield ratio is less than 0.85.

In an exemplary embodiment, the carbon equivalent $C_e$, for tubular members having a carbon content (by weight percentage) less than or equal to 0.12%, is given by the following expression:

$$C_e=C+Mn/6+(Cr+Mo+V+Ti+Nb)/5+(Ni+Cu)/15$$

where $C_e$=carbon equivalent value;

a. C=carbon percentage by weight;
b. Mn=manganese percentage by weight;
c. Cr=chromium percentage by weight;
d. Mo=molybdenum percentage by weight;
e. V=vanadium percentage by weight;
f. Ti=titanium percentage by weight;
g. Nb=niobium percentage by weight;
h. Ni=nickel percentage by weight; and
i. Cu=copper percentage by weight.

In an exemplary embodiment, the carbon equivalent value $C_e$, for tubular members having a carbon content less than or equal to 0.12% (by weight), for one or more of the expandable tubular members, 12, 14, 24, 26, 102, 104, 106, 108, 202 and/or 204 is less than 0.21.

In an exemplary embodiment, the carbon equivalent $C_e$, for tubular members having more than 0.12% carbon content (by weight), is given by the following expression:

$$C_e=C+Si/30+(Mn+Cu+Cr)/20+Ni/60+Mo/15+V/10+5*B$$

where $C_o$=carbon equivalent value;

a. C=carbon percentage by weight;
b. Si=silicon percentage by weight;
c. Mn=manganese percentage by weight;
d. Cu=copper percentage by weight;
e. Cr=chromium percentage by weight;
f. Ni=nickel percentage by weight;
g. Mo=molybdenum percentage by weight;
h. V=vanadium percentage by weight; and
i. B=boron percentage by weight.

In an exemplary embodiment, the carbon equivalent value $C_e$, for tubular members having greater than 0.12% carbon content (by weight), for one or more of the expandable tubular members, 12, 14, 24, 26, 102, 104, 106, 108, 202 and/or 204 is less than 0.36.

Figure 22:
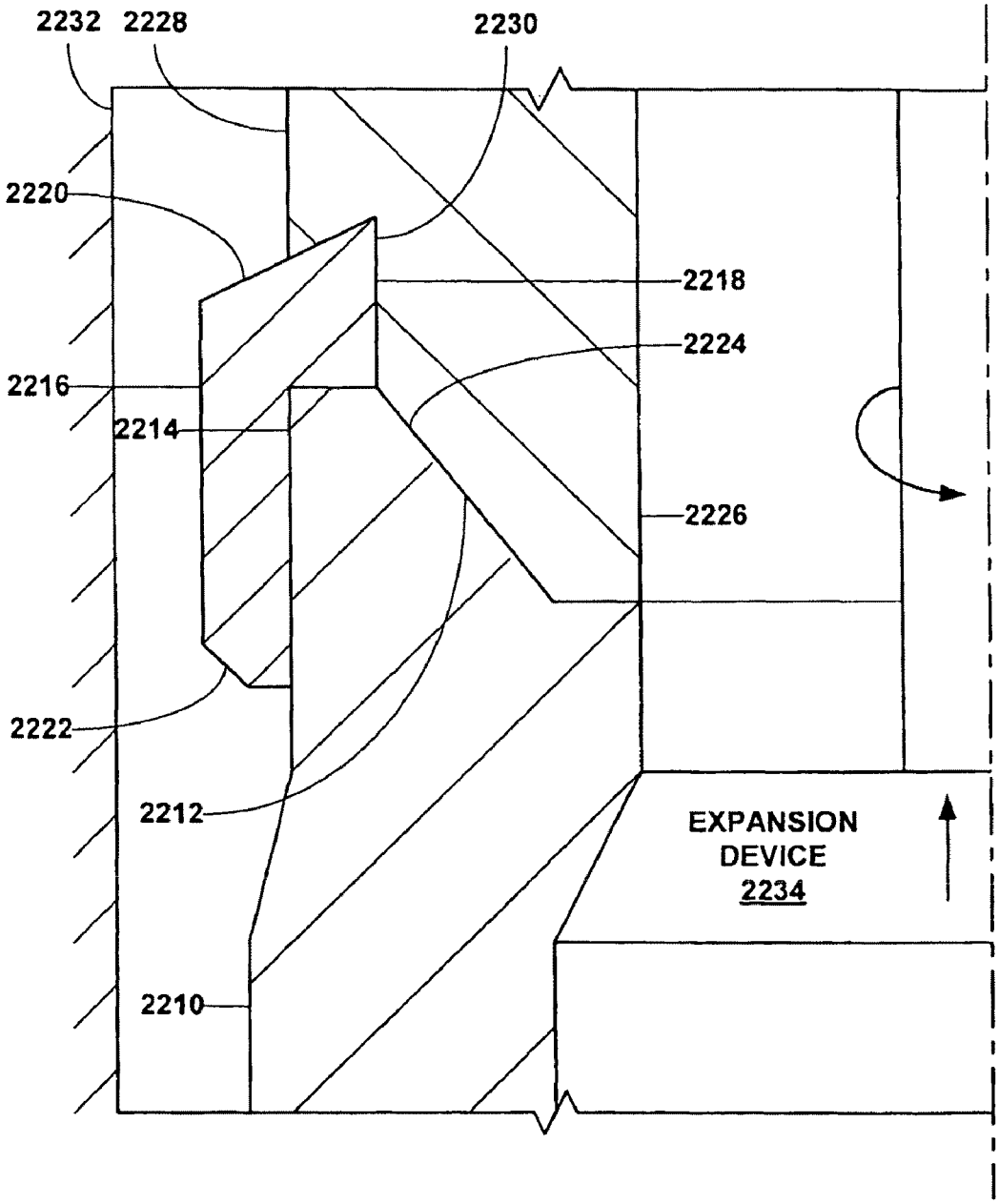
FIG. 22 is a fragmentary cross-sectional view illustrating an embodiment of the radial expansion and plastic deformation of a portion of a first tubular member having an internally threaded connection at an end portion, an embodiment of a tubular sleeve supported by the end portion of the first tubular member, and a second tubular member having an externally threaded portion coupled to the internally threaded portion of the first tubular member and engaged by a flange of the sleeve. The sleeve includes the flange at one end for increasing axial compression loading.

Referring to FIG. 22 in an exemplary embodiment, a first tubular member 2210 includes an internally threaded connection 2212 at an end portion 2214. A first end of a tubular sleeve 2216 that includes an internal flange 2218 having a tapered portion 2220, and a second end that includes a tapered portion 2222, is then mounted upon and receives the end portion 2214 of the first tubular member 2210. In an exemplary embodiment, the end portion 2214 of the first tubular member 2210 abuts one side of the internal flange 2218 of the tubular sleeve 2216, and the internal diameter of the internal flange 2218 of the tubular sleeve 2216 is substantially equal to or greater than the maximum internal diameter of the internally threaded connection 2212 of the end portion 2214 of the first tubular member 2210. An externally threaded connection 2224 of an end portion 2226 of a second tubular member 2228 having an annular recess 2230 is then positioned within the tubular sleeve 2216 and threadably coupled to the internally threaded connection 2212 of the end portion 2214 of the first tubular member 2210. In an exemplary embodiment, the internal flange 2218 of the tubular sleeve 2216 mates with and is received within the annular recess 2230 of the end portion 2226 of the second tubular member 2228. Thus, the tubular sleeve 2216 is coupled to and surrounds the external surfaces of the first and second tubular members, 2210 and 2228.

The internally threaded connection 2212 of the end portion 2214 of the first tubular member 2210 is a box connection, and the externally threaded connection 2224 of the end portion 2226 of the second tubular member 2228 is a pin connection. In an exemplary embodiment, the internal diameter of the tubular sleeve 2216 is at least approximately 0.020" greater than the outside diameters of the first and second tubular members, 2210 and 2228. In this manner, during the threaded coupling of the first and second tubular members, 2210 and 2228, fluidic materials within the first and second tubular members may be vented from the tubular members.

As illustrated in FIG. 22, the first and second tubular members, 2210 and 2228, and the tubular sleeve 2216 may be positioned within another structure 2232 such as, for example, a cased or uncased wellbore, and radially expanded and plastically deformed, for example, by displacing and/or rotating a conventional expansion device 2234 within and/or through the interiors of the first and second tubular members. The tapered portions, 2220 and 2222, of the tubular sleeve 2216 facilitate the insertion and movement of the first and second tubular members within and through the structure 2232, and the movement of the expansion device 2234 through the interiors of the first and second tubular members, 2210 and 2228, may be, for example, from top to bottom or from bottom to top.

During the radial expansion and plastic deformation of the first and second tubular members, 2210 and 2228, the tubular sleeve 2216 is also radially expanded and plastically deformed. As a result, the tubular sleeve 2216 may be maintained in circumferential tension and the end portions, 2214 and 2226, of the first and second tubular members, 2210 and 2228, may be maintained in circumferential compression.

Sleeve 2216 increases the axial compression loading of the connection between tubular members 2210 and 2228 before and after expansion by the expansion device 2234. Sleeve 2216 may, for example, be secured to tubular members 2210 and 2228 by a heat shrink fit.

In several alternative embodiments, the first and second tubular members, 2210 and 2228, are radially expanded and plastically deformed using other conventional methods for radially expanding and plastically deforming tubular members such as, for example, internal pressurization, hydroforming, and/or roller expansion devices and/or any one or combination of the conventional commercially available expansion products and services available from Baker Hughes, Weatherford International, and/or Enventure Global Technology L.L.C.

The use of the tubular sleeve 2216 during (a) the coupling of the first tubular member 2210 to the second tubular member 2228, (b) the placement of the first and second tubular members in the structure 2232, and (c) the radial expansion and plastic deformation of the first and second tubular members provides a number of significant benefits. For example, the tubular sleeve 2216 protects the exterior surfaces of the end portions, 2214 and 2226, of the first and second tubular members, 2210 and 2228, during handling and insertion of the tubular members within the structure 2232. In this manner, damage to the exterior surfaces of the end portions, 2214 and 2226, of the first and second tubular members, 2210 and 2228, is avoided that could otherwise result in stress concentrations that could cause a catastrophic failure during subsequent radial expansion operations. Furthermore, the tubular sleeve 2216 provides an alignment guide that facilitates the insertion and threaded coupling of the second tubular member 2228 to the first tubular member 2210. In this manner, misalignment that could result in damage to the threaded connections, 2212 and 2224, of the first and second tubular members, 2210 and 2228, may be avoided. In addition, during the relative rotation of the second tubular member with respect to the first tubular member, required during the threaded coupling of the first and second tubular members, the tubular sleeve 2216 provides an indication of to what degree the first and second tubular members are threadably coupled. For example, if the tubular sleeve 2216 can be easily rotated, that would indicate that the first and second tubular members, 2210 and 2228, are not fully threadably coupled and in intimate contact with the internal flange 2218 of the tubular sleeve. Furthermore, the tubular sleeve 2216 may prevent crack propagation during the radial expansion and plastic deformation of the first and second tubular members, 2210 and 2228. In this manner, failure modes such as, for example, longitudinal cracks in the end portions, 2214 and 2226, of the first and second tubular members may be limited in severity or eliminated all together. In addition, after completing the radial expansion and plastic deformation of the first and second tubular members, 2210 and 2228, the tubular sleeve 2216 may provide a fluid tight metal-to-metal seal between interior surface of the tubular sleeve 2216 and the exterior surfaces of the end portions, 2214 and 2226, of the first and second tubular members. In this manner, fluidic materials are prevented from passing through the threaded connections, 2212 and 2224, of the first and second tubular members, 2210 and 2228, into the annulus between the first and second tubular members and the structure 2232. Furthermore, because, following the radial expansion and plastic deformation of the first and second tubular members, 2210 and 2228, the tubular sleeve 2216 may be maintained in circumferential tension and the end portions, 2214 and 2226, of the first and second tubular members, 2210 and 2228, may be maintained in circumferential compression, axial loads and/or torque loads may be transmitted through the tubular sleeve.

In several exemplary embodiments, one or more portions of the first and second tubular members, 2210 and 2228, and the tubular sleeve 2216 have one or more of the material properties of one or more of the tubular members 12, 14, 24, 26, 102, 104, 106, 108, 202 and/or 204.

Figure 23:
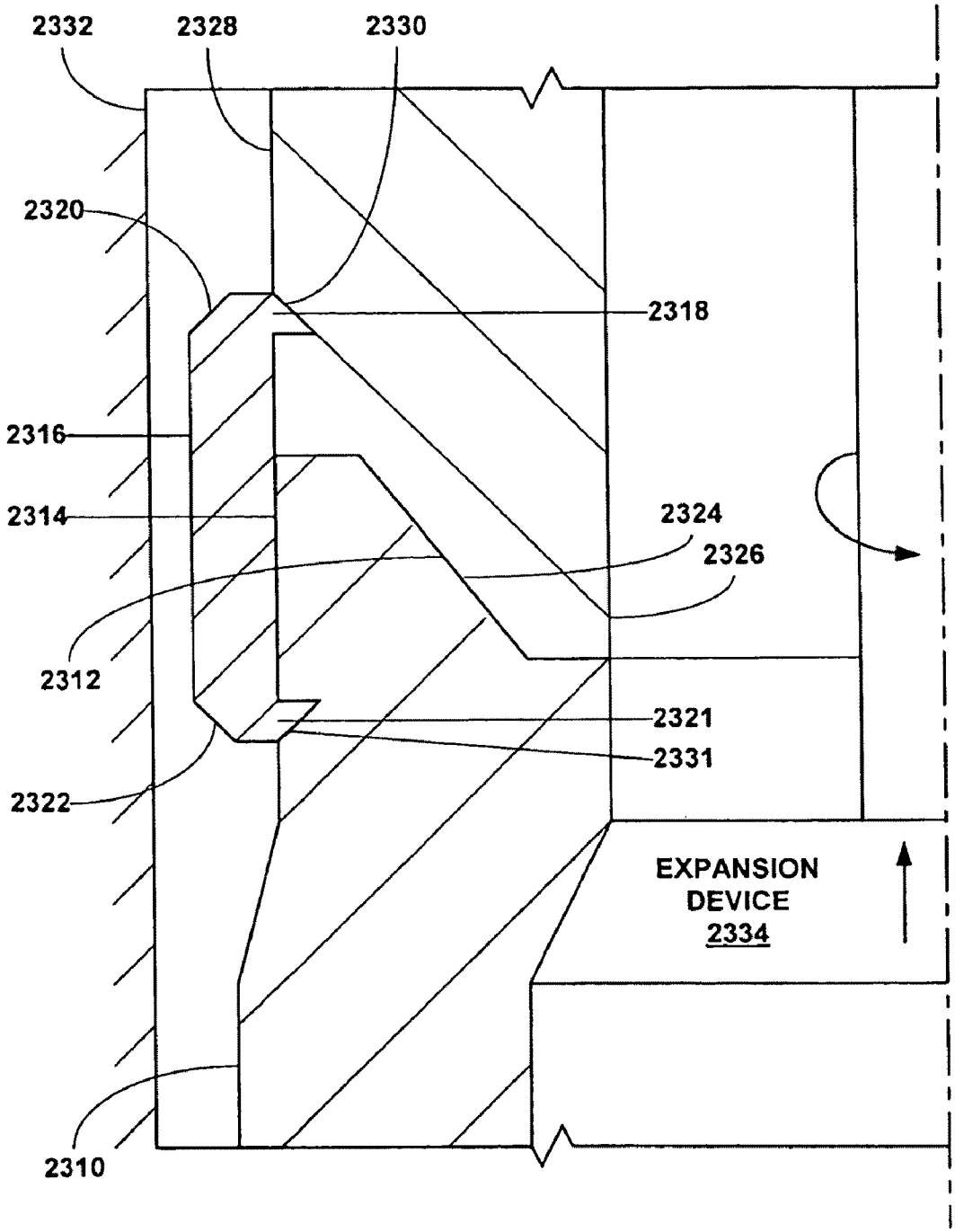
FIG. 23 is a fragmentary cross-sectional view illustrating an embodiment of the radial expansion and plastic deformation of a portion of a first tubular member having an internally threaded connection at an end portion, a second tubular member having an externally threaded portion coupled to the internally threaded portion of the first tubular member, and an embodiment of a tubular sleeve supported by the end portion of both tubular members. The sleeve includes flanges at opposite ends for increasing axial tension loading.

Referring to FIG. 23, in an exemplary embodiment, a first tubular member 210 includes an internally threaded connection 2312 at an end portion 2314. A first end of a tubular sleeve 2316 includes an internal flange 2318 and a tapered portion 2320. A second end of the sleeve 2316 includes an internal flange 2321 and a tapered portion 2322. An externally threaded connection 2324 of an end portion 2326 of a second tubular member 2328 having an annular recess 2330, is then positioned within the tubular sleeve 2316 and threadably coupled to the internally threaded connection 2312 of the end portion 2314 of the first tubular member 2310. The internal flange 2318 of the sleeve 2316 mates with and is received within the annular recess 2330.

The first tubular member 2310 includes a recess 2331. The internal flange 2321 mates with and is received within the annular recess 2331. Thus, the sleeve 2316 is coupled to and surrounds the external surfaces of the first and second tubular members 2310 and 2328.

The internally threaded connection 2312 of the end portion 2314 of the first tubular member 2310 is a box connection, and the externally threaded connection 2324 of the end portion 2326 of the second tubular member 2328 is a pin connection. In an exemplary embodiment, the internal diameter of the tubular sleeve 2316 is at least approximately 0.020" greater than the outside diameters of the first and second tubular members 2310 and 2328. In this manner, during the threaded coupling of the first and second tubular members 2310 and 2328, fluidic materials within the first and second tubular members may be vented from the tubular members.

As illustrated in FIG. 23, the first and second tubular members 2310 and 2328, and the tubular sleeve 2316 may then be positioned within another structure 2332 such as, for example, a wellbore, and radially expanded and plastically deformed, for example, by displacing and/or rotating an expansion device 2334 through and/or within the interiors of the first and second tubular members. The tapered portions 2320 and 2322, of the tubular sleeve 2316 facilitates the insertion and movement of the first and second tubular members within and through the structure 2332, and the displacement of the expansion device 2334 through the interiors of the first and second tubular members 2310 and 2328, may be from top to bottom or from bottom to top.

During the radial expansion and plastic deformation of the first and second tubular members 2310 and 2328, the tubular sleeve 2316 is also radially expanded and plastically deformed. In an exemplary embodiment, as a result, the tubular sleeve 2316 may be maintained in circumferential tension and the end portions 2314 and 2326, of the first and second tubular members 2310 and 2328, may be maintained in circumferential compression.

Sleeve 2316 increases the axial tension loading of the connection between tubular members 2310 and 2328 before and after expansion by the expansion device 2334. Sleeve 2316 may be secured to tubular members 2310 and 2328 by a heat shrink fit.

In several exemplary embodiments, one or more portions of the first and second tubular members, 2310 and 2328, and the tubular sleeve 2316 have one or more of the material properties of one or more of the tubular members 12, 14, 24, 26, 102, 104, 106, 108, 202 and/or 204.

Figure 24:
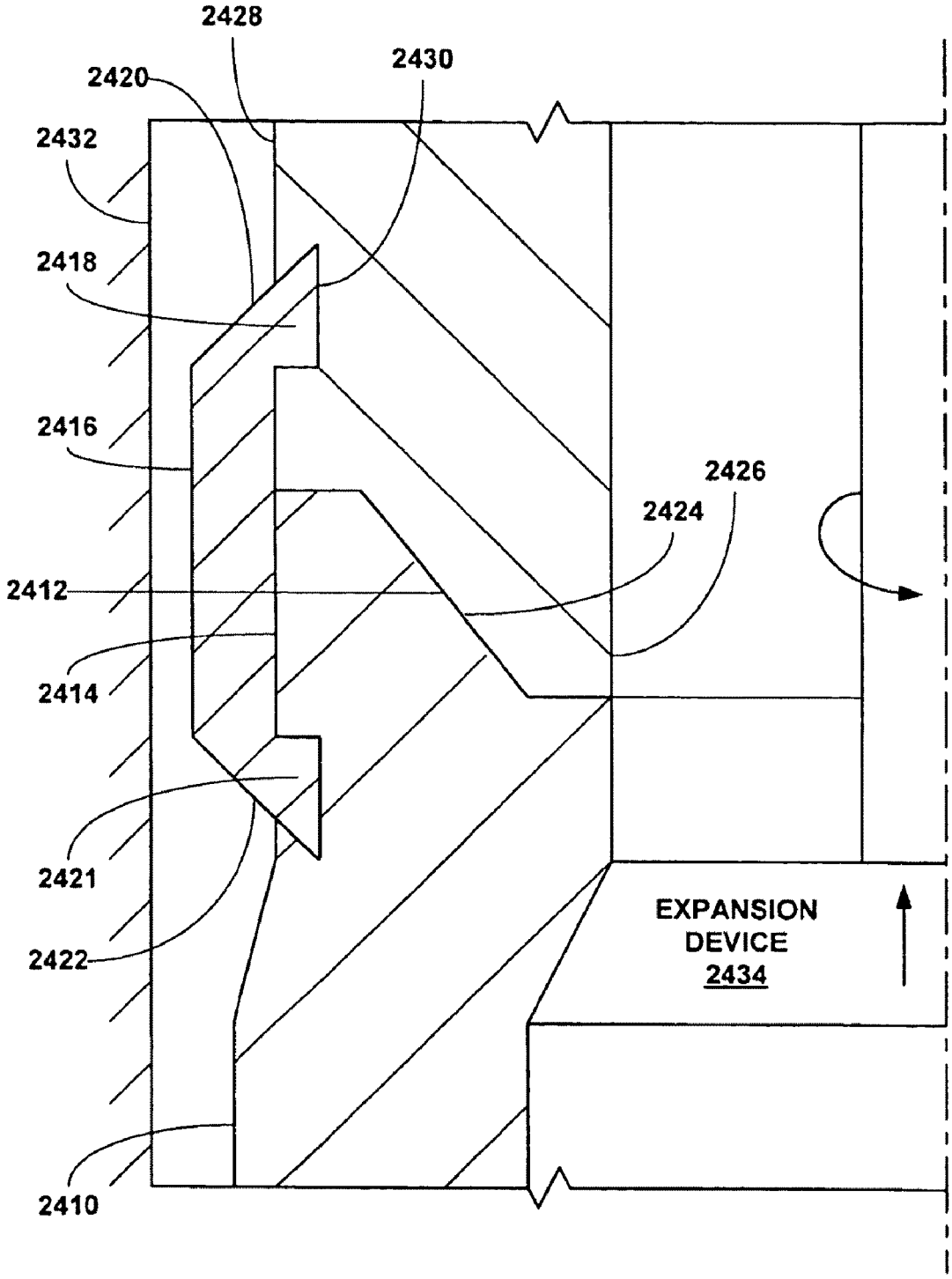
FIG. 24 is a fragmentary cross-sectional illustration of the radial expansion and plastic deformation of a portion of a first tubular member having an internally threaded connection at an end portion, a second tubular member having an externally threaded portion coupled to the internally threaded portion of the first tubular member, and an embodiment of a tubular sleeve supported by the end portion of both tubular members. The sleeve includes flanges at opposite ends for increasing axial compression/tension loading.

Referring to FIG. 24, in an exemplary embodiment, a first tubular member 2410 includes an internally threaded connection 2412 at an end portion 2414. A first end of a tubular sleeve 2416 includes an internal flange 2418 and a tapered portion 2420. A second end of the sleeve 2416 includes an internal flange 2421 and a tapered portion 2422. An externally threaded connection 2424 of an end portion 2426 of a second tubular member 2428 having an annular recess 2430, is then positioned within the tubular sleeve 2416 and threadably coupled to the internally threaded connection 2412 of the end portion 2414 of the first tubular member 2410. The internal flange 2418 of the sleeve 2416 mates with and is received within the annular recess 2430. The first tubular member 2410 includes a recess 2431. The internal flange 2421 mates with and is received within the annular recess 2431. Thus, the sleeve 2416 is coupled to and surrounds the external surfaces of the first and second tubular members 2410 and 2428.

The internally threaded connection 2412 of the end portion 2414 of the first tubular member 2410 is a box connection, and the externally threaded connection 2424 of the end portion 2426 of the second tubular member 2428 is a pin connection. In an exemplary embodiment, the internal diameter of the tubular sleeve 2416 is at least approximately 0.020" greater than the outside diameters of the first and second tubular members 2410 and 2428. In this manner, during the threaded coupling of the first and second tubular members 2410 and 2428, fluidic materials within the first and second tubular members may be vented from the tubular members.

As illustrated in FIG. 24, the first and second tubular members 2410 and 2428, and the tubular sleeve 2416 may then be positioned within another structure 2432 such as, for example, a wellbore, and radially expanded and plastically deformed, for example, by displacing and/or rotating an expansion device 2434 through and/or within the interiors of the first and second tubular members. The tapered portions 2420 and 2422, of the tubular sleeve 2416 facilitate the insertion and movement of the first and second tubular members within and through the structure 2432, and the displacement of the expansion device 2434 through the interiors of the first and second tubular members, 2410 and 2428, may be from top to bottom or from bottom to top.

During the radial expansion and plastic deformation of the first and second tubular members, 2410 and 2428, the tubular sleeve 2416 is also radially expanded and plastically deformed. In an exemplary embodiment, as a result, the tubular sleeve 2416 may be maintained in circumferential tension and the end portions, 2414 and 2426, of the first and second tubular members, 2410 and 2428, may be maintained in circumferential compression.

The sleeve 2416 increases the axial compression and tension loading of the connection between tubular members 2410 and 2428 before and after expansion by expansion device 2424. Sleeve 2416 may be secured to tubular members 2410 and 2428 by a heat shrink fit.

In several exemplary embodiments, one or more portions of the first and second tubular members, 2410 and 2428, and the tubular sleeve 2416 have one or more of the material properties of one or more of the tubular members 12, 14, 24, 26, 102, 104, 106, 108, 202 and/or 204.

Figure 25:
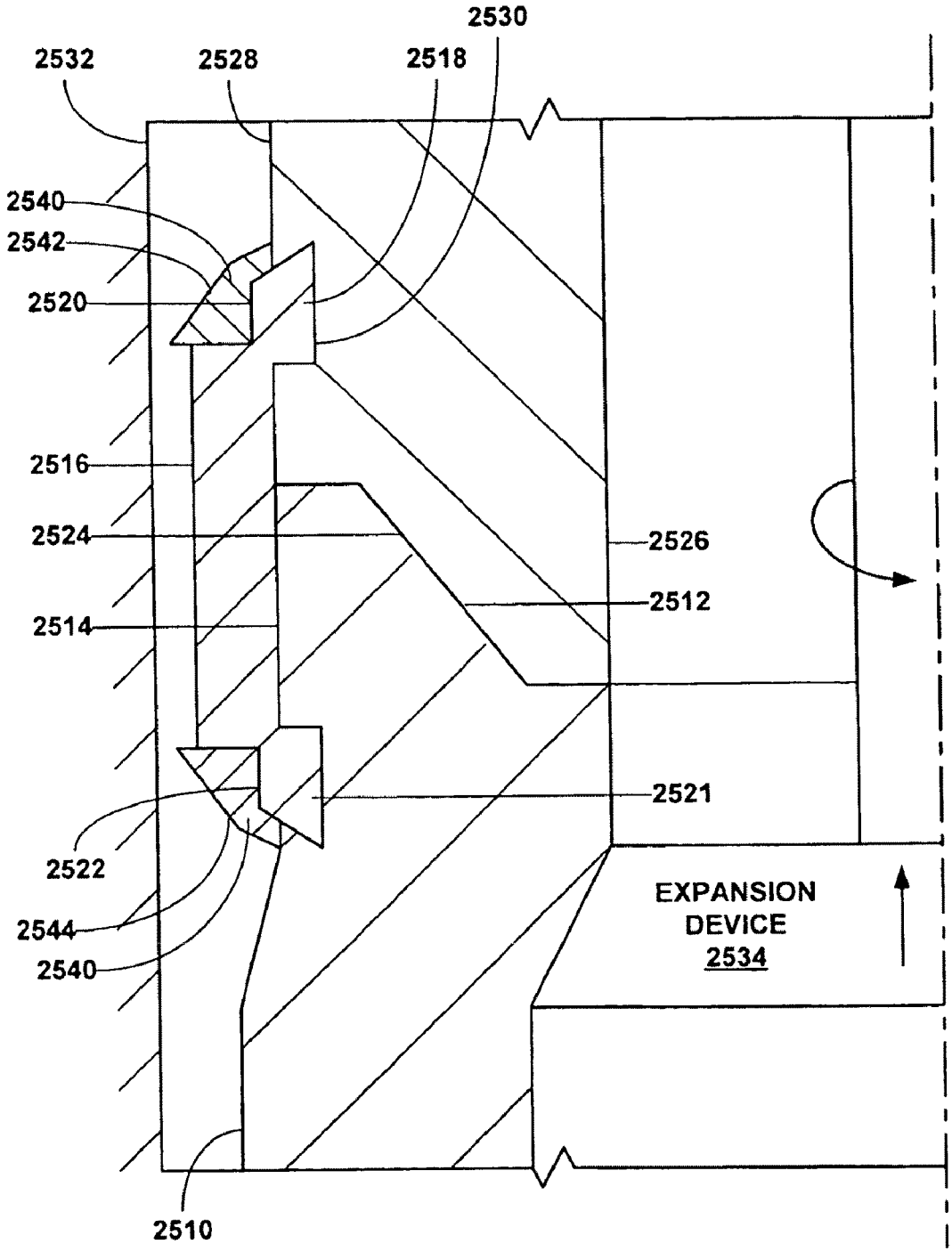
FIG. 25 is a fragmentary cross-sectional illustration of the radial expansion and plastic deformation of a portion of a first tubular member having an internally threaded connection at an end portion, a second tubular member having an externally threaded portion coupled to the internally threaded portion of the first tubular member, and an embodiment of a tubular sleeve supported by the end portion of both tubular members. The sleeve includes flanges at opposite ends having sacrificial material thereon.

Referring to FIG. 25, in an exemplary embodiment, a first tubular member 2510 includes an internally threaded connection 2512 at an end portion 2514. A first end of a tubular sleeve 2516 includes an internal flange 2518 and a relief 2520. A second end of the sleeve 2516 includes an internal flange 2521 and a relief 2522. An externally threaded connection 2524 of an end portion 2526 of a second tubular member 2528 having an annular recess 2530, is then positioned within the tubular sleeve 2516 and threadably coupled to the internally threaded connection 2512 of the end portion 2514 of the first tubular member 2510. The internal flange 2518 of the sleeve 2516 mates with and is received within the annular recess 2530. The first tubular member 2510 includes a recess 2531. The internal flange 2521 mates with and is received within the annular recess 2531. Thus, the sleeve 2516 is coupled to and surrounds the external surfaces of the first and second tubular members 2510 and 2528.

The internally threaded connection 2512 of the end portion 2514 of the first tubular member 2510 is a box connection, and the externally threaded connection 2524 of the end portion 2526 of the second tubular member 2528 is a pin connection. In an exemplary embodiment, the internal diameter of the tubular sleeve 2516 is at least approximately 0.020" greater than the outside diameters of the first and second tubular members 2510 and 2528. In this manner, during the threaded coupling of the first and second tubular members 2510 and 2528, fluidic materials within the first and second tubular members may be vented from the tubular members.

As illustrated in FIG. 25, the first and second tubular members 2510 and, 2528, and the tubular sleeve 2516 may then be positioned within another structure 2532 such as, for example, a wellbore, and radially expanded and plastically deformed, for example, by displacing and/or rotating an expansion device 2534 through and/or within the interiors of the first and second tubular members. The reliefs 2520 and 2522 are each filled with a sacrificial material 2540 including a tapered surface 2542 and 2544, respectively. The material 2540 may be a metal or a synthetic, and is provided to facilitate the insertion and movement of the first and second tubular members 2510 and 2528, through the structure 2532. The displacement of the expansion device 2534 through the interiors of the first and second tubular members 2510 and 2528, may, for example, be from top to bottom or from bottom to top.

During the radial expansion and plastic deformation of the first and second tubular members 2510 and 2528, the tubular sleeve 2516 is also radially expanded and plastically deformed. In an exemplary embodiment, as a result, the tubular sleeve 2516 may be maintained in circumferential tension and the end portions 2514 and 2526, of the first and second tubular members, 2510 and 2528, may be maintained in circumferential compression.

The addition of the sacrificial material 2540, provided on sleeve 2516, avoids stress risers on the sleeve 2516 and the tubular member 2510. The tapered surfaces 2542 and 2544 are intended to wear or even become damaged, thus incurring such wear or damage which would otherwise be borne by sleeve 2516. Sleeve 2516 may be secured to tubular members 2510 and 2528 by a heat shrink fit.

In several exemplary embodiments, one or more portions of the first and second tubular members, 2510 and 2528, and the tubular sleeve 2516 have one or more of the material properties of one or more of the tubular members 12, 14, 24, 26, 102, 104, 106, 108, 202 and/or 204.

Figure 26:
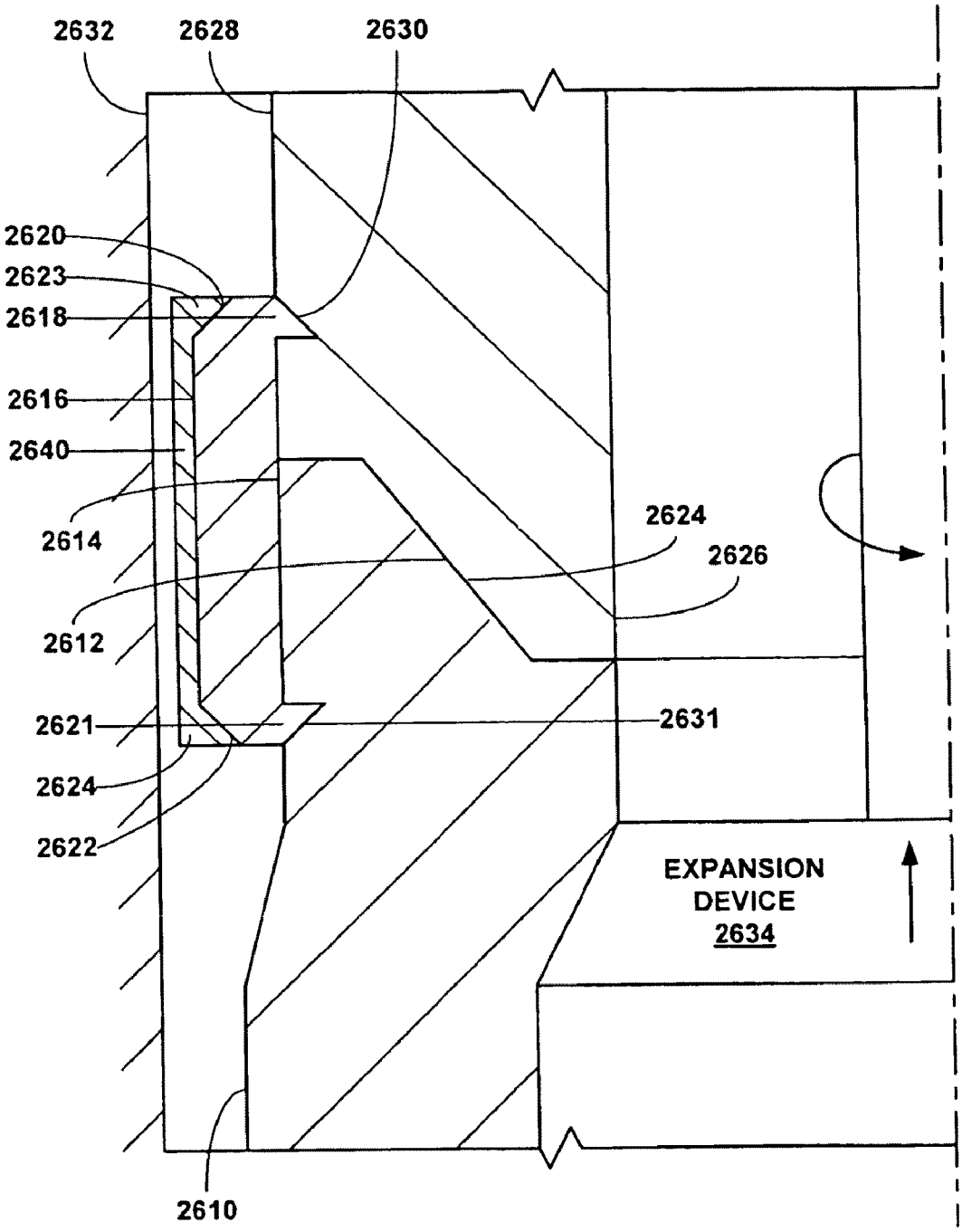
FIG. 26 is a fragmentary cross-sectional illustration of the radial expansion and plastic deformation of a portion of a first tubular member having an internally threaded connection at an end portion, a second tubular member having an externally threaded portion coupled to the internally threaded portion of the first tubular member, and an embodiment of a tubular sleeve supported by the end portion of both tubular members. The sleeve includes a thin walled cylinder of sacrificial material.

Referring to FIG. 26, in an exemplary embodiment, a first tubular member 2610 includes an internally threaded connection 2612 at an end portion 2614. A first end of a tubular sleeve 2616 includes an internal flange 2618 and a tapered portion 2620. A second end of the sleeve 2616 includes an internal flange 2621 and a tapered portion 2622. An externally threaded connection 2624 of an end portion 2626 of a second tubular member 2628 having an annular recess 2630, is then positioned within the tubular sleeve 2616 and threadably coupled to the internally threaded connection 2612 of the end portion 2614 of the first tubular member 2610. The internal flange 2618 of the sleeve 2616 mates with and is received within the annular recess 2630.

The first tubular member 2610 includes a recess 2631. The internal flange 2621 mates with and is received within the annular recess 2631. Thus, the sleeve 2616 is coupled to and surrounds the external surfaces of the first and second tubular members 2610 and 2628.

The internally threaded connection 2612 of the end portion 2614 of the first tubular member 2610 is a box connection, and the externally threaded connection 2624 of the end portion 2626 of the second tubular member 2628 is a pin connection. In an exemplary embodiment, the internal diameter of the tubular sleeve 2616 is at least approximately 0.020" greater than the outside diameters of the first and second tubular members 2610 and 2628. In this manner, during the threaded coupling of the first and second tubular members 2610 and 2628, fluidic materials within the first and second tubular members may be vented from the tubular members.

As illustrated in FIG. 26, the first and second tubular members 2610 and 2628, and the tubular sleeve 2616 may then be positioned within another structure 2632 such as, for example, a wellbore, and radially expanded and plastically deformed, for example, by displacing and/or rotating an expansion device 2634 through and/or within the interiors of the first and second tubular members. The tapered portions 2620 and 2622, of the tubular sleeve 2616 facilitates the insertion and movement of the first and second tubular members within and through the structure 2632, and the displacement of the expansion device 2634 through the interiors of the first and second tubular members 2610 and 2628, may, for example, be from top to bottom or from bottom to top.

During the radial expansion and plastic deformation of the first and second tubular members 2610 and 2628, the tubular sleeve 2616 is also radially expanded and plastically deformed. In an exemplary embodiment, as a result, the tubular sleeve 2616 may be maintained in circumferential tension and the end portions 2614 and 2626, of the first and second tubular members 2610 and 2628, may be maintained in circumferential compression.

Sleeve 2616 is covered by a thin walled cylinder of sacrificial material 2640. Spaces 2623 and 2624, adjacent tapered portions 2620 and 2622, respectively, are also filled with an excess of the sacrificial material 2640. The material may be a metal or a synthetic, and is provided to facilitate the insertion and movement of the first and second tubular members 2610 and 2628, through the structure 2632.

The addition of the sacrificial material 2640, provided on sleeve 2616, avoids stress risers on the sleeve 2616 and the tubular member 2610. The excess of the sacrificial material 2640 adjacent tapered portions 2620 and 2622 are intended to wear or even become damaged, thus incurring such wear or damage which would otherwise be borne by sleeve 2616. Sleeve 2616 may be secured to tubular members 2610 and 2628 by a heat shrink fit.

In several exemplary embodiments, one or more portions of the first and second tubular members, 2610 and 2628, and the tubular sleeve 2616 have one or more of the material properties of one or more of the tubular members 12, 14, 24, 26, 102, 104, 106, 108, 202 and/or 204.

Figure 27:
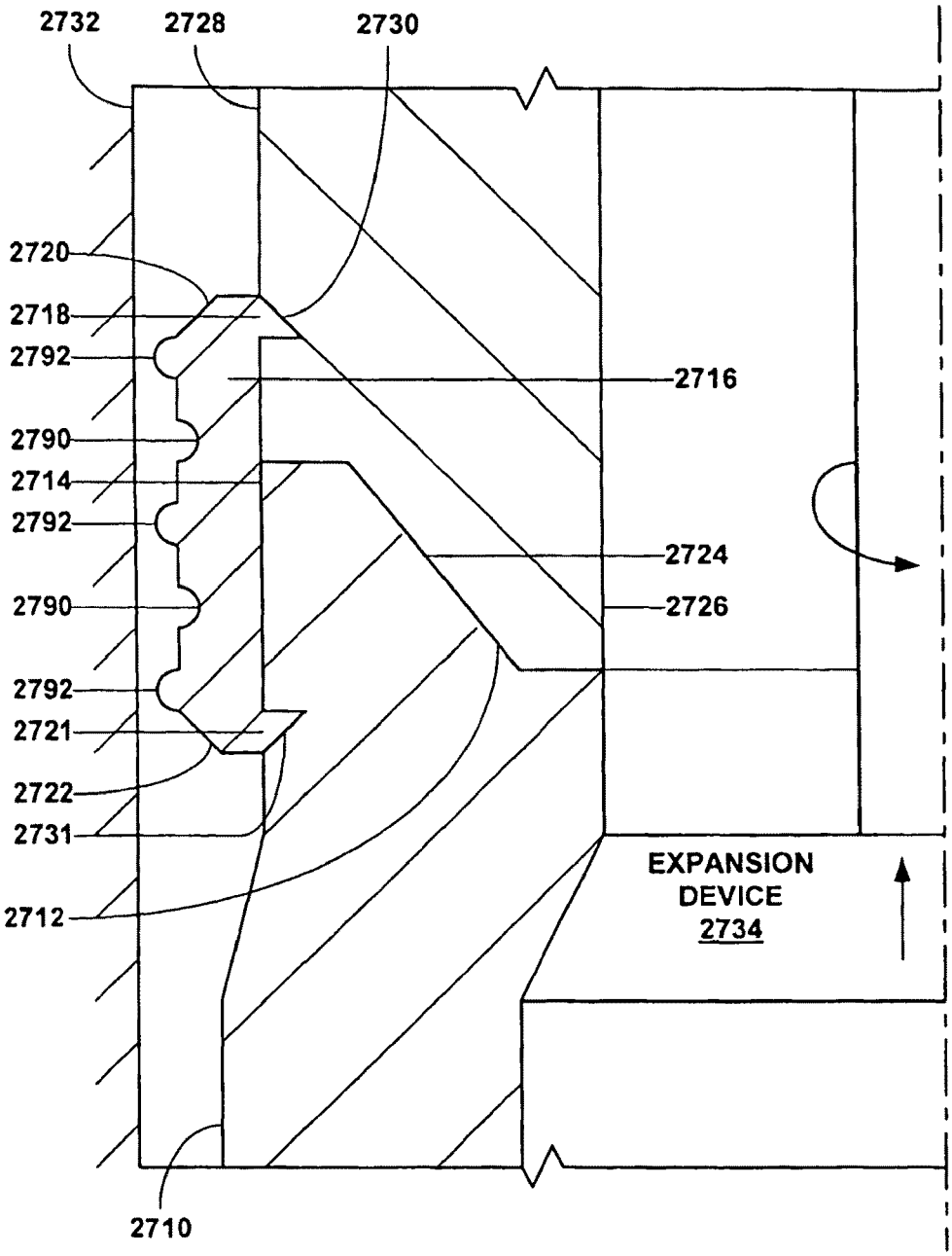
FIG. 27 is a fragmentary cross-sectional illustration of the radial expansion and plastic deformation of a portion of a first tubular member having an internally threaded connection at an end portion, a second tubular member having an externally threaded portion coupled to the internally threaded portion of the first tubular member, and an embodiment of a tubular sleeve supported by the end portion of both tubular members. The sleeve includes a variable thickness along the length thereof.

Referring to FIG. 27, in an exemplary embodiment, a first tubular member 2710 includes an internally threaded connection 2712 at an end portion 2714. A first end of a tubular sleeve 2716 includes an internal flange 2718 and a tapered portion 2720. A second end of the sleeve 2716 includes an internal flange 2721 and a tapered portion 2722. An externally threaded connection 2724 of an end portion 2726 of a second tubular member 2728 having an annular recess 2730, is then positioned within the tubular sleeve 2716 and threadably coupled to the internally threaded connection 2712 of the end portion 2714 of the first tubular member 2710. The internal flange 2718 of the sleeve 2716 mates with and is received within the annular recess 2730.

The first tubular member 2710 includes a recess 2731. The internal flange 2721 mates with and is received within the annular recess 2731. Thus, the sleeve 2716 is coupled to and surrounds the external surfaces of the first and second tubular members 2710 and 2728.

The internally threaded connection 2712 of the end portion 2714 of the first tubular member 2710 is a box connection, and the externally threaded connection 2724 of the end portion 2726 of the second tubular member 2728 is a pin connection. In an exemplary embodiment, the internal diameter of the tubular sleeve 2716 is at least approximately 0.020" greater than the outside diameters of the first and second tubular members 2710 and 2728. In this manner, during the threaded coupling of the first and second tubular members

2710 and 2728, fluidic materials within the first and second tubular members may be vented from the tubular members.

As illustrated in FIG. 27, the first and second tubular members 2710 and 2728, and the tubular sleeve 2716 may then be positioned within another structure 2732 such as, for example, a wellbore, and radially expanded and plastically deformed, for example, by displacing and/or rotating an expansion device 2734 through and/or within the interiors of the first and second tubular members. The tapered portions 2720 and 2722, of the tubular sleeve 2716 facilitates the insertion and movement of the first and second tubular members within and through the structure 2732, and the displacement of the expansion device 2734 through the interiors of the first and second tubular members 2710 and 2728, may be from top to bottom or from bottom to top.

During the radial expansion and plastic deformation of the first and second tubular members 2710 and 2728, the tubular sleeve 2716 is also radially expanded and plastically deformed. In an exemplary embodiment, as a result, the tubular sleeve 2716 may be maintained in circumferential tension and the end portions 2714 and 2726, of the first and second tubular members 2710 and 2728, may be maintained in circumferential compression.

Sleeve 2716 has a variable thickness due to one or more reduced thickness portions 2790 and/or increased thickness portions 2792.

Varying the thickness of sleeve 2716 provides the ability to control or induce stresses at selected positions along the length of sleeve 2716 and the end portions 2724 and 2726. Sleeve 2716 may be secured to tubular members 2710 and 2728 by a heat shrink fit.

In several exemplary embodiments, one or more portions of the first and second tubular members, 2710 and 2728, and the tubular sleeve 2716 have one or more of the material properties of one or more of the tubular members 12, 14, 24, 26, 102, 104, 106, 108, 202 and/or 204.

Figure 28:
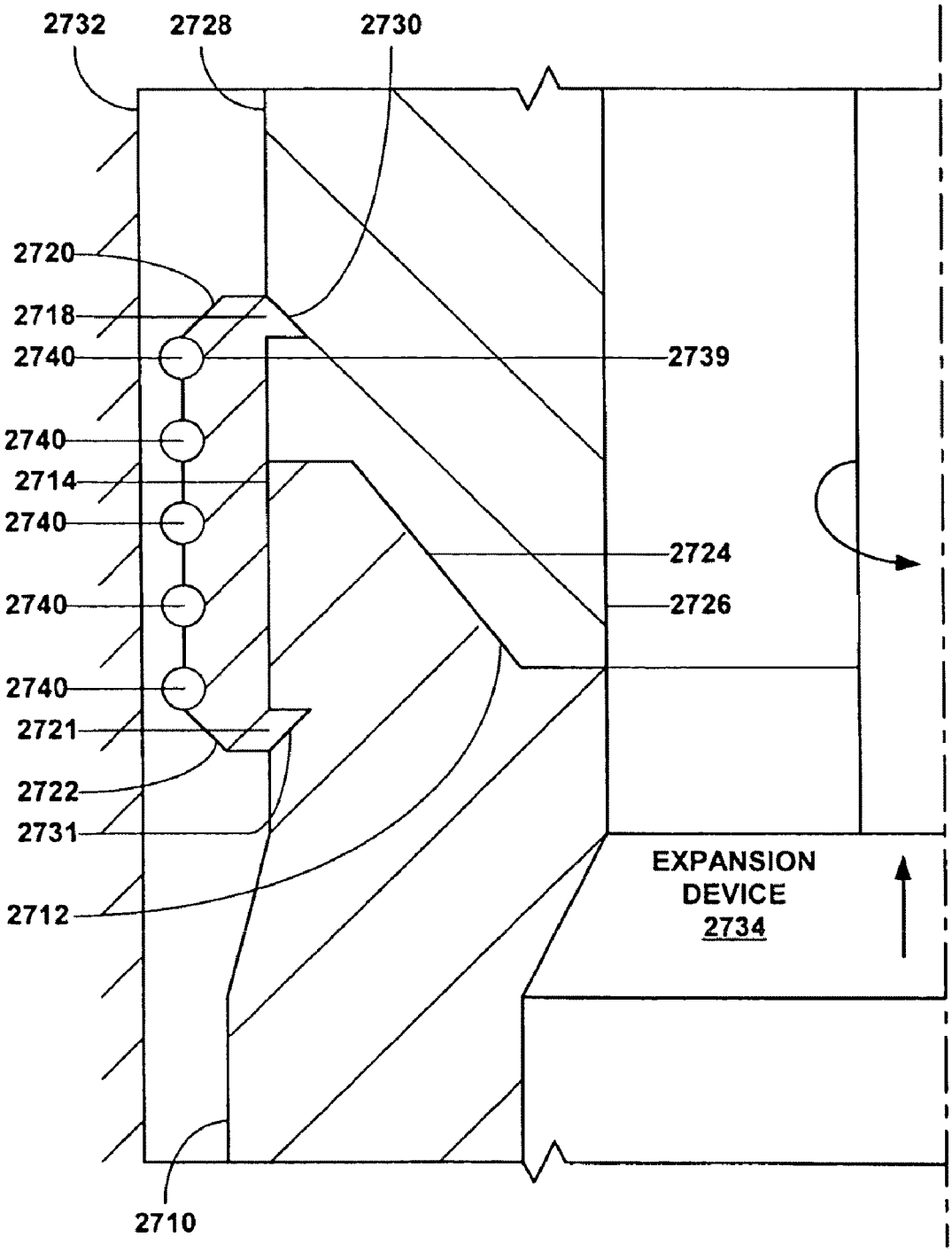
FIG. 28 is a fragmentary cross-sectional illustration of the radial expansion and plastic deformation of a portion of a first tubular member having an internally threaded connection at an end portion, a second tubular member having an externally threaded portion coupled to the internally threaded portion of the first tubular member, and an embodiment of a tubular sleeve supported by the end portion of both tubular members. The sleeve includes a member coiled onto grooves formed in the sleeve for varying the sleeve thickness.

Referring to FIG. 28, in an alternative embodiment, instead of varying the thickness of sleeve 2716, the same result described above with reference to FIG. 27, may be achieved by adding a member 2740 which may be coiled onto the grooves 2739 formed in sleeve 2716, thus varying the thickness along the length of sleeve 2716.

Figure 29:
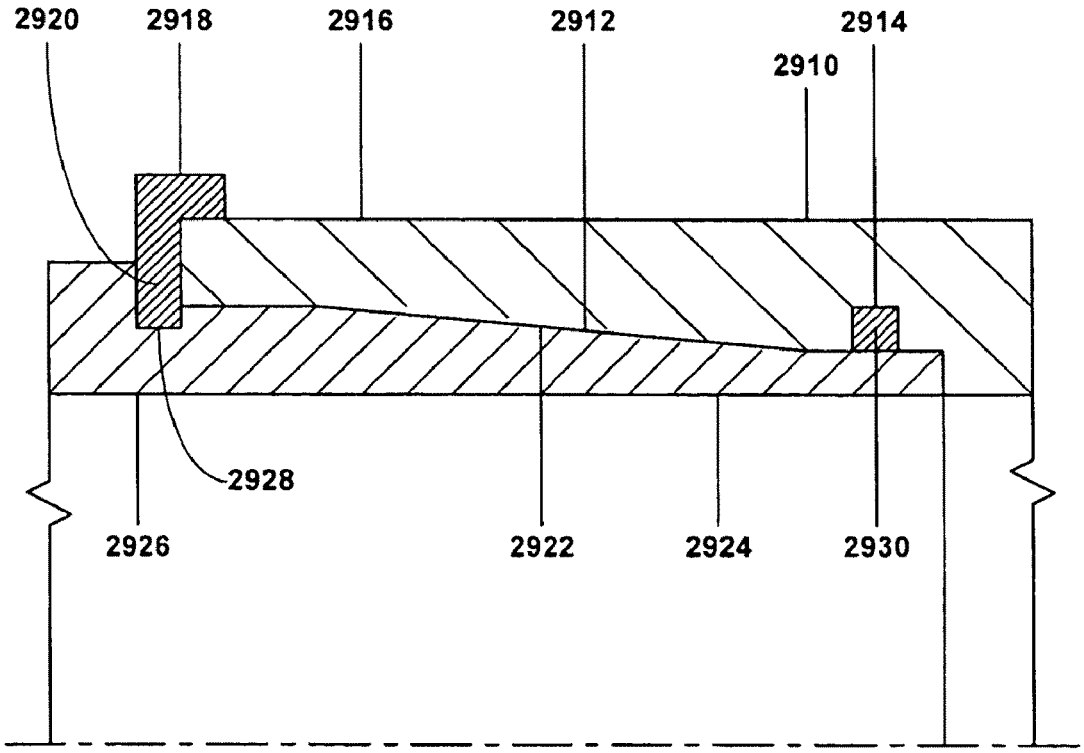
FIG. 29 is a fragmentary cross-sectional illustration of an exemplary embodiment of an expandable connection.

Referring to FIG. 29, in an exemplary embodiment, a first tubular member 2910 includes an internally threaded connection 2912 and an internal annular recess 2914 at an end portion 2916. A first end of a tubular sleeve 2918 includes an internal flange 2920, and a second end of the sleeve 2916 mates with and receives the end portion 2916 of the first tubular member 2910. An externally threaded connection 2922 of an end portion 2924 of a second tubular member 2926 having an annular recess 2928, is then positioned within the tubular sleeve 2918 and threadably coupled to the internally threaded connection 2912 of the end portion 2916 of the first tubular member 2910. The internal flange 2920 of the sleeve 2918 mates with and is received within the annular recess 2928. A sealing element 2930 is received within the internal annular recess 2914 of the end portion 2916 of the first tubular member 2910.

The internally threaded connection 2912 of the end portion 2916 of the first tubular member 2910 is a box connection, and the externally threaded connection 2922 of the end portion 2924 of the second tubular member 2926 is a pin connection. In an exemplary embodiment, the internal diameter of the tubular sleeve 2918 is at least approximately 0.020" greater than the outside diameters of the first tubular member 2910. In this manner, during the threaded coupling of the first and second tubular members 2910 and 2926, fluidic materials within the first and second tubular members may be vented from the tubular members.

The first and second tubular members 2910 and 2926, and the tubular sleeve 2918 may be positioned within another structure such as, for example, a wellbore, and radially expanded and plastically deformed, for example, by displacing and/or rotating an expansion device through and/or within the interiors of the first and second tubular members.

During the radial expansion and plastic deformation of the first and second tubular members 2910 and 2926, the tubular sleeve 2918 is also radially expanded and plastically deformed. In an exemplary embodiment, as a result, the tubular sleeve 2918 may be maintained in circumferential tension and the end portions 2916 and 2924, of the first and second tubular members 2910 and 2926, respectively, may be maintained in circumferential compression.

In an exemplary embodiment, before, during, and after the radial expansion and plastic deformation of the first and second tubular members 2910 and 2926, and the tubular sleeve 2918, the sealing element 2930 seals the interface between the first and second tubular members. In an exemplary embodiment, during and after the radial expansion and plastic deformation of the first and second tubular members 2910 and 2926, and the tubular sleeve 2918, a metal to metal seal is formed between at least one of: the first and second tubular members 2910 and 2926, the first tubular member and the tubular sleeve 2918, and/or the second tubular member and the tubular sleeve. In an exemplary embodiment, the metal to metal seal is both fluid tight and gas tight.

In several exemplary embodiments, one or more portions of the first and second tubular members, 2910 and 2926, the tubular sleeve 2918, and the sealing element 2930 have one or more of the material properties of one or more of the tubular members 12, 14, 24, 26, 102, 104, 106, 108, 202 and/or 204.

Figure 30A:
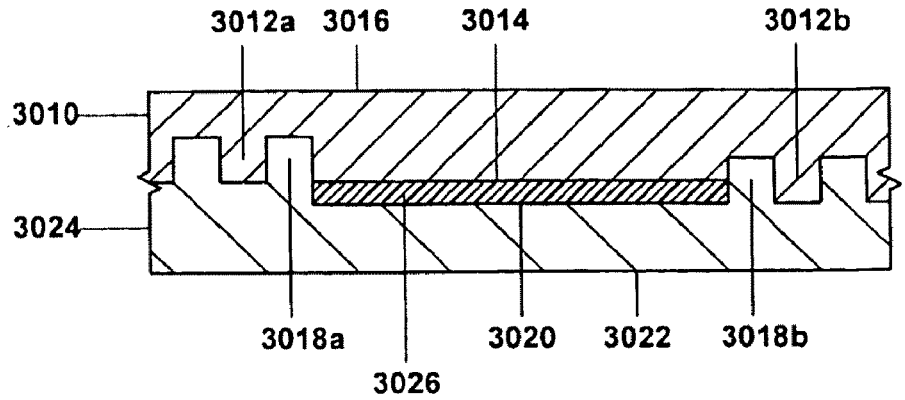
FIGS. 30*a*-30*c* are fragmentary cross-sectional illustrations of exemplary embodiments of expandable connections.

Referring to FIG. 30*a*, in an exemplary embodiment, a first tubular member 3010 includes internally threaded connections 3012*a* and 3012*b*, spaced apart by a cylindrical internal surface 3014, at an end portion 3016. Externally threaded connections 3018*a* and 3018*b*, spaced apart by a cylindrical external surface 3020, of an end portion 3022 of a second tubular member 3024 are threadably coupled to the internally threaded connections, 3012*a* and 3012*b*, respectively, of the end portion 3016 of the first tubular member 3010. A sealing element 3026 is received within an annulus defined between the internal cylindrical surface 3014 of the first tubular member 3010 and the external cylindrical surface 3020 of the second tubular member 3024.

The internally threaded connections, 3012*a* and 3012*b*, of the end portion 3016 of the first tubular member 3010 are box connections, and the externally threaded connections, 3018*a* and 3018*b*, of the end portion 3022 of the second tubular member 3024 are pin connections. In an exemplary embodiment, the sealing element 3026 is an elastomeric and/or metallic sealing element.

The first and second tubular members 3010 and 3024 may be positioned within another structure such as, for example, a wellbore, and radially expanded and plastically deformed, for example, by displacing and/or rotating an expansion device through and/or within the interiors of the first and second tubular members.

In an exemplary embodiment, before, during, and after the radial expansion and plastic deformation of the first and second tubular members 3010 and 3024, the sealing element 3026 seals the interface between the first and second tubular members. In an exemplary embodiment, before, during and/or after the radial expansion and plastic deformation of the first and second tubular members 3010 and 3024, a metal to metal seal is formed between at least one of: the first and second tubular members 3010 and 3024, the first tubular member and the sealing element 3026, and/or the second tubular member and the sealing element. In an exemplary embodiment, the metal to metal seal is both fluid tight and gas tight.

In an alternative embodiment, the sealing element 3026 is omitted, and during and/or after the radial expansion and plastic deformation of the first and second tubular members 3010 and 3024, a metal to metal seal is formed between the first and second tubular members.

In several exemplary embodiments, one or more portions of the first and second tubular members, 3010 and 3024, the sealing element 3026 have one or more of the material properties of one or more of the tubular members 12, 14, 24, 26, 102, 104, 106, 108, 202 and/or 204.

Figure 30B:
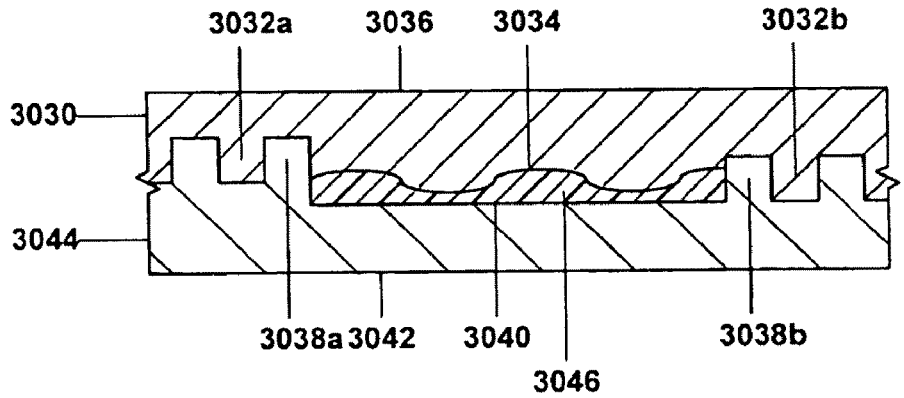

Referring to FIG. 30*b*, in an exemplary embodiment, a first tubular member 3030 includes internally threaded connections 3032*a* and 3032*b*, spaced apart by an undulating approximately cylindrical internal surface 3034, at an end portion 3036. Externally threaded connections 3038*a* and 3038*b*, spaced apart by a cylindrical external surface 3040, of an end portion 3042 of a second tubular member 3044 are threadably coupled to the internally threaded connections, 3032*a* and 3032*b*, respectively, of the end portion 3036 of the first tubular member 3030. A sealing element 3046 is received within an annulus defined between the undulating approximately cylindrical internal surface 3034 of the first tubular member 3030 and the external cylindrical surface 3040 of the second tubular member 3044.

The internally threaded connections, 3032*a* and 3032*b*, of the end portion 3036 of the first tubular member 3030 are box connections, and the externally threaded connections, 3038*a* and 3038*b*, of the end portion 3042 of the second tubular member 3044 are pin connections. In an exemplary embodiment, the sealing element 3046 is an elastomeric and/or metallic sealing element.

The first and second tubular members 3030 and 3044 may be positioned within another structure such as, for example, a wellbore, and radially expanded and plastically deformed, for example, by displacing and/or rotating an expansion device through and/or within the interiors of the first and second tubular members.

In an exemplary embodiment, before, during, and after the radial expansion and plastic deformation of the first and second tubular members 3030 and 3044, the sealing element 3046 seals the interface between the first and second tubular members. In an exemplary embodiment, before, during and/or after the radial expansion and plastic deformation of the first and second tubular members 3030 and 3044, a metal to metal seal is formed between at least one of: the first and second tubular members 3030 and 3044, the first tubular member and the sealing element 3046, and/or the second tubular member and the sealing element. In an exemplary embodiment, the metal to metal seal is both fluid tight and gas tight.

In an alternative embodiment, the sealing element 3046 is omitted, and during and/or after the radial expansion and plastic deformation of the first and second tubular members 3030 and 3044, a metal to metal seal is formed between the first and second tubular members.

In several exemplary embodiments, one or more portions of the first and second tubular members, 3030 and 3044, the sealing element 3046 have one or more of the material properties of one or more of the tubular members 12, 14, 24, 26, 102, 104, 106, 108, 202 and/or 204.

Figure 30C:
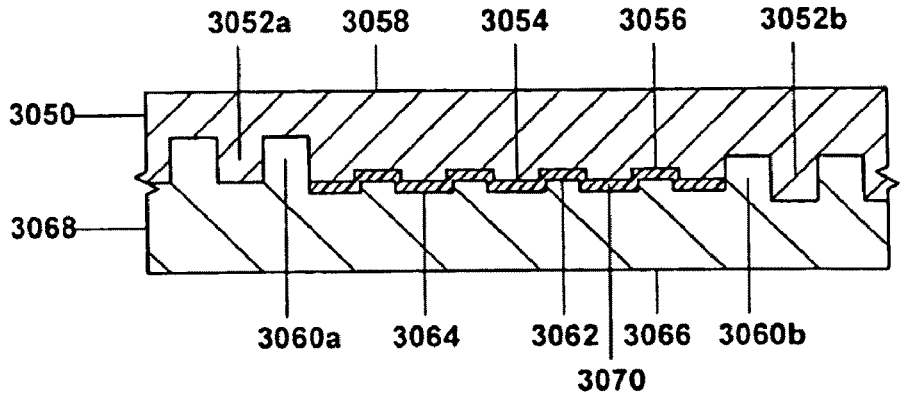

Referring to FIG. 30*c*, in an exemplary embodiment, a first tubular member 3050 includes internally threaded connections 3052*a* and 3052*b*, spaced apart by a cylindrical internal surface 3054 including one or more square grooves 3056, at an end portion 3058. Externally threaded connections 3060*a* and 3060*b*, spaced apart by a cylindrical external surface 3062 including one or more square grooves 3064, of an end portion 3066 of a second tubular member 3068 are threadably coupled to the internally threaded connections, 3052*a* and 3052*b*, respectively, of the end portion 3058 of the first tubular member 3050. A sealing element 3070 is received within an annulus defined between the cylindrical internal surface 3054 of the first tubular member 3050 and the external cylindrical surface 3062 of the second tubular member 3068.

The internally threaded connections, 3052*a* and 3052*b*, of the end portion 3058 of the first tubular member 3050 are box connections, and the externally threaded connections, 3060*a* and 3060*b*, of the end portion 3066 of the second tubular member 3068 are pin connections. In an exemplary embodiment, the sealing element 3070 is an elastomeric and/or metallic sealing element.

The first and second tubular members 3050 and 3068 may be positioned within another structure such as, for example, a wellbore, and radially expanded and plastically deformed, for example, by displacing and/or rotating an expansion device through and/or within the interiors of the first and second tubular members.

In an exemplary embodiment, before, during, and after the radial expansion and plastic deformation of the first and second tubular members 3050 and 3068, the sealing element 3070 seals the interface between the first and second tubular members. In an exemplary embodiment, before, during and/or after the radial expansion and plastic deformation of the first and second tubular members, 3050 and 3068, a metal to metal seal is formed between at least one of: the first and second tubular members, the first tubular member and the sealing element 3070, and/or the second tubular member and the sealing element. In an exemplary embodiment, the metal to metal seal is both fluid tight and gas tight.

In an alternative embodiment, the sealing element 3070 is omitted, and during and/or after the radial expansion and plastic deformation of the first and second tubular members 950 and 968, a metal to metal seal is formed between the first and second tubular members.

In several exemplary embodiments, one or more portions of the first and second tubular members, 3050 and 3068, the sealing element 3070 have one or more of the material properties of one or more of the tubular members 12, 14, 24, 26, 102, 104, 106, 108, 202 and/or 204.

Figure 31:
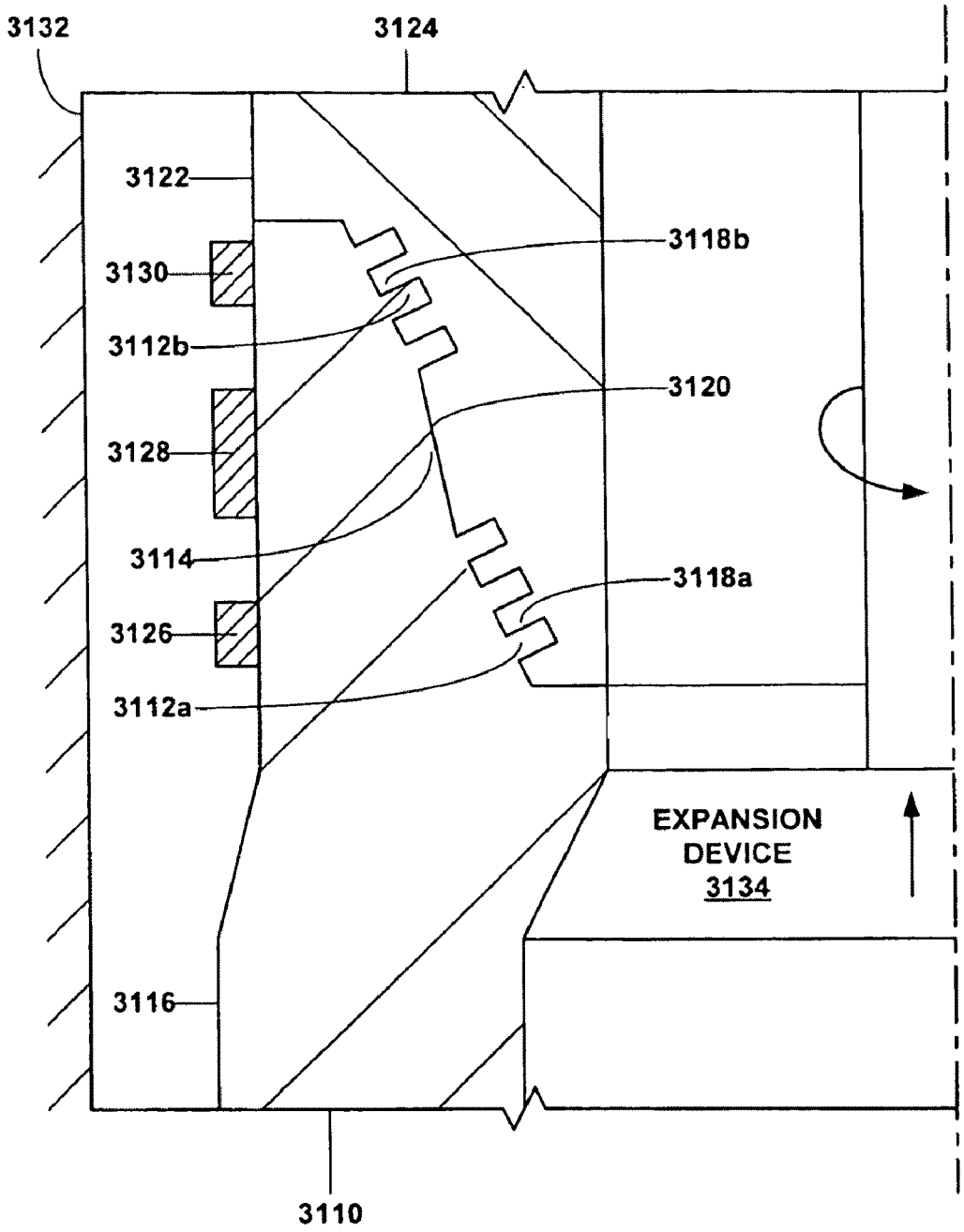
FIG. 31 is a fragmentary cross-sectional illustration of an exemplary embodiment of an expandable connection.

Referring to FIG. 31, in an exemplary embodiment, a first tubular member 3110 includes internally threaded connections, 3112*a* and 3112*b*, spaced apart by a non-threaded internal surface 3114, at an end portion 3116. Externally threaded connections, 3118*a* and 3118*b*, spaced apart by a non-threaded external surface 3120, of an end portion 3122 of a second tubular member 3124 are threadably coupled to the internally threaded connections, 3112*a* and 3112*b*, respectively, of the end portion 3122 of the first tubular member 3124.

First, second, and/or third tubular sleeves, 3126, 3128, and 3130, are coupled the external surface of the first tubular member 3110 in opposing relation to the threaded connection formed by the internal and external threads, 3112*a* and 3118*a*, the interface between the non-threaded surfaces, 3114 and 3120, and the threaded connection formed by the internal and external threads, 3112*b* and 3118*b*, respectively.

The internally threaded connections, 3112*a* and 3112*b*, of the end portion 3116 of the first tubular member 3110 are box connections, and the externally threaded connections, 3118*a* and 3118*b*, of the end portion 3122 of the second tubular member 3124 are pin connections.

The first and second tubular members 3110 and 3124, and the tubular sleeves 3126, 3128, and/or 3130, may then be positioned within another structure 3132 such as, for example, a wellbore, and radially expanded and plastically deformed, for example, by displacing and/or rotating an expansion device 3134 through and/or within the interiors of the first and second tubular members.

During the radial expansion and plastic deformation of the first and second tubular members 3110 and 3124, the tubular sleeves 3126, 3128 and/or 3130 are also radially expanded and plastically deformed. In an exemplary embodiment, as a result, the tubular sleeves 3126, 3128, and/or 3130 are maintained in circumferential tension and the end portions 3116 and 3122, of the first and second tubular members 3110 and 3124, may be maintained in circumferential compression.

The sleeves 3126, 3128, and/or 3130 may, for example, be secured to the first tubular member 3110 by a heat shrink fit.

In several exemplary embodiments, one or more portions of the first and second tubular members, 3110 and 3124, and the sleeves, 3126, 3128, and 3130, have one or more of the material properties of one or more of the tubular members 12, 14, 24, 26, 102, 104, 106, 108, 202 and/or 204.

Figure 32A:
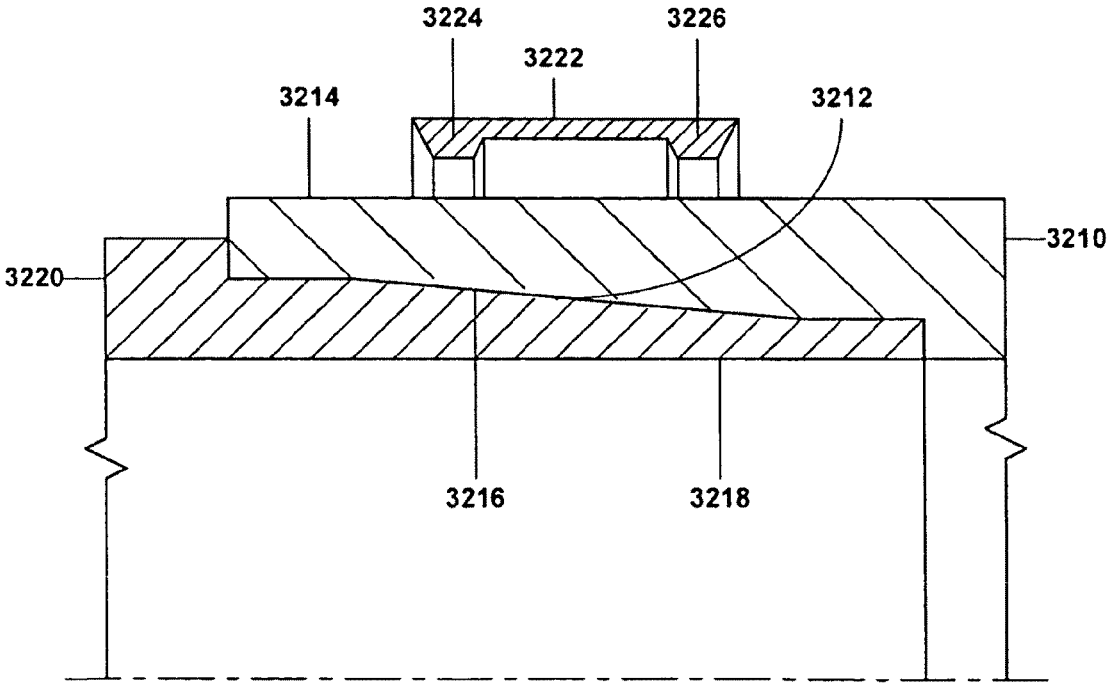
FIGS. 32*a* and 32*b* are fragmentary cross-sectional illustrations of the formation of an exemplary embodiment of an expandable connection.

Referring to FIG. 32*a*, in an exemplary embodiment, a first tubular member 3210 includes an internally threaded connection 3212 at an end portion 3214. An externally threaded connection 3216 of an end portion 3218 of a second tubular member 3220 are threadably coupled to the internally threaded connection 3212 of the end portion 3214 of the first tubular member 3210.

The internally threaded connection 3212 of the end portion 3214 of the first tubular member 3210 is a box connection, and the externally threaded connection 3216 of the end portion 3218 of the second tubular member 3220 is a pin connection.

Figure 32B:
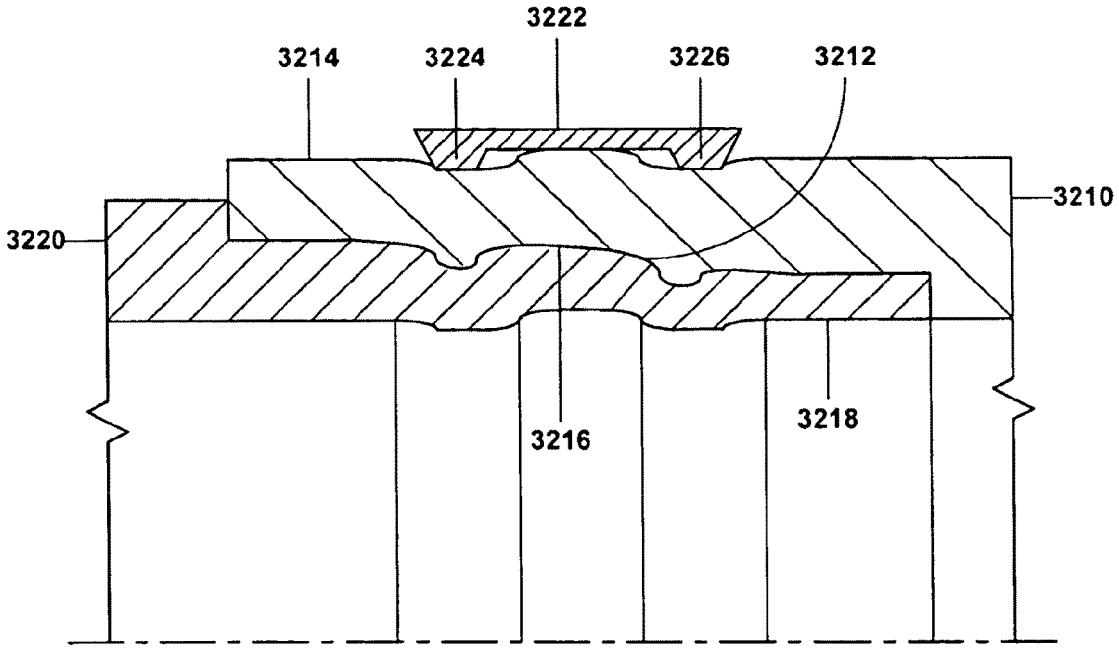

A tubular sleeve 3222 including internal flanges 3224 and 3226 is positioned proximate and surrounding the end portion 3214 of the first tubular member 3210. As illustrated in FIG. 32*b*, the tubular sleeve 3222 is then forced into engagement with the external surface of the end portion 3214 of the first tubular member 3210 in a conventional manner. As a result, the end portions, 3214 and 3218, of the first and second tubular members, 3210 and 3220, are upset in an undulating fashion.

The first and second tubular members 3210 and 3220, and the tubular sleeve 3222, may then be positioned within another structure such as, for example, a wellbore, and radially expanded and plastically deformed, for example, by displacing and/or rotating an expansion device through and/or within the interiors of the first and second tubular members.

During the radial expansion and plastic deformation of the first and second tubular members 3210 and 3220, the tubular sleeve 3222 is also radially expanded and plastically deformed. In an exemplary embodiment, as a result, the tubular sleeve 3222 is maintained in circumferential tension and the end portions 3214 and 3218, of the first and second tubular members 3210 and 3220, may be maintained in circumferential compression.

In several exemplary embodiments, one or more portions of the first and second tubular members, 3210 and 3220, and the sleeve 3222 have one or more of the material properties of one or more of the tubular members 12, 14, 24, 26, 102, 104, 106, 108, 202 and/or 204.

Figure 33:
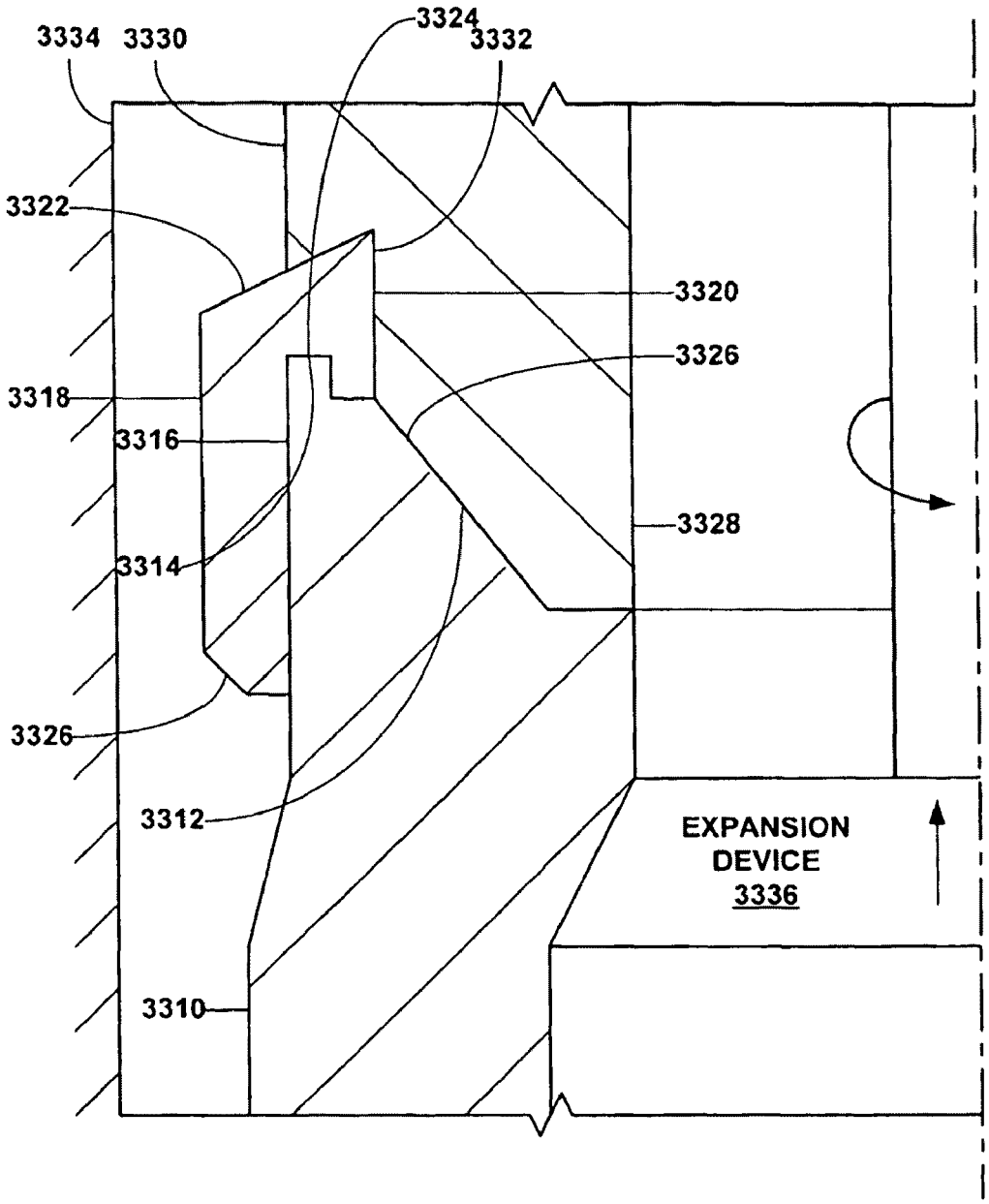
FIG. 33 is a fragmentary cross-sectional illustration of an exemplary embodiment of an expandable connection.

Referring to FIG. 33, in an exemplary embodiment, a first tubular member 3310 includes an internally threaded connection 3312 and an annular projection 3314 at an end portion 3316.

A first end of a tubular sleeve 3318 that includes an internal flange 3320 having a tapered portion 3322 and an annular recess 3324 for receiving the annular projection 3314 of the first tubular member 3310, and a second end that includes a tapered portion 3326, is then mounted upon and receives the end portion 3316 of the first tubular member 3310.

In an exemplary embodiment, the end portion 3316 of the first tubular member 3310 abuts one side of the internal flange 3320 of the tubular sleeve 3318 and the annular projection 3314 of the end portion of the first tubular member mates with and is received within the annular recess 3324 of the internal flange of the tubular sleeve, and the internal diameter of the internal flange 3320 of the tubular sleeve 3318 is substantially equal to or greater than the maximum internal diameter of the internally threaded connection 3312 of the end portion 3316 of the first tubular member 3310. An externally threaded connection 3326 of an end portion 3328 of a second tubular member 3330 having an annular recess 3332 is then positioned within the tubular sleeve 3318 and threadably coupled to the internally threaded connection 3312 of the end portion 3316 of the first tubular member 3310. In an exemplary embodiment, the internal flange 3332 of the tubular sleeve 3318 mates with and is received within the annular recess 3332 of the end portion 3328 of the second tubular member 3330. Thus, the tubular sleeve 3318 is coupled to and surrounds the external surfaces of the first and second tubular members, 3310 and 3328.

The internally threaded connection 3312 of the end portion 3316 of the first tubular member 3310 is a box connection, and the externally threaded connection 3326 of the end portion 3328 of the second tubular member 3330 is a pin connection. In an exemplary embodiment, the internal diameter of the tubular sleeve 3318 is at least approximately 0.020" greater than the outside diameters of the first and second tubular members, 3310 and 3330. In this manner, during the threaded coupling of the first and second tubular members, 3310 and 3330, fluidic materials within the first and second tubular members may be vented from the tubular members.

As illustrated in FIG. 33, the first and second tubular members, 3310 and 3330, and the tubular sleeve 3318 may be positioned within another structure 3334 such as, for example, a cased or uncased wellbore, and radially expanded and plastically deformed, for example, by displacing and/or rotating a conventional expansion device 3336 within and/or through the interiors of the first and second tubular members. The tapered portions, 3322 and 3326, of the tubular sleeve 3318 facilitate the insertion and movement of the first and second tubular members within and through the structure 3334, and the movement of the expansion device 3336 through the interiors of the first and second tubular members, 3310 and 3330, may, for example, be from top to bottom or from bottom to top.

During the radial expansion and plastic deformation of the first and second tubular members, 3310 and 3330, the tubular sleeve 3318 is also radially expanded and plastically deformed. As a result, the tubular sleeve 3318 may be maintained in circumferential tension and the end portions, 3316 and 3328, of the first and second tubular members, 3310 and 3330, may be maintained in circumferential compression.

Sleeve 3316 increases the axial compression loading of the connection between tubular members 3310 and 3330 before and after expansion by the expansion device 3336. Sleeve 3316 may be secured to tubular members 3310 and 3330, for example, by a heat shrink fit.

In several alternative embodiments, the first and second tubular members, 3310 and 3330, are radially expanded and plastically deformed using other conventional methods for radially expanding and plastically deforming tubular members such as, for example, internal pressurization, hydroforming, and/or roller expansion devices and/or any one or combination of the conventional commercially available expansion products and services available from Baker Hughes, Weatherford International, and/or Enventure Global Technology L.L.C.

The use of the tubular sleeve 3318 during (a) the coupling of the first tubular member 3310 to the second tubular member 3330, (b) the placement of the first and second tubular members in the structure 3334, and (c) the radial expansion and plastic deformation of the first and second tubular members provides a number of significant benefits. For example, the tubular sleeve 3318 protects the exterior surfaces of the end portions, 3316 and 3328, of the first and second tubular members, 3310 and 3330, during handling and insertion of the tubular members within the structure 3334. In this manner, damage to the exterior surfaces of the end portions, 3316 and 3328, of the first and second tubular members, 3310 and 3330, is avoided that could otherwise result in stress concentrations that could cause a catastrophic failure during subsequent radial expansion operations. Furthermore, the tubular sleeve 3318 provides an alignment guide that facilitates the insertion and threaded coupling of the second tubular member 3330 to the first tubular member 3310. In this manner, misalignment that could result in damage to the threaded connections, 3312 and 3326, of the first and second tubular members, 3310 and 3330, may be avoided. In addition, during the relative rotation of the second tubular member with respect to the first tubular member, required during the threaded coupling of the first and second tubular members, the tubular sleeve 3318 provides an indication of to what degree the first and second tubular members are threadably coupled. For example, if the tubular sleeve 3318 can be easily rotated, that would indicate that the first and second tubular members, 3310 and 3330, are not fully threadably coupled and in intimate contact with the internal flange 3320 of the tubular sleeve. Furthermore, the tubular sleeve 3318 may prevent crack propagation during the radial expansion and plastic deformation of the first and second tubular members, 3310 and 3330. In this manner, failure modes such as, for example, longitudinal cracks in the end portions, 3316 and 3328, of the first and second tubular members may be limited in severity or eliminated all together. In addition, after completing the radial expansion and plastic deformation of the first and second tubular members, 3310 and 3330, the tubular sleeve 3318 may provide a fluid tight metal-to-metal seal between interior surface of the tubular sleeve 3318 and the exterior surfaces of the end portions, 3316 and 3328, of the first and second tubular members. In this manner, fluidic materials are prevented from passing through the threaded connections, 3312 and 3326, of the first and second tubular members, 3310 and 3330, into the annulus between the first and second tubular members and the structure 3334. Furthermore, because, following the radial expansion and plastic deformation of the first and second tubular members, 3310 and 3330, the tubular sleeve 3318 may be maintained in circumferential tension and the end portions, 3316 and 3328, of the first and second tubular members, 3310 and 3330, may be maintained in circumferential compression, axial loads and/or torque loads may be transmitted through the tubular sleeve.

In several exemplary embodiments, one or more portions of the first and second tubular members, 3310 and 3330, and the sleeve 3318 have one or more of the material properties of one or more of the tubular members 12, 14, 24, 26, 102, 104, 106, 108, 202 and/or 204.

Figure 34A:
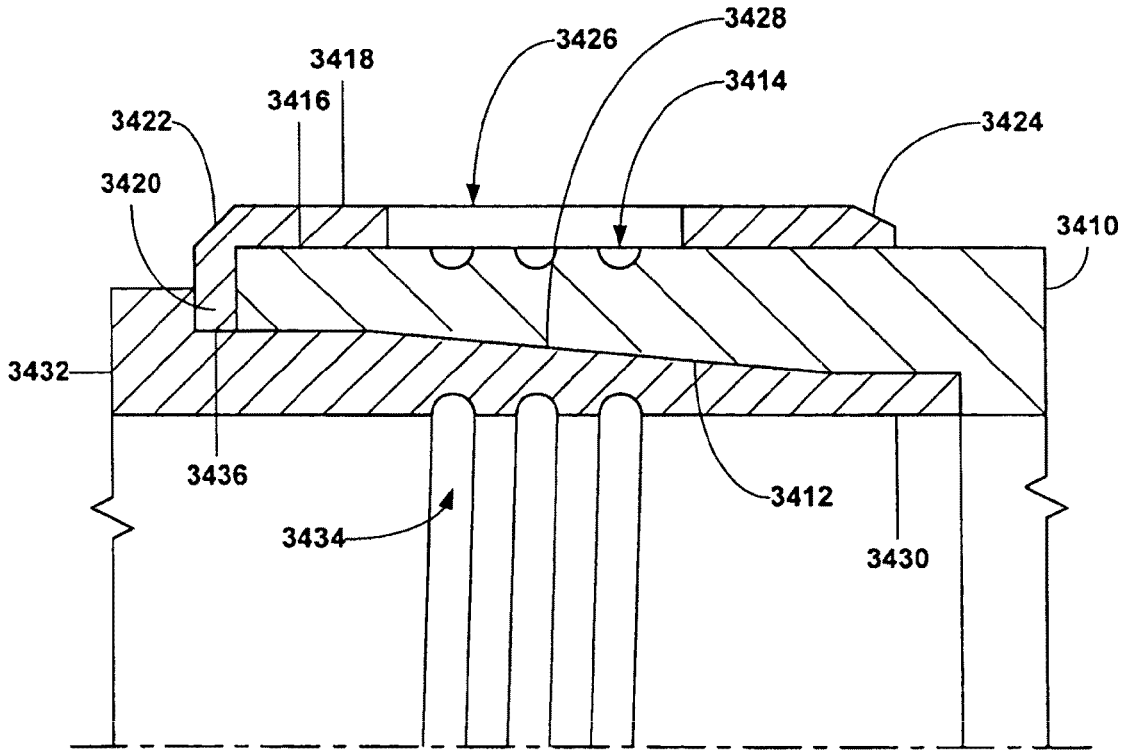
FIGS. 34*a*, 34*b* and 34*c* are fragmentary cross-sectional illustrations of an exemplary embodiment of an expandable connection.
Figure 34B:
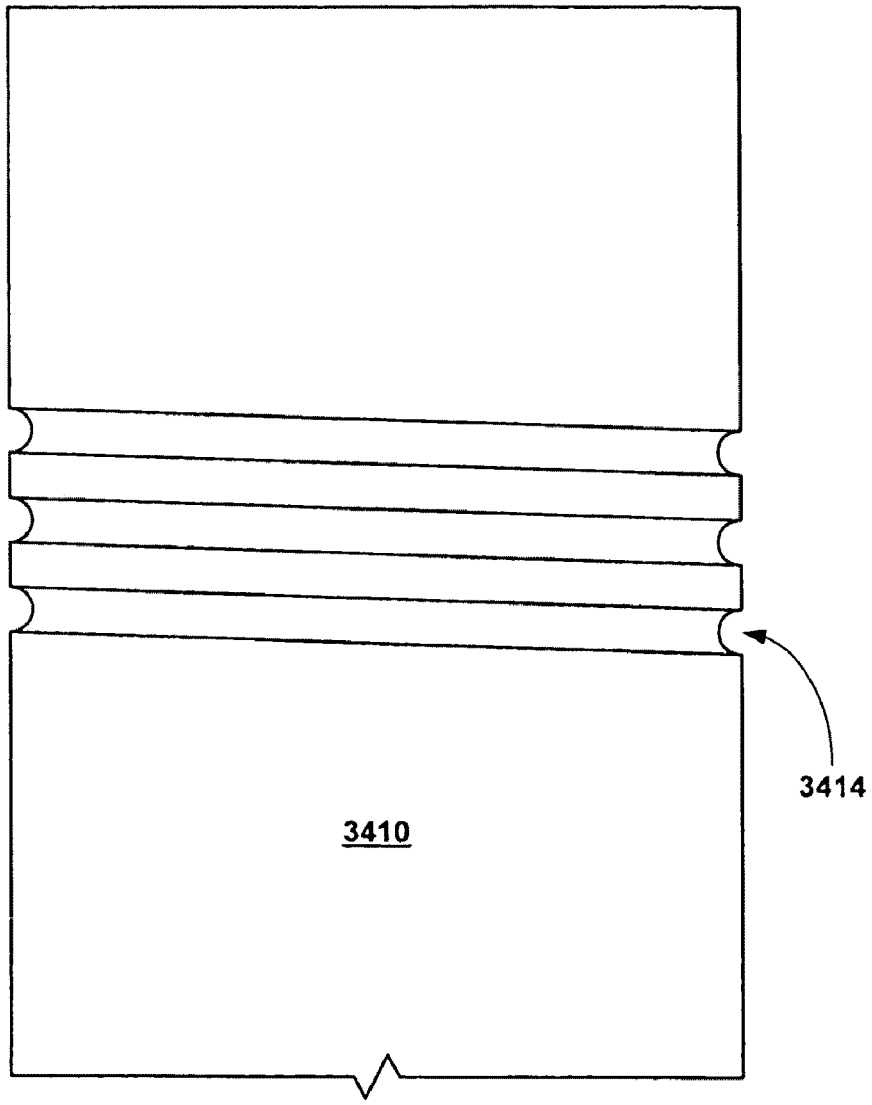
Figure 34C:
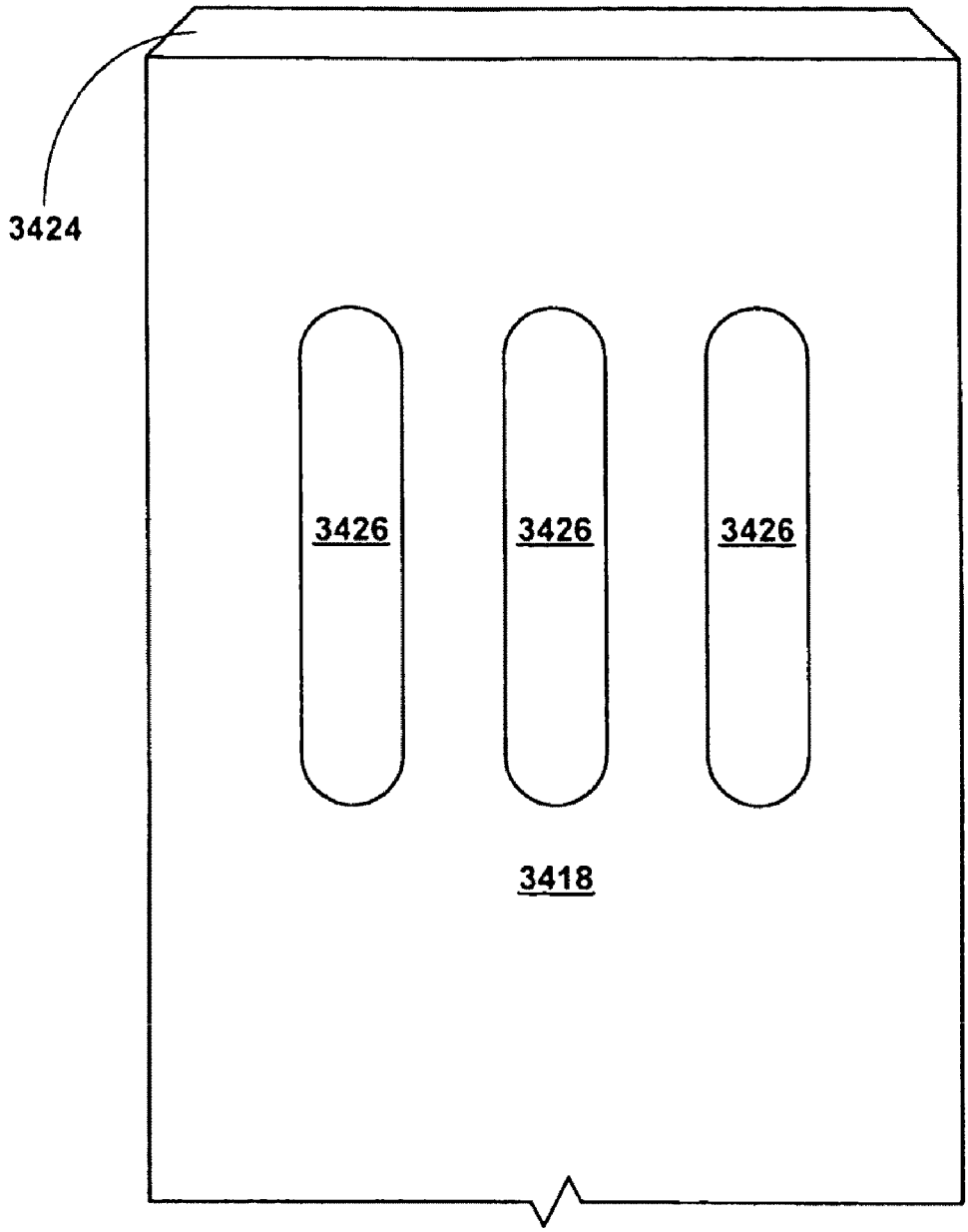

Referring to FIGS. 34*a*, 34*b*, and 34*c*, in an exemplary embodiment, a first tubular member 3410 includes an internally threaded connection 1312 and one or more external grooves 3414 at an end portion 3416.

A first end of a tubular sleeve 3418 that includes an internal flange 3420 and a tapered portion 3422, a second end that includes a tapered portion 3424, and an intermediate portion that includes one or more longitudinally aligned openings 3426, is then mounted upon and receives the end portion 3416 of the first tubular member 3410.

In an exemplary embodiment, the end portion 3416 of the first tubular member 3410 abuts one side of the internal flange 3420 of the tubular sleeve 3418, and the internal diameter of the internal flange 3420 of the tubular sleeve 3416 is substantially equal to or greater than the maximum internal diameter of the internally threaded connection 3412 of the end portion 3416 of the first tubular member 3410. An externally threaded connection 3428 of an end portion 3430 of a second tubular member 3432 that includes one or more internal grooves 3434 is then positioned within the tubular sleeve 3418 and threadably coupled to the internally threaded connection 3412 of the end portion 3416 of the first tubular member 3410. In an exemplary embodiment, the internal flange 3420 of the tubular sleeve 3418 mates with and is received within an annular recess 3436 defined in the end portion 3430 of the second tubular member 3432. Thus, the tubular sleeve 3418 is coupled to and surrounds the external surfaces of the first and second tubular members, 3410 and 3432.

The first and second tubular members, 3410 and 3432, and the tubular sleeve 3418 may be positioned within another structure such as, for example, a cased or uncased wellbore, and radially expanded and plastically deformed, for example, by displacing and/or rotating a conventional expansion device within and/or through the interiors of the first and second tubular members. The tapered portions, 3422 and 3424, of the tubular sleeve 3418 facilitate the insertion and movement of the first and second tubular members within and through the structure, and the movement of the expansion device through the interiors of the first and second tubular members, 3410 and 3432, may be from top to bottom or from bottom to top.

During the radial expansion and plastic deformation of the first and second tubular members, 3410 and 3432, the tubular sleeve 3418 is also radially expanded and plastically deformed. As a result, the tubular sleeve 3418 may be maintained in circumferential tension and the end portions, 3416 and 3430, of the first and second tubular members, 3410 and 3432, may be maintained in circumferential compression.

Sleeve 3416 increases the axial compression loading of the connection between tubular members 3410 and 3432 before and after expansion by the expansion device. The sleeve 3418 may be secured to tubular members 3410 and 3432, for example, by a heat shrink fit.

During the radial expansion and plastic deformation of the first and second tubular members, 3410 and 3432, the grooves 3414 and/or 3434 and/or the openings 3426 provide stress concentrations that in turn apply added stress forces to the mating threads of the threaded connections, 3412 and 3428. As a result, during and after the radial expansion and plastic deformation of the first and second tubular members, 3410 and 3432, the mating threads of the threaded connections, 3412 and 3428, are maintained in metal to metal contact thereby providing a fluid and gas tight connection. In an exemplary embodiment, the orientations of the grooves 3414 and/or 3434 and the openings 3426 are orthogonal to one another. In an exemplary embodiment, the grooves 3414 and/or 3434 are helical grooves.

In several alternative embodiments, the first and second tubular members, 3410 and 3432, are radially expanded and plastically deformed using other conventional methods for radially expanding and plastically deforming tubular members such as, for example, internal pressurization, hydroforming, and/or roller expansion devices and/or any one or combination of the conventional commercially available expansion products and services available from Baker Hughes, Weatherford International, and/or Enventure Global Technology L.L.C.

The use of the tubular sleeve 3418 during (a) the coupling of the first tubular member 3410 to the second tubular member 3432, (b) the placement of the first and second tubular members in the structure, and (c) the radial expansion and plastic deformation of the first and second tubular members provides a number of significant benefits. For example, the tubular sleeve 3418 protects the exterior surfaces of the end portions, 3416 and 3430, of the first and second tubular members, 3410 and 3432, during handling and insertion of the tubular members within the structure. In this manner, damage to the exterior surfaces of the end portions, 3416 and 3430, of the first and second tubular members, 3410 and 3432, is avoided that could otherwise result in stress concentrations that could cause a catastrophic failure during subsequent radial expansion operations. Furthermore, the tubular sleeve 3418 provides an alignment guide that facilitates the insertion and threaded coupling of the second tubular member 3432 to the first tubular member 3410. In this manner, misalignment that could result in damage to the threaded connections, 3412 and 3428, of the first and second tubular members, 3410 and 3432, may be avoided. In addition, during the relative rotation of the second tubular member with respect to the first tubular member, required during the threaded coupling of the first and second tubular members, the tubular sleeve 3416 provides an indication of to what degree the first and second tubular members are threadably coupled. For example, if the tubular sleeve 3418 can be easily rotated, that would indicate that the first and second tubular members, 3410 and 3432, are not fully threadably coupled and in intimate contact with the internal flange 3420 of the tubular sleeve. Furthermore, the tubular sleeve 3418 may prevent crack propagation during the radial expansion and plastic deformation of the first and second tubular members, 3410 and 3432. In this manner, failure modes such as, for example, longitudinal cracks in the end portions, 3416 and 3430, of the first and second tubular members may be limited in severity or eliminated all together. In addition, after completing the radial expansion and plastic deformation of the first and second tubular members, 3410 and 3432, the tubular sleeve 3418 may provide a fluid and gas tight metal-to-metal seal between interior surface of the tubular sleeve 3418 and the exterior surfaces of the end portions, 3416 and 3430, of the first and second tubular members. In this manner, fluidic materials are prevented from passing through the threaded connections, 3412 and 3430, of the first and second tubular members, 3410 and 3432, into the annulus between the first and second tubular members and the structure. Furthermore, because, following the radial expansion and plastic deformation of the first and second tubular members, 3410 and 3432, the tubular sleeve 3418 may be maintained in circumferential tension and the end portions, 3416 and 3430, of the first and second tubular members, 3410 and 3432, may be maintained in circumferential compression, axial loads and/or torque loads may be transmitted through the tubular sleeve.

In several exemplary embodiments, the first and second tubular members described above with reference to FIGS. 1 to 34*c* are radially expanded and plastically deformed using the expansion device in a conventional manner and/or using one or more of the methods and apparatus disclosed in one or more of the following: The present application is related to the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, (20) U.S. provisional patent application Ser. No. 60/233,638, filed on Sep. 18, 2000, (21) U.S. provisional patent application Ser. No. 60/237,334, filed on Oct. 2, 2000, (22) U.S. provisional patent application Ser. No. 60/270,007, filed on Feb. 20, 2001, (23) U.S. provisional patent application Ser. No. 60/262,434, filed on Jan. 17, 2001, (24) U.S. provisional patent application Ser. No. 60/259,486, filed on Jan. 3, 2001, (25) U.S. provisional patent application Ser. No. 60/303,740, filed on Jul. 6, 2001, (26) U.S. provisional patent application Ser. No. 60/313,453, filed on Aug. 20, 2001, (27) U.S. provisional patent application Ser. No. 60/317,985, filed on Sep. 6, 2001, (28) U.S. provisional patent application Ser. No. 60/3318,386, filed on Sep. 10, 2001, (29) U.S. utility patent application Ser. No. 09/969,922, filed on Oct. 3, 2001, (30) U.S. utility patent application Ser. No. 10/016,467, filed on Dec. 10, 2001, (31) U.S. provisional patent application Ser. No. 60/343,674, filed on Dec. 27, 2001; and (32) U.S. provisional patent application Ser. No. 60/346,309, filed on Jan. 7, 2002, the disclosures of which are incorporated herein by reference.

Figure 35A:
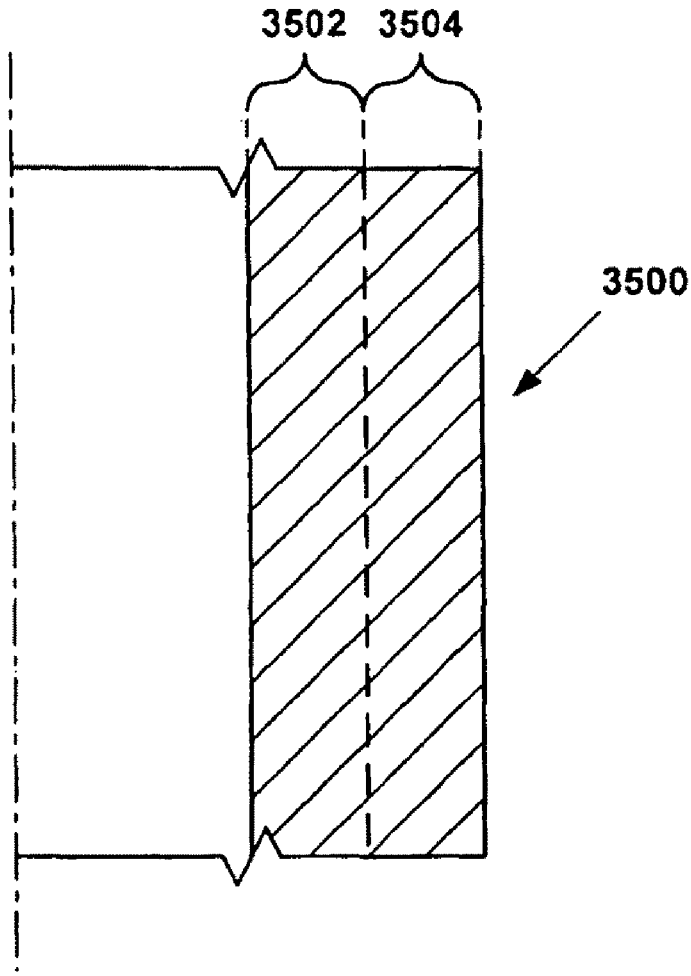
FIG. 35*a* is a fragmentary cross-sectional illustration of an exemplary embodiment of an expandable tubular member.

Referring to FIG. 35*a* an exemplary embodiment of an expandable tubular member 3500 includes a first tubular region 3502 and a second tubular portion 3504. In an exemplary embodiment, the material properties of the first and second tubular regions, 3502 and 3504, are different. In an exemplary embodiment, the yield points of the first and second tubular regions, 3502 and 3504, are different. In an exemplary embodiment, the yield point of the first tubular region 3502 is less than the yield point of the second, tubular region 3504. In several exemplary embodiments, one or more of the expandable tubular members, 12, 14, 24, 26, 102, 104, 106, 108, 202 and/or 204 incorporate the tubular member 3500.

Figure 35B:
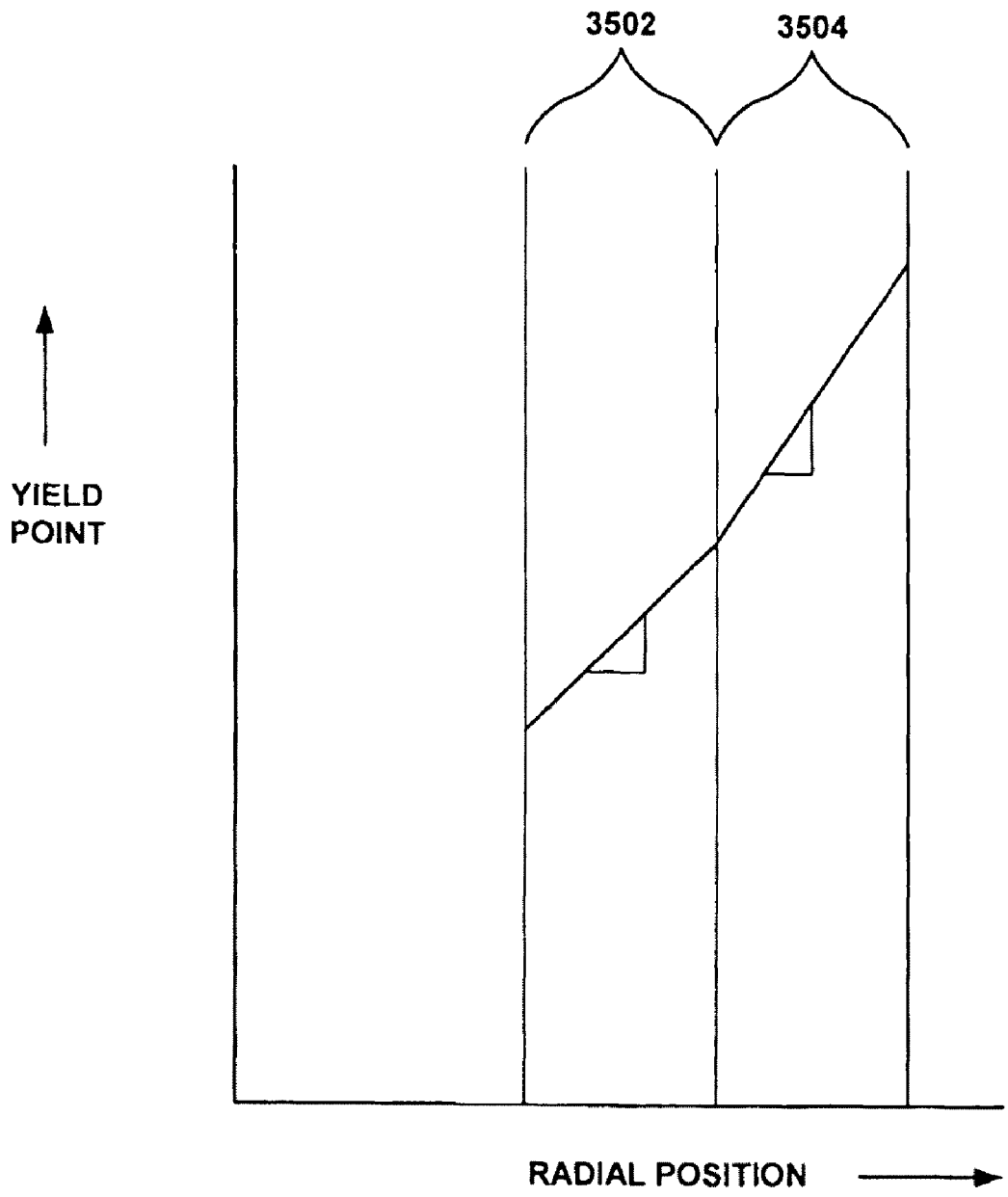
FIG. 35*b* is a graphical illustration of an exemplary embodiment of the variation in the yield point for the expandable tubular member of FIG. 35*a*.

Referring to FIG. 35*b*, in an exemplary embodiment, the yield point within the first and second tubular regions, 3502*a* and 3502*b*, of the expandable tubular member 3502 vary as a function of the radial position within the expandable tubular member. In an exemplary embodiment, the yield point increases as a function of the radial position within the expandable tubular member 3502. In an exemplary embodiment, the relationship between the yield point and the radial position within the expandable tubular member 3502 is a linear relationship. In an exemplary embodiment, the relationship between the yield point and the radial position within the expandable tubular member 3502 is a non-linear relationship. In an exemplary embodiment, the yield point increases at different rates within the first and second tubular regions, 3502*a* and 3502*b*, as a function of the radial position within the expandable tubular member 3502. In an exemplary embodiment, the functional relationship, and value, of the yield points within the first and second tubular regions, 3502*a* and 3502*b*, of the expandable tubular member 3502 are modified by the radial expansion and plastic deformation of the expandable tubular member.

In several exemplary embodiments, one or more of the expandable tubular members, 12, 14, 24, 26, 102, 104, 106, 108, 202, 204 and/or 3502, prior to a radial expansion and plastic deformation, include a microstructure that is a combination of a hard phase, such as martensite, a soft phase, such as ferrite, and a transitionary phase, such as retained austenite. In this manner, the hard phase provides high strength, the soft phase provides ductility, and the transitionary phase transitions to a hard phase, such as martensite, during a radial expansion and plastic deformation. Furthermore, in this manner, the yield point of the tubular member increases as a result of the radial expansion and plastic deformation. Further, in this manner, the tubular member is ductile, prior to the radial expansion and plastic deformation, thereby facilitating the radial expansion and plastic deformation. In an exemplary embodiment, the composition of a dual-phase expandable tubular member includes (weight percentages): about 0.1% C, 1.2% Mn, and 0.3% Si.

Figure 36A:
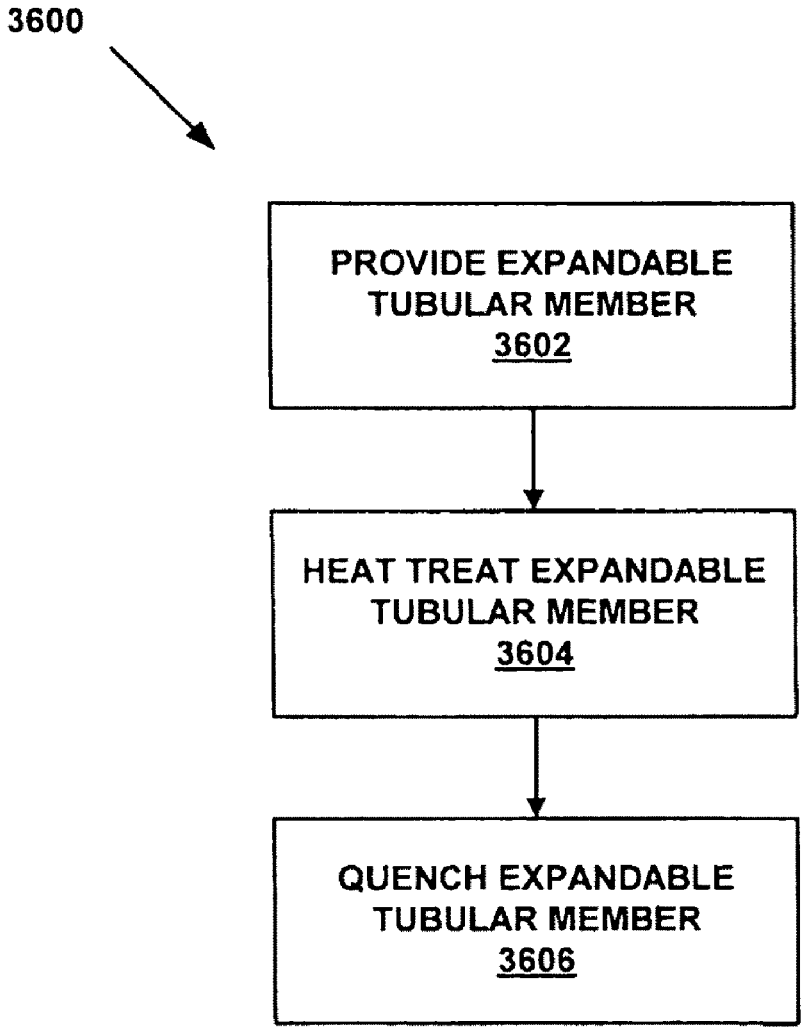
FIG. 36*a* is a flow chart illustration of an exemplary embodiment of a method for processing a tubular member.
Figure 36B:
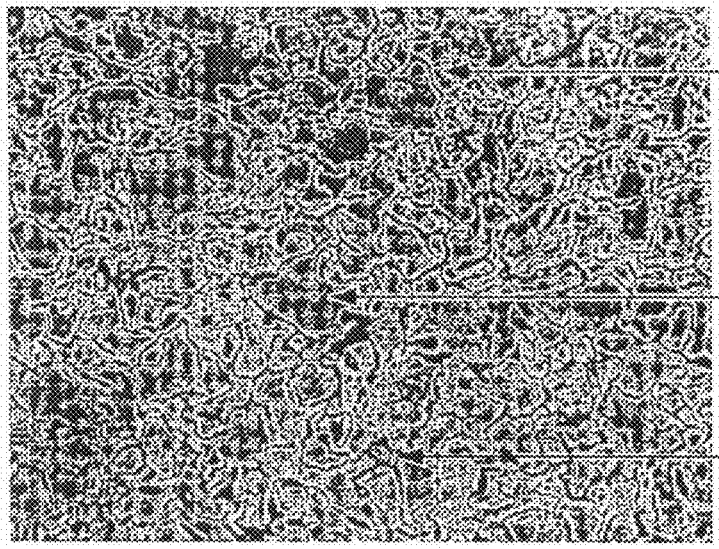
FIG. 36*b* is an illustration of the microstructure of an exemplary embodiment of a tubular member prior to thermal processing.

In an exemplary experimental embodiment, as illustrated in FIGS. 36*a*-36*c*, one or more of the expandable tubular members, 12, 14, 24, 26, 102, 104, 106, 108, 202, 204 and/or 3502 are processed in accordance with a method 3600, in which, in step 3602, an expandable tubular member 3602*a* is provided that is a steel alloy having following material composition (by weight percentage): 0.065% C, 1.44% Mn, 0.01% P, 0.002% S, 0.24% Si, 0.01% Cu, 0.01% Ni, 0.02% Cr, 0.05% V, 0.01% Mo, 0.01% Nb, and 0.01% Ti. In an exemplary experimental embodiment, the expandable tubular member 3602*a* provided in step 3602 has a yield strength of 45 ksi, and a tensile strength of 69 ksi.

In an exemplary experimental embodiment, as illustrated in FIG. 36*b*, in step 3602, the expandable tubular member 3602*a* includes a microstructure that includes martensite, pearlite, and V, Ni, and/or Ti carbides.

In an exemplary embodiment, the expandable tubular member 3602*a* is then heated at a temperature of 790° C. for about 10 minutes in step 3604.

In an exemplary embodiment, the expandable tubular member 3602*a* is then quenched in water in step 3606.

In an exemplary experimental embodiment, as illustrated in FIG. 36*c*, following the completion of step 3606, the expandable tubular member 3602*a* includes a microstructure that includes new ferrite, grain pearlite, martensite, and ferrite. In an exemplary experimental embodiment, following the completion of step 3606, the expandable tubular member 3602*a* has a yield strength of 67 ksi, and a tensile strength of 95 ksi.

In an exemplary embodiment, the expandable tubular member 3602*a* is then radially expanded and plastically deformed using one or more of the methods and apparatus described above. In an exemplary embodiment, following the radial expansion and plastic deformation of the expandable tubular member 3602*a*, the yield strength of the expandable tubular member is about 95 ksi.

Figure 37A:
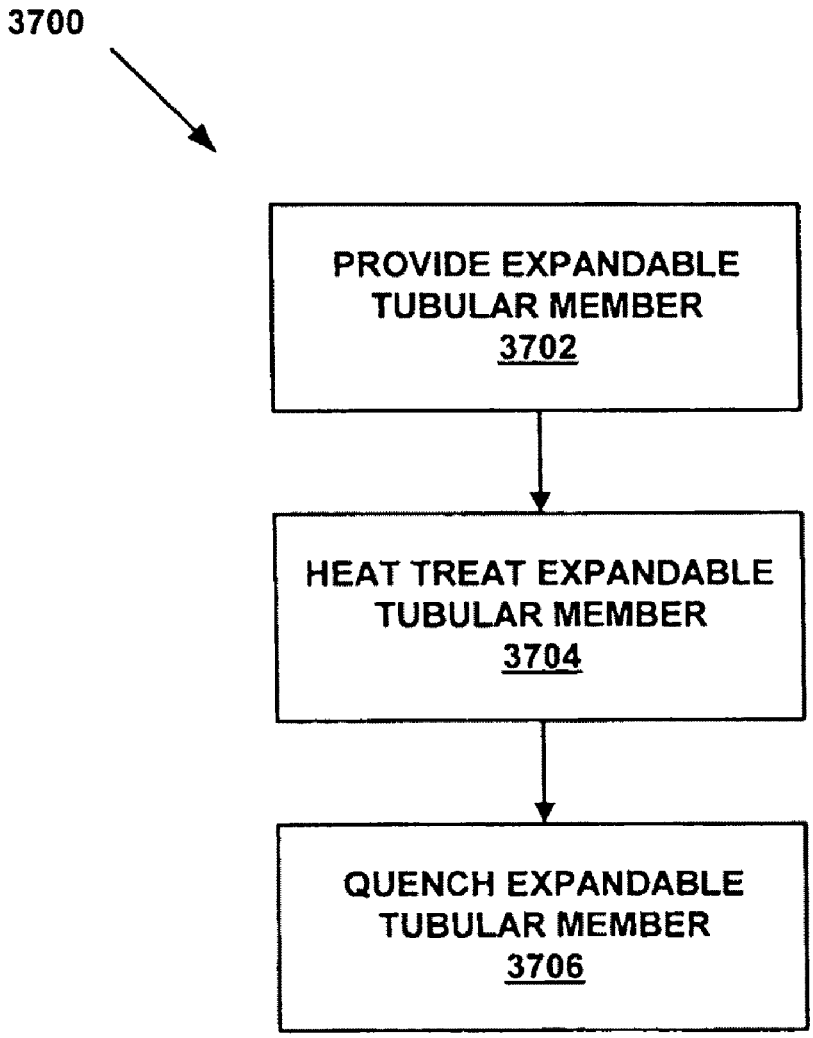
FIG. 37*a* is a flow chart illustration of an exemplary embodiment of a method for processing a tubular member.
Figure 37B:
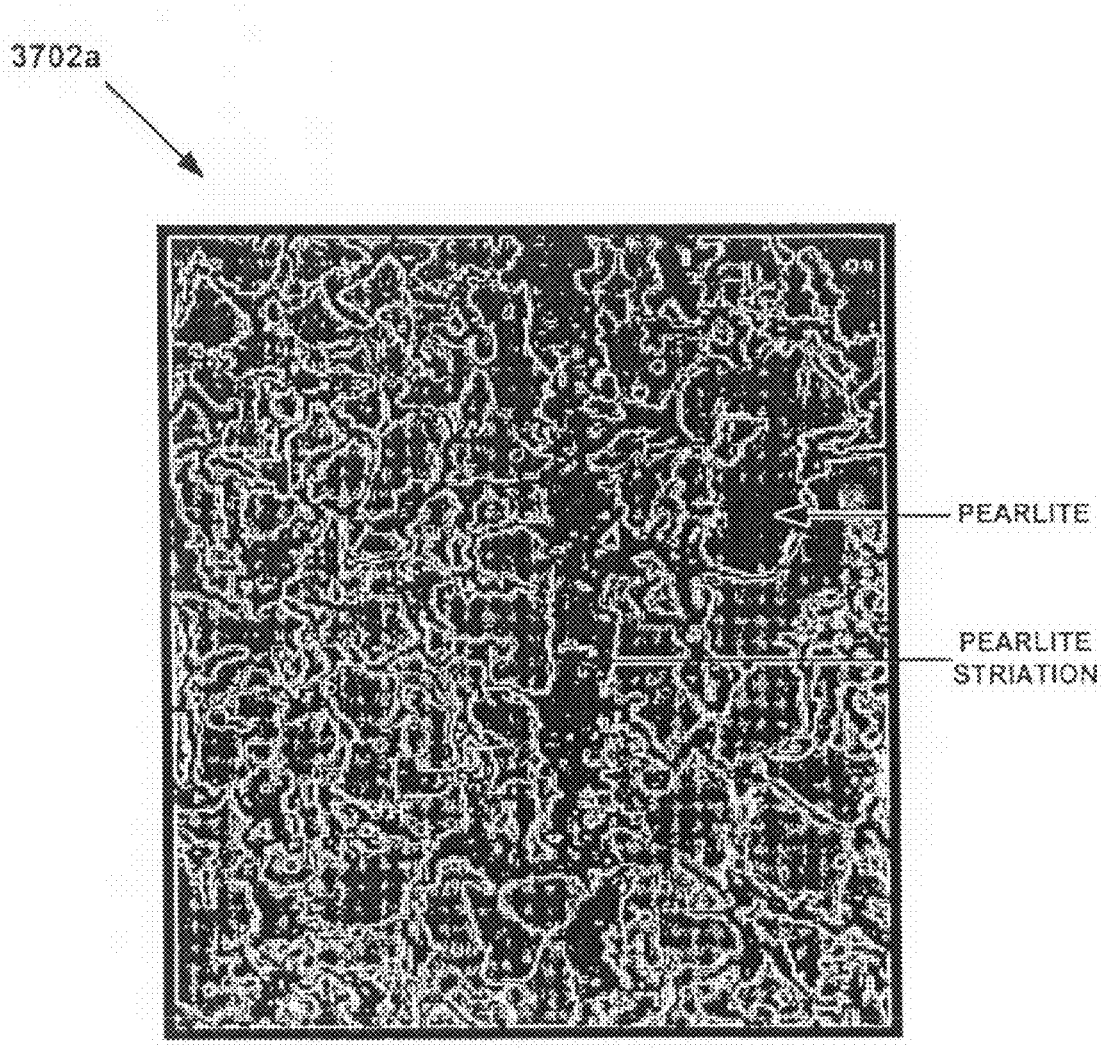
FIG. 37*b* is an illustration of the microstructure of an exemplary embodiment of a tubular member prior to thermal processing.
Figure 37C:
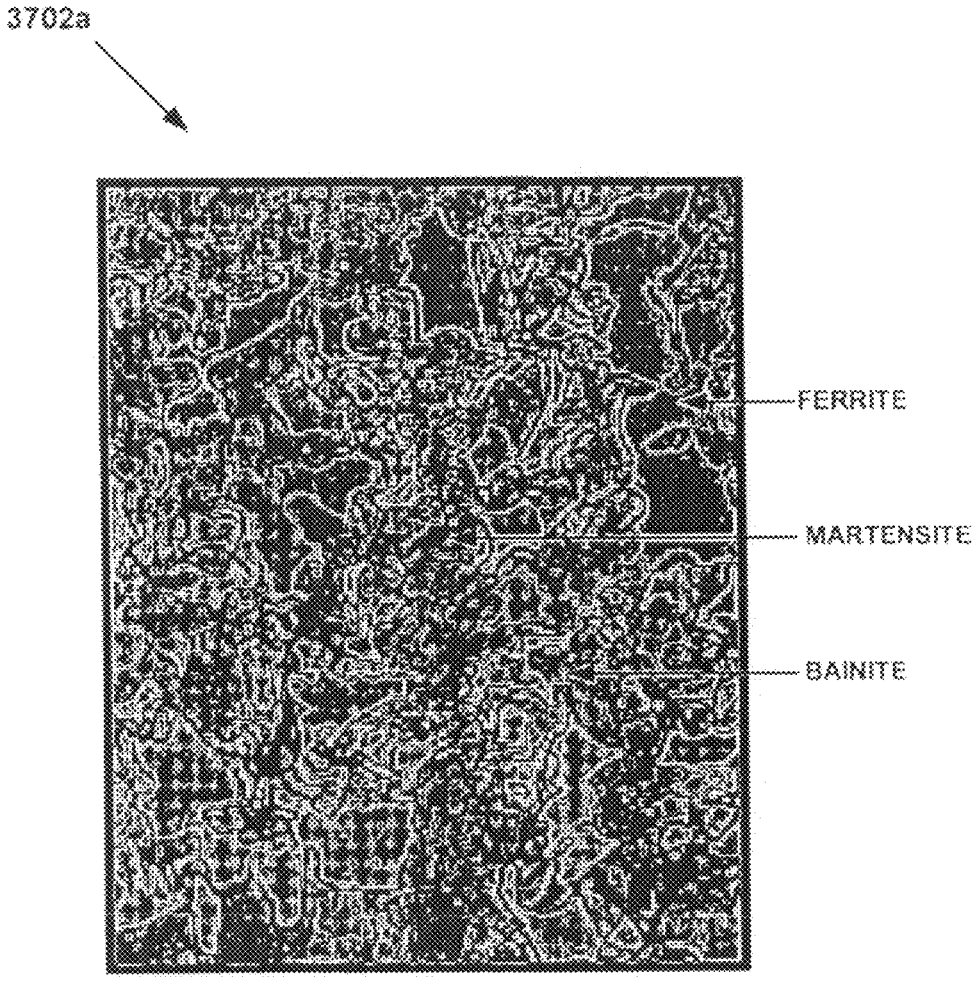
FIG. 37*c* is an illustration of the microstructure of an exemplary embodiment of a tubular member after thermal processing.

In an exemplary experimental embodiment, as illustrated in FIGS. 37*a*-37*c*, one or more of the expandable tubular members, 12, 14, 24, 26, 102, 104, 106, 108, 202, 204 and/or 3502 are processed in accordance with a method 3700, in which, in step 3702, an expandable tubular member 3702*a* is provided that is a steel alloy having following material composition (by weight percentage): 0.18% C, 1.28% Mn, 0.017% P, 0.004% S, 0.29% Si, 0.01% Cu, 0.01% Ni, 0.03% Cr, 0.04% V, 0.01% Mo, 0.03% Nb, and 0.01% Ti. In an exemplary experimental embodiment, the expandable tubular member 3702*a* provided in step 3702 has a yield strength of 60 ksi, and a tensile strength of 80 ksi.

In an exemplary experimental embodiment, as illustrated in FIG. 37*b*, in step 3702, the expandable tubular member 3702*a* includes a microstructure that includes pearlite and pearlite striation.

In an exemplary embodiment, the expandable tubular member 3702*a* is then heated at a temperature of 790° C. for about 10 minutes in step 3704.

In an exemplary embodiment, the expandable tubular member 3702*a* is then quenched in water in step 3706.

In an exemplary experimental embodiment, as illustrated in FIG. 37*c*, following the completion of step 3706, the expandable tubular member 3702*a* includes a microstructure that includes ferrite, martensite, and bainite. In an exemplary experimental embodiment, following the completion of step 3706, the expandable tubular member 3702*a* has a yield strength of 82 ksi, and a tensile strength of 130 ksi.

In an exemplary embodiment, the expandable tubular member 3702*a* is then radially expanded and plastically deformed using one or more of the methods and apparatus described above. In an exemplary embodiment, following the radial expansion and plastic deformation of the expandable tubular member 3702*a*, the yield strength of the expandable tubular member is about 130 ksi.

Figure 38C:
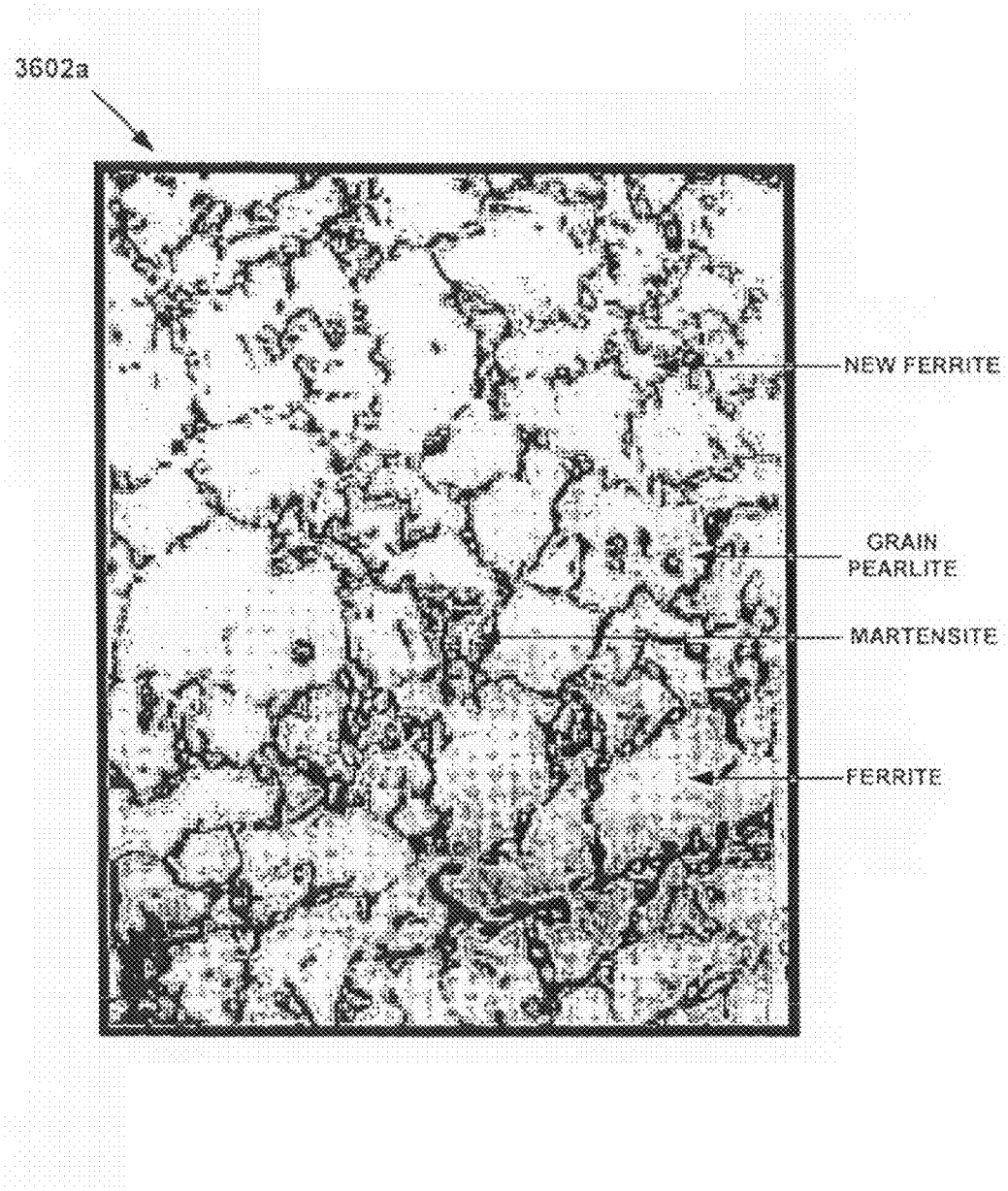
FIG. 38*c* is an illustration of the microstructure of an exemplary embodiment of a tubular member after thermal processing.
Figure 38A:
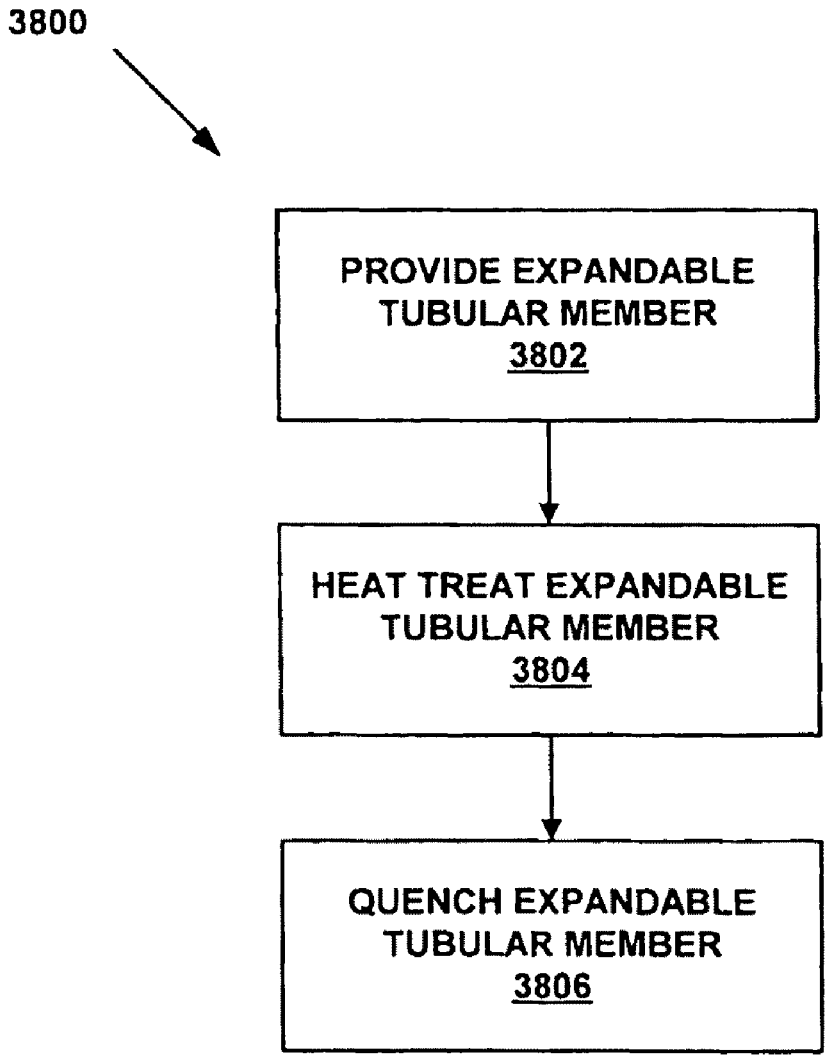
FIG. 38*a* is a flow chart illustration of an exemplary embodiment of a method for processing a tubular member.
Figure 38B:
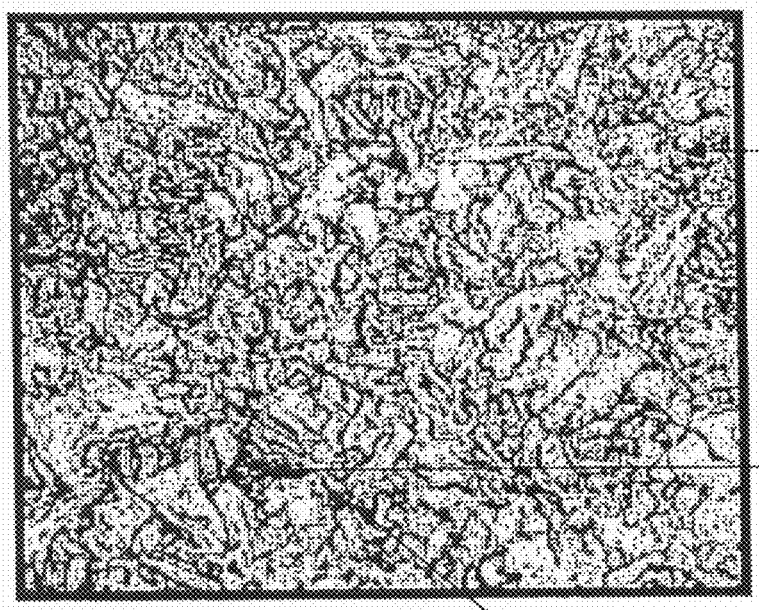
FIG. 38*b* is an illustration of the microstructure of an exemplary embodiment of a tubular member prior to thermal processing.
Figure 38C:
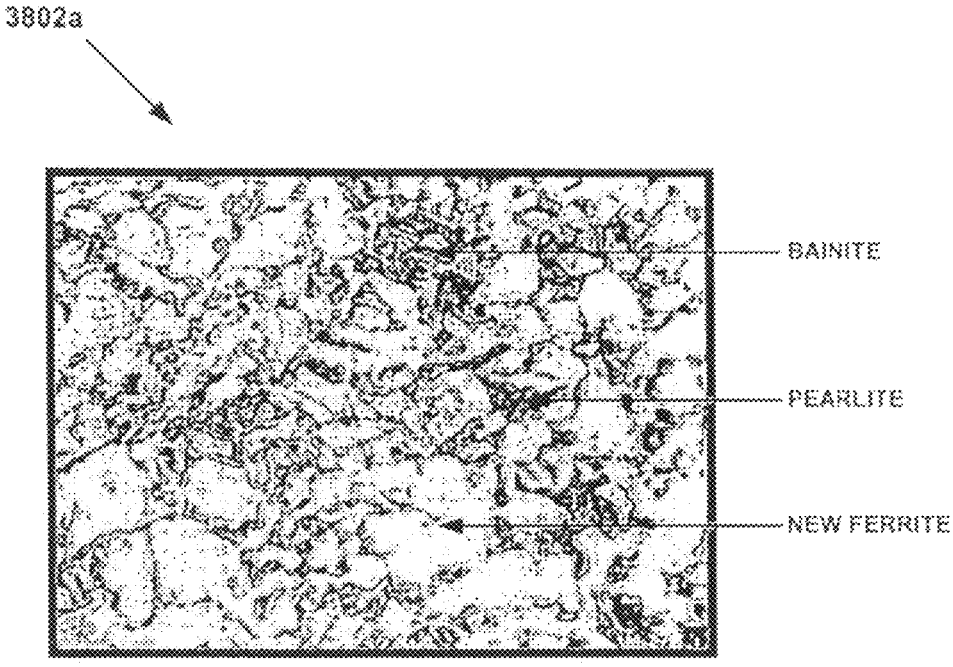

In an exemplary experimental embodiment, as illustrated in FIGS. 38*a*-38*c*, one or more of the expandable tubular members, 12, 14, 24, 26, 102, 104, 106, 108, 202, 204 and/or 3502 are processed in accordance with a method 3800, in which, in step 3802, an expandable tubular member 3802*a* is provided that is a steel alloy having following material composition (by weight percentage): 0.08% C, 0.82% Mn, 0.006% P, 0.003% S, 0.30% Si, 0.06% Cu, 0.05% Ni, 0.05% Cr. 0.03% V, 0.03% Mo, 0.01% Nb, and 0.01% Ti. In an exemplary experimental embodiment, the expandable tubular member 3802*a* provided in step 3802 has a yield strength of 56 ksi, and a tensile strength of 75 ksi.

In an exemplary experimental embodiment, as illustrated in FIG. 38*b*, in step 3802, the expandable tubular member 3802*a* includes a microstructure that includes grain pearlite, widmanstatten martensite and carbides of V, Ni, and/or Ti.

In an exemplary embodiment, the expandable tubular member 3802*a* is then heated at a temperature of 790° C. for about 10 minutes in step 3804.

In an exemplary embodiment, the expandable tubular member 3802*a* is then quenched in water in step 3806.

In an exemplary experimental embodiment, as illustrated in FIG. 38*c*, following the completion of step 3806, the expandable tubular member 3802*a* includes a microstructure that includes bainite, pearlite, and new ferrite. In an exemplary experimental embodiment, following the completion of step 3806, the expandable tubular member 3802*a* has a yield strength of 60 ksi, and a tensile strength of 97 ksi.

In an exemplary embodiment, the expandable tubular member 3802*a* is then radially expanded and plastically deformed using one or more of the methods and apparatus described above. In an exemplary embodiment, following the radial expansion and plastic deformation of the expandable tubular member 3802*a*, the yield strength of the expandable tubular member is about 97 ksi.

In several exemplary embodiments, the teachings of the present disclosure are combined with one or more of the teachings disclosed in FR 2 841 626, filed on Jun. 28, 2002, and published on Jan. 2, 2004, the disclosure of which is incorporated herein by reference.

Referring to FIGS. 39*a*-39*f*, an exemplary embodiment of an expansion system 3900 includes an adjustable expansion device 3902 and a hydroforming expansion device 3904 that are both coupled to a support member 3906.

In several exemplary embodiments, the adjustable expansion device 3902 includes one or more elements of conventional adjustable expansion devices and/or one or more elements of the adjustable expansion devices disclosed in one or more of the related applications referenced above and/or one or more elements of the conventional commercially available adjustable expansion devices available from Baker Hughes, Weatherford International, Schlumberger, and/or Enventure Global Technology L.L.C. In several exemplary embodiments, the hydroforming expansion device 3904 includes one or more elements of conventional hydroforming expansion devices and/or one or more elements of the hydroforming expansion devices disclosed in one or more of the related applications referenced above and/or one or more elements of the conventional commercially available hydroforming devices available from Baker Hughes, Weatherford International, Schlumberger, and/or Enventure Global Technology L.L.C. and/or one or more elements of the hydroforming expansion devices disclosed in U.S. Pat. No. 5,901,594, the disclosure of which is incorporated herein by reference. In several exemplary embodiments, the adjustable expansion device 3902 and the hydroforming expansion device 3904 may be combined in a single device and/or include one or more elements of each other.

Figure 39A:
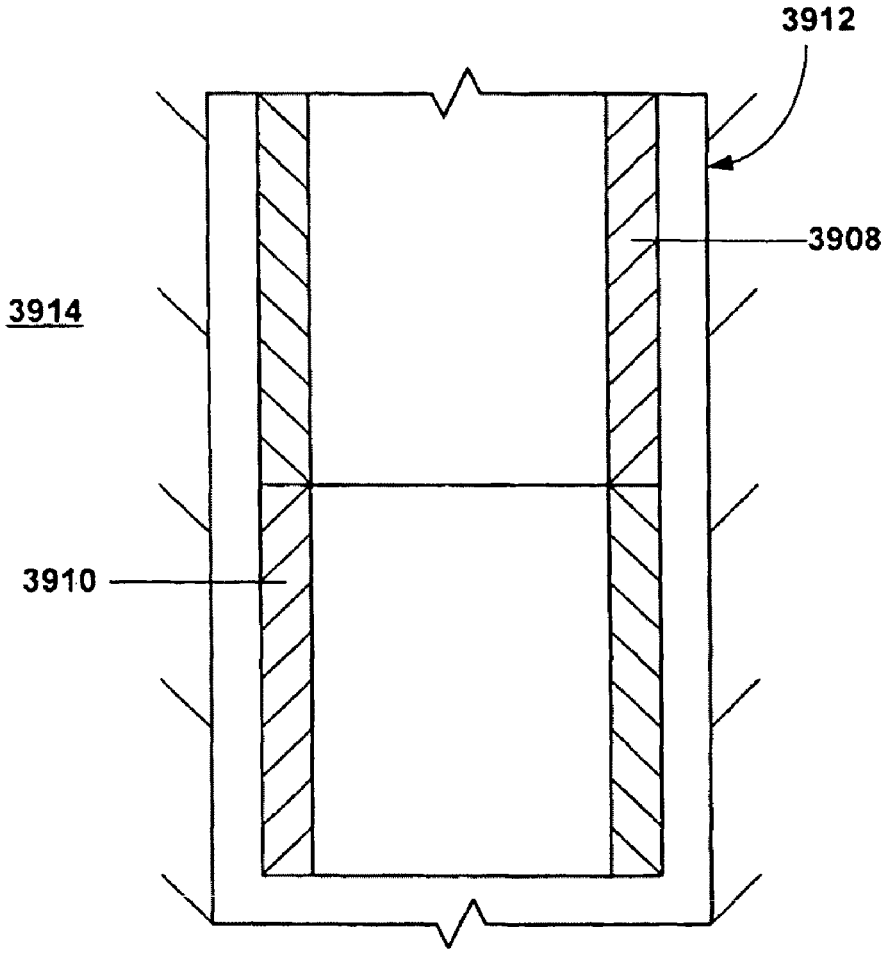
FIG. 39*a* is a fragmentary cross sectional illustration of an exemplary embodiment of expandable tubular members positioned within a preexisting structure.
Figure 39B:
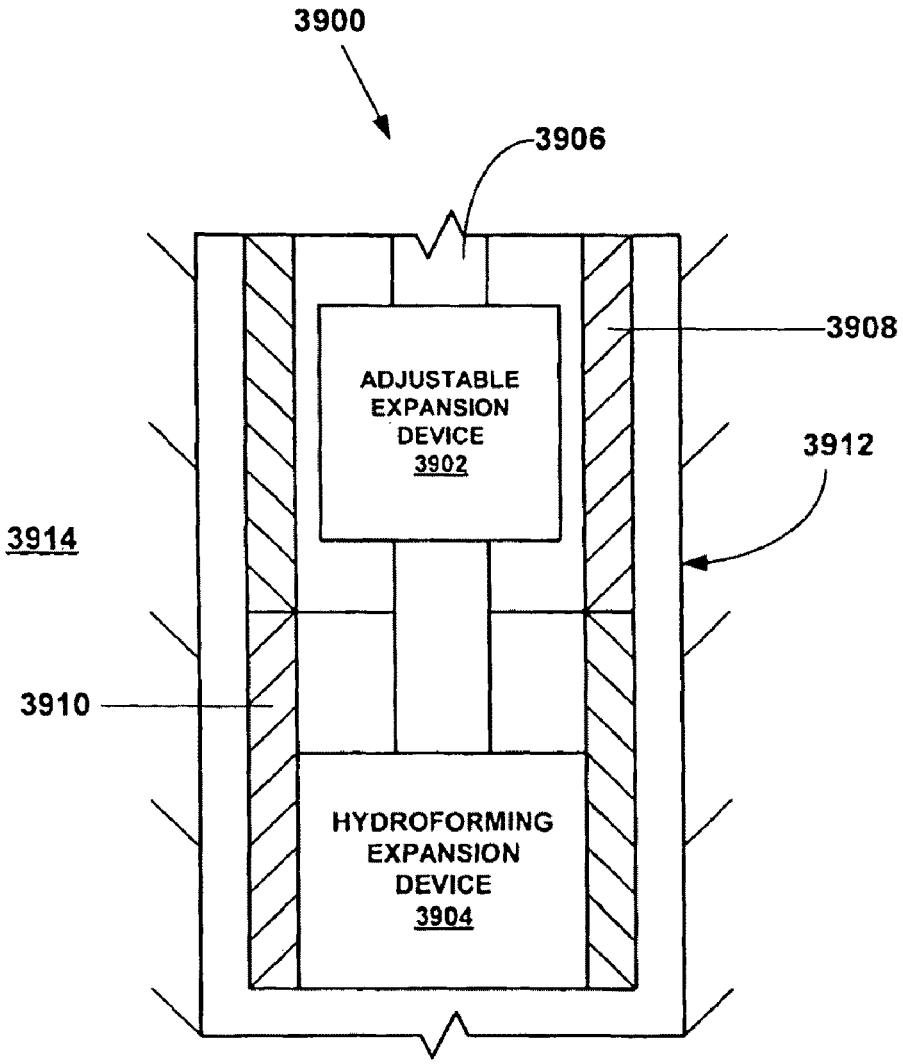
FIG. 39*b* is a fragmentary cross sectional illustration of the expandable tubular members of FIG. 39*a* after placing an adjustable expansion device and a hydroforming expansion device within the expandable tubular members.

In an exemplary embodiment, during the operation of the expansion system 3900, as illustrated in FIGS. 39*a* and 39*b*, the expansion system is positioned within an expandable tubular assembly that includes first and second tubular members, 3908 and 3910, that are coupled end to end and positioned and supported within a preexisting structure such as, for example, a wellbore 3912 that traverses a subterranean formation 3914. In several exemplary embodiments, the first and second tubular members, 3908 and 3910, include one or more of the characteristics of the expandable tubular members described in the present application.

Figure 39C:
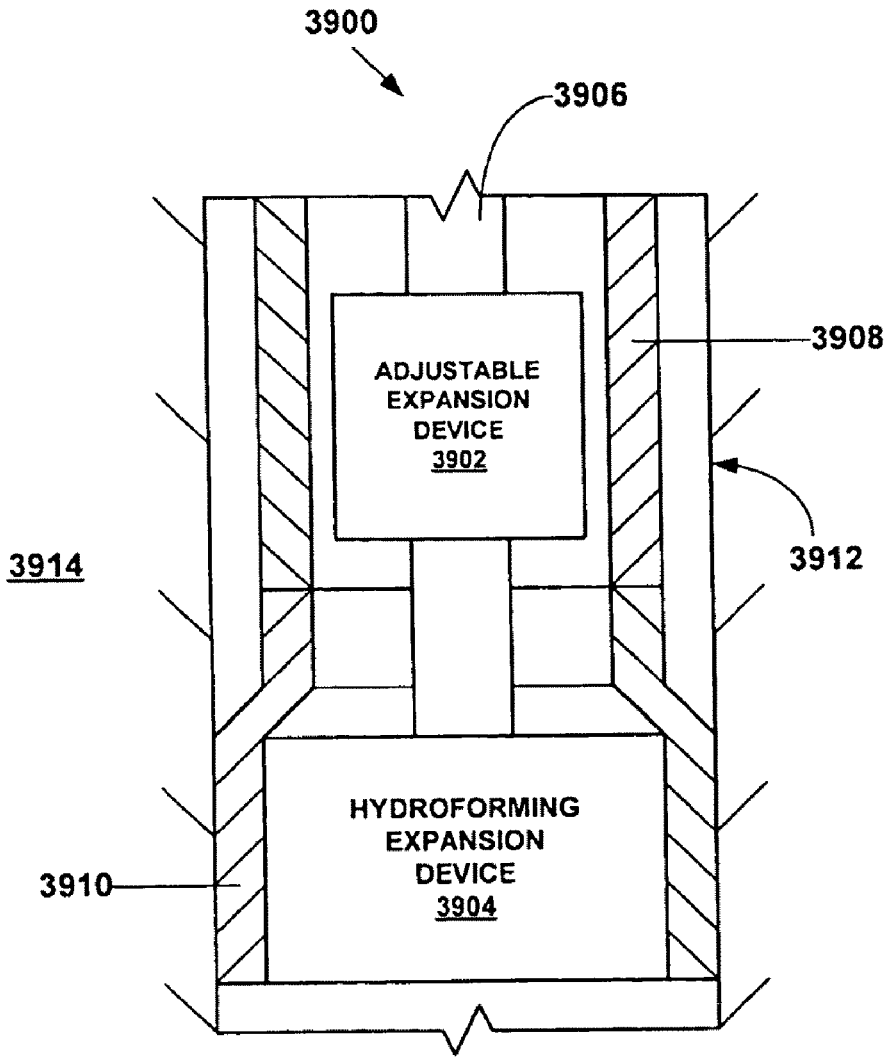
FIG. 39*c* is a fragmentary cross sectional illustration of the expandable tubular members of FIG. 39*b* after operating the hydroforming expansion device to radially expand and plastically deform at least a portion of the expandable tubular members.

In an exemplary embodiment, as illustrated in FIG. 39*c*, the hydroforming expansion device 3904 may then be operated to radially expand and plastically deform a portion of the second tubular member 3910.

Figure 39D:
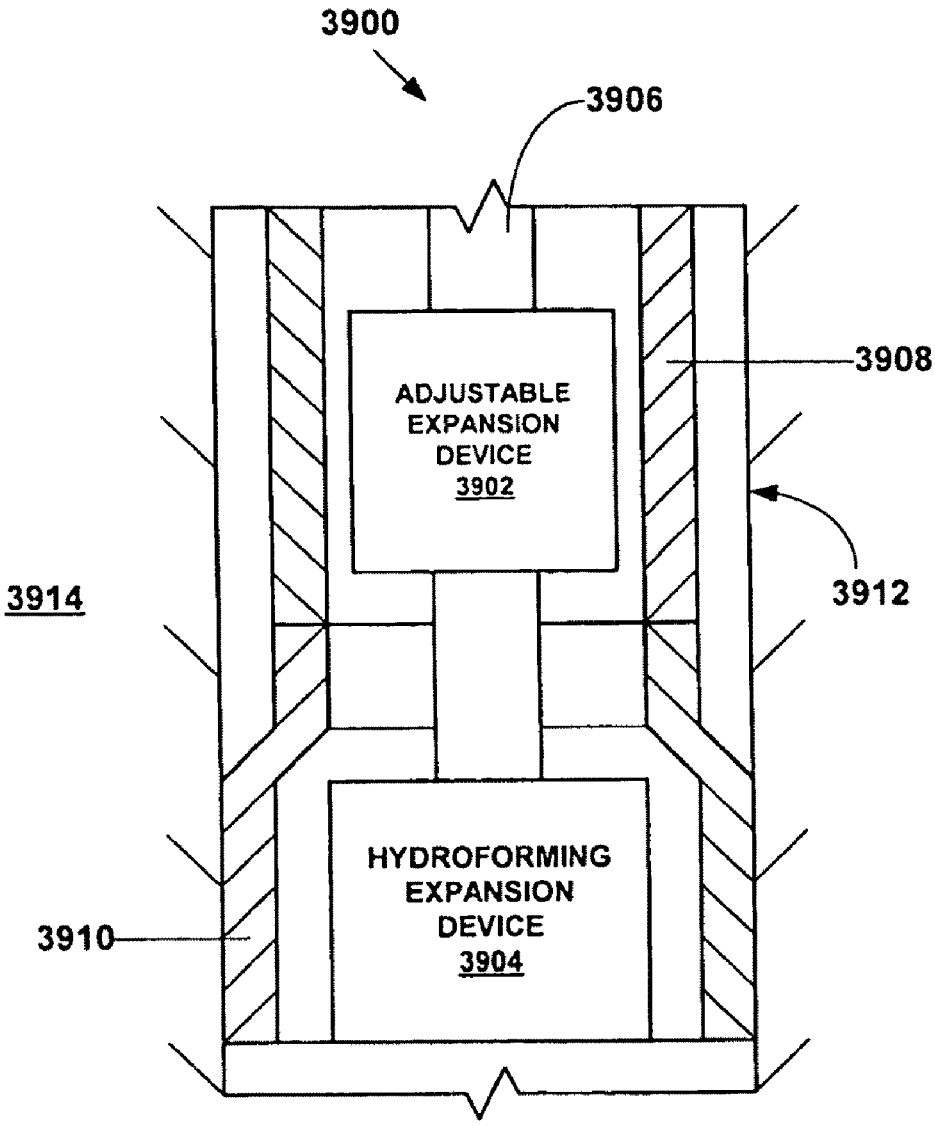
FIG. 39*d* is a fragmentary cross sectional illustration of the expandable tubular members of FIG. 39*c* after operating the hydroforming expansion device to disengage from the expandable tubular members.

In an exemplary embodiment, as illustrated in FIG. 39*d*, the hydroforming expansion device 3904 may then be disengaged from the second tubular member 3910.

Figure 39E:
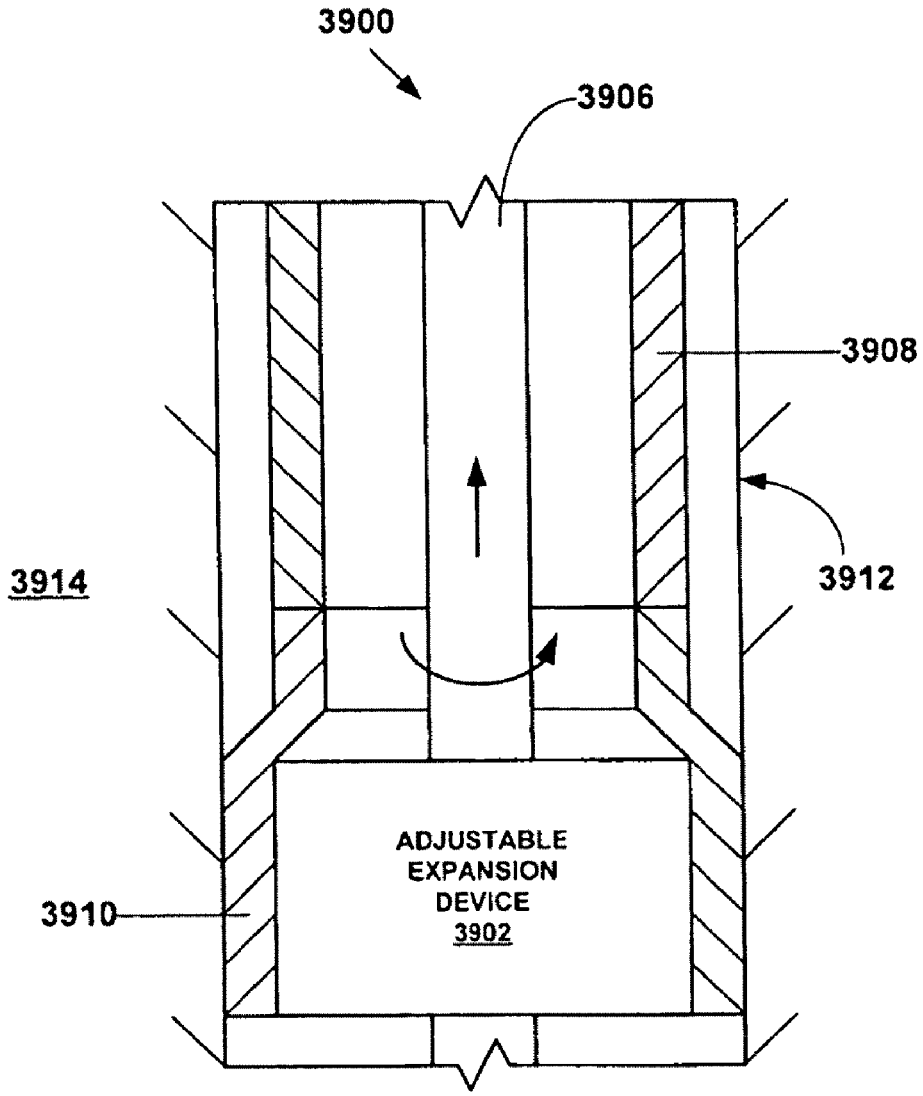
FIG. 39*e* is a fragmentary cross sectional illustration of the expandable tubular members of FIG. 39*d* after positioning the adjustable expansion device within the radially expanded portion of the expandable tubular members and then adjusting the size of the adjustable expansion device.

In an exemplary embodiment, as illustrated in FIG. 39*e*, the adjustable expansion device 3902 may then be positioned within the radially expanded portion of the second tubular member 3910 and the size the adjustable expansion device increased.

Figure 39F:
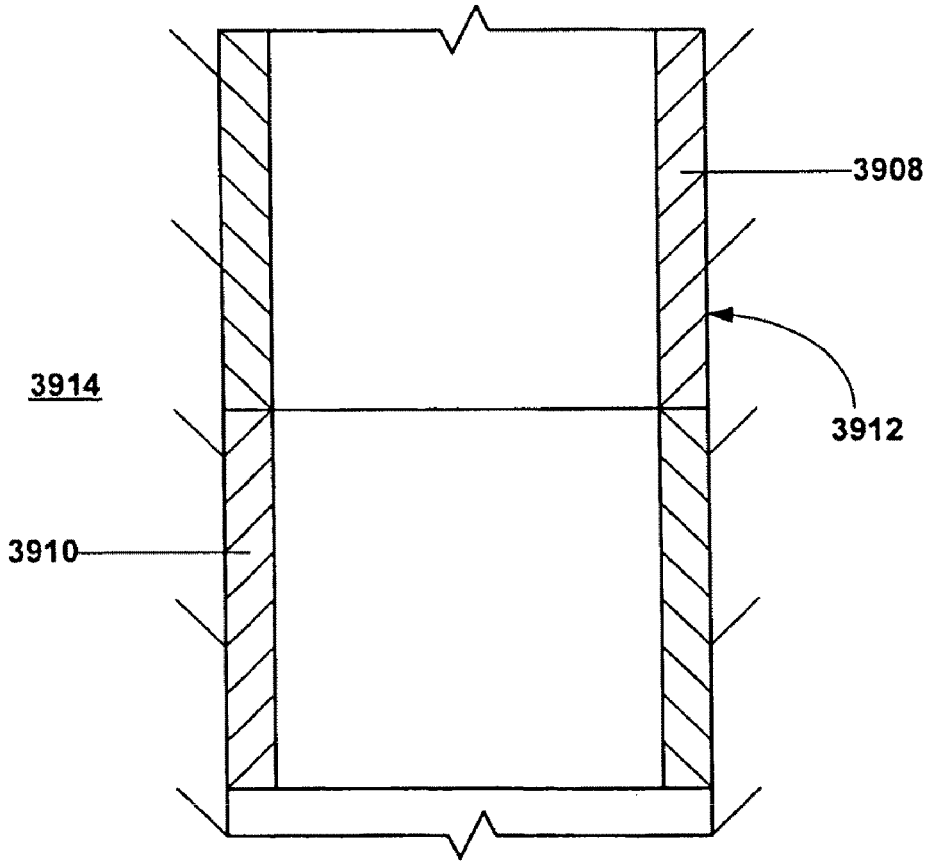
FIG. 39*f* is a fragmentary cross sectional illustration of the expandable tubular members of FIG. 39*e* after operating the adjustable expansion device to radially expand another portion of the expandable tubular members.

In an exemplary embodiment, as illustrated in FIG. 39*f*, the adjustable expansion device 3902 may then be operated to radially expand and plastically deform one or more portions of the first and second tubular members, 3908 and 3910.

Referring to FIGS. 40*a*-40*g*, an exemplary embodiment of an expansion system 4000 includes a hydroforming expansion device 4002 that is coupled to a support member 4004.

In several exemplary embodiments, the hydroforming expansion device 4002 includes one or more elements of conventional hydroforming expansion devices and/or one or more elements of the hydroforming expansion devices disclosed in one or more of the related applications referenced above and/or one or more elements of the conventional commercially available hydroforming devices available from Baker Hughes, Weatherford International, Schlumberger, and/or Enventure Global Technology L.L.C. and/or one or more elements of the hydroforming expansion devices disclosed in U.S. Pat. No. 5,901,594, the disclosure of which is incorporated herein by reference.

Figure 40A:
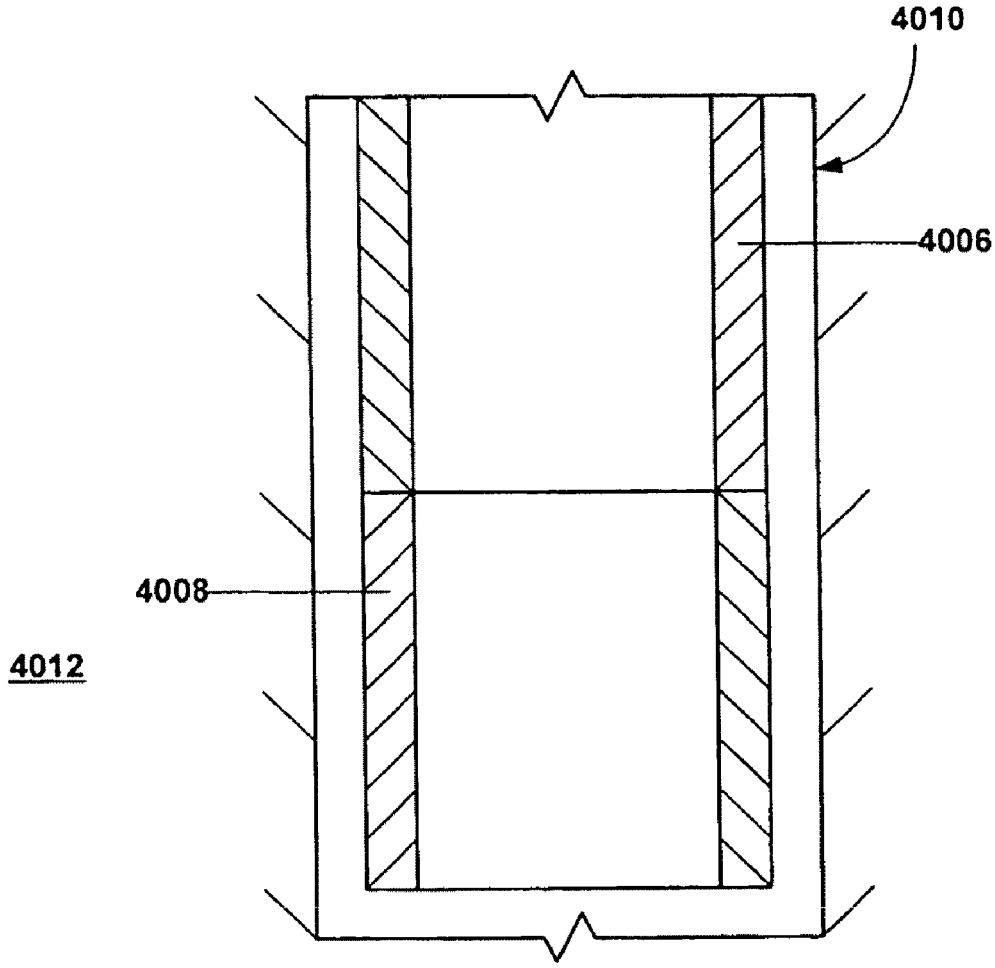
FIG. 40*a* is a fragmentary cross sectional illustration of an exemplary embodiment of expandable tubular members positioned within a preexisting structure.
Figure 40B:
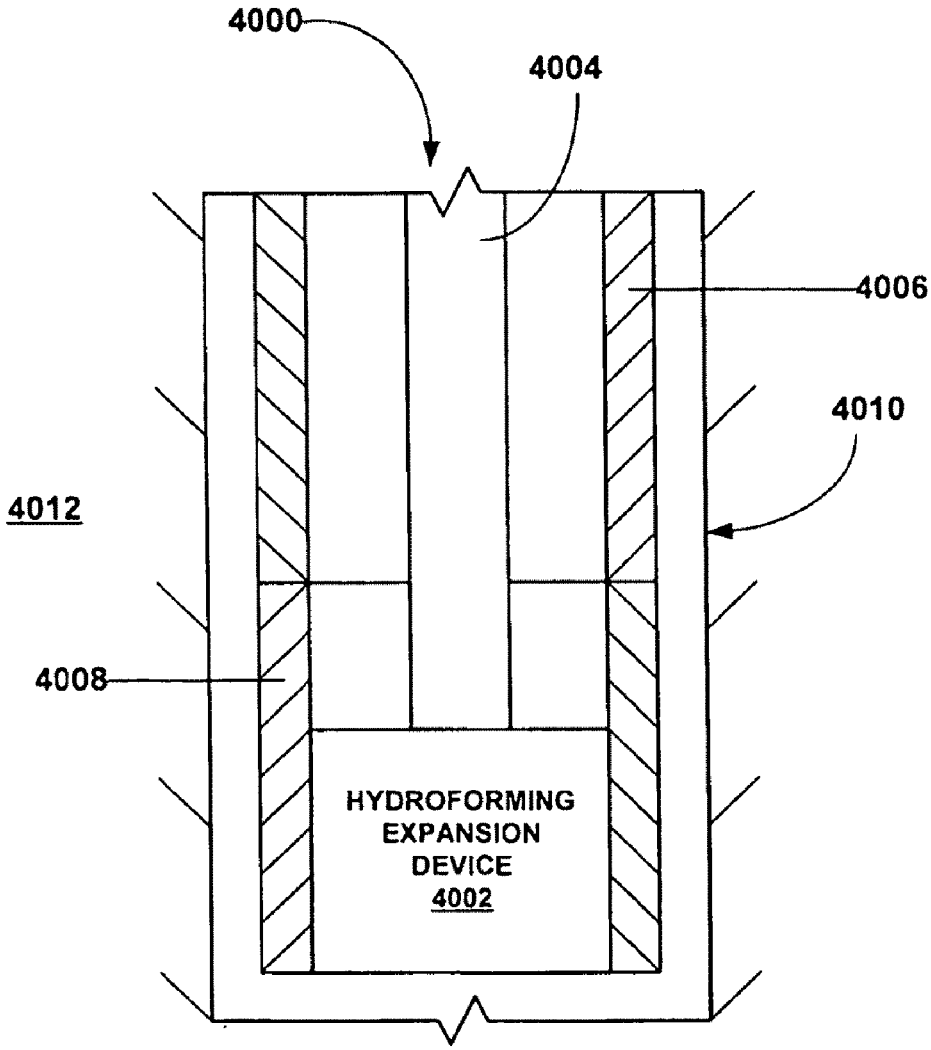
FIG. 40*b* is a fragmentary cross sectional illustration of the expandable tubular members of FIG. 40*a* after placing a hydroforming expansion device within a portion of the expandable tubular members.
Figure 40C:
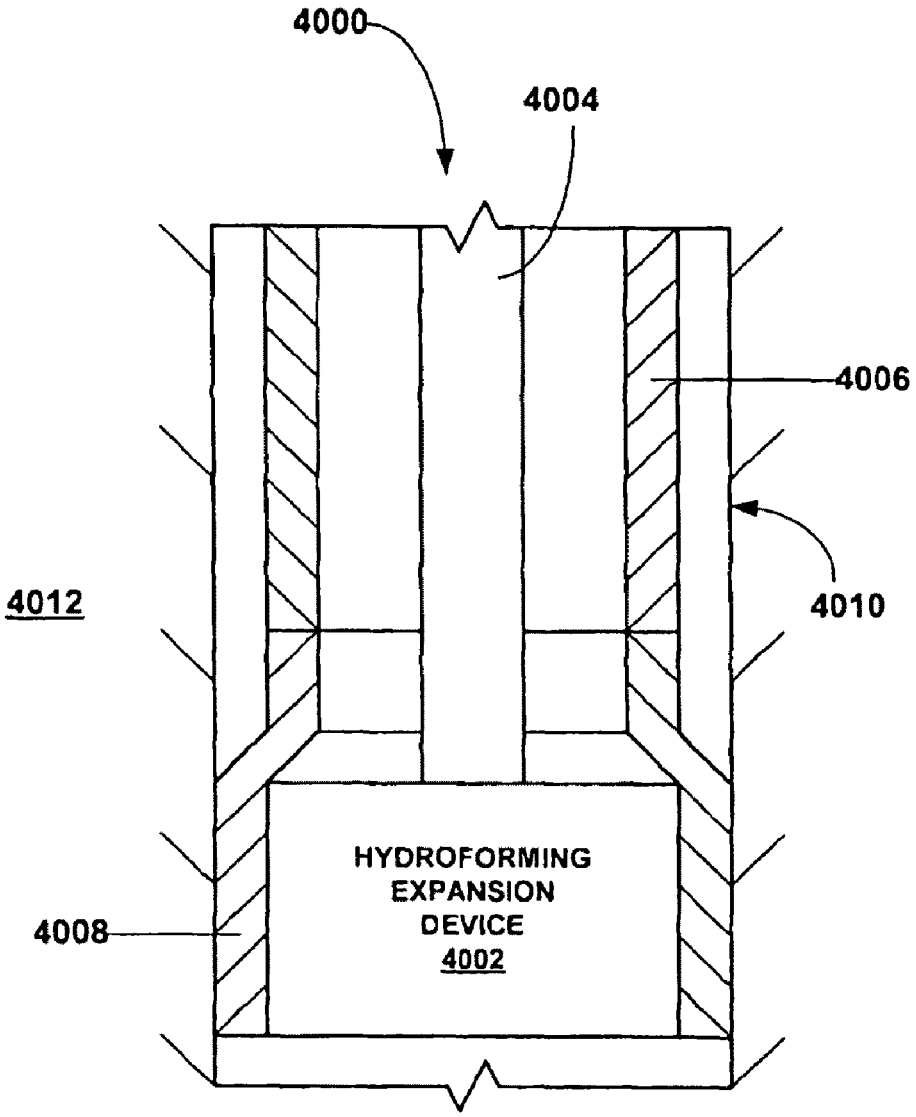
FIG. 40*c* is a fragmentary cross sectional illustration of the expandable tubular members of FIG. 40*b* after operating the hydroforming expansion device to radially expand and plastically deform at least a portion of the expandable tubular members.
Figure 40D:
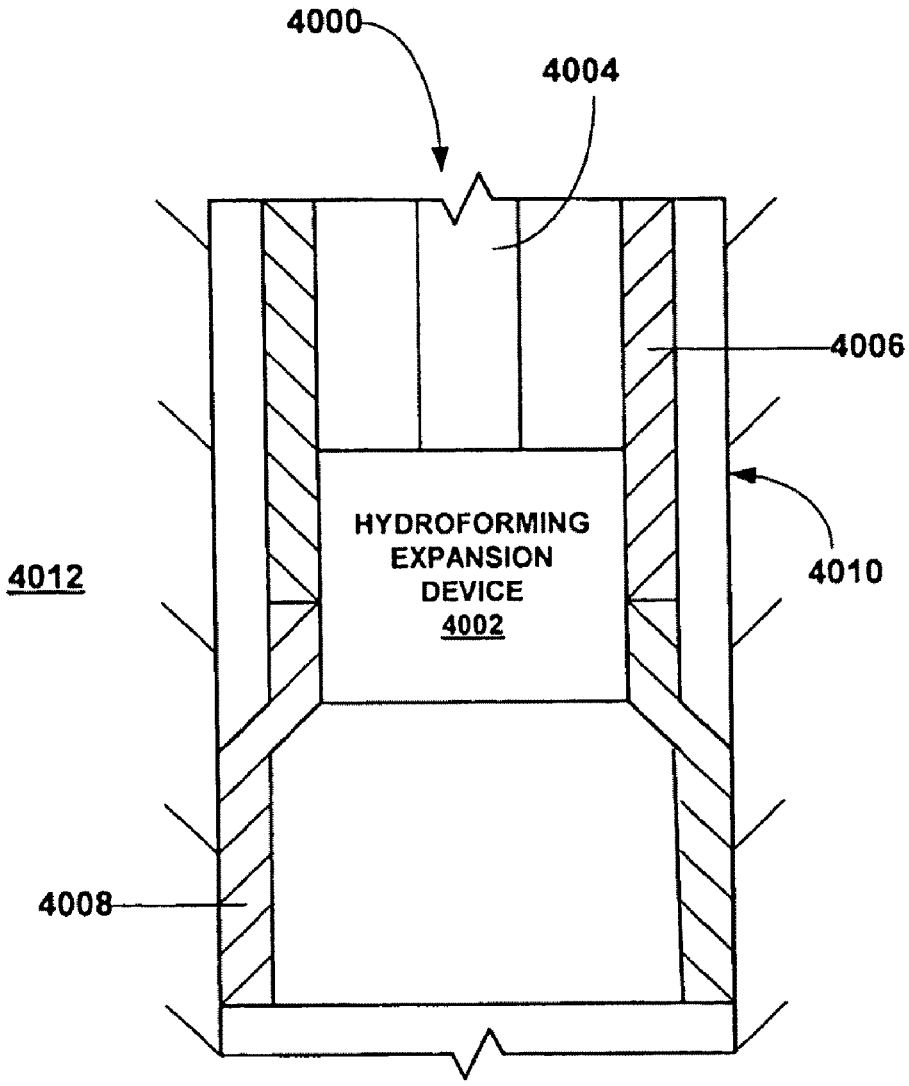
FIG. 40*d* is a fragmentary cross sectional illustration of the expandable tubular members of FIG. 40*c* after placing the hydroforming expansion device within another portion of the expandable tubular members.
Figure 40E:
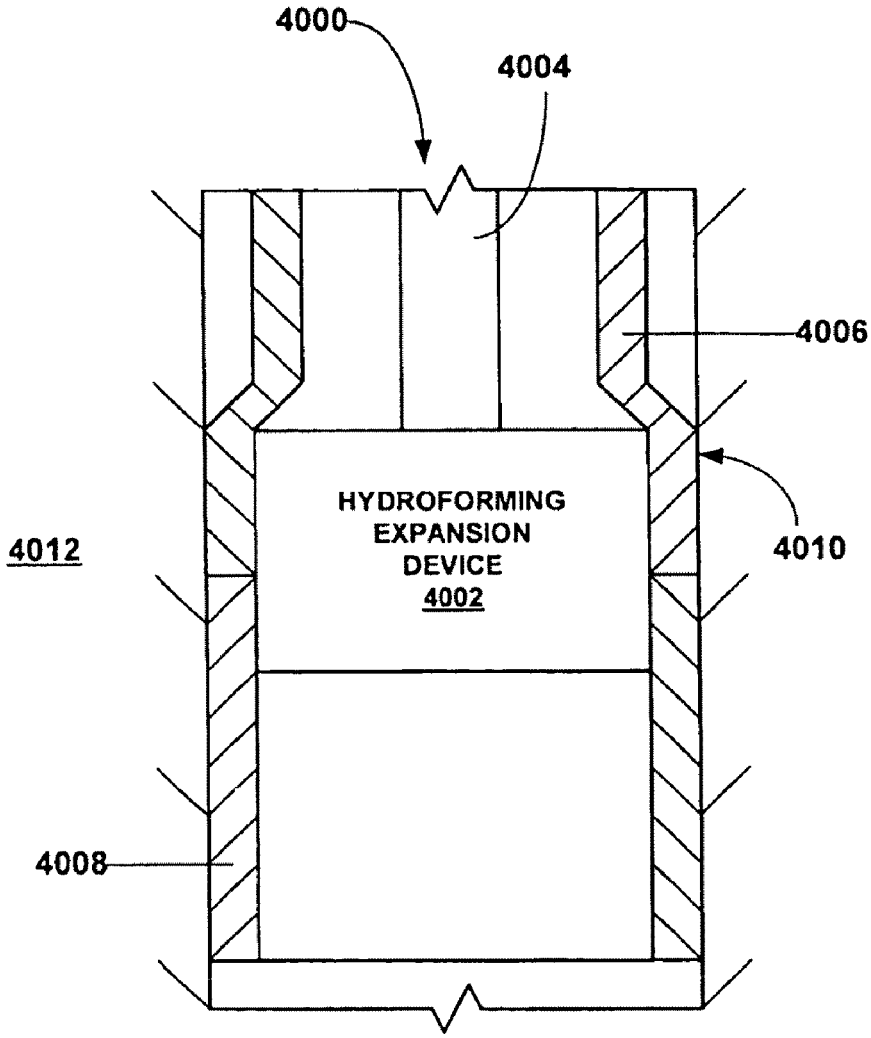
FIG. 40*e* is a fragmentary cross sectional illustration of the expandable tubular members of FIG. 40*d* after operating the hydroforming expansion device to radially expand and plastically deform at least another portion of the expandable tubular members.
Figure 40F:
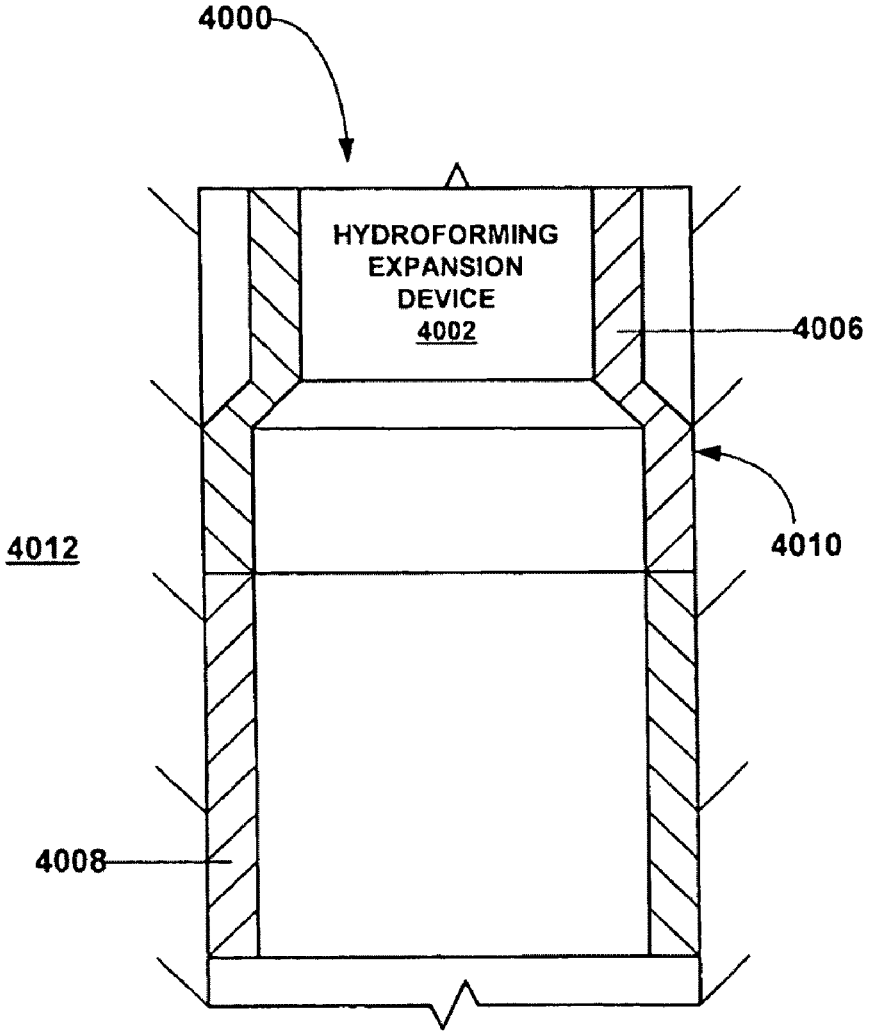
FIG. 40*f* is a fragmentary cross sectional illustration of the expandable tubular members of FIG. 40*e* after placing the hydroforming expansion device within another portion of the expandable tubular members.
Figure 40G:
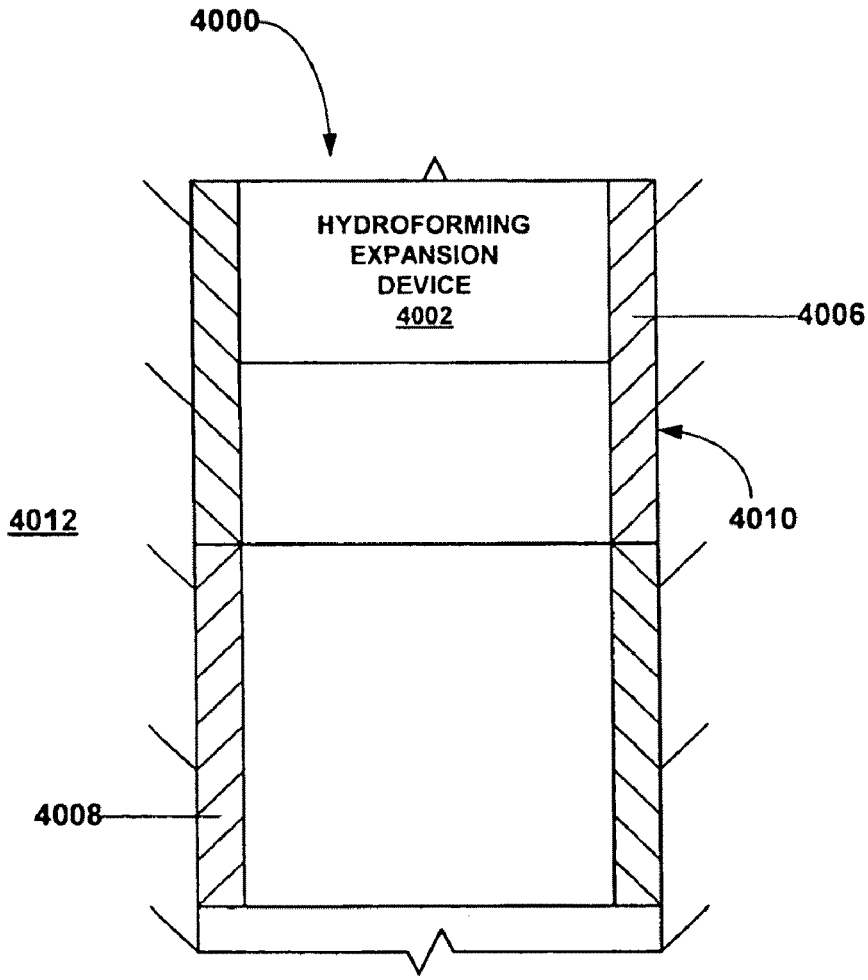
FIG. 40*g* is a fragmentary cross sectional illustration of the expandable tubular members of FIG. 40*f* after operating the hydroforming expansion device to radially expand and plastically deform at least another portion of the expandable tubular members.

In an exemplary embodiment, during the operation of the expansion system 4000, as illustrated in FIGS. 40*a* and 40*b*, the expansion system is positioned within an expandable tubular assembly that includes first and second tubular members, 4006 and 4008, that are coupled end to end and positioned and supported within a preexisting structure such as, for example, a wellbore 4010 that traverses a subterranean formation 4012. In several exemplary embodiments, the first and second tubular members, 4004 and 4006, include one or more of the characteristics of the expandable tubular members described in the present application.

In an exemplary embodiment, as illustrated in FIGS. 40*c* to 40*f*, the hydroforming expansion device 4002 may then be repeatedly operated to radially expand and plastically deform one or more portions of the first and second tubular members, 4008 and 4010.

Referring to FIGS. 41*a*-41*h*, an exemplary embodiment of an expansion system 4100 includes an adjustable expansion device 4102 and a hydroforming expansion device 4104 that are both coupled to a tubular support member 4106.

In several exemplary embodiments, the adjustable expansion device 4102 includes one or more elements of conventional adjustable expansion devices and/or one or more elements of the adjustable expansion devices disclosed in one or more of the related applications referenced above and/or one or more elements of the conventional commercially available adjustable expansion devices available from Baker Hughes, Weatherford International, Schlumberger, and/or Enventure Global Technology L.L.C. In several exemplary embodiments, the hydroforming expansion device 4104 includes one or more elements of conventional hydroforming expansion devices and/or one or more elements of the hydroforming expansion devices disclosed in one or more of the related applications referenced above and/or one or more elements of the conventional commercially available hydroforming devices available from Baker Hughes, Weatherford International, Schlumberger, and/or Enventure Global Technology L.L.C. and/or one or more elements of the hydroforming expansion devices disclosed in U.S. Pat. No. 5,901,594, the disclosure of which is incorporated herein by reference. In several exemplary embodiments, the adjustable expansion device 4102 and the hydroforming expansion device 4104 may be combined in a single device and/or include one or more elements of each other.

Figure 41A:
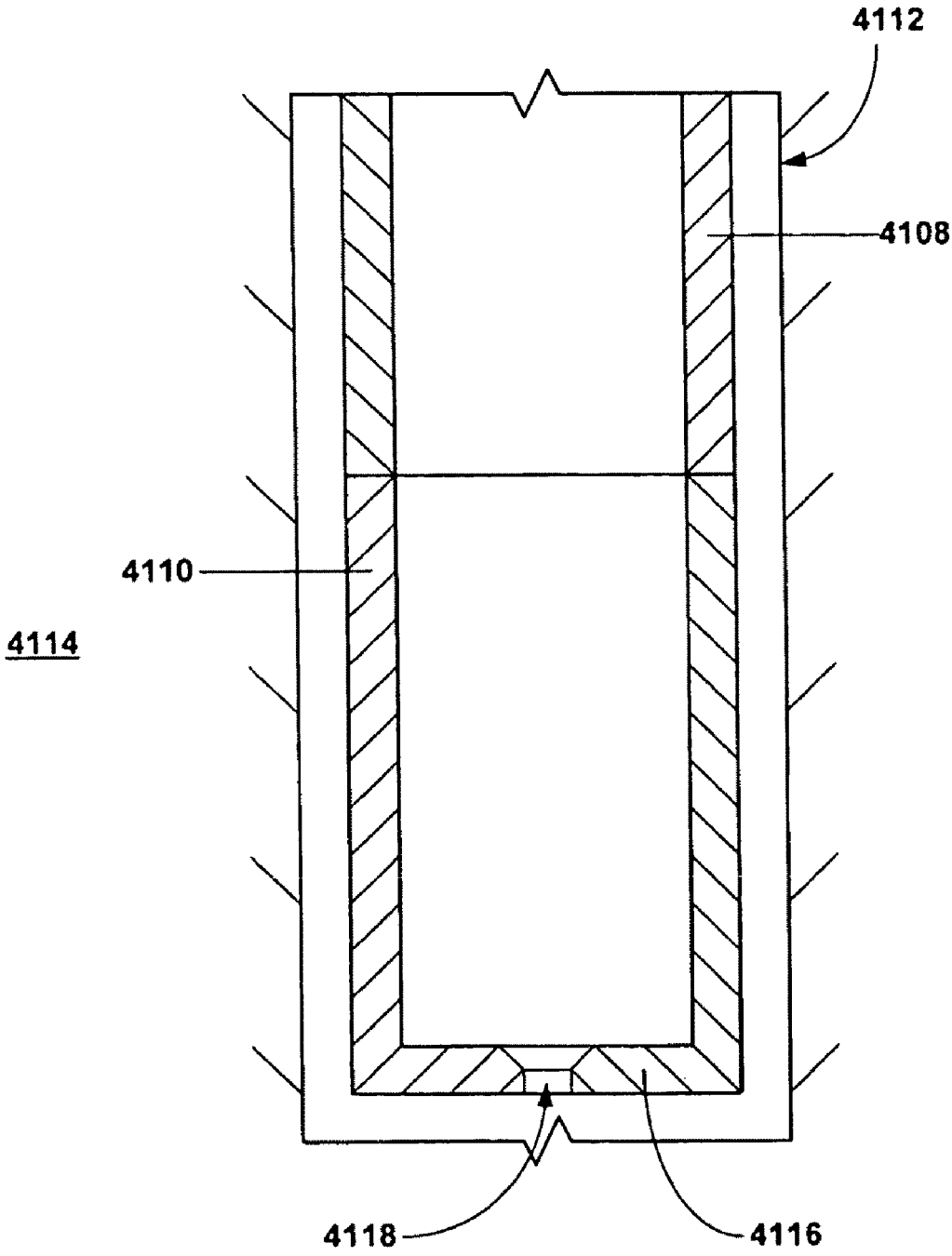
FIG. 41*a* is a fragmentary cross sectional illustration of an exemplary embodiment of expandable tubular members positioned within a preexisting structure, wherein the bottom most tubular member includes a valveable passageway.
Figure 41B:
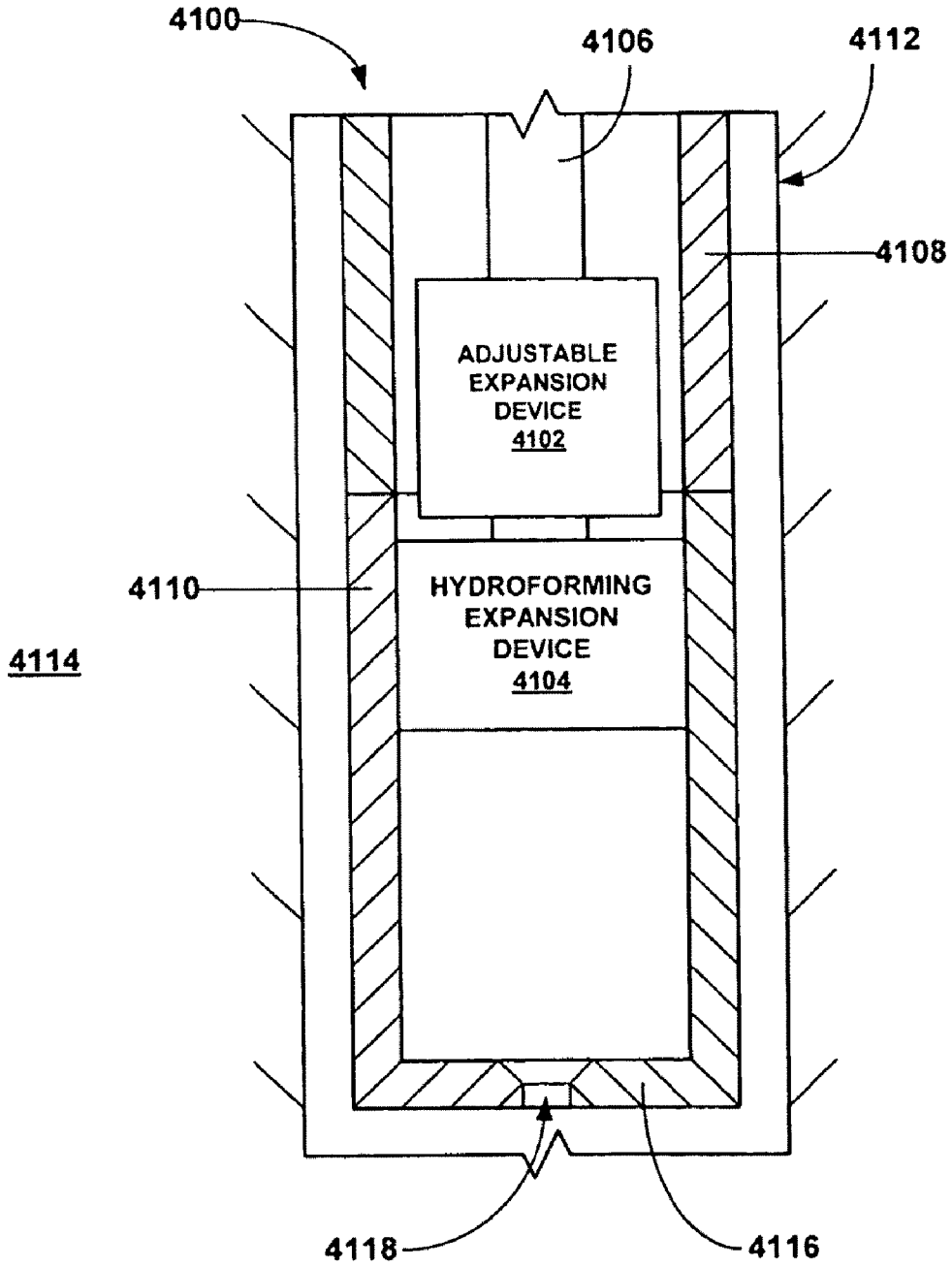
FIG. 41*b* is a fragmentary cross sectional illustration of the expandable tubular members of FIG. 41*a* after placing a hydroforming expansion device within the lower most expandable tubular member.

In an exemplary embodiment, during the operation of the expansion system 4100, as illustrated in FIGS. 41*a* and 41*b*, the expansion system is positioned within an expandable tubular assembly that includes first and second tubular members, 4108 and 4110, that are coupled end to end and positioned and supported within a preexisting structure such as, for example, a wellbore 4112 that traverses a subterranean formation 4114. In an exemplary embodiment, a shoe 4116 having a valveable passage 4118 is coupled to the lower portion of the second tubular member 4110. In several exemplary embodiments, the first and second tubular members, 4108 and 4110, include one or more of the characteristics of the expandable tubular members described in the present application.

Figure 41C:
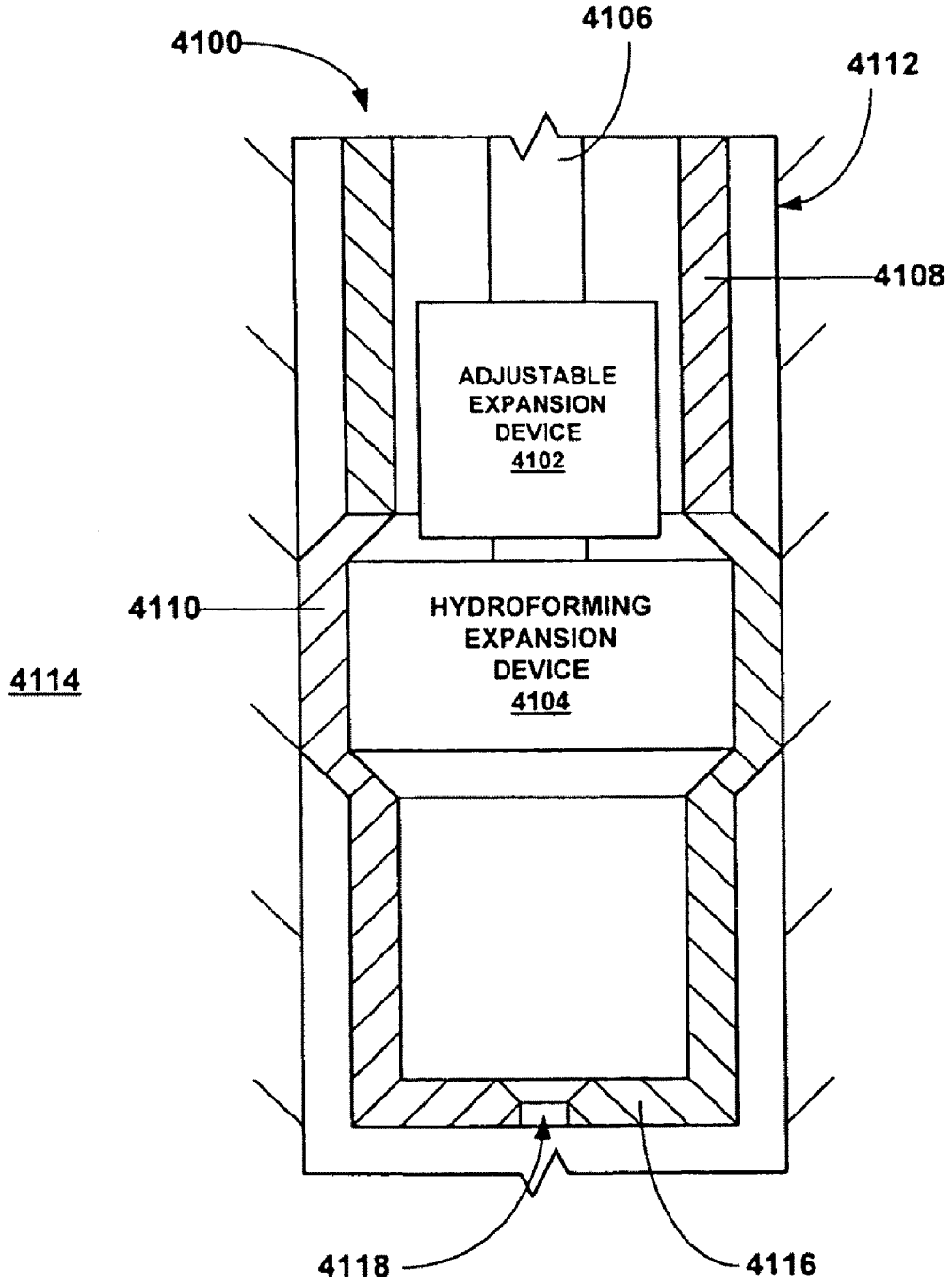
FIG. 41*c* is a fragmentary cross sectional illustration of the expandable tubular members of FIG. 41*b* after operating the hydroforming expansion device to radially expand and plastically deform at least a portion of the lower most expandable tubular member.

In an exemplary embodiment, as illustrated in FIG. 41*c*, the hydroforming expansion device 4104 may then be operated to radially expand and plastically deform a portion of the second tubular member 4110.

Figure 41D:
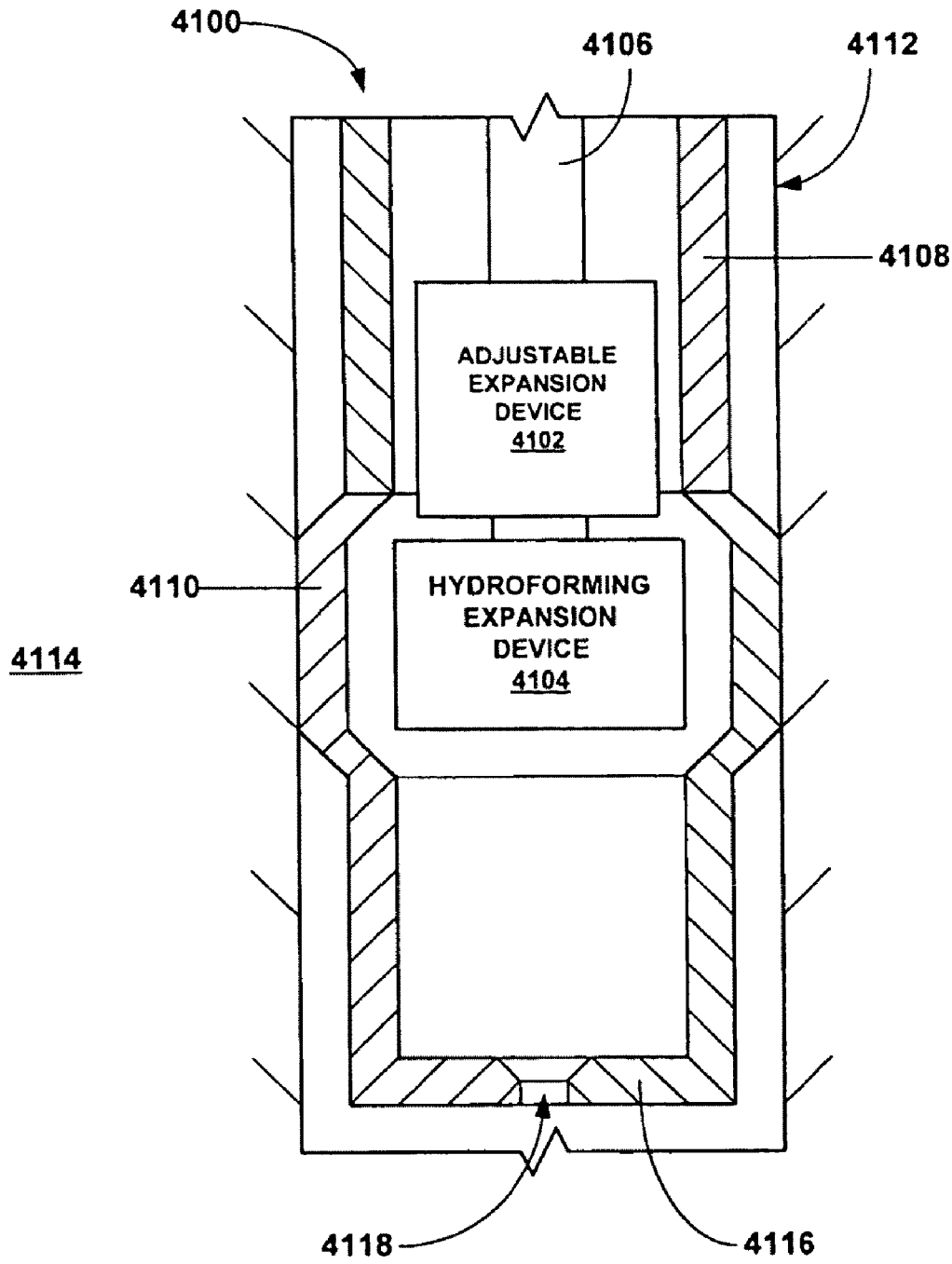
FIG. 41*d* is a fragmentary cross sectional illustration of the expandable tubular members of FIG. 41*c* after disengaging hydroforming expansion device from the lower most expandable tubular member.

In an exemplary embodiment, as illustrated in FIG. 41*d*, the hydroforming expansion device 4104 may then be disengaged from the second tubular member 4110.

Figure 41E:
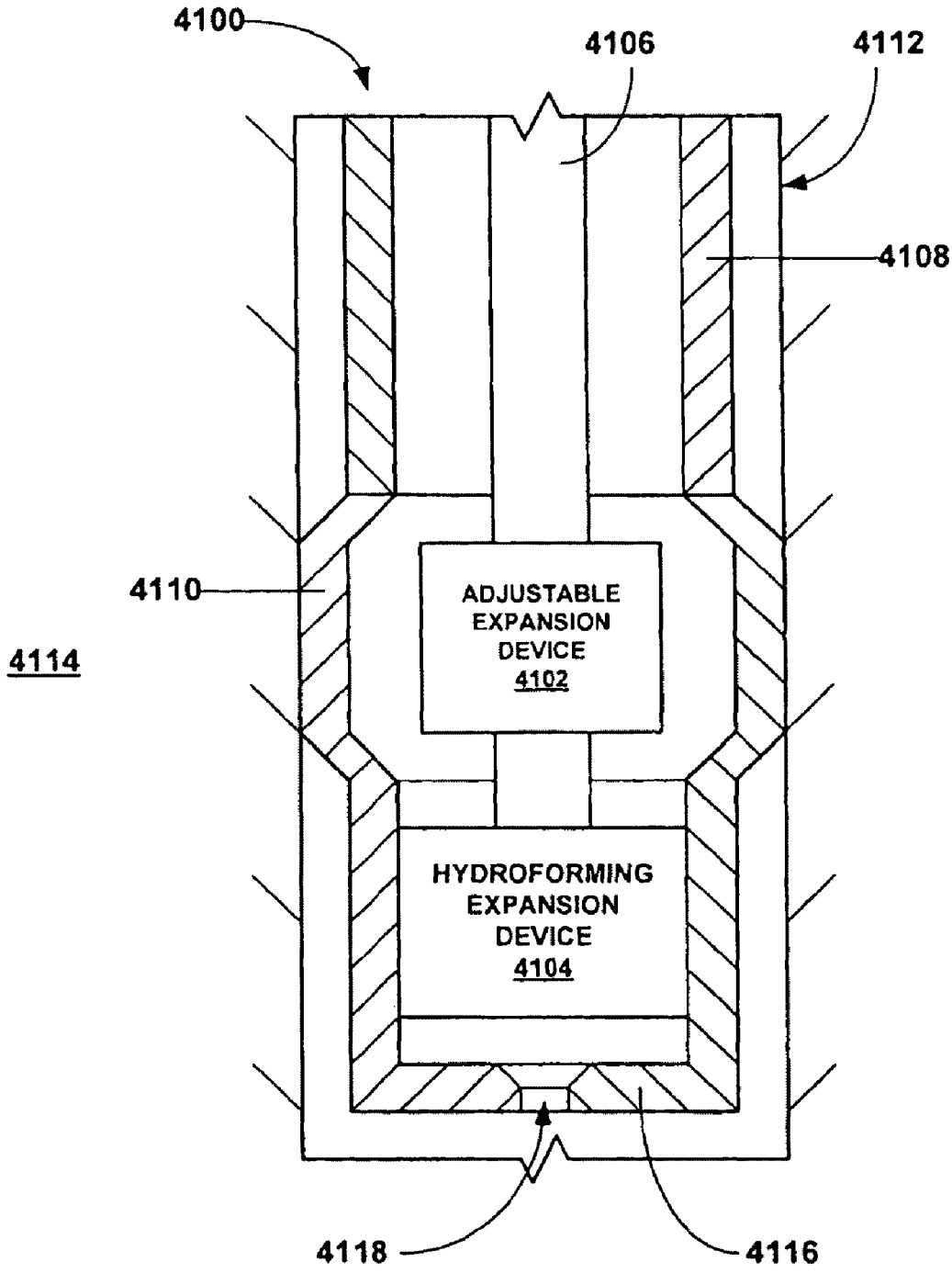
FIG. 41*e* is a fragmentary cross sectional illustration of the expandable tubular members of FIG. 41*d* after positioning the adjustable expansion device within the radially expanded and plastically deformed portion of the lower most expandable tubular member.
Figure 41F:
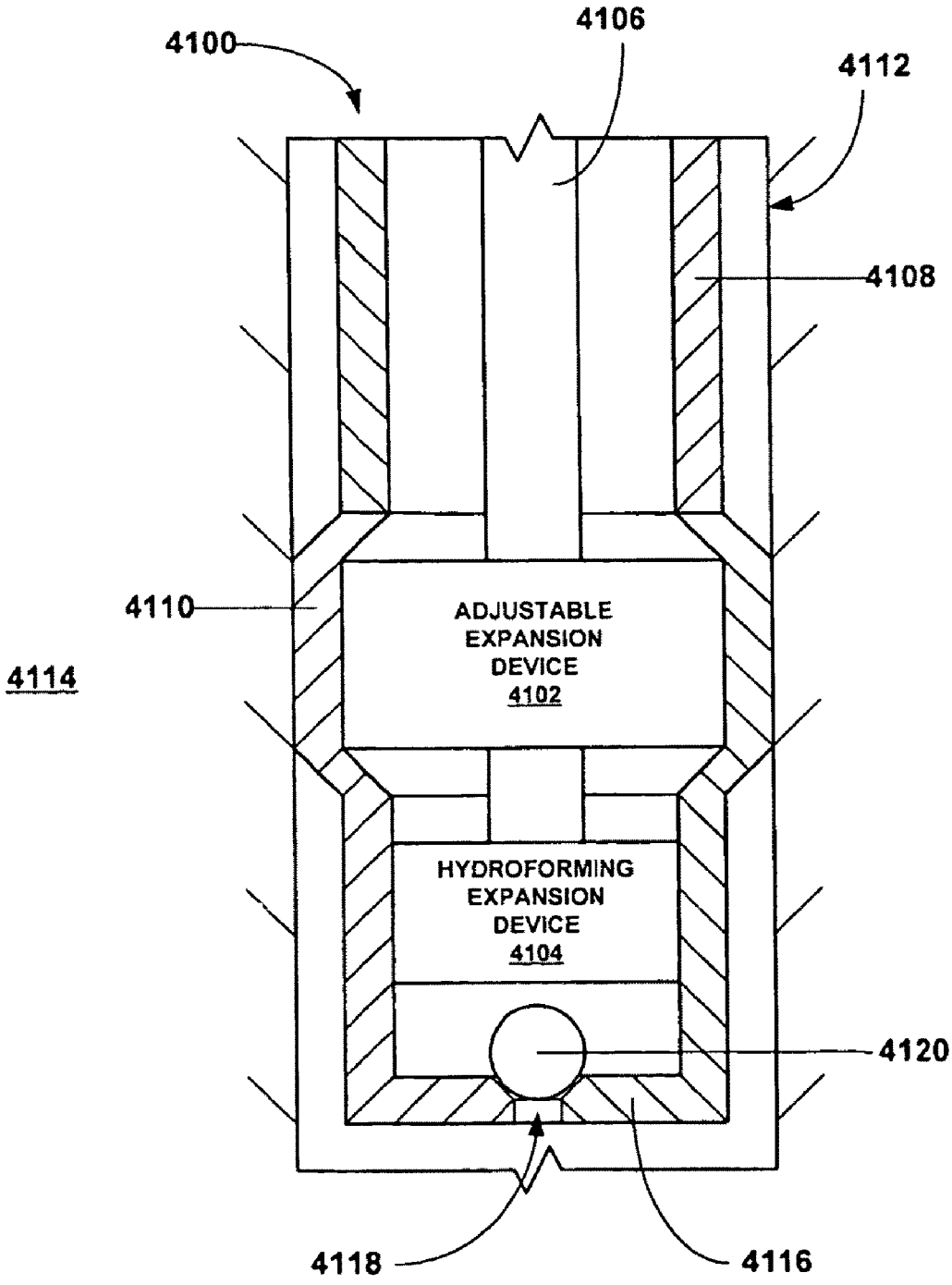
FIG. 41*f* is a fragmentary cross sectional illustration of the expandable tubular members of FIG. 41*e* after operating the adjustable expansion device to engage the radially expanded and plastically deformed portion of the lower most expandable tubular member.

In an exemplary embodiment, as illustrated in FIGS. 41*e* and 41*f*, the adjustable expansion device 4102 may then be positioned within the radially expanded portion of the second tubular member 4110 and the size the adjustable expansion device increased. The valveable passage 4118 of the shoe 4116 may then be closed, for example, by placing a ball 4120 within the passage in a conventional manner.

Figure 41G:
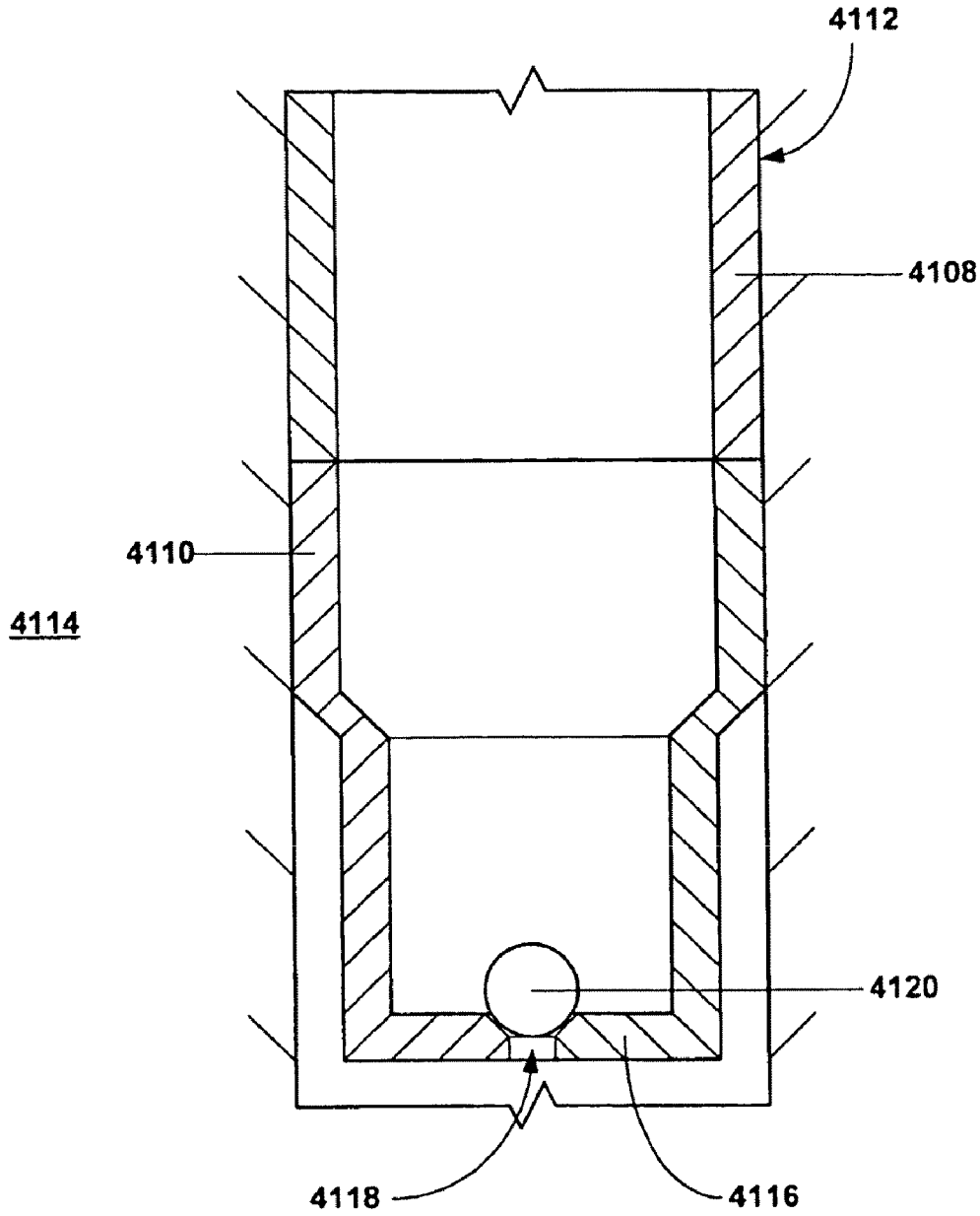
FIG. 41*g* is a fragmentary cross sectional illustration of the expandable tubular members of FIG. 41*f* after operating the adjustable expansion device to radially expand and plastically deform at least another portion of the expandable tubular members.

In an exemplary embodiment, as illustrated in FIG. 41*g*, the adjustable expansion device 4102 may then be operated to radially expand and plastically deform one or more portions of the first and second tubular members, 4108 and 4110, above the shoe 4116.

Figure 41H:
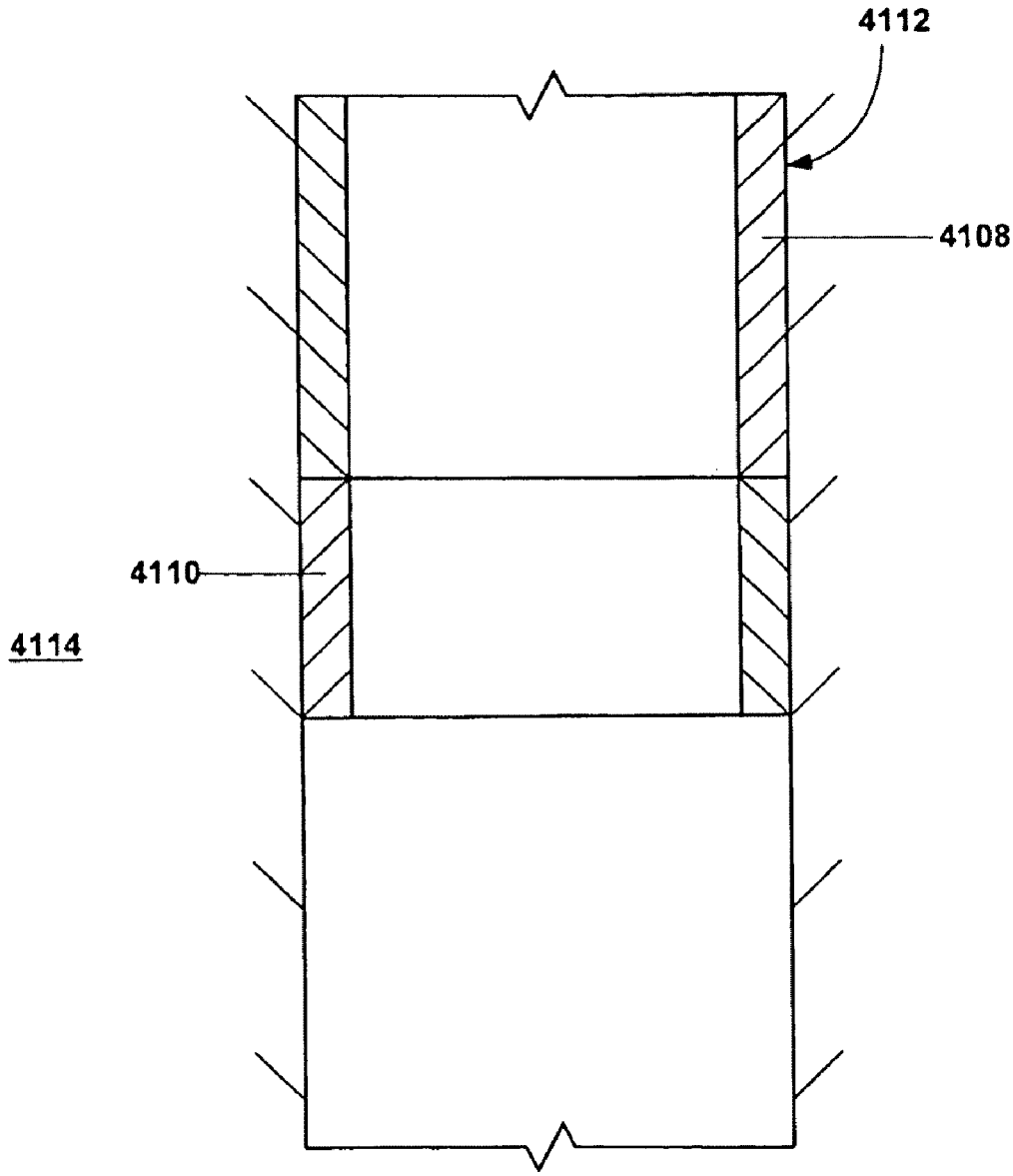
FIG. 41*h* is a fragmentary cross sectional illustration of the expandable tubular members of FIG. 41*g* after machining away the lower most portion of the lower most expandable tubular member.

In an exemplary embodiment, as illustrated in FIG. 41*h*, the expansion system 4100 may then be removed from the tubular assembly and the lower, radially unexpanded, portion of the second tubular member 4110 and the shoe 4116 may be machined away.

Referring to FIGS. 42*a*-42*e*, an exemplary embodiment of an expansion system 4200 includes a hydroforming expansion device 4202 that is coupled to a tubular support member 4204. An expandable tubular member 4206 is coupled to and supported by the hydroforming expansion device 4202.

In several exemplary embodiments, the hydroforming expansion device 4202 includes one or more elements of conventional hydroforming expansion devices and/or one or more elements of the hydroforming expansion devices disclosed in one or more of the related applications referenced above and/or one or more elements of the conventional commercially available hydroforming devices available from Baker Hughes, Weatherford International, Schlumberger, and/or Enventure Global Technology L.L.C. and/or one or more elements of the hydroforming expansion devices disclosed in U.S. Pat. No. 5,901,594, the disclosure of which is incorporated herein by reference.

In several exemplary embodiments, the expandable tubular member 4206 includes one or more of the characteristics of the expandable tubular members described in the present application.

Figure 42A:
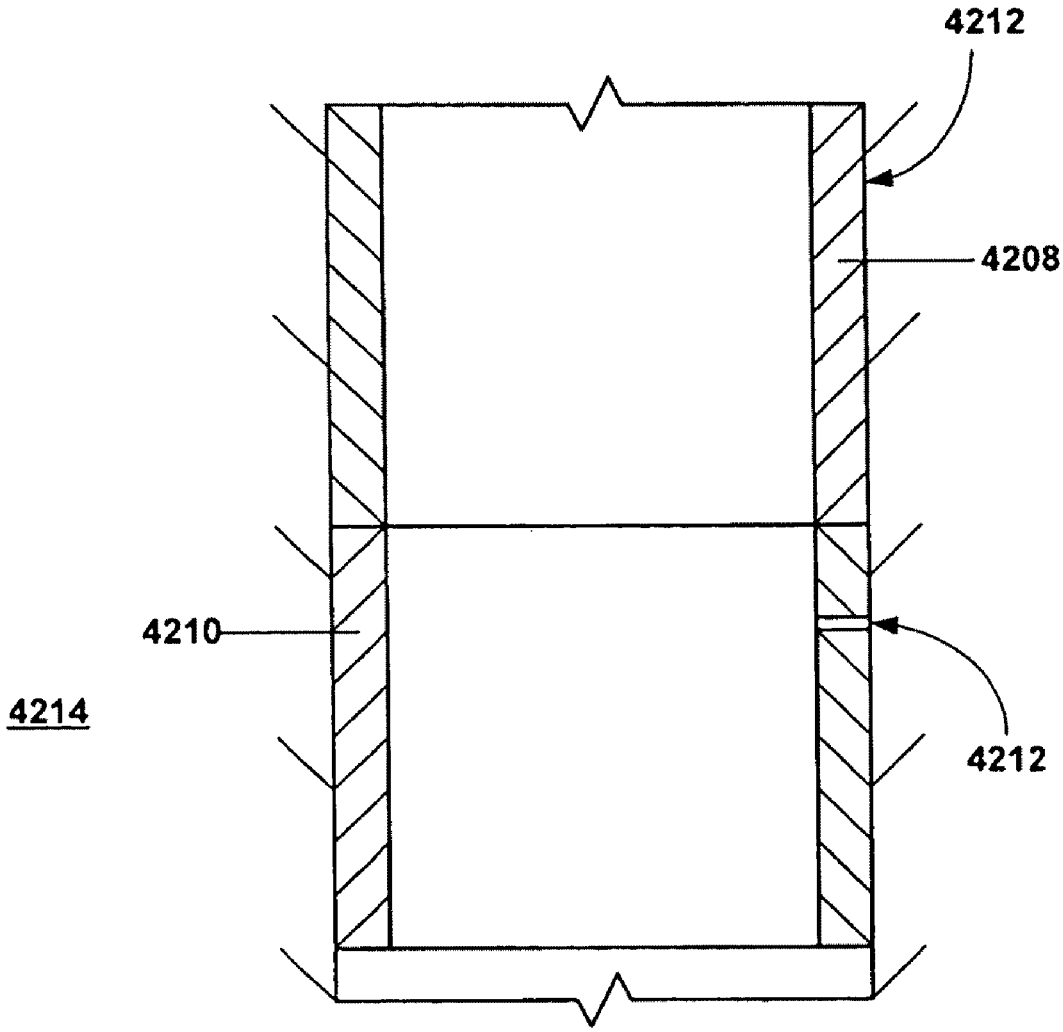
FIG. 42*a* is a fragmentary cross sectional illustration of an exemplary embodiment of tubular members positioned within a preexisting structure, wherein one of the tubular members includes one or more radial passages.
Figure 42B:
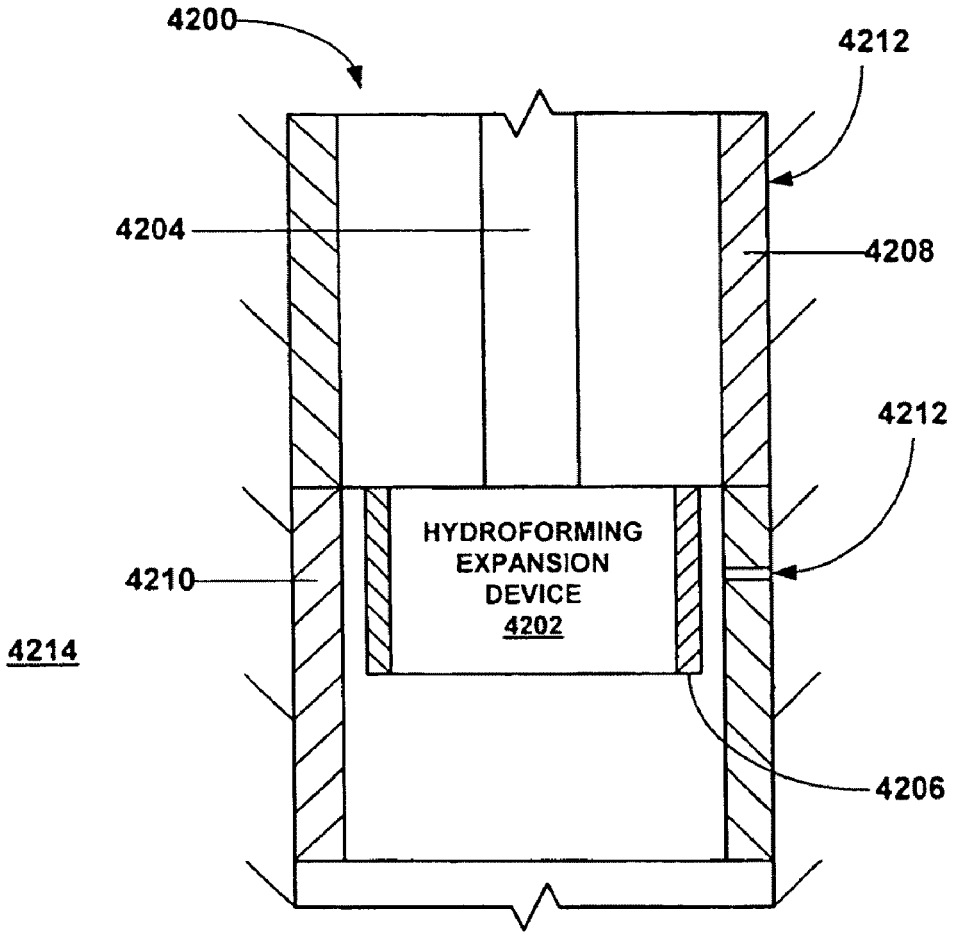
FIG. 42*b* is a fragmentary cross sectional illustration of the tubular members of FIG. 42*a* after placing a hydroforming casing patch device within the tubular member having the radial passages.

In an exemplary embodiment, during the operation of the expansion system 4200, as illustrated in FIGS. 42*a* and 42*b*, the expansion system is positioned within an expandable tubular assembly that includes first and second tubular members, 4208 and 4210, that are coupled end to end and positioned and supported within a preexisting structure such as, for example, a wellbore 4212 that traverses a subterranean formation 4214. In an exemplary embodiment, the second tubular member 4210 includes one or more radial passages 4212. In an exemplary embodiment, the expandable tubular member 4206 is positioned in opposing relation to the radial passages 4212 of the second tubular member 4210.

Figure 42C:
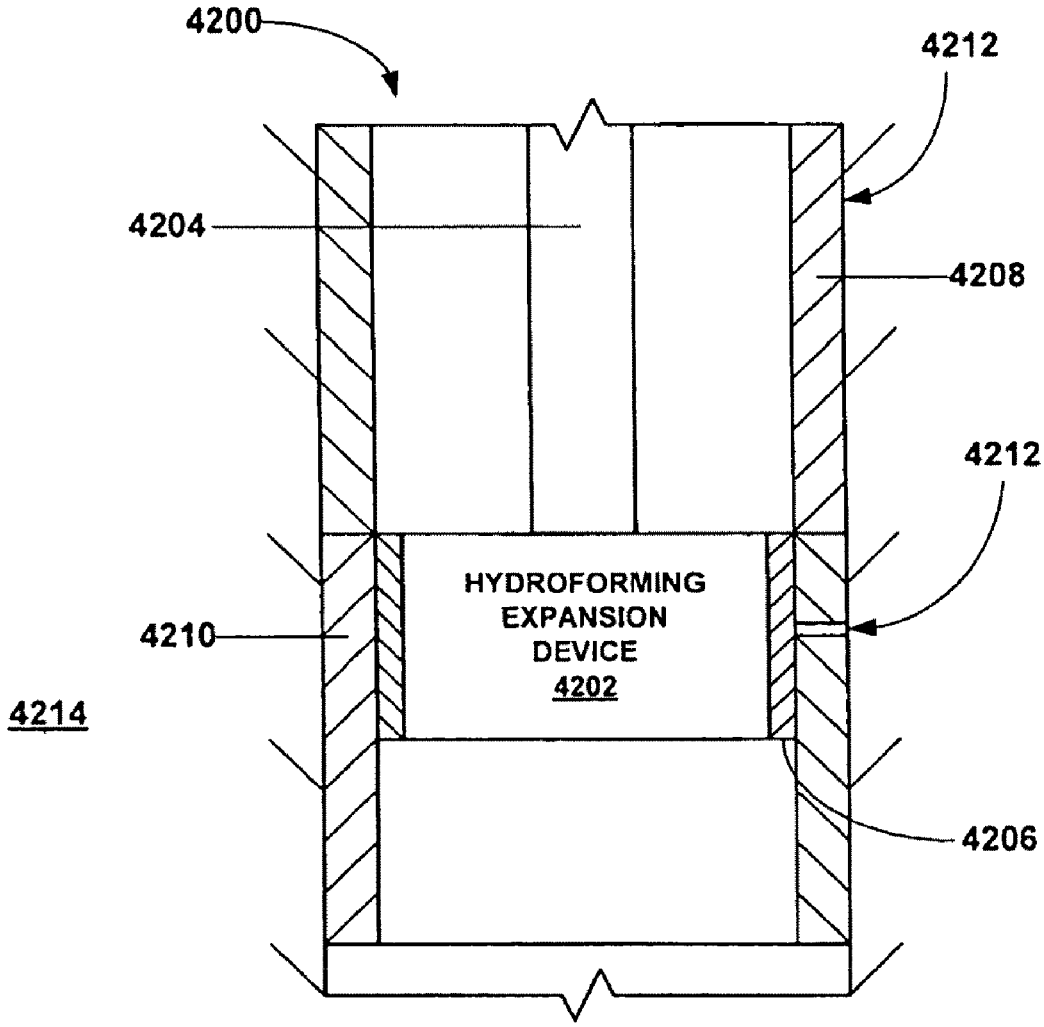
FIG. 42*c* is a fragmentary cross sectional illustration of the tubular members of FIG. 42*b* after operating the hydroforming expansion device to radially expand and plastically deform a tubular casing patch into engagement with the tubular member having the radial passages.

In an exemplary embodiment, as illustrated in FIG. 42*c*, the hydroforming expansion device 4202 may then be operated to radially expand and plastically deform the expandable tubular member 4206 into contact with the interior surface of the second tubular member 4210 thereby covering and sealing off the radial passages 4212 of the second tubular member.

Figure 42D:
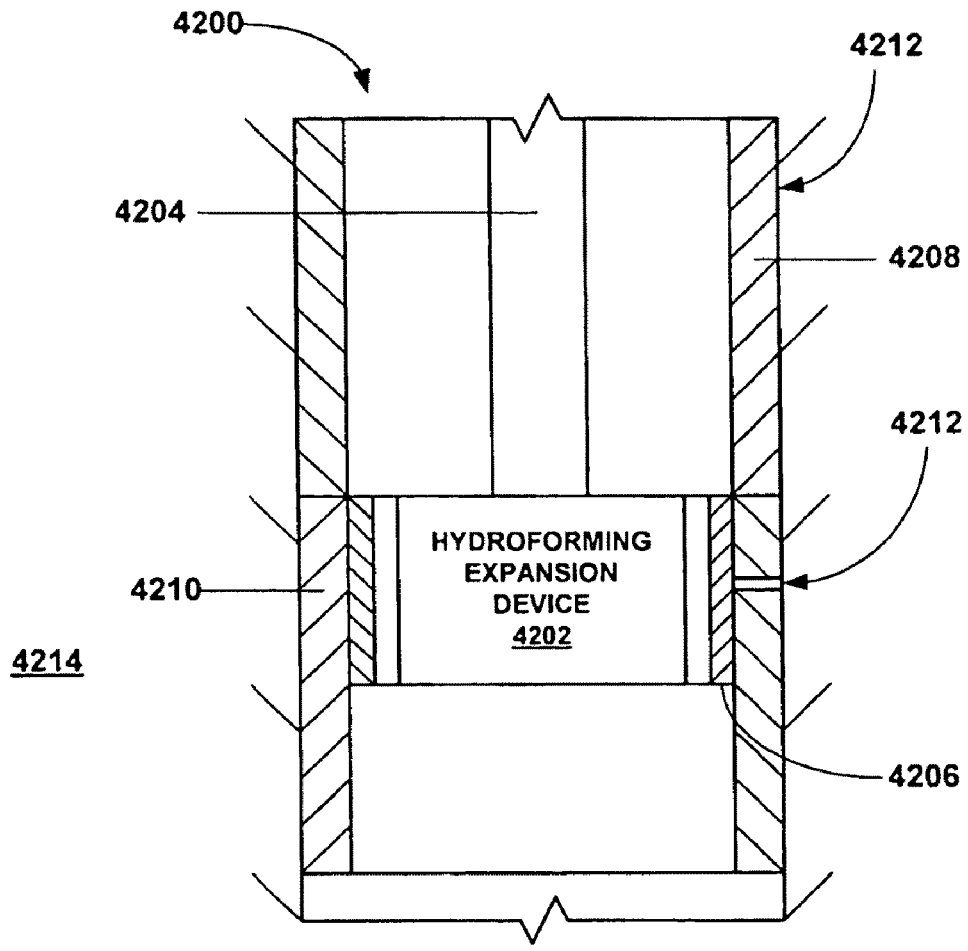
FIG. 42*d* is a fragmentary cross sectional illustration of the expandable tubular members of FIG. 41*c* after disengaging the hydroforming expansion device from the tubular member having the radial passages.

In an exemplary embodiment, as illustrated in FIG. 42*d*, the hydroforming expansion device 4202 may then be disengaged from the expandable tubular member 4206.

Figure 42E:
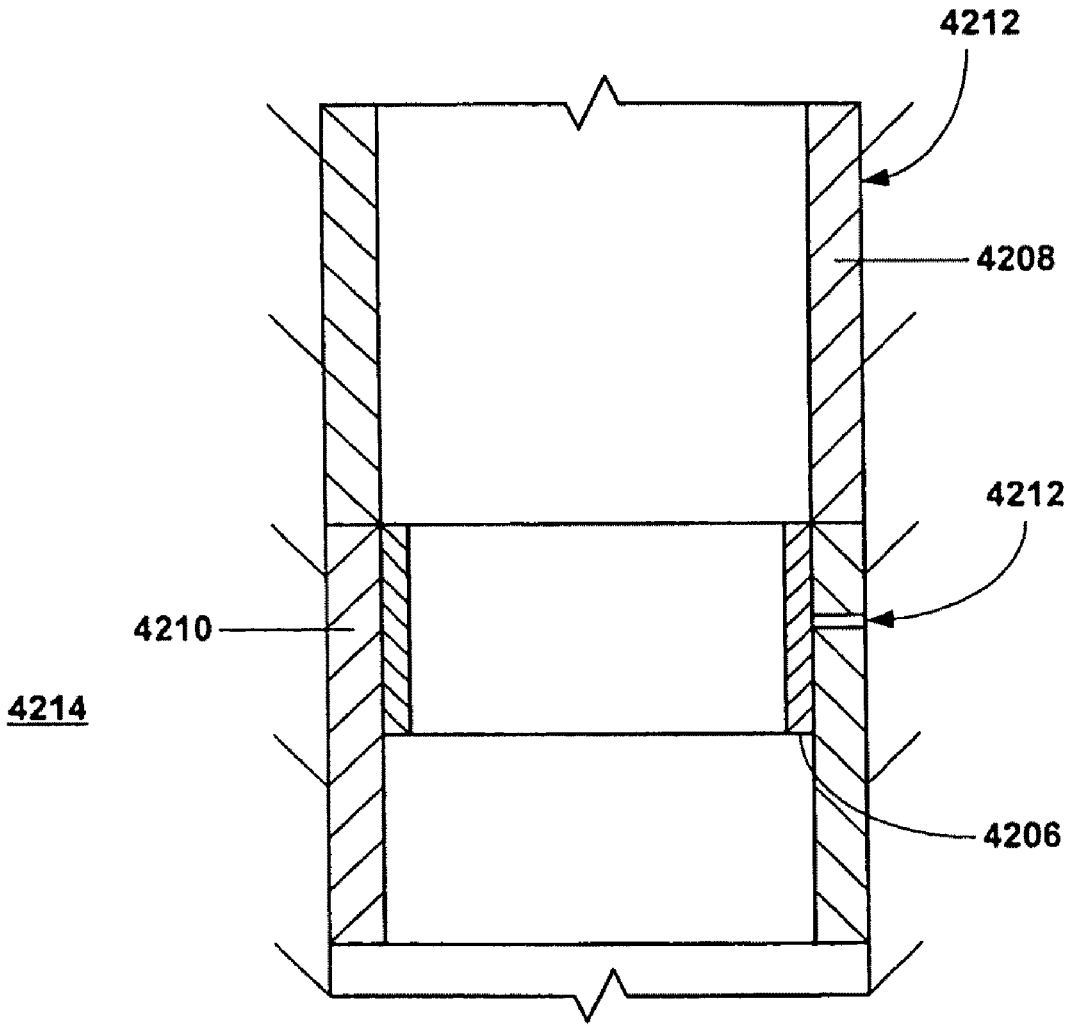
FIG. 42*e* is a fragmentary cross sectional illustration of the expandable tubular members of FIG. 41*d* after removing the hydroforming expansion device from the tubular member having the radial passages.

In an exemplary embodiment, as illustrated in FIG. 42*e*, the expansion system 4200 may then be removed from the wellbore 4212.

Figure 43:
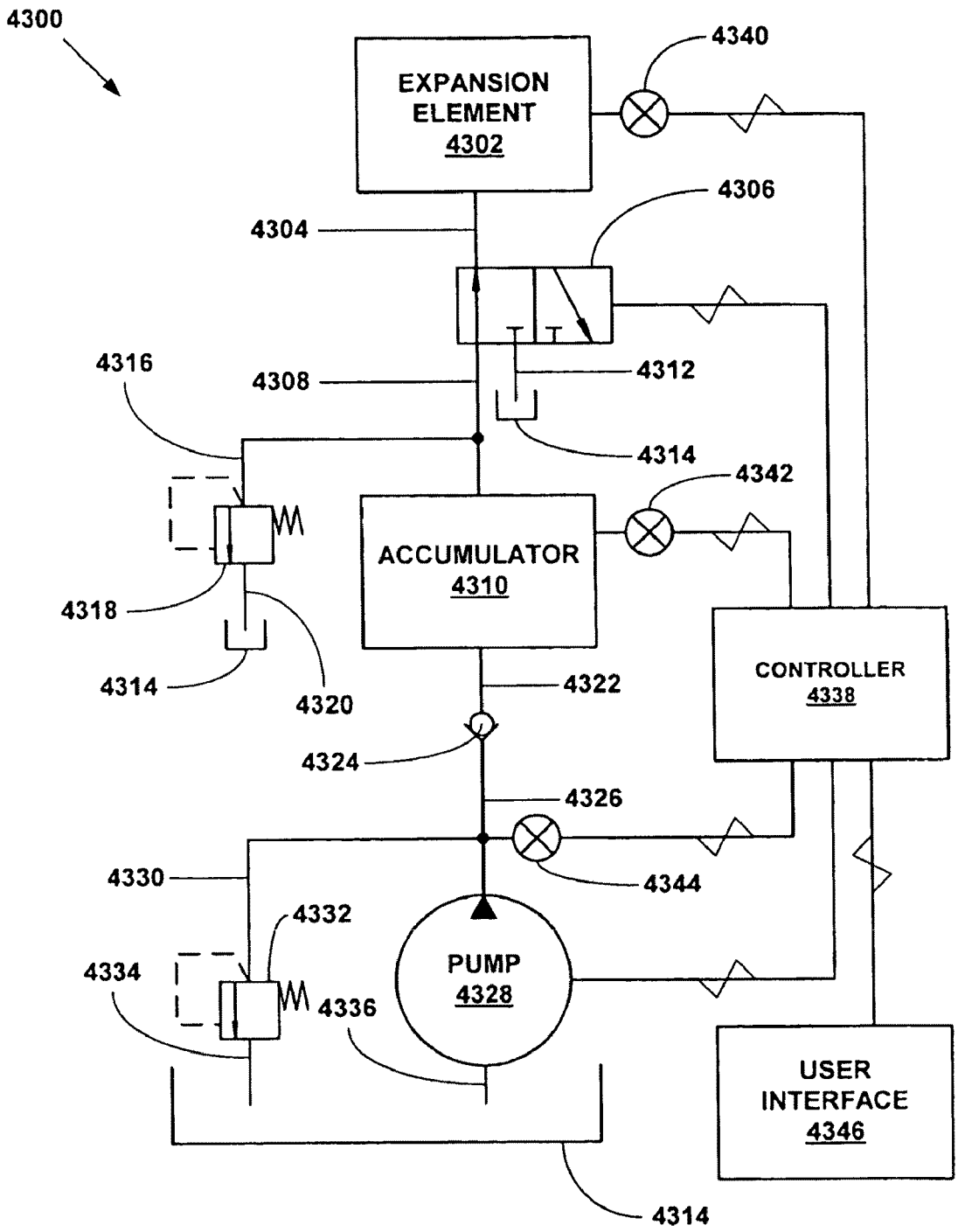
FIG. 43 is a schematic illustration of an exemplary embodiment of a hydroforming expansion device.

Referring to FIG. 43, an exemplary embodiment of a hydroforming expansion system 4300 includes an expansion element 4302 that is provided substantially as disclosed in U.S. Pat. No. 5,901,594, the disclosure of which is incorporated herein by reference.

A flow line 4304 is coupled to the inlet of the expansion element 4302 and the outlet of conventional 2-way/2-position flow control valve 4306. A flow line 4308 is coupled to an inlet of the flow control valve 4306 and an outlet of a conventional accumulator 4310, and a flow line 4312 is coupled to another inlet of the flow control valve and a fluid reservoir 4314.

A flow line 4316 is coupled to the flow line 4308 and an the inlet of a conventional pressure relief valve 4318, and a flow line 4320 is coupled to the outlet of the pressure relief valve and the fluid reservoir 4314. A flow line 4322 is coupled to the inlet of the accumulator 4310 and the outlet of a conventional check valve 4324.

A flow line 4326 is coupled to the inlet of the check valve 4324 and the outlet of a conventional pump 4328. A flow line 4330 is coupled to the flow line 4326 and the inlet of a conventional pressure relief valve 4332.

A flow line 4334 is coupled to the outlet of the pressure relief valve 4332 and the fluid reservoir 4314, and a flow line 4336 is coupled to the inlet of the pump 4328 and the fluid reservoir.

A controller 4338 is operably coupled to the flow control valve 4306 and the pump 4328 for controlling the operation of the flow control valve and the pump. In an exemplary embodiment, the controller 4338 is a programmable general purpose controller. Conventional pressure sensors, 4340, 4342 and 4344, are operably coupled to the expansion element 4302, the accumulator 4310, and the flow line 4326, respectively, and the controller 4338. A conventional user interface 4346 is operably coupled to the controller 4338.

Figure 44A:
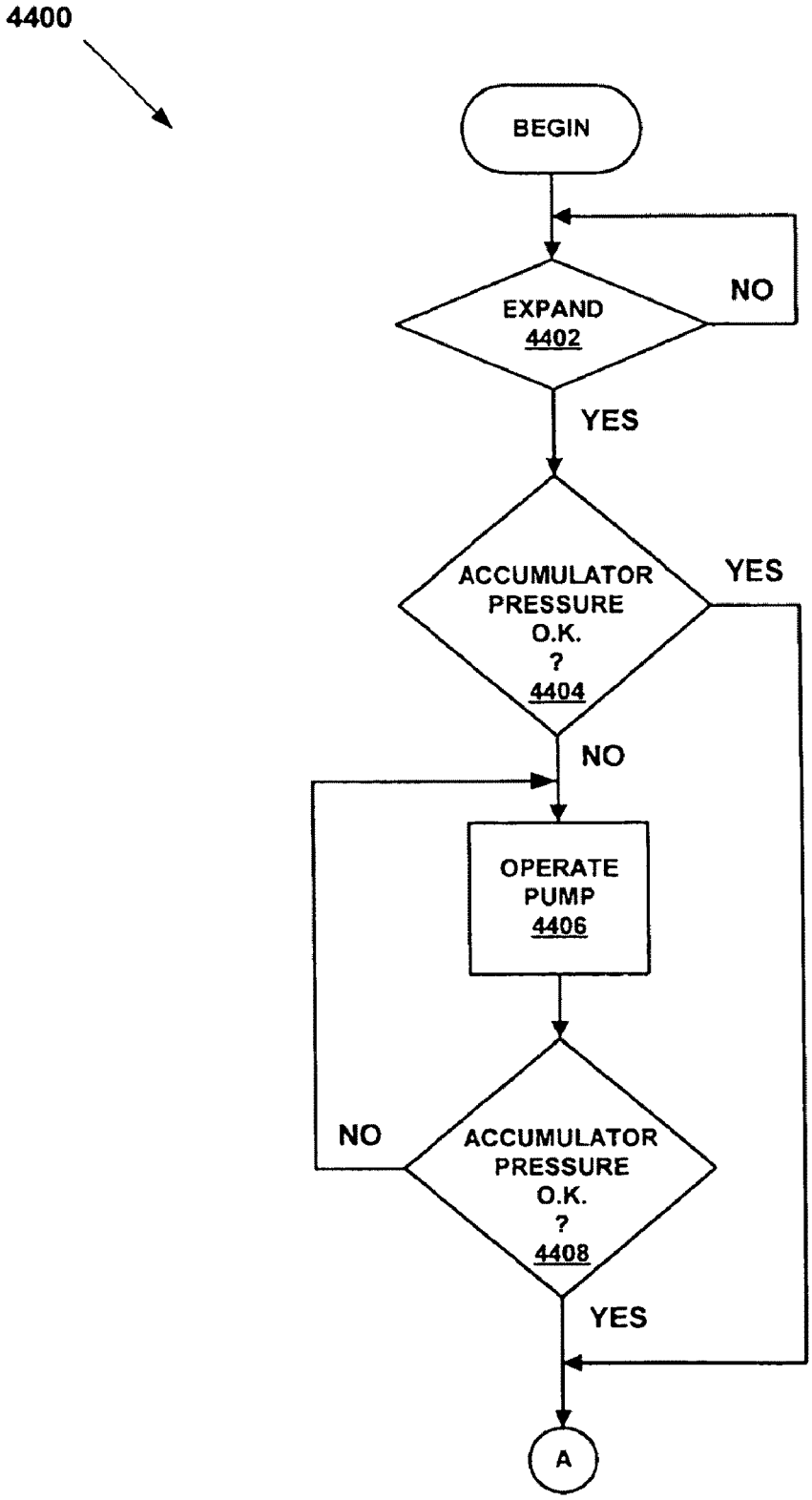
FIGS. 44*a*-44*b* are flow chart illustrations of an exemplary method of operating the hydroforming expansion device of FIG. 43.
Figure 44B:
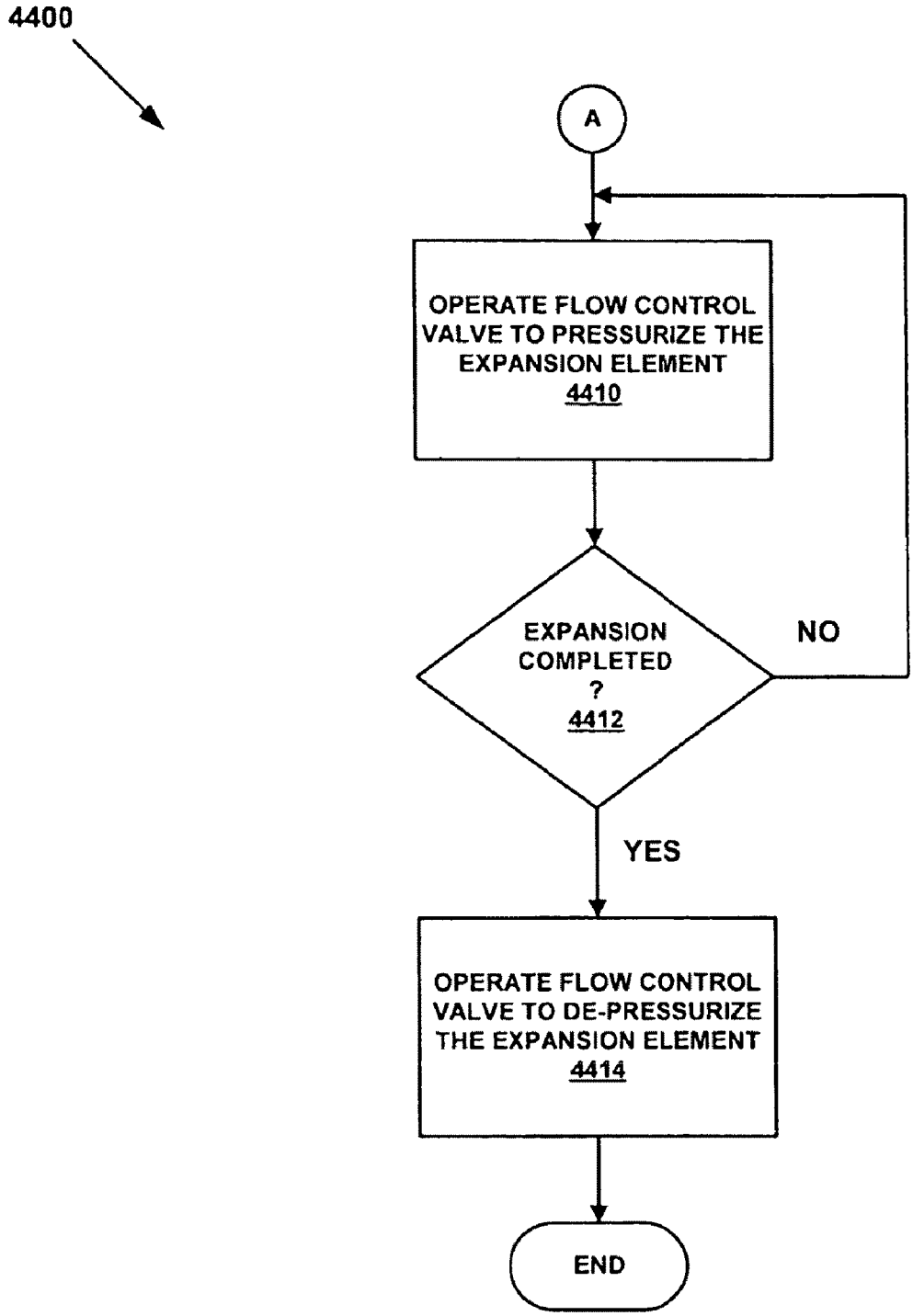

During operation of the hydroforming expansion system 4300, as illustrated in FIGS. 44*a*-44*b*, the system implements a method of operation 4400 in which, in step 4402, the user may select expansion of an expandable tubular member. If the user selects expansion in step 4402, then the controller 4338 determines if the operating pressure of the accumulator 4310, as sensed by the pressure sensor 4342, is greater than or equal to a predetermined value in step 4404.

If the operating pressure of the accumulator 4310, as sensed by the pressure sensor 4342, is not greater than or equal to the predetermined value in step 4404, then the controller 4338 operates the pump 4328 to increase the operating pressure of the accumulator in step 4406. The controller 4338 then determines if the operating pressure of the accumulator 4310, as sensed by the pressure sensor 4342, is greater than or equal to a predetermined value in step 4408. If the operating pressure of the accumulator 4310, as sensed by the pressure sensor 4342, in step 4408, is not greater than or equal to the predetermined value, then the controller 4338 continues to operate the pump 4328 to increase the operating pressure of the accumulator in step 4406.

If the operating pressure of the accumulator 4310, as sensed by the pressure sensor 4342, in steps 4404 or 4408, is greater than or equal to the predetermined value, then the controller 4338 operates the flow control valve 4306 to pressurize the expansion element 4302 in step 4410 by positioning the flow control valve to couple the flow lines 4304 and 4308 to one another. If the expansion operation has been completed in step 4412, then the controller 4338 operates the flow control valve 4306 to de-pressurize the expansion element 4302 in step 4414 by positioning the flow control valve to couple the flow lines 4304 and 4312 to one another.

In several exemplary embodiments, one or more of the hydroforming expansion devices 4002, 4104, and 4202, incorporate one or more elements of the hydroforming expansion system 4300 and/or the operational steps of the method 4400.

Figure 45A:
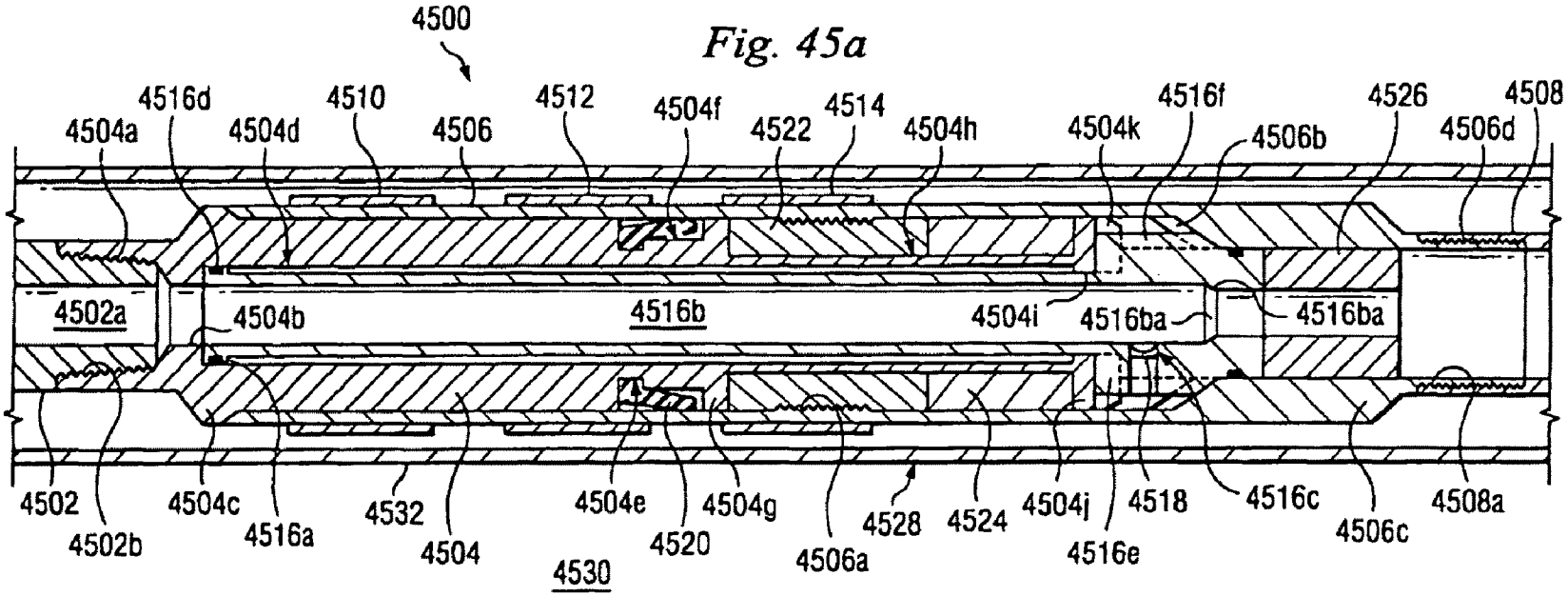
FIG. 45*a* is a fragmentary cross sectional illustration of an exemplary embodiment of a radial expansion system positioned within a cased section of a wellbore.

Referring to FIG. 45*a*, an exemplary embodiment of a liner hanger system 4500 includes a tubular support member 4502 that defines a passage 4502*a* and includes an externally threaded connection 4502*b* at an end. An internally threaded connection 4504*a* of an end of an outer tubular mandrel 4504 that defines a passage 4504*b*, and includes an external flange 4504*c*, an internal annular recess 4504*d*, an external annular recess 4504*e*, an external annular recess 4504*f*, an external flange 4504*g*, an external annular recess 4504*h*, an internal flange 4504*i*, an external flange 4504*j*, and a plurality of circumferentially spaced apart longitudinally aligned teeth 4504*k* at another end, is coupled to and receives the externally threaded connection 4502*b* of the end of the tubular support member 4502.

An end of a tubular liner hanger 4506 that abuts and mates with an end face of the external flange 4504*c* of the outer tubular mandrel 4504 receives and mates with the outer tubular mandrel, and includes internal teeth 4506*a*, a plurality of circumferentially spaced apart longitudinally aligned internal teeth 4506*b*, an internal flange 4506*c*, and an external threaded connection 4506*d* at another end. In an exemplary embodiment, at least a portion of the tubular liner hanger 4506 includes one or more of the characteristics of the expandable tubular members described in the present application.

An internal threaded connection 4508*a* of an end of a tubular liner 4508 receives and is coupled to the external threaded connection 4506*d* of the tubular liner hanger 4506. Spaced apart elastomeric sealing elements, 4510, 4512, and 4514, are coupled to the exterior surface of the end of the tubular liner hanger 4506

An external flange 4516*a* of an end of an inner tubular mandrel 4516 that defines a longitudinal passage 4516*b* having a throat 4516*ba* and a radial passage 4516*c* and includes a sealing member 4516*d* mounted upon the external flange for sealingly engaging the inner annular recess 4504*d* of the outer tubular mandrel 4504, an external flange 4516*e* at another end that includes a plurality of circumferentially spaced apart teeth 4516*f* that mate with and engage the teeth, 4504*k* and 4506*b*, of the outer tubular mandrel 4504 and the tubular liner hanger 4506, respectively, for transmitting torsional loads therebetween, and another end that is received within and mates with the internal flange 4506*c* of the tubular liner hanger 4506 mates with and is received within the inner annular recess 4504*d* of the outer tubular mandrel 4504. A conventional rupture disc 4518 is received within and coupled to the radial passage 4516*c* of the inner tubular mandrel 4516.

A conventional packer cup 4520 is mounted within and coupled to the external annular recess 4504*e* of the outer tubular mandrel 4504 for sealingly engaging the interior surface of the tubular liner hanger 4506. A locking assembly 4522 is mounted upon and coupled to the outer tubular mandrel 4504 proximate the external flange 4504*g* in opposing relation to the internal teeth 4506*a* of the tubular liner hanger 4506 for controllably engaging and locking the position of the tubular liner hanger relative to the outer tubular mandrel 4504. In several exemplary embodiments, the locking assembly 4522 may be a conventional locking device for locking the position of a tubular member relative to another member. In several alternative embodiments, the locking assembly 4522 may include one or more elements of the locking assemblies disclosed in one or more of the following: (1) PCT patent application serial number PCT/US02/36157, filed on Nov. 12, 2002, (2) PCT patent application serial number PCT/US02/36267, filed on Nov. 12, 2002, (3) PCT patent application serial number PCT/US03/04837, filed on Feb. 29, 2003, (4) PCT patent application serial number PCT/US03/29859, filed on Sep. 22, 2003, (5) PCT patent application serial number PCT/US03/14153, filed on Nov. 13, 2003, (6) PCT patent application serial number PCT/US03/18530, filed on Jun. 11, 2003, (7) PCT patent application serial number PCT/US03/29858, (8) PCT patent application serial number PCT/US03/29460, filed on Sep. 23, 2003, filed on Sep. 22, 2003, (9) PCT patent application serial number PCT/US04/07711, filed on Mar. 11, 2004, (10) PCT patent application serial number PCT/US2004/009434, filed on Mar. 26, 2004, (11) PCT patent application serial number PCT/US2004/010317, filed on Apr. 2, 2004, (12) PCT patent application serial number PCT/US2004/010712, filed on Apr. 7, 2004, (13) PCT patent application serial number PCT/US2004/010762, filed on Apr. 6, 2004, and/or (14) PCT patent application serial number PCT/US2004/011973, filed on Apr. 15, 2004, the disclosures of which are incorporated herein by reference.

An adjustable expansion device assembly 4524 is mounted upon and coupled to the outer tubular mandrel 4504 between the locking assembly 4522 and the external flange 4504*j* for controllably radially expanding and plastically deforming the tubular liner hanger 4506. In several exemplary embodiments, the adjustable expansion device assembly 4524 may be a conventional adjustable expansion device assembly for radially expanding and plastically deforming tubular members that may include one or more elements of conventional adjustable expansion cones, mandrels, rotary expansion devices, hydroforming expansion devices and/or one or more elements of the one or more of the commercially available adjustable expansion devices of Enventure Global Technology LLC, Baker Hughes, Weatherford International, and/or Schlumberger and/or one or more elements of the adjustable expansion devices disclosed in one or more of the published patent applications and/or issued patents of Enventure Global Technology LLC, Baker Hughes, Weatherford International, Shell Oil Co. and/or Schlumberger. In several alternative embodiments, the adjustable expansion device assembly 4524 may include one or more elements of the adjustable expansion device assemblies disclosed in one or more of the following: (1) PCT patent application serial number PCT/US02136157, filed on Nov. 12, 2002, (2) PCT patent application serial number PCT/US02/36267, filed on Nov. 12, 2002, (3) PCT patent application serial number PCT/US03/04837, filed on Feb. 29, 2003, (4) PCT patent application serial number PCT/US03/29859, filed on Sep. 22, 2003, (5) PCT patent application serial number PCT/US03/14153, filed on Nov. 13, 2003, (6) PCT patent application serial number PCT/US03/18530, filed on Jun. 11, 2003, (7) PCT patent application serial number PCT/US03/29858, (8) PCT patent application serial number PCT/US03/29460, filed on Sep. 23, 2003, filed on Sep. 22, 2003, (9) PCT patent application serial number PCT/US04/07711, filed on Mar. 11, 2004, (10) PCT patent application serial number PCT/US2004/009434, filed on Mar. 26, 2004, (11) PCT patent application serial number PCT/US2004/010317, filed on Apr. 2, 2004, (12) PCT patent application serial number PCT/US2004/010712, filed on Apr. 7, 2004, (13) PCT patent application serial number PCT/US2004/010762, filed on Apr. 6, 2004, and/or (14) PCT patent application serial number PCT/US2004/011973, filed on Apr. 15, 2004, the disclosures of which are incorporated herein by reference.

A conventional SSR plug set 4526 is mounted within and coupled to the internal flange 4506*c* of the tubular liner hanger 4506.

In an exemplary embodiment, during operation of the system 4500, as illustrated in FIG. 45*a*, the system is positioned within a wellbore 4528 that traverses a subterranean formation 4530 and includes a preexisting wellbore casing 4532 coupled to and positioned within the wellbore. In an exemplary embodiment, the system 4500 is positioned such that the tubular liner hanger 4506 overlaps with the casing 4532.

Figure 45B:
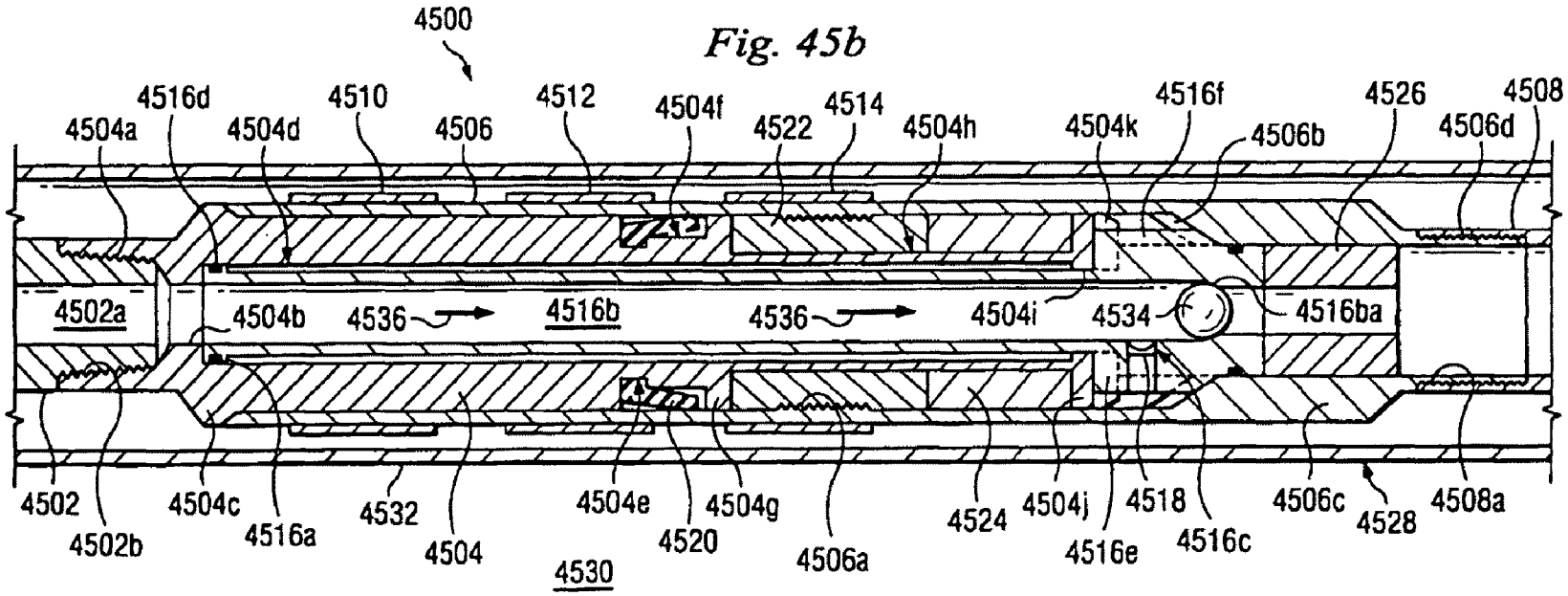
FIG. 45*b* is a fragmentary cross sectional illustration of the system of FIG. 45*a* following the placement of a ball within the throat passage of the system.

Referring to FIG. 45*b*, in an exemplary embodiment, a ball 4534 is then positioned in the throat passage 4516*ba* by injecting fluidic materials 4536 into the system 4500 through the passages 4502*a*, 4504*b*, and 4516*b*, of the tubular support member 4502, outer tubular mandrel 4504, and inner tubular mandrel 4516, respectively.

Figure 45C:
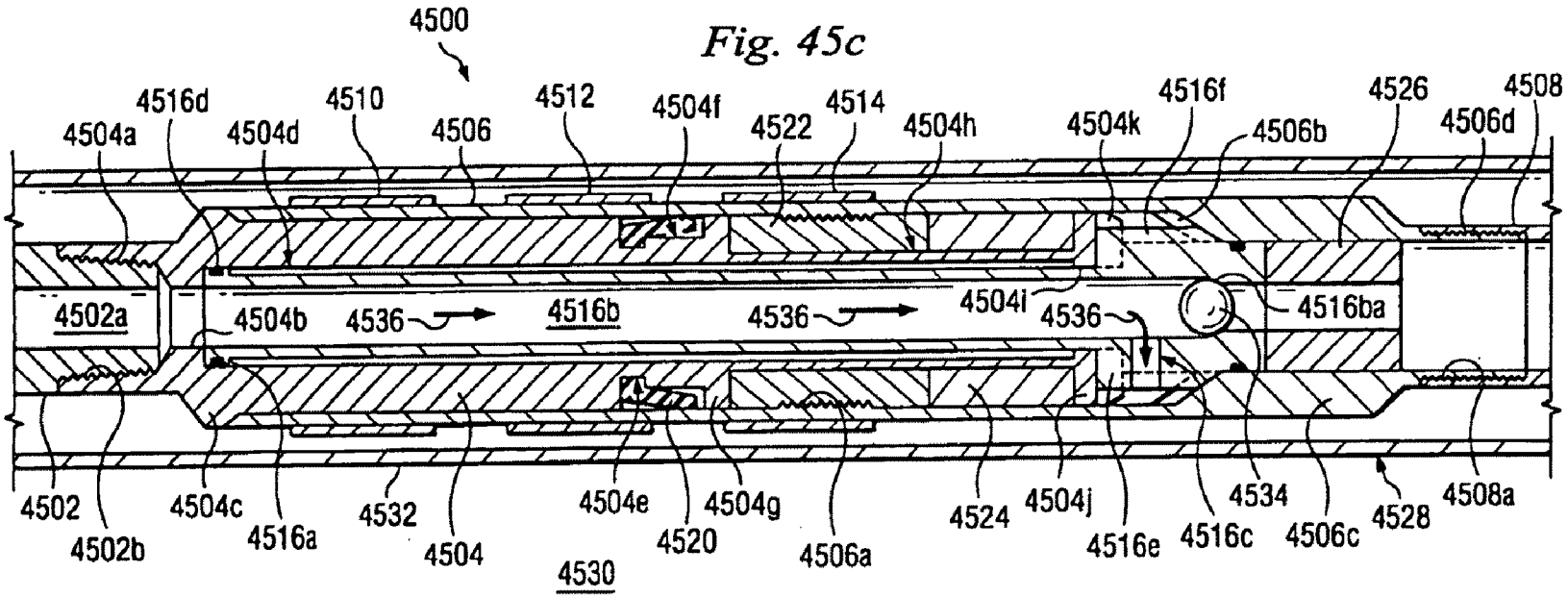
FIG. 45*c* is a fragmentary cross sectional illustration of the system of FIG. 45*b* during the injection of fluidic materials to burst the burst disc of the system.

Referring to FIG. 45*c*, in an exemplary embodiment, the continued injection of the fluidic materials 4536 into the system 4500, following the placement of the ball 4534 in the throat passage 4516*ba*, pressurizes the passage 4516*b* of the inner tubular mandrel 4516 such that the rupture disc 4518 is ruptured thereby permitting the fluidic materials to pass through the radial passage 4516*c* of the inner tubular mandrel. As a result, the interior of the tubular liner hanger 4506 is pressurized.

Figure 45D:
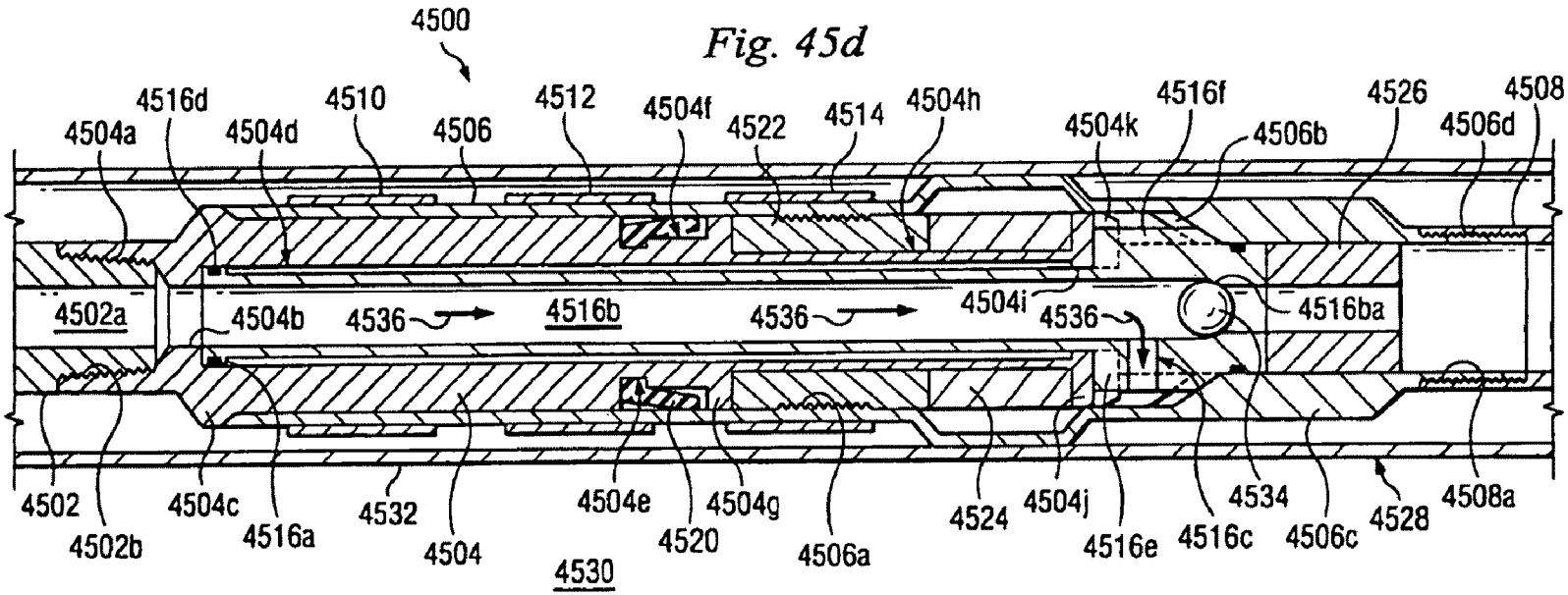
FIG. 45*d* is a fragmentary cross sectional illustration of the system of FIG. 45*c* during the continued injection of fluidic materials to radially expand and plastically deform at least a portion of the tubular liner hanger.

Referring to FIG. 45*d*, in an exemplary embodiment, the continued injection of the fluidic materials 4536 into the interior of the tubular liner hanger 4506 radially expands and plastically deforms at least a portion of the tubular liner hanger. In an exemplary embodiment, the continued injection of the fluidic materials 4536 into the interior of the tubular liner hanger 4506 radially expands and plastically deforms a portion of the tubular liner hanger positioned in opposition to the adjustable expansion device assembly 4524. In an exemplary embodiment, the continued injection of the fluidic materials 4536 into the interior of the tubular liner hanger 4506 radially expands and plastically deforms a portion of the tubular liner hanger positioned in opposition to the adjustable expansion device assembly 4524 into engagement with the wellbore casing 4532.

Figure 45E:
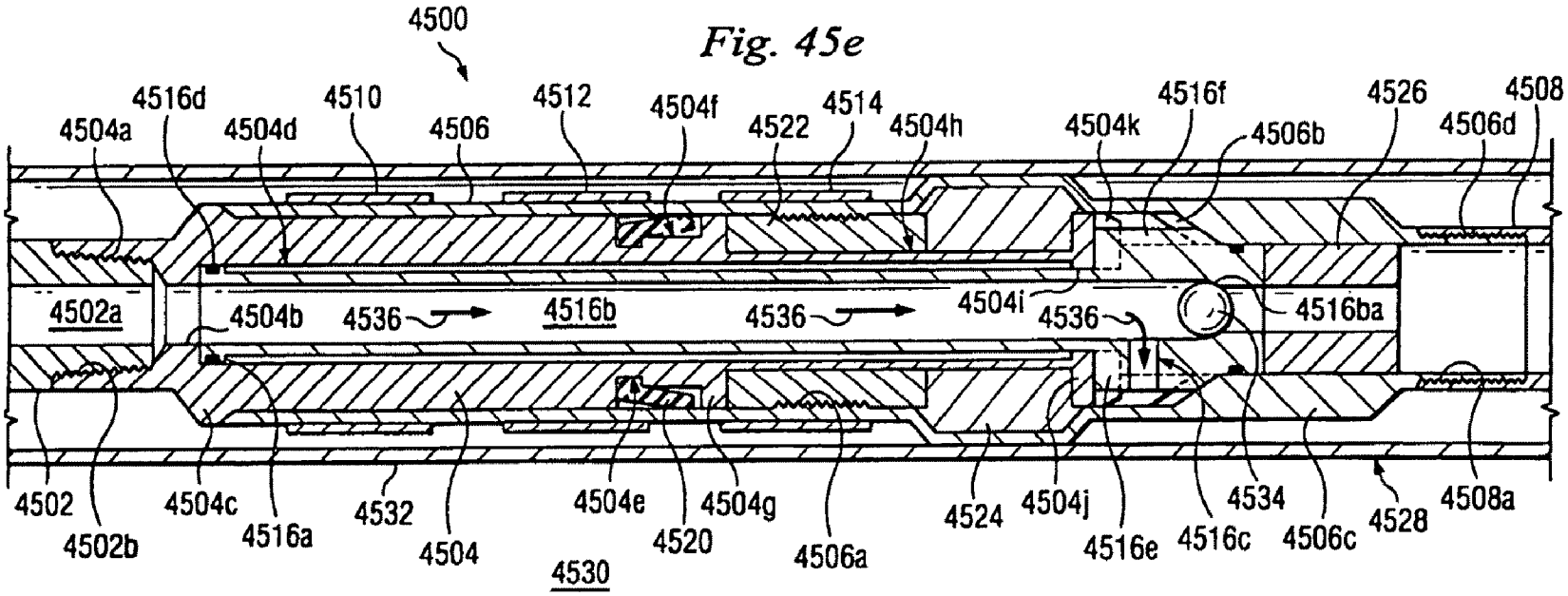
FIG. 45*e* is a fragmentary cross sectional illustration of the system of FIG. 45*d* during the continued injection of fluidic materials to adjust the size of the adjustable expansion device assembly.

Referring to FIG. 45*e*, in an exemplary embodiment, the size of the adjustable expansion device assembly 4524 is then increased within the radially expanded portion of the tubular liner hanger 4506, and the locking assembly 4522 is operated to unlock the tubular liner hanger from engagement with the locking assembly. In an exemplary embodiment, the locking assembly 4522 and the adjustable expansion device assembly 4524 are operated using the operating pressure provided by the continued injection of the fluidic materials 4536 into the system 4500. In an exemplary embodiment, the adjustment of the adjustable expansion device assembly 4524 to a larger size radially expands and plastically deforms at least a portion of the tubular liner hanger 4506.

Figure 45F:
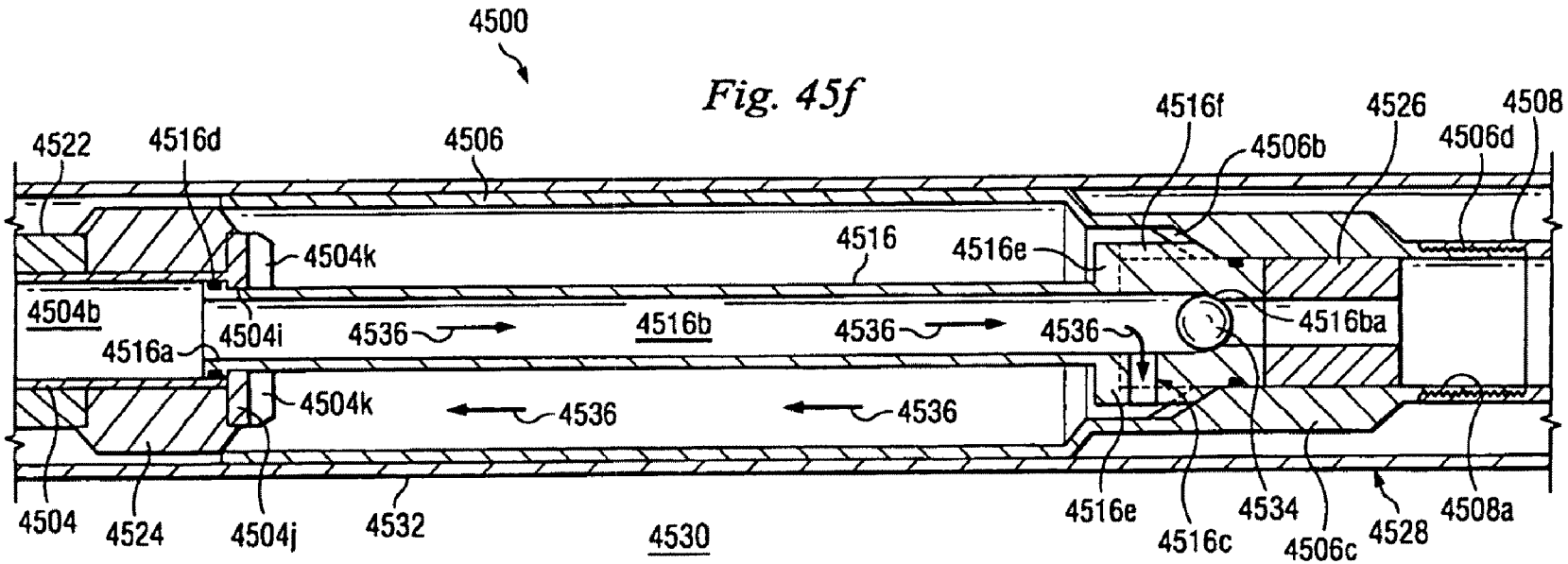
FIG. 45*f* is a fragmentary cross sectional illustration of the system of FIG. 45*e* during the displacement of the adjustable expansion device assembly to radially expand another portion of the tubular liner hanger.

Referring to FIG. 45*f*, in an exemplary embodiment, the adjustable expansion device assembly 4524 is displaced in a longitudinal direction relative to the tubular liner hanger 4506 thereby radially expanding and plastically deforming the tubular liner hanger. In an exemplary embodiment, the tubular liner hanger 4506 is radially expanded and plastically deformed into engagement with the casing 4532. In an exemplary embodiment, the adjustable expansion device assembly 4524 is displaced in a longitudinal direction relative to the tubular liner hanger 4506 due to the operating pressure within the tubular liner hanger generated by the continued injection of the fluidic materials 4536. In an exemplary embodiment, the adjustable expansion device assembly 4524 is displaced in a longitudinal direction relative to the tubular liner hanger 4506 due to the operating pressure within the tubular liner hanger below the packer cup 4520 generated by the continued injection of the fluidic materials 4536. In this manner, the adjustable expansion device assembly 4524 is pulled through the tubular liner hanger 4506 by the operation of the packer cup 4520. In an exemplary embodiment, the adjustable expansion device assembly 4524 is displaced in a longitudinal direction relative to the tubular liner hanger 4506 thereby radially expanding and plastically deforming the tubular liner hanger until the internal flange 4504*i* of the outer tubular mandrel 4504 engages the external flange 4516*a* of the end of the inner tubular mandrel 4516.

Figure 45G:
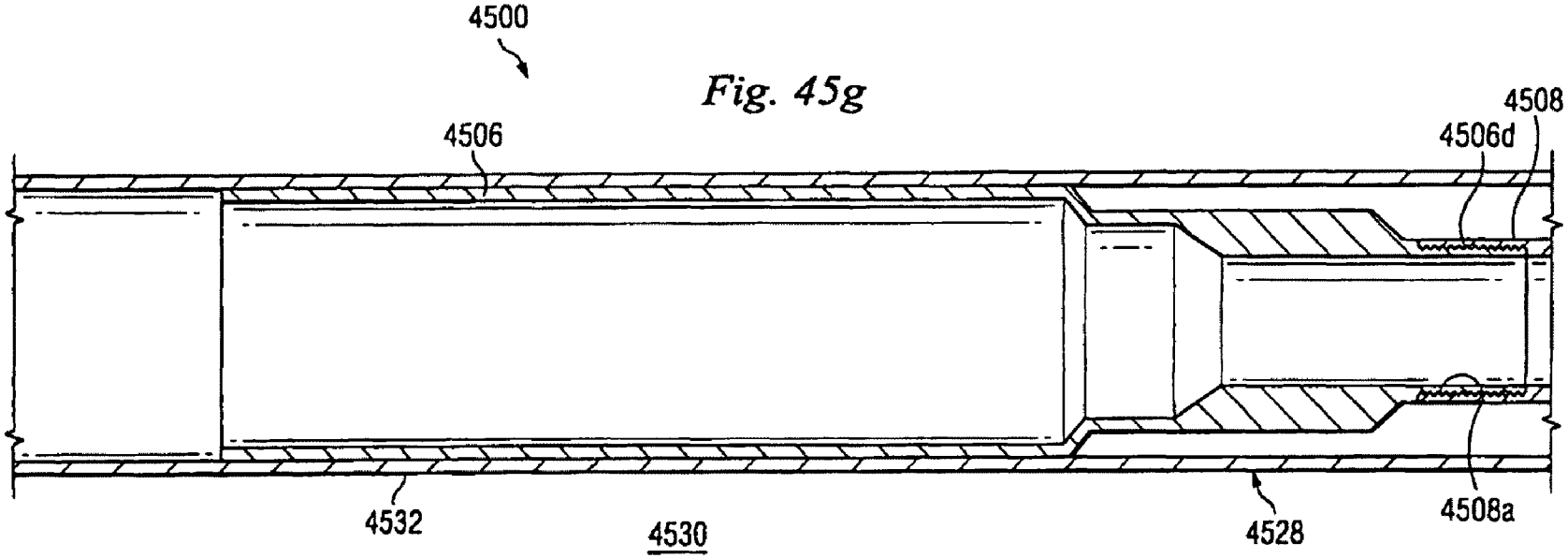
FIG. 45*g* is a fragmentary cross sectional illustration of the system of FIG. 45*f* following the removal of the system from the wellbore.

Referring to FIG. 45*g*, in an exemplary embodiment, the 4504, due to the engagement of the internal flange 4504*i* of the outer tubular mandrel 4504 with the external flange 4516*a* of the end of the inner tubular mandrel 4516, the inner tubular mandrel and the SSR plug set 4526 may be removed from the wellbore 4528. As a result, the tubular liner 4508 is suspended within the wellbore 4528 by virtue of the engagement of the tubular liner hanger 4506 with the wellbore casing 4532.

In several alternative embodiments, during the operation of the system 4500, a hardenable fluidic sealing material such as, for example, cement, may injected through the system 4500 before, during or after the radial expansion of the liner hanger 4506 in order to form an annular barrier between the wellbore 4528 and the tubular liner 4508.

In several alternative embodiments, during the operation of the system 4500, the size of the adjustable expansion device 4524 is increased prior to, during, or after the hydroforming expansion of the tubular liner hanger 4506 caused by the injection of the fluidic materials 4536 into the interior of the tubular liner hanger.

In several alternative embodiments, at least a portion of the tubular liner hanger 4506 includes a plurality of nested expandable tubular members bonded together by, for example, amorphous bonding.

In several alternative embodiments, at least a portion of the tubular liner hanger 4506 is fabricated for materials particularly suited for subsequent drilling out operations such as, for example, aluminum and/or copper based materials and alloys.

In several alternative embodiments, during the operation of the system 4500, the portion of the tubular liner hanger 4506 positioned below the adjustable expansion device 4524 is radially expanded and plastically deformed by displacing the adjustable expansion device downwardly.

In several alternative embodiments, at least a portion of the tubular liner hanger 4506 is fabricated for materials particularly suited for subsequent drilling out operations such as, for example, aluminum and/or copper based materials and alloys. In several alternative embodiments, during the operation of the system 4500, the portion of the tubular liner hanger 4506 fabricated for materials particularly suited for subsequent drilling out operations is not hydroformed by the injection of the fluidic materials 4536.

In several alternative embodiments, during the operation of the system 4500, at least a portion of the tubular liner hanger 4506 is hydroformed by the injection of the fluidic materials 4536, the remaining portion of the tubular liner hanger above the initial position of the adjustable expansion device 4524 is then radially expanded and plastically deformed by displacing the adjustable expansion device upwardly, and the portion of the tubular liner hanger below the initial position of the adjustable expansion device is radially expanded by then displacing the adjustable expansion device downwardly.

In several alternative embodiments, during the operation of the system 4500, the portion of the tubular liner hanger 4506 that is radially expanded and plastically deformed is radially expanded and plastically deformed solely by hydroforming caused by the injection of the fluidic materials 4536.

In several alternative embodiments, during the operation of the system 4500, the portion of the tubular liner hanger 4506 that is radially expanded and plastically deformed is radially expanded and plastically deformed solely by the adjustment of the adjustable expansion device 4524 to an increased size and the subsequent displacement of the adjustable expansion device relative to the tubular liner hanger.

Figure 46A:
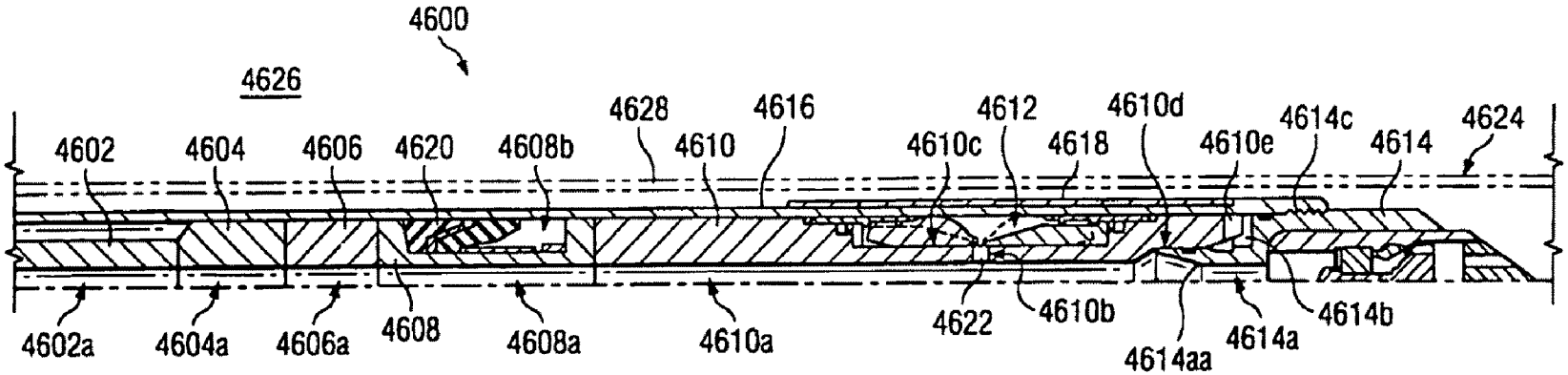
FIG. 46*a* is a fragmentary cross sectional illustration of an exemplary embodiment of a radial expansion system positioned within a cased section of a wellbore.

Referring to FIG. 46*a*, an exemplary embodiment of a system 4600 for radially expanding a tubular member includes a tubular support member 4602 that defines a passage 4602*a*. An end of a conventional tubular safety sub 4604 that defines a passage 4604*a* is coupled to an end of the tubular support member 4602, and another end of the safety sub 4604 is coupled to an end of a tubular casing lock assembly 4606 that defines a passage 4606*a*.

In several exemplary embodiments, the lock assembly 4606 may be a conventional locking device for locking the position of a tubular member relative to another member. In several alternative embodiments, the lock assembly 4606 may include one or more elements of the locking assemblies disclosed in one or more of the following: (1) PCT patent application serial number PCT/US02/36157, filed on Nov. 12, 2002, (2) PCT patent application serial number PCT/US02/36267, filed on Nov. 12, 2002, (3) PCT patent application serial number PCT/US03/04837, filed on Feb. 29, 2003, (4) PCT patent application serial number PCT/US03/29859, filed on Sep. 22, 2003, (5) PCT patent application serial number PCT/US03/14153, filed on Nov. 13, 2003, (6) PCT patent application serial number PCT/US03/18530, filed on Jun. 11, 2003, (7) PCT patent application serial number PCT/US03/29858, (8) PCT patent application serial number PCT/US03/29460, filed on Sep. 23, 2003, filed on Sep. 22, 2003, (9) PCT patent application serial number PCT/US04/07711, filed on Mar. 11, 2004, (10) PCT patent application serial number PCT/US2004/009434, filed on Mar. 26, 2004, (11) PCT patent application serial number PCT/US2004/010317, filed on Apr. 2, 2004, (12) PCT patent application serial number PCT/US2004/010712, filed on Apr. 7, 2004, (13) PCT patent application serial number PCT/US2004/010762, filed on Apr. 6, 2004, and/or (14) PCT patent application serial number PCT/US2004/011973, filed on Apr. 15, 2004, the disclosures of which are incorporated herein by reference.

A end of a tubular support member 4608 that defines a passage 4608*a* and includes an outer annular recess 4608*b* is coupled to another end of the lock assembly 4606, and another end of the tubular support member 4608 is coupled to an end of a tubular support member 4610 that defines a passage 4610*a*, a radial passage 4610*b*, and includes an outer annular recess 4610*c*, an inner annular recess 4610*d*, and circumferentially spaced apart teeth 4610*e* at another end.

An adjustable expansion device assembly 4612 is mounted upon and coupled to the outer annular recess 4610*c* of the tubular support member 4610. In several exemplary embodiments, the adjustable expansion device assembly 4612 may be a conventional adjustable expansion device assembly for radially expanding and plastically deforming tubular members that may include one or more elements of conventional adjustable expansion cones, mandrels, rotary expansion devices, hydroforming expansion devices and/or one or more elements of the one or more of the commercially available adjustable expansion devices of Enventure Global Technology LLC, Baker Hughes, Weatherford International, and/or Schlumberger and/or one or more elements of the adjustable expansion devices disclosed in one or more of the published patent applications and/or issued patents of Enventure Global Technology LLC, Baker Hughes, Weatherford International, Shell Oil Co. and/or Schlumberger. In several alternative embodiments, the adjustable expansion device assembly 4524 may include one or more elements of the adjustable expansion device assemblies disclosed in one or more of the following: (1) PCT patent application serial number PCT/US02/36157, filed on Nov. 12, 2002, (2) PCT patent application serial number PCT/US02/36267, filed on Nov. 12, 2002, (3) PCT patent application serial number PCT/US03/04837, filed on Feb. 29, 2003, (4) PCT patent application serial number PCT/US03/29859, filed on Sep. 22, 2003, (5) PCT patent application serial number PCT/US03/14153, filed on Nov. 13, 2003, (6) PCT patent application serial number PCT/US03/18530, filed on Jun. 11, 2003, (7) PCT patent application serial number PCT/US03/29858, (8) PCT patent application serial number PCT/US03/29460, filed on Sep. 23, 2003, filed on Sep. 22, 2003, (9) PCT patent application serial number PCT/US04/07711, filed on Mar. 11, 2004, (10) PCT patent application serial number PCT/US2004/009434, filed on Mar. 26, 2004, (11) PCT patent application serial number PCT/US2004/010317, filed on Apr. 2, 2004, (12) PCT patent application serial number PCT/US2004/010712, filed on Apr. 7, 2004, (13) PCT patent application serial number PCT/US2004/010762, filed on Apr. 6, 2004, and/or (14) PCT patent application serial number PCT/US2004/011973, filed on Apr. 15, 2004, the disclosures of which are incorporated herein by reference.

An end of a float shoe 4614 that defines a passage 4614*a* having a throat 4614*aa* and includes a plurality of circumferentially spaced apart teeth 4614*b* at an end that mate with and engage the teeth 4610*e* of the tubular support member 4610 for transmitting torsional loads therebetween and an external threaded connection 4614*c* is received within the inner annular recess 4610*d* of the tubular support member.

An end of an expandable tubular member 4616 is coupled to the external threaded connection 4614*c* of the float shoe 4614 and another portion of the expandable tubular member is coupled to the lock assembly 4606. In an exemplary embodiment, at least a portion of the expandable tubular member 4616 includes one or more of the characteristics of the expandable tubular members described in the present application. In an exemplary embodiment, the portion of the expandable tubular member 4616 proximate and positioned in opposition to the adjustable expansion device assembly 4612 includes an outer expansion limiter sleeve 4618 for limiting the amount of radial expansion of the portion of the expandable tubular member proximate and positioned in opposition to the adjustable expansion device assembly. In an exemplary embodiment, at least a portion of the outer expansion limiter sleeve 4618 includes one or more of the characteristics of the expandable tubular members described in the present application.

A cup seal assembly 4620 is coupled to and positioned within the outer annular recess 4608*b* of the tubular support member 4608 for sealingly engaging the interior surface of the expandable tubular member 4616. A rupture disc 4622 is positioned within and coupled to the radial passage 4610*b* of the tubular support member 4610.

In an exemplary embodiment, during operation of the system 4600, as illustrated in FIG. 46*a*, the system is positioned within a wellbore 4624 that traverses a subterranean formation 4626 and includes a preexisting wellbore casing 4628 coupled to and positioned within the wellbore. In an exemplary embodiment, the system 4600 is positioned such that the expandable tubular member 4616 overlaps with the casing 4628.

Figure 46B:
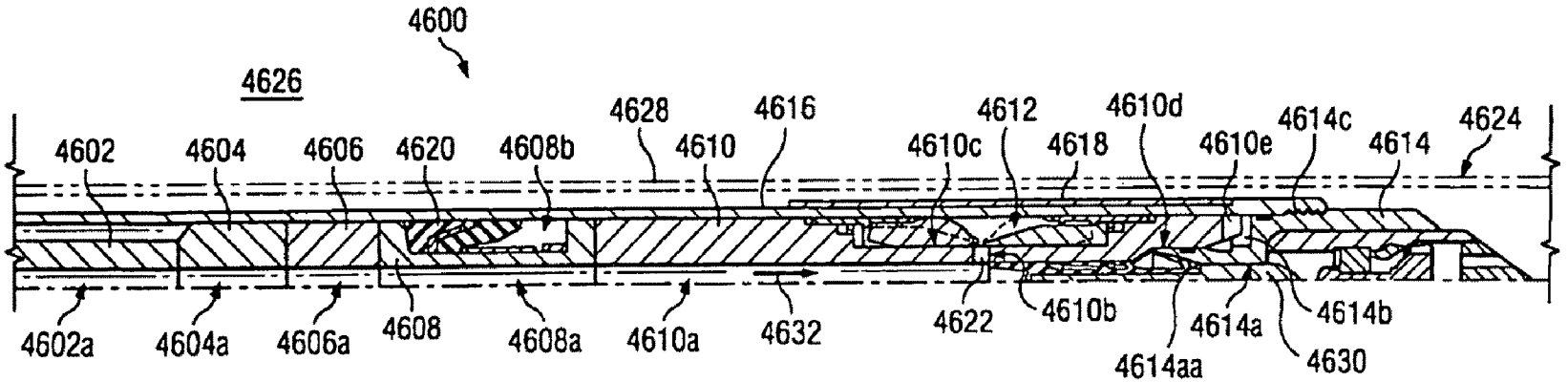
FIG. 46*b* is a fragmentary cross sectional illustration of the system of FIG. 46*a* following the placement of a plug within the throat passage of the system.

Referring to FIG. 46*b*, in an exemplary embodiment, a plug 4630 is then positioned in the throat passage 4614*aa* of the float shoe 4614 by injecting fluidic materials 4632 into the system 4600 through the passages 4602*a*, 4604*a*, 4606*a*, 4608*a*, and 4610*a*, of the tubular support member 4602, safety sub 4604, lock assembly 4606, tubular support member 4608, and tubular support member 4610, respectively.

Figure 46C:
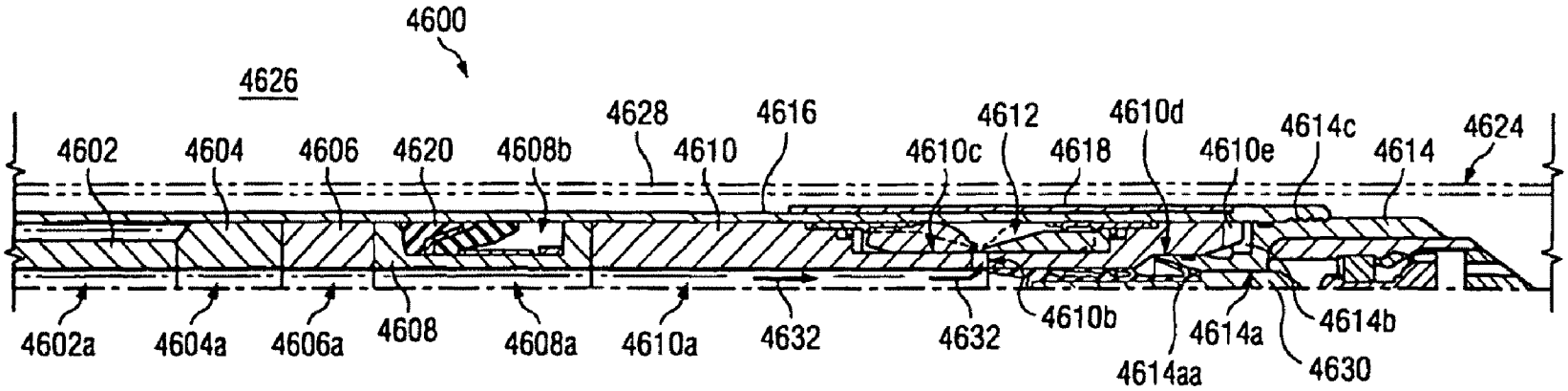
FIG. 46*c* is a fragmentary cross sectional illustration of the system of FIG. 46*b* during the injection of fluidic materials to burst the burst disc of the system.
Figure 46D:
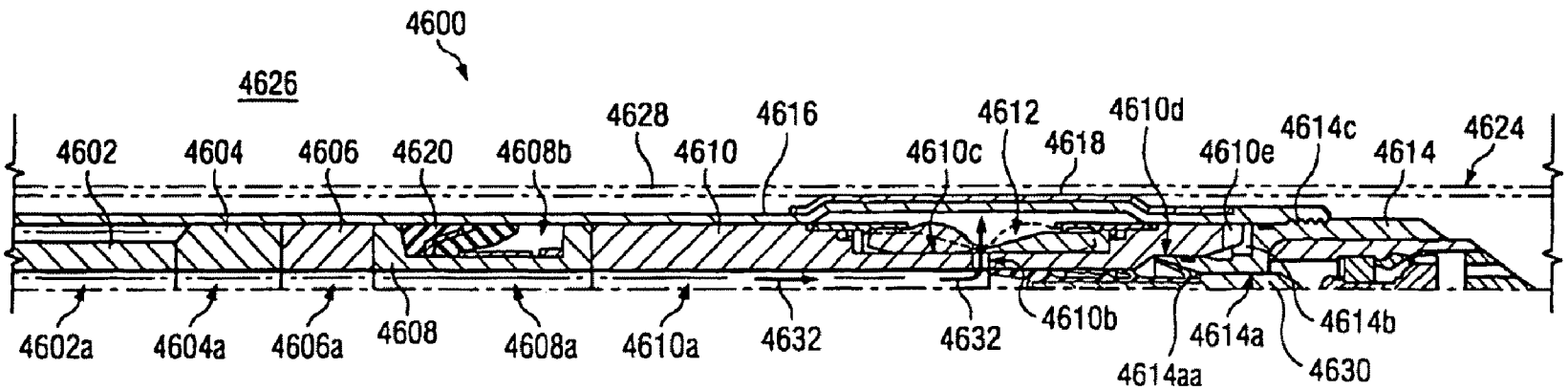
FIG. 46*d* is a fragmentary cross sectional illustration of the system of FIG. 46*c* during the continued injection of fluidic materials to radially expand and plastically deform at least a portion of the tubular liner hanger.

Referring to FIG. 46*c*, in an exemplary embodiment, the continued injection of the fluidic materials 4632 into the system 4600, following the placement of the plug 4630 in the throat passage 4614*aa*, pressurizes the passage 4610*a* of the tubular support member 4610 such that the rupture disc 4622 is ruptured thereby permitting the fluidic materials to pass through the radial passage 4610*b* of the tubular support member. As a result, the interior of the expandable tubular member 4616 proximate the adjustable expansion device assembly 4612 is pressurized.

Referring to FIG. 45*d*, in an exemplary embodiment, the continued injection of the fluidic materials 4632 into the interior of the expandable tubular member 4616 radially expands and plastically deforms at least a portion of the expandable tubular member. In an exemplary embodiment, the continued injection of the fluidic materials 4632 into the interior of the expandable tubular member 4616 radially expands and plastically deforms a portion of the expandable tubular member positioned in opposition to the adjustable expansion device assembly 4612. In an exemplary embodiment, the continued injection of the fluidic materials 4632 into the interior of the expandable tubular member 4616 radially expands and plastically deforms a portion of the expandable tubular member positioned in opposition to the adjustable expansion device assembly 4612 into engagement with the wellbore casing 4628. In an exemplary embodiment, the transformation of the material properties of the expansion limiter sleeve 4618, during the radial expansion process, limit the extent to which the expandable tubular member 4616 may be radially expanded.

Figure 46E:
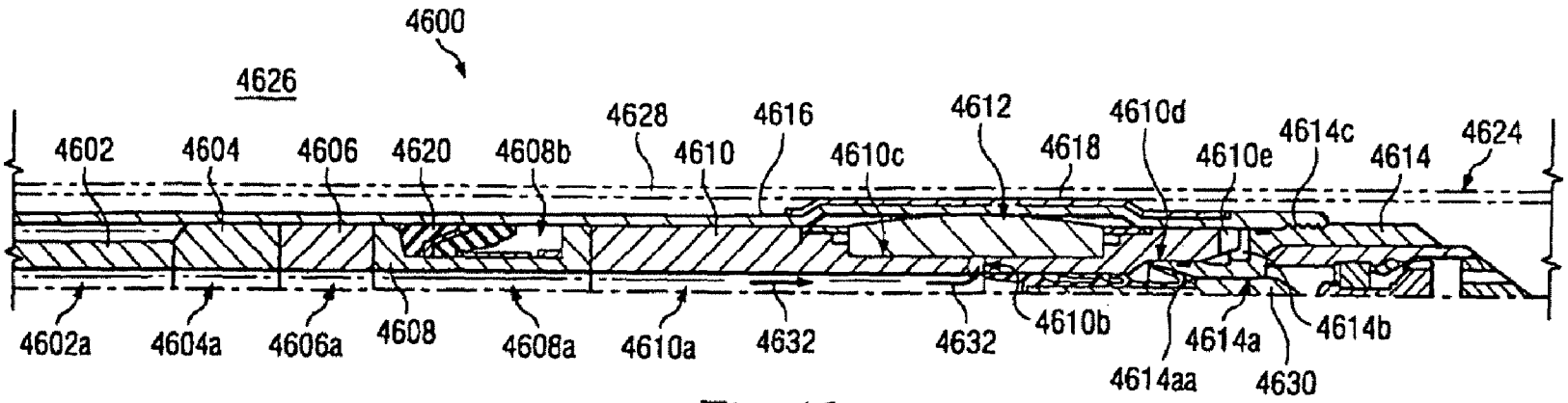
FIG. 46*e* is a fragmentary cross sectional illustration of the system of FIG. 46*d* during the continued injection of fluidic materials to adjust the size of the adjustable expansion device assembly.

Referring to FIG. 46*e*, in an exemplary embodiment, the size of the adjustable expansion device assembly 4612 is then increased within the radially expanded portion of the expandable tubular member 4616, and the lock assembly 4606 is operated to unlock the expandable tubular member from engagement with the lock assembly. In an exemplary embodiment, the lock assembly 4606 and the adjustable expansion device assembly 4612 are operated using the operating pressure provided by the continued injection of the fluidic materials 4632 into the system 4600. In an exemplary embodiment, the adjustment of the adjustable expansion device assembly 4612 to a larger size radially expands and plastically deforms at least a portion of the expandable tubular member 4616.

Figure 46F:
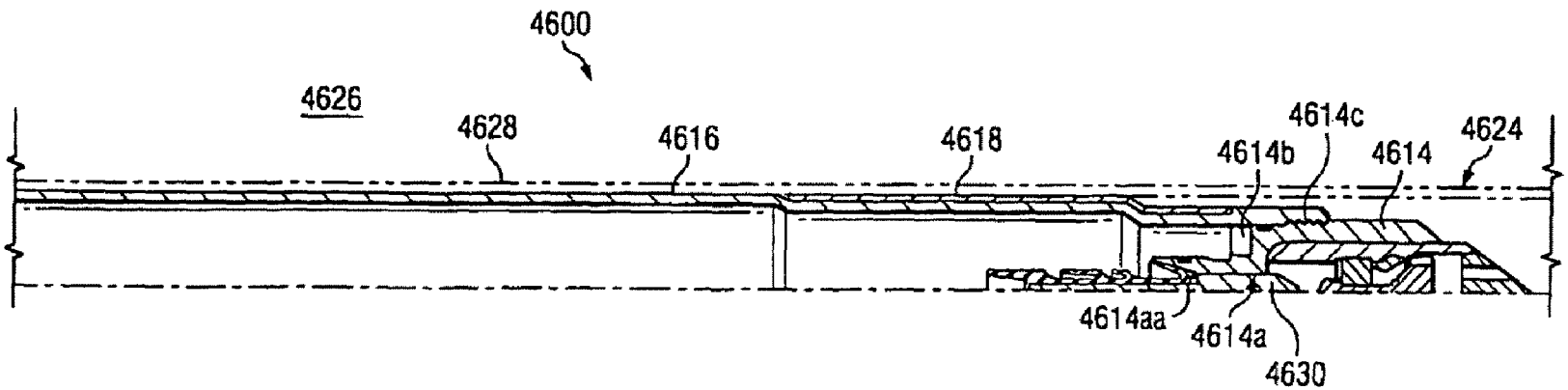
FIG. 46*f* is a fragmentary cross sectional illustration of the system of FIG. 46*e* during the displacement of the adjustable expansion device assembly to radially expand another portion of the tubular liner hanger.

Referring to FIG. 46*f*, in an exemplary embodiment, the adjustable expansion device assembly 4612 is displaced in a longitudinal direction relative to the expandable tubular member 4616 thereby radially expanding and plastically deforming the expandable tubular member. In an exemplary embodiment, the expandable tubular member 4616 is radially expanded and plastically deformed into engagement with the casing 4628. In an exemplary embodiment, the adjustable expansion device assembly 4612 is displaced in a longitudinal direction relative to the expandable tubular member 4616 due to the operating pressure within the expandable tubular member generated by the continued injection of the fluidic materials 4632.

In several alternative embodiments, during the operation of the system 4600, a hardenable fluidic sealing material such as, for example, cement, may injected through the system 4600 before, during or after the radial expansion of the expandable tubular member 4616 in order to form an annular barrier between the wellbore 4624 and/or the wellbore casing 4628 and the expandable tubular member.

In several alternative embodiments, during the operation of the system 4600, the size of the adjustable expansion device 4612 is increased prior to, during, or after the hydroforming expansion of the expandable tubular member 4616 caused by the injection of the fluidic materials 4632 into the interior of the expandable tubular member.

In several alternative embodiments, at least a portion of the expandable tubular member 4616 includes a plurality of nested expandable tubular members bonded together by, for example, amorphous bonding.

In several alternative embodiments, at least a portion of the expandable tubular member 4616 is fabricated for materials particularly suited for subsequent drilling out operations such as, for example, aluminum and/or copper based materials and alloys.

In several alternative embodiments, during the operation of the system 4600, the portion of the expandable tubular member 4616 positioned below the adjustable expansion device 4612 is radially expanded and plastically deformed by displacing the adjustable expansion device downwardly.

In several alternative embodiments, at least a portion of the expandable tubular member 4616 is fabricated for materials particularly suited for subsequent drilling out operations such as, for example, aluminum and/or copper based materials and alloys. In several alternative embodiments, during the operation of the system 4600, the portion of the expandable tubular member 4616 fabricated for materials particularly suited for subsequent drilling out operations is not hydroformed by the injection of the fluidic materials 4632.

In several alternative embodiments, during the operation of the system 4600, at least a portion of the expandable tubular member 4616 is hydroformed by the injection of the fluidic materials 4632, the remaining portion of the expandable tubular member above the initial position of the adjustable expansion device 4612 is then radially expanded and plastically deformed by displacing the adjustable expansion device upwardly, and the portion of the expandable tubular member below the initial position of the adjustable expansion device is radially expanded by then displacing the adjustable expansion device downwardly.

In several alternative embodiments, during the operation of the system 4600, the portion of the expandable tubular member 4616 that is radially expanded and plastically deformed is radially expanded and plastically deformed solely by hydroforming caused by the injection of the fluidic materials 4632.

In several alternative embodiments, during the operation of the system 4600, the portion of the expandable tubular member 4616 that is radially expanded and plastically deformed is radially expanded and plastically deformed solely by the adjustment of the adjustable expansion device 4612 to an increased size and the subsequent displacement of the adjustable expansion device relative to the expandable tubular member.

In an exemplary experimental embodiment, expandable tubular members fabricated from tellurium copper, leaded naval brass, phosphorous bronze, and aluminum-silicon bronze were successfully hydroformed and thereby radially expanded and plastically deformed by up to about 30% radial expansion, all of which were unexpected results.

Figure 46G:
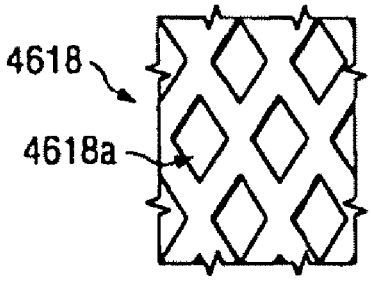
FIG. 46*g* is a top view of a portion of an exemplary embodiment of an expansion limiter sleeve prior to the radial expansion and plastic deformation of the expansion limiter sleeve.
Figure 46H:
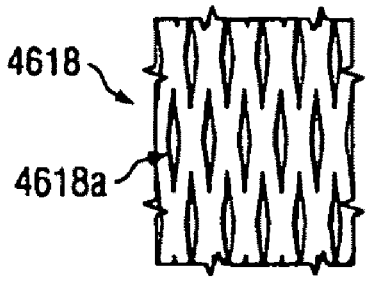
FIG. 46*h* is a top view of a portion of the expansion limiter sleeve of FIG. 46*g* after the radial expansion and plastic deformation of the expansion limiter sleeve.

Referring to FIG. 46*g*, in an exemplary embodiment, at least a portion of the expansion limiter sleeve 4618, prior to the radial expansion and plastic deformation of the expansion limiter sleeve by operation of the system 4600, includes one or more diamond shaped slots 4618*a*. Referring to FIG. 46*h*, in an exemplary embodiment, during the radial expansion and plastic deformation of the expansion limiter sleeve by operation of the system 4600, the diamond shaped slots 4618*a* are deformed such that further radial expansion of the expansion limiter sleeve requires increased force. More generally, the expansion limiter sleeve 4618 may be manufactured with slots whose cross sectional areas are decreased by the radial expansion and plastic deformation of the expansion limited sleeve thereby increasing the amount of force required to further radially expand the expansion limiter sleeve. In this manner, the extent to which the expandable tubular member 4616 may be radially expanded is limited. In several alternative embodiments, at least a portion of the expandable tubular member 4616 includes slots whose cross sectional areas are decreased by the radial expansion and plastic deformation of the expandable tubular member thereby increasing the amount of force required to further radially expand the expandable tubular member.

Figure 46I:
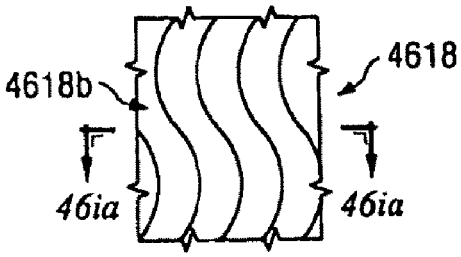
FIG. 46*i* is a top view of a portion of an exemplary embodiment of an expansion limiter sleeve prior to the radial expansion and plastic deformation of the expansion limiter sleeve.
Figure 46J:
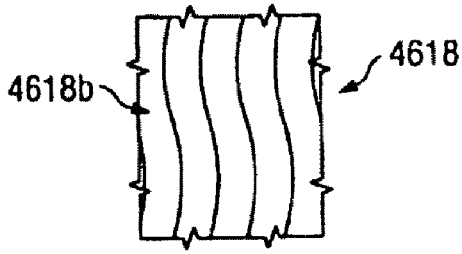
FIG. 46*j* is a top view of a portion of the expansion limiter sleeve of FIG. 46*i* after the radial expansion and plastic deformation of the expansion limiter sleeve.
Figure 46I:
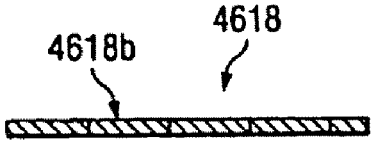

Referring to FIGS. 46*i* and 46*ia*, in an exemplary embodiment, at least a portion of the expansion limiter sleeve 4618, prior to the radial expansion and plastic deformation of the expansion limiter sleeve by operation of the system 4600, includes one or more wavy circumferentially oriented spaced apart bands 4618*b*. Referring to FIG. 46*j*, in an exemplary embodiment, during the radial expansion and plastic deformation of the expansion limiter sleeve by operation of the system 4600, the bands 4618*b* are deformed such that the further radial expansion of the expansion limiter sleeve requires added force. More generally, the expansion limiter sleeve 4618 may be manufactured with a circumferential bands whose orientation becomes more and more aligned with a direction that is orthogonal to the longitudinal axis of the sectional areas as a result of the radial expansion and plastic deformation of the bands thereby increasing the amount of force required to further radially expand the expansion limiter sleeve. In this manner, the extent to which the expandable tubular member 4616 may be radially expanded is limited. In several alternative embodiments, at least a portion of the expandable tubular member 4616 includes circumferential bands whose orientation becomes more and more aligned with a direction that is orthogonal to the longitudinal axis of the sectional areas as a result of the radial expansion and plastic deformation of the bands thereby increasing the amount of force required to further radially expand the expandable tubular member.

In several exemplary embodiments, the design of the expansion limiter sleeve 4618 provides a restraining force that limits the extent to which the expandable tubular member 4616 may be radially expanded and plastically deformed. Furthermore, in several exemplary embodiments, the design of the expansion limiter sleeve 4618 provides a variable restraining force that limits the extent to which the expandable tubular member 4616 may be radially expanded and plastically deformed. In several exemplary embodiments, the variable restraining force of the expansion limiter sleeve 4618 increases in proportion to the degree to which the expandable tubular member 4616 has been radially expanded.

A method of forming a tubular liner within a preexisting structure has been described that includes positioning a tubular assembly within the preexisting structure; and radially expanding and plastically deforming the tubular assembly within the preexisting structure, wherein, prior to the radial expansion and plastic deformation of the tubular assembly, a predetermined portion of the tubular assembly has a lower yield point than another portion of the tubular assembly. In an exemplary embodiment, the predetermined portion of the tubular assembly has a higher ductility and a lower yield point prior to the radial expansion and plastic deformation than after the radial expansion and plastic deformation. In an exemplary embodiment, the predetermined portion of the tubular assembly has a higher ductility prior to the radial expansion and plastic deformation than after the radial expansion and plastic deformation. In an exemplary embodiment, the predetermined portion of the tubular assembly has a lower yield point prior to the radial expansion and plastic deformation than after the radial expansion and plastic deformation. In an exemplary embodiment, the predetermined portion of the tubular assembly has a larger inside diameter after the radial expansion and plastic deformation than other portions of the tubular assembly. In an exemplary embodiment, the method further includes positioning another tubular assembly within the preexisting structure in overlapping relation to the tubular assembly; and radially expanding and plastically deforming the other tubular assembly within the preexisting structure, wherein, prior to the radial expansion and plastic deformation of the tubular assembly, a predetermined portion of the other tubular assembly has a lower yield point than another portion of the other tubular assembly. In an exemplary embodiment, the inside diameter of the radially expanded and plastically deformed other portion of the tubular assembly is equal to the inside diameter of the radially expanded and plastically deformed other portion of the other tubular assembly. In an exemplary embodiment, the predetermined portion of the tubular assembly includes an end portion of the tubular assembly. In an exemplary embodiment, the predetermined portion of the tubular assembly includes a plurality of predetermined portions of the tubular assembly. In an exemplary embodiment, the predetermined portion of the tubular assembly includes a plurality of spaced apart predetermined portions of the tubular assembly. In an exemplary embodiment, the other portion of the tubular assembly includes an end portion of the tubular assembly. In an exemplary embodiment, the other portion of the tubular assembly includes a plurality of other portions of the tubular assembly. In an exemplary embodiment, the other portion of the tubular assembly includes a plurality of spaced apart other portions of the tubular assembly. In an exemplary embodiment, the tubular assembly includes a plurality of tubular members coupled to one another by corresponding tubular couplings. In an exemplary embodiment, the tubular couplings include the predetermined portions of the tubular assembly; and wherein the tubular members comprise the other portion of the tubular assembly. In an exemplary embodiment, one or more of the tubular couplings include the predetermined portions of the tubular assembly. In an exemplary embodiment, one or more of the tubular members include the predetermined portions of the tubular assembly. In an exemplary embodiment, the predetermined portion of the tubular assembly defines one or more openings. In an exemplary embodiment, one or more of the openings include slots. In an exemplary embodiment, the anisotropy for the predetermined portion of the tubular assembly is greater than 1. In an exemplary embodiment, the anisotropy for the predetermined portion of the tubular assembly is greater than 1. In an exemplary embodiment, the strain hardening exponent for the predetermined portion of the tubular assembly is greater than 0.12. In an exemplary embodiment, the anisotropy for the predetermined portion of the tubular assembly is greater than 1; and the strain hardening exponent for the predetermined portion of the tubular assembly is greater than 0.12. In an exemplary embodiment, the predetermined portion of the tubular assembly is a first steel alloy including: 0.065% C, 1.44% Mn, 0.01% P, 0.002% S, 0.24% Si, 0.01% Cu, 0.01% Ni, and 0.02% Cr. In an exemplary embodiment, the yield point of the predetermined portion of the tubular assembly is at most about 46.9 ksi prior to the radial expansion and plastic deformation; and the yield point of the predetermined portion of the tubular assembly is at least about 65.9 ksi after the radial expansion and plastic deformation. In an exemplary embodiment, the yield point of the predetermined portion of the tubular assembly after the radial expansion and plastic deformation is at least about 40% greater than the yield point of the predetermined portion of the tubular assembly prior to the radial expansion and plastic deformation. In an exemplary embodiment, the anisotropy of the predetermined portion of the tubular assembly, prior to the radial expansion and plastic deformation, is about 1.48. In an exemplary embodiment, the predetermined portion of the tubular assembly includes a second steel alloy including: 0.18% C, 1.28% Mn, 0.017% P, 0.004% S, 0.29% Si, 0.01% Cu, 0.01% Ni, and 0.03% Cr. In an exemplary embodiment, the yield point of the predetermined portion of the tubular assembly is at most about 57.8 ksi prior to the radial expansion and plastic deformation; and the yield point of the predetermined portion of the tubular assembly is at least about 74.4 ksi after the radial expansion and plastic deformation. In an exemplary embodiment, the yield point of the predetermined portion of the tubular assembly after the radial expansion and plastic deformation is at least about 28% greater than the yield point of the predetermined portion of the tubular assembly prior to the radial expansion and plastic deformation. In an exemplary embodiment, the anisotropy of the predetermined portion of the tubular assembly, prior to the radial expansion and plastic deformation, is about 1.04. In an exemplary embodiment, the predetermined portion of the tubular assembly includes a third steel alloy including: 0.08% C, 0.82% Mn, 0.006% P, 0.003% S, 0.30% Si, 0.16% Cu, 0.05% Ni, and 0.05% Cr. In an exemplary embodiment, the anisotropy of the predetermined portion of the tubular assembly, prior to the radial expansion and plastic deformation, is about 1.92. In an exemplary embodiment, the predetermined portion of the tubular assembly includes a fourth steel alloy including: 0.02% C, 1.31% Mn, 0.02% P, 0.001% S, 0.45% Si, 9.1% Ni, and 18.7% Cr. In an exemplary embodiment, the anisotropy of the predetermined portion of the tubular assembly, prior to the radial expansion and plastic deformation, is about 1.34. In an exemplary embodiment, the yield point of the predetermined portion of the tubular assembly is at most about 46.9 ksi prior to the radial expansion and plastic deformation; and wherein the yield point of the predetermined portion of the tubular assembly is at least about 65.9 ksi after the radial expansion and plastic deformation. In an exemplary embodiment, the yield point of the predetermined portion of the tubular assembly after the radial expansion and plastic deformation is at least about 40% greater than the yield point of the predetermined portion of the tubular assembly prior to the radial expansion and plastic deformation. In an exemplary embodiment, the anisotropy of the predetermined portion of the tubular assembly, prior to the radial expansion and plastic deformation, is at least about 1.48. In an exemplary embodiment, the yield point of the predetermined portion of the tubular assembly is at most about 57.8 ksi prior to the radial expansion and plastic deformation; and the yield point of the predetermined portion of the tubular assembly is at least about 74.4 ksi after the radial expansion and plastic deformation. In an exemplary embodiment, the yield point of the predetermined portion of the tubular assembly after the radial expansion and plastic deformation is at least about 28% greater than the yield point of the predetermined portion of the tubular assembly prior to the radial expansion and plastic deformation. In an exemplary embodiment, the anisotropy of the predetermined portion of the tubular assembly, prior to the radial expansion and plastic deformation, is at least about 1.04. In an exemplary embodiment, the anisotropy of the predetermined portion of the tubular assembly, prior to the radial expansion and plastic deformation, is at least about 1.92. In an exemplary embodiment, the anisotropy of the predetermined portion of the tubular assembly, prior to the radial expansion and plastic deformation, is at least about 1.34. In an exemplary embodiment, the anisotropy of the predetermined portion of the tubular assembly, prior to the radial expansion and plastic deformation, ranges from about 1.04 to about 1.92. In an exemplary embodiment, the yield point of the predetermined portion of the tubular assembly, prior to the radial expansion and plastic deformation, ranges from about 47.6 ksi to about 61.7 ksi. In an exemplary embodiment, the expandability coefficient of the predetermined portion of the tubular assembly, prior to the radial expansion and plastic deformation, is greater than 0.12. In an exemplary embodiment, the expandability coefficient of the predetermined portion of the tubular assembly is greater than the expandability coefficient of the other portion of the tubular assembly. In an exemplary embodiment, the tubular assembly includes a wellbore casing, a pipeline, or a structural support. In an exemplary embodiment, the carbon content of the predetermined portion of the tubular assembly is less than or equal to 0.12 percent; and wherein the carbon equivalent value for the predetermined portion of the tubular assembly is less than 0.21. In an exemplary embodiment, the carbon content of the predetermined portion of the tubular assembly is greater than 0.12 percent; and wherein the carbon equivalent value for the predetermined portion of the tubular assembly is less than 0.36. In an exemplary embodiment, a yield point of an inner tubular portion of at least a portion of the tubular assembly is less than a yield point of an outer tubular portion of the portion of the tubular assembly. In an exemplary embodiment, yield point of the inner tubular portion of the tubular body varies as a function of the radial position within the tubular body. In an exemplary embodiment, the yield point of the inner tubular portion of the tubular body varies in an linear fashion as a function of the radial position within the tubular body. In an exemplary embodiment, the yield point of the inner tubular portion of the tubular body varies in an non-linear fashion as a function of the radial position within the tubular body. In an exemplary embodiment, the yield point of the outer tubular portion of the tubular body varies as a function of the radial position within the tubular body. In an exemplary embodiment, the yield point of the outer tubular portion of the tubular body varies in an linear fashion as a function of the radial position within the tubular body. In an exemplary embodiment, the yield point of the outer tubular portion of the tubular body varies in an non-linear fashion as a function of the radial position within the tubular body. In an exemplary embodiment, the yield point of the inner tubular portion of the tubular body varies as a function of the radial position within the tubular body; and wherein the yield point of the outer tubular portion of the tubular body varies as a function of the radial position within the tubular body. In an exemplary embodiment, the yield point of the inner tubular portion of the tubular body varies in a linear fashion as a function of the radial position within the tubular body; and wherein the yield point of the outer tubular portion of the tubular body varies in a linear fashion as a function of the radial position within the tubular body. In an exemplary embodiment, the yield point of the inner tubular portion of the tubular body varies in a linear fashion as a function of the radial position within the tubular body; and wherein the yield point of the outer tubular portion of the tubular body varies in a non-linear fashion as a function of the radial position within the tubular body. In an exemplary embodiment, the yield point of the inner tubular portion of the tubular body varies in a non-linear fashion as a function of the radial position within the tubular body; and wherein the yield point of the outer tubular portion of the tubular body varies in a linear fashion as a function of the radial position within the tubular body. In an exemplary embodiment, the yield point of the inner tubular portion of the tubular body varies in a non-linear fashion as a function of the radial position within the tubular body; and wherein the yield point of the outer tubular portion of the tubular body varies in a non-linear fashion as a function of the radial position within the tubular body. In an exemplary embodiment, the rate of change of the yield point of the inner tubular portion of the tubular body is different than the rate of change of the yield point of the outer tubular portion of the tubular body. In an exemplary embodiment, the rate of change of the yield point of the inner tubular portion of the tubular body is different than the rate of change of the yield point of the outer tubular portion of the tubular body. In an exemplary embodiment, prior to the radial expansion and plastic deformation, at least a portion of the tubular assembly comprises a microstructure comprising a hard phase structure and a soft phase structure. In an exemplary embodiment, prior to the radial expansion and plastic deformation, at least a portion of the tubular assembly comprises a microstructure comprising a transitional phase structure. In an exemplary embodiment, the hard phase structure comprises martensite. In an exemplary embodiment, the soft phase structure comprises ferrite. In an exemplary embodiment, the transitional phase structure comprises retained austentite. In an exemplary embodiment, the hard phase structure comprises martensite; wherein the soft phase structure comprises ferrite; and wherein the transitional phase structure comprises retained austentite. In an exemplary embodiment, the portion of the tubular assembly comprising a microstructure comprising a hard phase structure and a soft phase structure comprises, by weight percentage, about 0.1% C, about 1.2% Mn, and about 0.3% Si.

An expandable tubular member has been described that includes a steel alloy including: 0.065% C, 1.44% Mn, 0.01% P, 0.002% S, 0.24% Si, 0.01% Cu, 0.01% Ni, and 0.02% Cr. In an exemplary embodiment, a yield point of the tubular member is at most about 46.9 ksi prior to a radial expansion and plastic deformation; and a yield point of the tubular member is at least about 65.9 ksi after the radial expansion and plastic deformation. In an exemplary embodiment, the yield point of the tubular member after the radial expansion and plastic deformation is at least about 40% greater than the yield point of the tubular member prior to the radial expansion and plastic deformation. In an exemplary embodiment, the anisotropy of the tubular member, prior to a radial expansion and plastic deformation, is about 1.48. In an exemplary embodiment, the tubular member includes a wellbore casing, a pipeline, or a structural support.

An expandable tubular member has been described that includes a steel alloy including: 0.18% C, 1.28% Mn, 0.017% P, 0.004% S, 0.29% Si, 0.01% Cu, 0.01% Ni, and 0.03% Cr. In an exemplary embodiment, a yield point of the tubular member is at most about 57.8 ksi prior to a radial expansion and plastic deformation; and the yield point of the tubular member is at least about 74.4 ksi after the radial expansion and plastic deformation. In an exemplary embodiment, a yield point of the of the tubular member after a radial expansion and plastic deformation is at least about 28% greater than the yield point of the tubular member prior to the radial expansion and plastic deformation. In an exemplary embodiment, the anisotropy of the tubular member, prior to a radial expansion and plastic deformation, is about 1.04. In an exemplary embodiment, the tubular member includes a wellbore casing, a pipeline, or a structural support.

An expandable tubular member has been described that includes a steel alloy including: 0.08% C, 0.82% Mn, 0.006% P, 0.003% S, 0.30% Si, 0.16% Cu, 0.05% Ni, and 0.05% Cr. In an exemplary embodiment, the anisotropy of the tubular member, prior to a radial expansion and plastic deformation, is about 1.92. In an exemplary embodiment, the tubular member includes a wellbore casing, a pipeline, or a structural support.

An expandable tubular member has been described that includes a steel alloy including: 0.02% C, 1.31% Mn, 0.02% P, 0.001% S, 0.45% Si, 9.1% Ni, and 18.7% Cr. In an exemplary embodiment, the anisotropy of the tubular member, prior to a radial expansion and plastic deformation, is about 1.34. In an exemplary embodiment, the tubular member includes a wellbore casing, a pipeline, or a structural support.

An expandable tubular member has been described, wherein the yield point of the expandable tubular member is at most about 46.9 ksi prior to a radial expansion and plastic deformation; and wherein the yield point of the expandable tubular member is at least about 65.9 ksi after the radial expansion and plastic deformation. In an exemplary embodiment, the tubular member includes a wellbore casing, a pipeline, or a structural support.

An expandable tubular member has been described, wherein a yield point of the expandable tubular member after a radial expansion and plastic deformation is at least about 40% greater than the yield point of the expandable tubular member prior to the radial expansion and plastic deformation. In an exemplary embodiment, the tubular member includes a wellbore casing, a pipeline, or a structural support.

An expandable tubular member has been described, wherein the anisotropy of the expandable tubular member, prior to the radial expansion and plastic deformation, is at least about 1.48. In an exemplary embodiment, the tubular member includes a wellbore casing, a pipeline, or a structural support.

An expandable tubular member has been described, wherein the yield point of the expandable tubular member is at most about 57.8 ksi prior to the radial expansion and plastic deformation; and wherein the yield point of the expandable tubular member is at least about 74.4 ksi after the radial expansion and plastic deformation. In an exemplary embodiment, the tubular member includes a wellbore casing, a pipeline, or a structural support.

An expandable tubular member has been described, wherein the yield point of the expandable tubular member after a radial expansion and plastic deformation is at least about 28% greater than the yield point of the expandable tubular member prior to the radial expansion and plastic deformation. In an exemplary embodiment, the tubular member includes a wellbore casing, a pipeline, or a structural support.

An expandable tubular member has been described, wherein the anisotropy of the expandable tubular member, prior to the radial expansion and plastic deformation, is at least about 1.04. In an exemplary embodiment, the tubular member includes a wellbore casing, a pipeline, or a structural support.

An expandable tubular member has been described, wherein the anisotropy of the expandable tubular member, prior to the radial expansion and plastic deformation, is at least about 1.92. In an exemplary embodiment, the tubular member includes a wellbore casing, a pipeline, or a structural support.

An expandable tubular member has been described, wherein the anisotropy of the expandable tubular member, prior to the radial expansion and plastic deformation, is at least about 1.34. In an exemplary embodiment, the tubular member includes a wellbore casing, a pipeline, or a structural support.

An expandable tubular member has been described, wherein the anisotropy of the expandable tubular member, prior to the radial expansion and plastic deformation, ranges from about 1.04 to about 1.92. In an exemplary embodiment, the tubular member includes a wellbore casing, a pipeline, or a structural support.

An expandable tubular member has been described, wherein the yield point of the expandable tubular member, prior to the radial expansion and plastic deformation, ranges from about 47.6 ksi to about 61.7 ksi. In an exemplary embodiment, the tubular member includes a wellbore casing, a pipeline, or a structural support.

An expandable tubular member has been described, wherein the expandability coefficient of the expandable tubular member, prior to the radial expansion and plastic deformation, is greater than 0.12. In an exemplary embodiment, the tubular member includes a wellbore casing, a pipeline, or a structural support.

An expandable tubular member has been described, wherein the expandability coefficient of the expandable tubular member is greater than the expandability coefficient of another portion of the expandable tubular member. In an exemplary embodiment, the tubular member includes a wellbore casing, a pipeline, or a structural support.

An expandable tubular member has been described, wherein the tubular member has a higher ductility and a lower yield point prior to a radial expansion and plastic deformation than after the radial expansion and plastic deformation. In an exemplary embodiment, the tubular member includes a wellbore casing, a pipeline, or a structural support.

A method of radially expanding and plastically deforming a tubular assembly including a first tubular member coupled to a second tubular member has been described that includes radially expanding and plastically deforming the tubular assembly within a preexisting structure; and using less power to radially expand each unit length of the first tubular member than to radially expand each unit length of the second tubular member. In an exemplary embodiment, the tubular member includes a wellbore casing, a pipeline, or a structural support.

A system for radially expanding and plastically deforming a tubular assembly including a first tubular member coupled to a second tubular member has been described that includes means for radially expanding the tubular assembly within a preexisting structure; and means for using less power to radially expand each unit length of the first tubular member than required to radially expand each unit length of the second tubular member. In an exemplary embodiment, the tubular member includes a wellbore casing, a pipeline, or a structural support.

A method of manufacturing a tubular member has been described that includes processing a tubular member until the tubular member is characterized by one or more intermediate characteristics; positioning the tubular member within a preexisting structure; and processing the tubular member within the preexisting structure until the tubular member is characterized one or more final characteristics. In an exemplary embodiment, the tubular member includes a wellbore casing, a pipeline, or a structural support. In an exemplary embodiment, the preexisting structure includes a wellbore that traverses a subterranean formation. In an exemplary embodiment, the characteristics are selected from a group consisting of yield point and ductility. In an exemplary embodiment, processing the tubular member within the preexisting structure until the tubular member is characterized one or more final characteristics includes: radially expanding and plastically deforming the tubular member within the preexisting structure.

An apparatus has been described that includes an expandable tubular assembly; and an expansion device coupled to the expandable tubular assembly; wherein a predetermined portion of the expandable tubular assembly has a lower yield point than another portion of the expandable tubular assembly. In an exemplary embodiment, the expansion device includes a rotary expansion device, an axially displaceable expansion device, a reciprocating expansion device, a hydroforming expansion device, and/or an impulsive force expansion device. In an exemplary embodiment, the predetermined portion of the tubular assembly has a higher ductility and a lower yield point than another portion of the expandable tubular assembly. In an exemplary embodiment, the predetermined portion of the tubular assembly has a higher ductility than another portion of the expandable tubular assembly. In an exemplary embodiment, the predetermined portion of the tubular assembly has a lower yield point than another portion of the expandable tubular assembly. In an exemplary embodiment, the predetermined portion of the tubular assembly includes an end portion of the tubular assembly. In an exemplary embodiment, the predetermined portion of the tubular assembly includes a plurality of predetermined portions of the tubular assembly. In an exemplary embodiment, the predetermined portion of the tubular assembly includes a plurality of spaced apart predetermined portions of the tubular assembly. In an exemplary embodiment, the other portion of the tubular assembly includes an end portion of the tubular assembly. In an exemplary embodiment, the other portion of the tubular assembly includes a plurality of other portions of the tubular assembly. In an exemplary embodiment, the other portion of the tubular assembly includes a plurality of spaced apart other portions of the tubular assembly. In an exemplary embodiment, the tubular assembly includes a plurality of tubular members coupled to one another by corresponding tubular couplings. In an exemplary embodiment, the tubular couplings comprise the predetermined portions of the tubular assembly; and wherein the tubular members comprise the other portion of the tubular assembly. In an exemplary embodiment, one or more of the tubular couplings comprise the predetermined portions of the tubular assembly. In an exemplary embodiment, one or more of the tubular members comprise the predetermined portions of the tubular assembly. In an exemplary embodiment, the predetermined portion of the tubular assembly defines one or more openings. In an exemplary embodiment, one or more of the openings comprise slots. In an exemplary embodiment, the anisotropy for the predetermined portion of the tubular assembly is greater than 1 In an exemplary embodiment, the anisotropy for the predetermined portion of the tubular assembly is greater than 1. In an exemplary embodiment, the strain hardening exponent for the predetermined portion of the tubular assembly is greater than 0.12. In an exemplary embodiment, the anisotropy for the predetermined portion of the tubular assembly is greater than 1; and wherein the strain hardening exponent for the predetermined portion of the tubular assembly is greater than 0.12. In an exemplary embodiment, the predetermined portion of the tubular assembly includes a first steel alloy including: 0.065% C, 1.44% Mn, 0.01% P, 0.002% S, 0.24% Si, 0.01% Cu, 0.01% Ni, and 0.02% Cr. In an exemplary embodiment, the yield point of the predetermined portion of the tubular assembly is at most about 46.9 ksi. In an exemplary embodiment, the anisotropy of the predetermined portion of the tubular assembly is about 1.48. In an exemplary embodiment, the predetermined portion of the tubular assembly includes a second steel alloy including: 0.18% C, 1.28% Mn, 0.017% P, 0.004% S, 0.29% Si, 0.01% Cu, 0.01% Ni, and 0.03% Cr. In an exemplary embodiment, the yield point of the predetermined portion of the tubular assembly is at most about 57.8 ksi. In an exemplary embodiment, the anisotropy of the predetermined portion of the tubular assembly is about 1.04. In an exemplary embodiment, the predetermined portion of the tubular assembly includes a third steel alloy including: 0.08% C, 0.82% Mn, 0.006% P, 0.003% S, 0.30% Si, 0.16% Cu, 0.05% Ni, and 0.05% Cr. In an exemplary embodiment, the anisotropy of the predetermined portion of the tubular assembly is about 1.92. In an exemplary embodiment, the predetermined portion of the tubular assembly includes a fourth steel alloy including: 0.02% C, 1.31% Mn, 0.02% P, 0.001% S, 0.45% Si, 9.1% Ni, and 18.7% Cr. In an exemplary embodiment, the anisotropy of the predetermined portion of the tubular assembly is at least about 1.34. In an exemplary embodiment, the yield point of the predetermined portion of the tubular assembly is at most about 46.9 ksi. In an exemplary embodiment, the anisotropy of the predetermined portion of the tubular assembly is at least about 1.48. In an exemplary embodiment, the yield point of the predetermined portion of the tubular assembly is at most about 57.8 ksi. In an exemplary embodiment, the anisotropy of the predetermined portion of the tubular assembly is at least about 1.04. In an exemplary embodiment, the anisotropy of the predetermined portion of the tubular assembly is at least about 1.92. In an exemplary embodiment, the anisotropy of the predetermined portion of the tubular assembly is at least about 1.34. In an exemplary embodiment, the anisotropy of the predetermined portion of the tubular assembly ranges from about 1.04 to about 1.92. In an exemplary embodiment, the yield point of the predetermined portion of the tubular assembly ranges from about 47.6 ksi to about 61.7 ksi. In an exemplary embodiment, the expandability coefficient of the predetermined portion of the tubular assembly is greater than 0.12. In an exemplary embodiment, the expandability coefficient of the predetermined portion of the tubular assembly is greater than the expandability coefficient of the other portion of the tubular assembly. In an exemplary embodiment, the tubular assembly includes a wellbore casing, a pipeline, or a structural support. In an exemplary embodiment, the carbon content of the predetermined portion of the tubular assembly is less than or equal to 0.12 percent; and wherein the carbon equivalent value for the predetermined portion of the tubular assembly is less than 0.21. In an exemplary embodiment, the carbon content of the predetermined portion of the tubular assembly is greater than 0.12 percent; and wherein the carbon equivalent value for the predetermined portion of the tubular assembly is less than 0.36. In an exemplary embodiment, a yield point of an inner tubular portion of at least a portion of the tubular assembly is less than a yield point of an outer tubular portion of the portion of the tubular assembly. In an exemplary embodiment, the yield point of the inner tubular portion of the tubular body varies as a function of the radial position within the tubular body. In an exemplary embodiment, the yield point of the inner tubular portion of the tubular body varies in an linear fashion as a function of the radial position within the tubular body. In an exemplary embodiment, the yield point of the inner tubular portion of the tubular body varies in an non-linear fashion as a function of the radial position within the tubular body. In an exemplary embodiment, the yield point of the outer tubular portion of the tubular body varies as a function of the radial position within the tubular body. In an exemplary embodiment, the yield point of the outer tubular portion of the tubular body varies in an linear fashion as a function of the radial position within the tubular body. In an exemplary embodiment, the yield point of the outer tubular portion of the tubular body varies in an non-linear fashion as a function of the radial position within the tubular body. In an exemplary embodiment, the yield point of the inner tubular portion of the tubular body varies as a function of the radial position within the tubular body; and wherein the yield point of the outer tubular portion of the tubular body varies as a function of the radial position within the tubular body. In an exemplary embodiment, the yield point of the inner tubular portion of the tubular body varies in a linear fashion as a function of the radial position within the tubular body; and wherein the yield point of the outer tubular portion of the tubular body varies in a linear fashion as a function of the radial position within the tubular body. In an exemplary embodiment, the yield point of the inner tubular portion of the tubular body varies in a linear fashion as a function of the radial position within the tubular body; and wherein the yield point of the outer tubular portion of the tubular body varies in a non-linear fashion as a function of the radial position within the tubular body. In an exemplary embodiment, the yield point of the inner tubular portion of the tubular body varies in a non-linear fashion as a function of the radial position within the tubular body; and wherein the yield point of the outer tubular portion of the tubular body varies in a linear fashion as a function of the radial position within the tubular body. In an exemplary embodiment, the yield point of the inner tubular portion of the tubular body varies in a non-linear fashion as a function of the radial position within the tubular body; and wherein the yield point of the outer tubular portion of the tubular body varies in a non-linear fashion as a function of the radial position within the tubular body. In an exemplary embodiment, the rate of change of the yield point of the inner tubular portion of the tubular body is different than the rate of change of the yield point of the outer tubular portion of the tubular body. In an exemplary embodiment, the rate of change of the yield point of the inner tubular portion of the tubular body is different than the rate of change of the yield point of the outer tubular portion of the tubular body. In an exemplary embodiment, at least a portion of the tubular assembly comprises a microstructure comprising a hard phase structure and a soft phase structure. In an exemplary embodiment, prior to the radial expansion and plastic deformation, at least a portion of the tubular assembly comprises a microstructure comprising a transitional phase structure. In an exemplary embodiment, wherein the hard phase structure comprises martensite. In an exemplary embodiment, wherein the soft phase structure comprises ferrite. In an exemplary embodiment, wherein the transitional phase structure comprises retained austentite. In an exemplary embodiment, the hard phase structure comprises martensite; wherein the soft phase structure comprises ferrite; and wherein the transitional phase structure comprises retained austentite. In an exemplary embodiment, the portion of the tubular assembly comprising a microstructure comprising a hard phase structure and a soft phase structure comprises, by weight percentage, about 0.1% C, about 1.2% Mn, and about 0.3% Si. In an exemplary embodiment, at least a portion of the tubular assembly comprises a microstructure comprising a hard phase structure and a soft phase structure. In an exemplary embodiment, the portion of the tubular assembly comprises, by weight percentage, 0.065% C, 1.44% Mn, 0.01% P, 0.002% S, 0.24% Si, 0.01% Cu, 0.01% Ni, 0.02% Cr. 0.05% V, 0.01% Mo, 0.01% Nb, and 0.01% Ti. In an exemplary embodiment, the portion of the tubular assembly comprises, by weight percentage, 0.18% C, 1.28% Mn, 0.017% P, 0.004% S, 0.29% Si, 0.01% Cu, 0.01% Ni, 0.03% Cr, 0.04% V, 0.01% Mo, 0.03% Nb, and 0.01% Ti. In an exemplary embodiment, the portion of the tubular assembly comprises, by weight percentage, 0.08% C, 0.82% Mn, 0.006% P, 0.003% S, 0.30% Si, 0.06% Cu, 0.05% Ni, 0.05% Cr, 0.03% V, 0.03% Mo, 0.01% Nb, and 0.01% Ti. In an exemplary embodiment, the portion of the tubular assembly comprises a microstructure comprising one or more of the following: martensite, pearlite, vanadium carbide, nickel carbide, or titanium carbide. In an exemplary embodiment, the portion of the tubular assembly comprises a microstructure comprising one or more of the following: pearlite or pearlite striation. In an exemplary embodiment, the portion of the tubular assembly comprises a microstructure comprising one or more of the following: grain pearlite, widmanstatten martensite, vanadium carbide, nickel carbide, or titanium carbide. In an exemplary embodiment, the portion of the tubular assembly comprises a microstructure comprising one or more of the following: ferrite, grain pearlite, or martensite. In an exemplary embodiment, the portion of the tubular assembly comprises a microstructure comprising one or more of the following: ferrite, martensite, or bainite. In an exemplary embodiment, the portion of the tubular assembly comprises a microstructure comprising one or more of the following: bainite, pearlite, or ferrite. In an exemplary embodiment, the portion of the tubular assembly comprises a yield strength of about 67 ksi and a tensile strength of about 95 ksi. In an exemplary embodiment, the portion of the tubular assembly comprises a yield strength of about 82 ksi and a tensile strength of about 130 ksi. In an exemplary embodiment, the portion of the tubular assembly comprises a yield strength of about 60 ksi and a tensile strength of about 97 ksi.

An expandable tubular member has been described, wherein a yield point of the expandable tubular member after a radial expansion and plastic deformation is at least about 5.8% greater than the yield point of the expandable tubular member prior to the radial expansion and plastic deformation. In an exemplary embodiment, the tubular member includes a wellbore casing, a pipeline, or a structural support.

A method of determining the expandability of a selected tubular member has been described that includes determining an anisotropy value for the selected tubular member, determining a strain hardening value for the selected tubular member; and multiplying the anisotropy value times the strain hardening value to generate an expandability value for the selected tubular member. In an exemplary embodiment, an anisotropy value greater than 0.12 indicates that the tubular member is suitable for radial expansion and plastic deformation. In an exemplary embodiment, the tubular member includes a wellbore casing, a pipeline, or a structural support.

A method of radially expanding and plastically deforming tubular members has been described that includes selecting a tubular member; determining an anisotropy value for the selected tubular member; determining a strain hardening value for the selected tubular member; multiplying the anisotropy value times the strain hardening value to generate an expandability value for the selected tubular member; and if the anisotropy value is greater than 0.12, then radially expanding and plastically deforming the selected tubular member. In an exemplary embodiment, the tubular member includes a wellbore casing, a pipeline, or a structural support. In an exemplary embodiment, radially expanding and plastically deforming the selected tubular member includes: inserting the selected tubular member into a preexisting structure; and then radially expanding and plastically deforming the selected tubular member. In an exemplary embodiment, the preexisting structure includes a wellbore that traverses a subterranean formation.

A radially expandable multiple tubular member apparatus has been described that includes a first tubular member; a second tubular member engaged with the first tubular member forming a joint; a sleeve overlapping and coupling the first and second tubular members at the joint; the sleeve having opposite tapered ends and a flange engaged in a recess formed in an adjacent tubular member; and one of the tapered ends being a surface formed on the flange. In an exemplary embodiment, the recess includes a tapered wall in mating engagement with the tapered end formed on the flange. In an exemplary embodiment, the sleeve includes a flange at each tapered end and each tapered end is formed on a respective flange. In an exemplary embodiment, each tubular member includes a recess. In an exemplary embodiment, each flange is engaged in a respective one of the recesses. In an exemplary embodiment, each recess includes a tapered wall in mating engagement with the tapered end formed on a respective one of the flanges.

A method of joining radially expandable multiple tubular members has also been described that includes providing a first tubular member; engaging a second tubular member with the first tubular member to form a joint; providing a sleeve having opposite tapered ends and a flange, one of the tapered ends being a surface formed on the flange; and mounting the sleeve for overlapping and coupling the first and second tubular members at the joint, wherein the flange is engaged in a recess formed in an adjacent one of the tubular members. In an exemplary embodiment, the method further includes providing a tapered wall in the recess for mating engagement with the tapered end formed on the flange. In an exemplary embodiment, the method further includes providing a flange at each tapered end wherein each tapered end is formed on a respective flange. In an exemplary embodiment, the method further includes providing a recess in each tubular member. In an exemplary embodiment, the method further includes engaging each flange in a respective one of the recesses. In an exemplary embodiment, the method further includes providing a tapered wall in each recess for mating engagement with the tapered end formed on a respective one of the flanges.

A radially expandable multiple tubular member apparatus has been described that includes a first tubular member; a second tubular member engaged with the first tubular member forming a joint; and a sleeve overlapping and coupling the first and second tubular members at the joint; wherein at least a portion of the sleeve is comprised of a frangible material.

A radially expandable multiple tubular member apparatus has been described that includes a first tubular member; a second tubular member engaged with the first tubular member forming a joint; and a sleeve overlapping and coupling the first and second tubular members at the joint; wherein the wall thickness of the sleeve is variable.

A method of joining radially expandable multiple tubular members has been described that includes providing a first tubular member; engaging a second tubular member with the first tubular member to form a joint; providing a sleeve comprising a frangible material; and mounting the sleeve for overlapping and coupling the first and second tubular members at the joint.

A method of joining radially expandable multiple tubular members has been described that includes providing a first tubular member; engaging a second tubular member with the first tubular member to form a joint; providing a sleeve comprising a variable wall thickness; and mounting the sleeve for overlapping and coupling the first and second tubular members at the joint.

An expandable tubular assembly has been described that includes a first tubular member; a second tubular member coupled to the first tubular member; and means for increasing the axial compression loading capacity of the coupling between the first and second tubular members before and after a radial expansion and plastic deformation of the first and second tubular members.

An expandable tubular assembly has been described that includes a first tubular member; a second tubular member coupled to the first tubular member; and means for increasing the axial tension loading capacity of the coupling between the first and second tubular members before and after a radial expansion and plastic deformation of the first and second tubular members.

An expandable tubular assembly has been described that includes a first tubular member; a second tubular member coupled to the first tubular member; and means for increasing the axial compression and tension loading capacity of the coupling between the first and second tubular members before and after a radial expansion and plastic deformation of the first and second tubular members.

An expandable tubular assembly has been described that includes a first tubular member; a second tubular member coupled to the first tubular member; and means for avoiding stress risers in the coupling between the first and second tubular members before and after a radial expansion and plastic deformation of the first and second tubular members.

An expandable tubular assembly has been described that includes a first tubular member; a second tubular member coupled to the first tubular member; and means for inducing stresses at selected portions of the coupling between the first and second tubular members before and after a radial expansion and plastic deformation of the first and second tubular members.

In several exemplary embodiments of the apparatus described above, the sleeve is circumferentially tensioned; and wherein the first and second tubular members are circumferentially compressed.

In several exemplary embodiments of the method described above, the method further includes maintaining the sleeve in circumferential tension; and maintaining the first and second tubular members in circumferential compression before, during, and/or after the radial expansion and plastic deformation of the first and second tubular members.

An expandable tubular assembly has been described that includes a first tubular member, a second tubular member coupled to the first tubular member, a first threaded connection for coupling a portion of the first and second tubular members, a second threaded connection spaced apart from the first threaded connection for coupling another portion of the first and second tubular members, a tubular sleeve coupled to and receiving end portions of the first and second tubular members, and a sealing element positioned between the first and second spaced apart threaded connections for sealing an interface between the first and second tubular member, wherein the sealing element is positioned within an annulus defined between the first and second tubular members. In an exemplary embodiment, the annulus is at least partially defined by an irregular surface. In an exemplary embodiment, the annulus is at least partially defined by a toothed surface. In an exemplary embodiment, the sealing element comprises an elastomeric material. In an exemplary embodiment, the sealing element comprises a metallic material. In an exemplary embodiment, the sealing element comprises an elastomeric and a metallic material.

A method of joining radially expandable multiple tubular members has been described that includes providing a first tubular member, providing a second tubular member, providing a sleeve, mounting the sleeve for overlapping and coupling the first and second tubular members, threadably coupling the first and second tubular members at a first location, threadably coupling the first and second tubular members at a second location spaced apart from the first location, and sealing an interface between the first and second tubular members between the first and second locations using a compressible sealing element. In an exemplary embodiment, the sealing element includes an irregular surface. In an exemplary embodiment, the sealing element includes a toothed surface. In an exemplary embodiment, the sealing element comprises an elastomeric material. In an exemplary embodiment, the sealing element comprises a metallic material. In an exemplary embodiment, the sealing element comprises an elastomeric and a metallic material.

An expandable tubular assembly has been described that includes a first tubular member, a second tubular member coupled to the first tubular member, a first threaded connection for coupling a portion of the first and second tubular members, a second threaded connection spaced apart from the first threaded connection for coupling another portion of the first and second tubular members, and a plurality of spaced apart tubular sleeves coupled to and receiving end portions of the first and second tubular members. In an exemplary embodiment, at least one of the tubular sleeves is positioned in opposing relation to the first threaded connection; and wherein at least one of the tubular sleeves is positioned in opposing relation to the second threaded connection. In an exemplary embodiment, at least one of the tubular sleeves is not positioned in opposing relation to the first and second threaded connections.

A method of joining radially expandable multiple tubular members has been described that includes providing a first tubular member, providing a second tubular member, threadably coupling the first and second tubular members at a first location, threadably coupling the first and second tubular members at a second location spaced apart from the first location, providing a plurality of sleeves, and mounting the sleeves at spaced apart locations for overlapping and coupling the first and second tubular members. In an exemplary embodiment, at least one of the tubular sleeves is positioned in opposing relation to the first threaded coupling; and wherein at least one of the tubular sleeves is positioned in opposing relation to the second threaded coupling. In an exemplary embodiment, at least one of the tubular sleeves is not positioned in opposing relation to the first and second threaded couplings.

An expandable tubular assembly has been described that includes a first tubular member, a second tubular member coupled to the first tubular member, and a plurality of spaced apart tubular sleeves coupled to and receiving end portions of the first and second tubular members.

A method of joining radially expandable multiple tubular members has been described that includes providing a first tubular member, providing a second tubular member, providing a plurality of sleeves, coupling the first and second tubular members, and mounting the sleeves at spaced apart locations for overlapping and coupling the first and second tubular members.

An expandable tubular assembly has been described that includes a first tubular member, a second tubular member coupled to the first tubular member, a threaded connection for coupling a portion of the first and second tubular members, and a tubular sleeves coupled to and receiving end portions of the first and second tubular members, wherein at least a portion of the threaded connection is upset. In an exemplary embodiment, at least a portion of tubular sleeve penetrates the first tubular member.

A method of joining radially expandable multiple tubular members has been described that includes providing a first tubular member, providing a second tubular member, threadably coupling the first and second tubular members, and upsetting the threaded coupling. In an exemplary embodiment, the first tubular member further comprises an annular extension extending therefrom, and the flange of the sleeve defines an annular recess for receiving and mating with the annular extension of the first tubular member. In an exemplary embodiment, the first tubular member further comprises an annular extension extending therefrom; and the flange of the sleeve defines an annular recess for receiving and mating with the annular extension of the first tubular member.

A radially expandable multiple tubular member apparatus has been described that includes a first tubular member, a second tubular member engaged with the first tubular member forming a joint, a sleeve overlapping and coupling the first and second tubular members at the joint, and one or more stress concentrators for concentrating stresses in the joint. In an exemplary embodiment, one or more of the stress concentrators comprises one or more external grooves defined in the first tubular member. In an exemplary embodiment, one or more of the stress concentrators comprises one or more internal grooves defined in the second tubular member. In an exemplary embodiment, one or more of the stress concentrators comprises one or more openings defined in the sleeve. In an exemplary embodiment, one or more of the stress concentrators comprises one or more external grooves defined in the first tubular member; and one or more of the stress concentrators comprises one or more internal grooves defined in the second tubular member. In an exemplary embodiment, one or more of the stress concentrators comprises one or more external grooves defined in the first tubular member; and one or more of the stress concentrators comprises one or more openings defined in the sleeve. In an exemplary embodiment, one or more of the stress concentrators comprises one or more internal grooves defined in the second tubular member; and one or more of the stress concentrators comprises one or more openings defined in the sleeve. In an exemplary embodiment, one or more of the stress concentrators comprises one or more external grooves defined in the first tubular member; wherein one or more of the stress concentrators comprises one or more internal grooves defined in the second tubular member; and wherein one or more of the stress concentrators comprises one or more openings defined in the sleeve.

A method of joining radially expandable multiple tubular members has been described that includes providing a first tubular member, engaging a second tubular member with the first tubular member to form a joint, providing a sleeve having opposite tapered ends and a flange, one of the tapered ends being a surface formed on the flange, and concentrating stresses within the joint. In an exemplary embodiment, concentrating stresses within the joint comprises using the first tubular member to concentrate stresses within the joint. In an exemplary embodiment, concentrating stresses within the joint comprises using the second tubular member to concentrate stresses within the joint. In an exemplary embodiment, concentrating stresses within the joint comprises using the sleeve to concentrate stresses within the joint. In an exemplary embodiment, concentrating stresses within the joint comprises using the first tubular member and the second tubular member to concentrate stresses within the joint. In an exemplary embodiment, concentrating stresses within the joint comprises using the first tubular member and the sleeve to concentrate stresses within the joint. In an exemplary embodiment, concentrating stresses within the joint comprises using the second tubular member and the sleeve to concentrate stresses within the joint. In an exemplary embodiment, concentrating stresses within the joint comprises using the first tubular member, the second tubular member, and the sleeve to concentrate stresses within the joint.

A system for radially expanding and plastically deforming a first tubular member coupled to a second tubular member by a mechanical connection has been described that includes means for radially expanding the first and second tubular members, and means for maintaining portions of the first and second tubular member in circumferential compression following the radial expansion and plastic deformation of the first and second tubular members.

A system for radially expanding and plastically deforming a first tubular member coupled to a second tubular member by a mechanical connection has been described that includes means for radially expanding the first and second tubular members; and means for concentrating stresses within the mechanical connection during the radial expansion and plastic deformation of the first and second tubular members.

A system for radially expanding and plastically deforming a first tubular member coupled to a second tubular member by a mechanical connection has been described that includes means for radially expanding the first and second tubular members; means for maintaining portions of the first and second tubular member in circumferential compression following the radial expansion and plastic deformation of the first and second tubular members; and means for concentrating stresses within the mechanical connection during the radial expansion and plastic deformation of the first and second tubular members.

A radially expandable tubular member apparatus has been described that includes a first tubular member; a second tubular member engaged with the first tubular member forming a joint; and a sleeve overlapping and coupling the first and second tubular members at the joint; wherein, prior to a radial expansion and plastic deformation of the apparatus, a predetermined portion of the apparatus has a lower yield point than another portion of the apparatus. In an exemplary embodiment, the carbon content of the predetermined portion of the apparatus is less than or equal to 0.12 percent; and wherein the carbon equivalent value for the predetermined portion of the apparatus is less than 0.21. In an exemplary embodiment, the carbon content of the predetermined portion of the apparatus is greater than 0.12 percent; and wherein the carbon equivalent value for the predetermined portion of the apparatus is less than 0.36. In an exemplary embodiment, the apparatus further includes means for maintaining portions of the first and second tubular member in circumferential compression following the radial expansion and plastic deformation of the first and second tubular members. In an exemplary embodiment, the apparatus further includes means for concentrating stresses within the mechanical connection during the radial expansion and plastic deformation of the first and second tubular members. In an exemplary embodiment, the apparatus further includes means for maintaining portions of the first and second tubular member in circumferential compression following the radial expansion and plastic deformation of the first and second tubular members; and means for concentrating stresses within the mechanical connection during the radial expansion and plastic deformation of the first and second tubular members. In an exemplary embodiment, the apparatus further includes one or more stress concentrators for concentrating stresses in the joint. In an exemplary embodiment, one or more of the stress concentrators comprises one or more external grooves defined in the first tubular member. In an exemplary embodiment, one or more of the stress concentrators comprises one or more internal grooves defined in the second tubular member. In an exemplary embodiment, one or more of the stress concentrators comprises one or more openings defined in the sleeve. In an exemplary embodiment, one or more of the stress concentrators comprises one or more external grooves defined in the first tubular member; and wherein one or more of the stress concentrators comprises one or more internal grooves defined in the second tubular member. In an exemplary embodiment, one or more of the stress concentrators comprises one or more external grooves defined in the first tubular member; and wherein one or more of the stress concentrators comprises one or more openings defined in the sleeve. In an exemplary embodiment, one or more of the stress concentrators comprises one or more internal grooves defined in the second tubular member; and wherein one or more of the stress concentrators comprises one or more openings defined in the sleeve. In an exemplary embodiment, one or more of the stress concentrators comprises one or more external grooves defined in the first tubular member; wherein one or more of the stress concentrators comprises one or more internal grooves defined in the second tubular member; and wherein one or more of the stress concentrators comprises one or more openings defined in the sleeve. In an exemplary embodiment, the first tubular member further comprises an annular extension extending therefrom; and wherein the flange of the sleeve defines an annular recess for receiving and mating with the annular extension of the first tubular member. In an exemplary embodiment, the apparatus further includes a threaded connection for coupling a portion of the first and second tubular members; wherein at least a portion of the threaded connection is upset. In an exemplary embodiment, at least a portion of tubular sleeve penetrates the first tubular member. In an exemplary embodiment, the apparatus further includes means for increasing the axial compression loading capacity of the joint between the first and second tubular members before and after a radial expansion and plastic deformation of the first and second tubular members. In an exemplary embodiment, the apparatus further includes means for increasing the axial tension loading capacity of the joint between the first and second tubular members before and after a radial expansion and plastic deformation of the first and second tubular members. In an exemplary embodiment, the apparatus further includes means for increasing the axial compression and tension loading capacity of the joint between the first and second tubular members before and after a radial expansion and plastic deformation of the first and second tubular members. In an exemplary embodiment, the apparatus further includes means for avoiding stress risers in the joint between the first and second tubular members before and after a radial expansion and plastic deformation of the first and second tubular members. In an exemplary embodiment, the apparatus further includes means for inducing stresses at selected portions of the coupling between the first and second tubular members before and after a radial expansion and plastic deformation of the first and second tubular members. In an exemplary embodiment, the sleeve is circumferentially tensioned; and wherein the first and second tubular members are circumferentially compressed. In an exemplary embodiment, the means for increasing the axial compression loading capacity of the coupling between the first and second tubular members before and after a radial expansion and plastic deformation of the first and second tubular members is circumferentially tensioned; and wherein the first and second tubular members are circumferentially compressed. In an exemplary embodiment, the means for increasing the axial tension loading capacity of the coupling between the first and second tubular members before and after a radial expansion and plastic deformation of the first and second tubular members is circumferentially tensioned; and wherein the first and second tubular members are circumferentially compressed. In an exemplary embodiment, the means for increasing the axial compression and tension loading capacity of the coupling between the first and second tubular members before and after a radial expansion and plastic deformation of the first and second tubular members is circumferentially tensioned; and wherein the first and second tubular members are circumferentially compressed. In an exemplary embodiment, the means for avoiding stress risers in the coupling between the first and second tubular members before and after a radial expansion and plastic deformation of the first and second tubular members is circumferentially tensioned; and wherein the first and second tubular members are circumferentially compressed. In an exemplary embodiment, the means for inducing stresses at selected portions of the coupling between the first and second tubular members before and after a radial expansion and plastic deformation of the first and second tubular members is circumferentially tensioned; and wherein the first and second tubular members are circumferentially compressed. In an exemplary embodiment, at least a portion of the sleeve is comprised of a frangible material. In an exemplary embodiment, the wall thickness of the sleeve is variable. In an exemplary embodiment, the predetermined portion of the apparatus has a higher ductility and a lower yield point prior to the radial expansion and plastic deformation than after the radial expansion and plastic deformation. In an exemplary embodiment, the predetermined portion of the apparatus has a higher ductility prior to the radial expansion and plastic deformation than after the radial expansion and plastic deformation. In an exemplary embodiment, the predetermined portion of the apparatus has a lower yield point prior to the radial expansion and plastic deformation than after the radial expansion and plastic deformation. In an exemplary embodiment, the predetermined portion of the apparatus has a larger inside diameter after the radial expansion and plastic deformation than other portions of the tubular assembly. In an exemplary embodiment, the sleeve is circumferentially tensioned; and wherein the first and second tubular members are circumferentially compressed. In an exemplary embodiment, the sleeve is circumferentially tensioned; and wherein the first and second tubular members are circumferentially compressed. In an exemplary embodiment, the apparatus further includes positioning another apparatus within the preexisting structure in overlapping relation to the apparatus; and radially expanding and plastically deforming the other apparatus within the preexisting structure; wherein, prior to the radial expansion and plastic deformation of the apparatus, a predetermined portion of the other apparatus has a lower yield point than another portion of the other apparatus. In an exemplary embodiment, the inside diameter of the radially expanded and plastically deformed other portion of the apparatus is equal to the inside diameter of the radially expanded and plastically deformed other portion of the other apparatus. In an exemplary embodiment, the predetermined portion of the apparatus comprises an end portion of the apparatus. In an exemplary embodiment, the predetermined portion of the apparatus comprises a plurality of predetermined portions of the apparatus. In an exemplary embodiment, the predetermined portion of the apparatus comprises a plurality of spaced apart predetermined portions of the apparatus. In an exemplary embodiment, the other portion of the apparatus comprises an end portion of the apparatus. In an exemplary embodiment, the other portion of the apparatus comprises a plurality of other portions of the apparatus. In an exemplary embodiment, the other portion of the apparatus comprises a plurality of spaced apart other portions of the apparatus. In an exemplary embodiment, the apparatus comprises a plurality of tubular members coupled to one another by corresponding tubular couplings. In an exemplary embodiment, the tubular couplings comprise the predetermined portions of the apparatus; and wherein the tubular members comprise the other portion of the apparatus. In an exemplary embodiment, one or more of the tubular couplings comprise the predetermined portions of the apparatus. In an exemplary embodiment, one or more of the tubular members comprise the predetermined portions of the apparatus. In an exemplary embodiment, the predetermined portion of the apparatus defines one or more openings. In an exemplary embodiment, one or more of the openings comprise slots. In an exemplary embodiment, the anisotropy for the predetermined portion of the apparatus is greater than 1. In an exemplary embodiment, the anisotropy for the predetermined portion of the apparatus is greater than 1. In an exemplary embodiment, the strain hardening exponent for the predetermined portion of the apparatus is greater than 0.12. In an exemplary embodiment, the anisotropy for the predetermined portion of the apparatus is greater than 1; and wherein the strain hardening exponent for the predetermined portion of the apparatus is greater than 0.12. In an exemplary embodiment, the predetermined portion of the apparatus comprises a first steel alloy comprising: 0.065% C, 1.44% Mn, 0.01% P, 0.002% S, 0.24% Si, 0.01% Cu, 0.01% Ni, and 0.02% Cr. In an exemplary embodiment, the yield point of the predetermined portion of the apparatus is at most about 46.9 ksi prior to the radial expansion and plastic deformation; and wherein the yield point of the predetermined portion of the apparatus is at least about 65.9 ksi after the radial expansion and plastic deformation. In an exemplary embodiment, the yield point of the predetermined portion of the apparatus after the radial expansion and plastic deformation is at least about 40% greater than the yield point of the predetermined portion of the apparatus prior to the radial expansion and plastic deformation. In an exemplary embodiment, the anisotropy of the predetermined portion of the apparatus, prior to the radial expansion and plastic deformation, is about 1.48. In an exemplary embodiment, the predetermined portion of the apparatus comprises a second steel alloy comprising: 0.18% C, 1.28% Mn, 0.017% P, 0.004% S, 0.29% Si, 0.01% Cu, 0.01% Ni, and 0.03% Cr. In an exemplary embodiment, the yield point of the predetermined portion of the apparatus is at most about 57.8 ksi prior to the radial expansion and plastic deformation; and wherein the yield point of the predetermined portion of the apparatus is at least about 74.4 ksi after the radial expansion and plastic deformation. In an exemplary embodiment, the yield point of the predetermined portion of the apparatus after the radial expansion and plastic deformation is at least about 28% greater than the yield point of the predetermined portion of the apparatus prior to the radial expansion and plastic deformation. In an exemplary embodiment, the anisotropy of the predetermined portion of the apparatus, prior to the radial expansion and plastic deformation, is about 1.04. In an exemplary embodiment, the predetermined portion of the apparatus comprises a third steel alloy comprising: 0.08% C, 0.82% Mn, 0.006% P, 0.003% S, 0.30% Si, 0.16% Cu, 0.05% Ni, and 0.05% Cr. In an exemplary embodiment, the anisotropy of the predetermined portion of the apparatus, prior to the radial expansion and plastic deformation, is about 1.92. In an exemplary embodiment, the predetermined portion of the apparatus comprises a fourth steel alloy comprising: 0.02% C, 1.31% Mn, 0.02% P, 0.001% S, 0.45% Si, 9.1% Ni, and 18.7% Cr. In an exemplary embodiment, the anisotropy of the predetermined portion of the apparatus, prior to the radial expansion and plastic deformation, is about 1.34. In an exemplary embodiment, the yield point of the predetermined portion of the apparatus is at most about 46.9 ksi prior to the radial expansion and plastic deformation; and wherein the yield point of the predetermined portion of the apparatus is at least about 65.9 ksi after the radial expansion and plastic deformation. In an exemplary embodiment, the yield point of the predetermined portion of the apparatus after the radial expansion and plastic deformation is at least about 40% greater than the yield point of the predetermined portion of the apparatus prior to the radial expansion and plastic deformation. In an exemplary embodiment, the anisotropy of the predetermined portion of the apparatus, prior to the radial expansion and plastic deformation, is at least about 1.48. In an exemplary embodiment, the yield point of the predetermined portion of the apparatus is at most about 57.8 ksi prior to the radial expansion and plastic deformation; and wherein the yield point of the predetermined portion of the apparatus is at least about 74.4 ksi after the radial expansion and plastic deformation. In an exemplary embodiment, the yield point of the predetermined portion of the apparatus after the radial expansion and plastic deformation is at least about 28% greater than the yield point of the predetermined portion of the apparatus prior to the radial expansion and plastic deformation. In an exemplary embodiment, the anisotropy of the predetermined portion of the apparatus, prior to the radial expansion and plastic deformation, is at least about 1.04. In an exemplary embodiment, the anisotropy of the predetermined portion of the apparatus, prior to the radial expansion and plastic deformation, is at least about 1.92. In an exemplary embodiment, the anisotropy of the predetermined portion of the apparatus, prior to the radial expansion and plastic deformation, is at least about 1.34. In an exemplary embodiment, the anisotropy of the predetermined portion of the apparatus, prior to the radial expansion and plastic deformation, ranges from about 1.04 to about 1.92. In an exemplary embodiment, the yield point of the predetermined portion of the apparatus, prior to the radial expansion and plastic deformation, ranges from about 47.6 ksi to about 61.7 ksi. In an exemplary embodiment, the expandability coefficient of the predetermined portion of the apparatus, prior to the radial expansion and plastic deformation, is greater than 0.12. In an exemplary embodiment, the expandability coefficient of the predetermined portion of the apparatus is greater than the expandability coefficient of the other portion of the apparatus. In an exemplary embodiment, the apparatus comprises a wellbore casing. In an exemplary embodiment, the apparatus comprises a pipeline. In an exemplary embodiment, the apparatus comprises a structural support.

A radially expandable tubular member apparatus has been described that includes a first tubular member; a second tubular member engaged with the first tubular member forming a joint; a sleeve overlapping and coupling the first and second tubular members at the joint; the sleeve having opposite tapered ends and a flange engaged in a recess formed in an adjacent tubular member; and one of the tapered ends being a surface formed on the flange; wherein, prior to a radial expansion and plastic deformation of the apparatus, a predetermined portion of the apparatus has a lower yield point than another portion of the apparatus. In an exemplary embodiment, the recess includes a tapered wall in mating engagement with the tapered end formed on the flange. In an exemplary embodiment, the sleeve includes a flange at each tapered end and each tapered end is formed on a respective flange. In an exemplary embodiment, each tubular member includes a recess. In an exemplary embodiment, each flange is engaged in a respective one of the recesses. In an exemplary embodiment, each recess includes a tapered wall in mating engagement with the tapered end formed on a respective one of the flanges. In an exemplary embodiment, the predetermined portion of the apparatus has a higher ductility and a lower yield point prior to the radial expansion and plastic deformation than after the radial expansion and plastic deformation. In an exemplary embodiment, the predetermined portion of the apparatus has a higher ductility prior to the radial expansion and plastic deformation than after the radial expansion and plastic deformation. In an exemplary embodiment, the predetermined portion of the apparatus has a lower yield point prior to the radial expansion and plastic deformation than after the radial expansion and plastic deformation. In an exemplary embodiment, the predetermined portion of the apparatus has a larger inside diameter after the radial expansion and plastic deformation than other portions of the tubular assembly. In an exemplary embodiment, the apparatus further includes positioning another apparatus within the preexisting structure in overlapping relation to the apparatus; and radially expanding and plastically deforming the other apparatus within the preexisting structure; wherein, prior to the radial expansion and plastic deformation of the apparatus, a predetermined portion of the other apparatus has a lower yield point than another portion of the other apparatus. In an exemplary embodiment, the inside diameter of the radially expanded and plastically deformed other portion of the apparatus is equal to the inside diameter of the radially expanded and plastically deformed other portion of the other apparatus. In an exemplary embodiment, the predetermined portion of the apparatus comprises an end portion of the apparatus. In an exemplary embodiment, the predetermined portion of the apparatus comprises a plurality of predetermined portions of the apparatus. In an exemplary embodiment, the predetermined portion of the apparatus comprises a plurality of spaced apart predetermined portions of the apparatus. In an exemplary embodiment, the other portion of the apparatus comprises an end portion of the apparatus. In an exemplary embodiment, the other portion of the apparatus comprises a plurality of other portions of the apparatus. In an exemplary embodiment, the other portion of the apparatus comprises a plurality of spaced apart other portions of the apparatus. In an exemplary embodiment, the apparatus comprises a plurality of tubular members coupled to one another by corresponding tubular couplings. In an exemplary embodiment, the tubular couplings comprise the predetermined portions of the apparatus; and wherein the tubular members comprise the other portion of the apparatus. In an exemplary embodiment, one or more of the tubular couplings comprise the predetermined portions of the apparatus. In an exemplary embodiment, one or more of the tubular members comprise the predetermined portions of the apparatus. In an exemplary embodiment, the predetermined portion of the apparatus defines one or more openings. In an exemplary embodiment, one or more of the openings comprise slots. In an exemplary embodiment, the anisotropy for the predetermined portion of the apparatus is greater than 1. In an exemplary embodiment, the anisotropy for the predetermined portion of the apparatus is greater than 1. In an exemplary embodiment, the strain hardening exponent for the predetermined portion of the apparatus is greater than 0.12. In an exemplary embodiment, the anisotropy for the predetermined portion of the apparatus is greater than 1; and wherein the strain hardening exponent for the predetermined portion of the apparatus is greater than 0.12. In an exemplary embodiment, the predetermined portion of the apparatus comprises a first steel alloy comprising: 0.065% C, 1.44% Mn, 0.01% P, 0.002% S, 0.24% Si, 0.01% Cu, 0.01% Ni, and 0.02% Cr. In an exemplary embodiment, the yield point of the predetermined portion of the apparatus is at most about 46.9 ksi prior to the radial expansion and plastic deformation; and wherein the yield point of the predetermined portion of the apparatus is at least about 65.9 ksi after the radial expansion and plastic deformation. In an exemplary embodiment, the yield point of the predetermined portion of the apparatus after the radial expansion and plastic deformation is at least about 40% greater than the yield point of the predetermined portion of the apparatus prior to the radial expansion and plastic deformation. In an exemplary embodiment, the anisotropy of the predetermined portion of the apparatus, prior to the radial expansion and plastic deformation, is about 1.48. In an exemplary embodiment, the predetermined portion of the apparatus comprises a second steel alloy comprising: 0.18% C, 1.28% Mn, 0.017% P, 0.004% S, 0.29% Si, 0.01% Cu, 0.01% Ni, and 0.03% Cr. In an exemplary embodiment, the yield point of the predetermined portion of the apparatus is at most about 57.8 ksi prior to the radial expansion and plastic deformation; and wherein the yield point of the predetermined portion of the apparatus is at least about 74.4 ksi after the radial expansion and plastic deformation. In an exemplary embodiment, the yield point of the predetermined portion of the apparatus after the radial expansion and plastic deformation is at least about 28% greater than the yield point of the predetermined portion of the apparatus prior to the radial expansion and plastic deformation. In an exemplary embodiment, the anisotropy of the predetermined portion of the apparatus, prior to the radial expansion and plastic deformation, is about 1.04. In an exemplary embodiment, the predetermined portion of the apparatus comprises a third steel alloy comprising: 0.08% C, 0.82% Mn, 0.006% P, 0.003% S, 0.30% Si, 0.16% Cu. 0.05% Ni, and 0.05% Cr. In an exemplary embodiment, the anisotropy of the predetermined portion of the apparatus, prior to the radial expansion and plastic deformation, is about 1.92. In an exemplary embodiment, the predetermined portion of the apparatus comprises a fourth steel alloy comprising: 0.02% C, 1.31% Mn, 0.02% P, 0.001% S, 0.45% Si, 9.1% Ni, and 18.7% Cr. In an exemplary embodiment, the anisotropy of the predetermined portion of the apparatus, prior to the radial expansion and plastic deformation, is about 1.34. In an exemplary embodiment, the yield point of the predetermined portion of the apparatus is at most about 46.9 ksi prior to the radial expansion and plastic deformation; and wherein the yield point of the predetermined portion of the apparatus is at least about 65.9 ksi after the radial expansion and plastic deformation. In an exemplary embodiment, the yield point of the predetermined portion of the apparatus after the radial expansion and plastic deformation is at least about 40% greater than the yield point of the predetermined portion of the apparatus prior to the radial expansion and plastic deformation. In an exemplary embodiment, the anisotropy of the predetermined portion of the apparatus, prior to the radial expansion and plastic deformation, is at least about 1.48. In an exemplary embodiment, the yield point of the predetermined portion of the apparatus is at most about 57.8 ksi prior to the radial expansion and plastic deformation; and wherein the yield point of the predetermined portion of the apparatus is at least about 74.4 ksi after the radial expansion and plastic deformation. In an exemplary embodiment, the yield point of the predetermined portion of the apparatus after the radial expansion and plastic deformation is at least about 28% greater than the yield point of the predetermined portion of the apparatus prior to the radial expansion and plastic deformation. In an exemplary embodiment, the anisotropy of the predetermined portion of the apparatus, prior to the radial expansion and plastic deformation, is at least about 1.04. In an exemplary embodiment, the anisotropy of the predetermined portion of the apparatus, prior to the radial expansion and plastic deformation, is at least about 1.92. In an exemplary embodiment, the anisotropy of the predetermined portion of the apparatus, prior to the radial expansion and plastic deformation, is at least about 1.34. In an exemplary embodiment, the anisotropy of the predetermined portion of the apparatus, prior to the radial expansion and plastic deformation, ranges from about 1.04 to about 1.92. In an exemplary embodiment, the yield point of the predetermined portion of the apparatus, prior to the radial expansion and plastic deformation, ranges from about 47.6 ksi to about 61.7 ksi. In an exemplary embodiment, the expandability coefficient of the predetermined portion of the apparatus, prior to the radial expansion and plastic deformation, is greater than 0.12. In an exemplary embodiment, the expandability coefficient of the predetermined portion of the apparatus is greater than the expandability coefficient of the other portion of the apparatus. In an exemplary embodiment, the apparatus comprises a wellbore casing. In an exemplary embodiment, the apparatus comprises a pipeline. In an exemplary embodiment, the apparatus comprises a structural support.

A method of joining radially expandable tubular members has been provided that includes: providing a first tubular member; engaging a second tubular member with the first tubular member to form a joint; providing a sleeve; mounting the sleeve for overlapping and coupling the first and second tubular members at the joint; wherein the first tubular member, the second tubular member, and the sleeve define a tubular assembly; and radially expanding and plastically deforming the tubular assembly; wherein, prior to the radial expansion and plastic deformation, a predetermined portion of the tubular assembly has a lower yield point than another portion of the tubular assembly. In an exemplary embodiment, the carbon content of the predetermined portion of the tubular assembly is less than or equal to 0.12 percent; and wherein the carbon equivalent value for the predetermined portion of the tubular assembly is less than 0.21. In an exemplary embodiment, the carbon content of the predetermined portion of the tubular assembly is greater than 0.12 percent; and wherein the carbon equivalent value for the predetermined portion of the tubular assembly is less than 0.36. In an exemplary embodiment, the method further includes: maintaining portions of the first and second tubular member in circumferential compression following a radial expansion and plastic deformation of the first and second tubular members. In an exemplary embodiment, the method further includes: concentrating stresses within the joint during a radial expansion and plastic deformation of the first and second tubular members. In an exemplary embodiment, the method further includes: maintaining portions of the first and second tubular member in circumferential compression following a radial expansion and plastic deformation of the first and second tubular members; and concentrating stresses within the joint during a radial expansion and plastic deformation of the first and second tubular members. In an exemplary embodiment, the method further includes: concentrating stresses within the joint. In an exemplary embodiment, concentrating stresses within the joint comprises using the first tubular member to concentrate stresses within the joint. In an exemplary embodiment, concentrating stresses within the joint comprises using the second tubular member to concentrate stresses within the joint. In an exemplary embodiment, concentrating stresses within the joint comprises using the sleeve to concentrate stresses within the joint. In an exemplary embodiment, concentrating stresses within the joint comprises using the first tubular member and the second tubular member to concentrate stresses within the joint. In an exemplary embodiment, concentrating stresses within the joint comprises using the first tubular member and the sleeve to concentrate stresses within the joint. In an exemplary embodiment, concentrating stresses within the joint comprises using the second tubular member and the sleeve to concentrate stresses within the joint. In an exemplary embodiment, concentrating stresses within the joint comprises using the first tubular member, the second tubular member, and the sleeve to concentrate stresses within the joint. In an exemplary embodiment, at least a portion of the sleeve is comprised of a frangible material. In an exemplary embodiment, the sleeve comprises a variable wall thickness. In an exemplary embodiment, the method further includes maintaining the sleeve in circumferential tension; and maintaining the first and second tubular members in circumferential compression. In an exemplary embodiment, the method further includes maintaining the sleeve in circumferential tension; and maintaining the first and second tubular members in circumferential compression. In an exemplary embodiment, the method further includes: maintaining the sleeve in circumferential tension; and maintaining the first and second tubular members in circumferential compression. In an exemplary embodiment, the method further includes: threadably coupling the first and second tubular members at a first location; threadably coupling the first and second tubular members at a second location spaced apart from the first location; providing a plurality of sleeves; and mounting the sleeves at spaced apart locations for overlapping and coupling the first and second tubular members. In an exemplary embodiment, at least one of the tubular sleeves is positioned in opposing relation to the first threaded coupling; and wherein at least one of the tubular sleeves is positioned in opposing relation to the second threaded coupling. In an exemplary embodiment, at least one of the tubular sleeves is not positioned in opposing relation to the first and second threaded couplings. In an exemplary embodiment, the method further includes: threadably coupling the first and second tubular members; and upsetting the threaded coupling. In an exemplary embodiment, the first tubular member further comprises an annular extension extending therefrom; and wherein the flange of the sleeve defines an annular recess for receiving and mating with the annular extension of the first tubular member. In an exemplary embodiment, the predetermined portion of the tubular assembly has a higher ductility and a lower yield point prior to the radial expansion and plastic deformation than after the radial expansion and plastic deformation. In an exemplary embodiment, the predetermined portion of the tubular assembly has a higher ductility prior to the radial expansion and plastic deformation than after the radial expansion and plastic deformation. In an exemplary embodiment, the predetermined portion of the tubular assembly has a lower yield point prior to the radial expansion and plastic deformation than after the radial expansion and plastic deformation. In an exemplary embodiment, the predetermined portion of the tubular assembly has a larger inside diameter after the radial expansion and plastic deformation than the other portion of the tubular assembly. In an exemplary embodiment, the method further includes: positioning another tubular assembly within the preexisting structure in overlapping relation to the tubular assembly; and radially expanding and plastically deforming the other tubular assembly within the preexisting structure; wherein, prior to the radial expansion and plastic deformation of the tubular assembly, a predetermined portion of the other tubular assembly has a lower yield point than another portion of the other tubular assembly. In an exemplary embodiment, the inside diameter of the radially expanded and plastically deformed other portion of the tubular assembly is equal to the inside diameter of the radially expanded and plastically deformed other portion of the other tubular assembly. In an exemplary embodiment, the predetermined portion of the tubular assembly comprises an end portion of the tubular assembly. In an exemplary embodiment, the predetermined portion of the tubular assembly comprises a plurality of predetermined portions of the tubular assembly. In an exemplary embodiment, the predetermined portion of the tubular assembly comprises a plurality of spaced apart predetermined portions of the tubular assembly. In an exemplary embodiment, the other portion of the tubular assembly comprises an end portion of the tubular assembly. In an exemplary embodiment, the other portion of the tubular assembly comprises a plurality of other portions of the tubular assembly. In an exemplary embodiment, the other portion of the tubular assembly comprises a plurality of spaced apart other portions of the tubular assembly. In an exemplary embodiment, the tubular assembly comprises a plurality of tubular members coupled to one another by corresponding tubular couplings. In an exemplary embodiment, the tubular couplings comprise the predetermined portions of the tubular assembly; and wherein the tubular members comprise the other portion of the tubular assembly. In an exemplary embodiment, one or more of the tubular couplings comprise the predetermined portions of the tubular assembly. In an exemplary embodiment, one or more of the tubular members comprise the predetermined portions of the tubular assembly. In an exemplary embodiment, the predetermined portion of the tubular assembly defines one or more openings. In an exemplary embodiment, one or more of the openings comprise slots. In an exemplary embodiment, the anisotropy for the predetermined portion of the tubular assembly is greater than 1. In an exemplary embodiment, the anisotropy for the predetermined portion of the tubular assembly is greater than 1. In an exemplary embodiment, the strain hardening exponent for the predetermined portion of the tubular assembly is greater than 0.12. In an exemplary embodiment, the anisotropy for the predetermined portion of the tubular assembly is greater than 1; and wherein the strain hardening exponent for the predetermined portion of the tubular assembly is greater than 0.12. In an exemplary embodiment, the predetermined portion of the tubular assembly comprises a first steel alloy comprising: 0.065% C, 1.44% Mn, 0.01% P, 0.002% S, 0.24% Si, 0.01% Cu, 0.01% Ni, and 0.02% Cr. In an exemplary embodiment, the yield point of the predetermined portion of the tubular assembly is at most about 46.9 ksi prior to the radial expansion and plastic deformation; and wherein the yield point of the predetermined portion of the tubular assembly is at least about 65.9 ksi after the radial expansion and plastic deformation. In an exemplary embodiment, the yield point of the predetermined portion of the tubular assembly after the radial expansion and plastic deformation is at least about 40% greater than the yield point of the predetermined portion of the tubular assembly prior to the radial expansion and plastic deformation. In an exemplary embodiment, the anisotropy of the predetermined portion of the tubular assembly, prior to the radial expansion and plastic deformation, is about 1.48. In an exemplary embodiment, the predetermined portion of the tubular assembly comprises a second steel alloy comprising: 0.18% C, 1.28% Mn, 0.017% P, 0.004% S, 0.29% Si, 0.01% Cu, 0.01% Ni, and 0.03% Cr. In an exemplary embodiment, the yield point of the predetermined portion of the tubular assembly is at most about 57.8 ksi prior to the radial expansion and plastic deformation; and wherein the yield point of the predetermined portion of the tubular assembly is at least about 74.4 ksi after the radial expansion and plastic deformation. In an exemplary embodiment, the yield point of the predetermined portion of the tubular assembly after the radial expansion and plastic deformation is at least about 28% greater than the yield point of the predetermined portion of the tubular assembly prior to the radial expansion and plastic deformation. In an exemplary embodiment, the anisotropy of the predetermined portion of the tubular assembly, prior to the radial expansion and plastic deformation, is about 1.04. In an exemplary embodiment, the predetermined portion of the tubular assembly comprises a third steel alloy comprising: 0.08% C, 0.82% Mn, 0.006% P. 0.003% S, 0.30% Si, 0.16% Cu, 0.05% Ni, and 0.05% Cr. In an exemplary embodiment, the anisotropy of the predetermined portion of the tubular assembly, prior to the radial expansion and plastic deformation, is about 1.92. In an exemplary embodiment, the predetermined portion of the tubular assembly comprises a fourth steel alloy comprising: 0.02% C, 1.31% Mn, 0.02% P, 0.001% S, 0.45% Si, 9.1% Ni, and 18.7% Cr. In an exemplary embodiment, the anisotropy of the predetermined portion of the tubular assembly, prior to the radial expansion and plastic deformation, is about 1.34. In an exemplary embodiment, the yield point of the predetermined portion of the tubular assembly is at most about 46.9 ksi prior to the radial expansion and plastic deformation; and wherein the yield point of the predetermined portion of the tubular assembly is at least about 65.9 ksi after the radial expansion and plastic deformation. In an exemplary embodiment, the yield point of the predetermined portion of the tubular assembly after the radial expansion and plastic deformation is at least about 40% greater than the yield point of the predetermined portion of the tubular assembly prior to the radial expansion and plastic deformation. In an exemplary embodiment, the anisotropy of the predetermined portion of the tubular assembly, prior to the radial expansion and plastic deformation, is at least about 1.48. In an exemplary embodiment, the yield point of the predetermined portion of the tubular assembly is at most about 57.8 ksi prior to the radial expansion and plastic deformation; and wherein the yield point of the predetermined portion of the tubular assembly is at least about 74.4 ksi after the radial expansion and plastic deformation. In an exemplary embodiment, the yield point of the predetermined portion of the tubular assembly after the radial expansion and plastic deformation is at least about 28% greater than the yield point of the predetermined portion of the tubular assembly prior to the radial expansion and plastic deformation. In an exemplary embodiment, the anisotropy of the predetermined portion of the tubular assembly, prior to the radial expansion and plastic deformation, is at least about 1.04. In an exemplary embodiment, the anisotropy of the predetermined portion of the tubular assembly, prior to the radial expansion and plastic deformation, is at least about 1.92. In an exemplary embodiment, the anisotropy of the predetermined portion of the tubular assembly, prior to the radial expansion and plastic deformation, is at least about 1.34. In an exemplary embodiment, the anisotropy of the predetermined portion of the tubular assembly, prior to the radial expansion and plastic deformation, ranges from about 1.04 to about 1.92. In an exemplary embodiment, the yield point of the predetermined portion of the tubular assembly, prior to the radial expansion and plastic deformation, ranges from about 47.6 ksi to about 61.7 ksi. In an exemplary embodiment, the expandability coefficient of the predetermined portion of the tubular assembly, prior to the radial expansion and plastic deformation, is greater than 0.12. In an exemplary embodiment, the expandability coefficient of the predetermined portion of the tubular assembly is greater than the expandability coefficient of the other portion of the tubular assembly. In an exemplary embodiment, the tubular assembly comprises a wellbore casing. In an exemplary embodiment, the tubular assembly comprises a pipeline. In an exemplary embodiment, the tubular assembly comprises a structural support.

A method of joining radially expandable tubular members has been described that includes: providing a first tubular member; engaging a second tubular member with the first tubular member to form a joint; providing a sleeve having opposite tapered ends and a flange, one of the tapered ends being a surface formed on the flange; mounting the sleeve for overlapping and coupling the first and second tubular members at the joint, wherein the flange is engaged in a recess formed in an adjacent one of the tubular members; wherein the first tubular member, the second tubular member, and the sleeve define a tubular assembly; and radially expanding and plastically deforming the tubular assembly; wherein, prior to the radial expansion and plastic deformation, a predetermined portion of the tubular assembly has a lower yield point than another portion of the tubular assembly. In an exemplary embodiment, the method further includes: providing a tapered wall in the recess for mating engagement with the tapered end formed on the flange. In an exemplary embodiment, the method further includes: providing a flange at each tapered end wherein each tapered end is formed on a respective flange. In an exemplary embodiment, the method further includes: providing a recess in each tubular member. In an exemplary embodiment, the method further includes: engaging each flange in a respective one of the recesses. In an exemplary embodiment, the method further includes: providing a tapered wall in each recess for mating engagement with the tapered end formed on a respective one of the flanges. In an exemplary embodiment, the predetermined portion of the tubular assembly has a higher ductility and a lower yield point prior to the radial expansion and plastic deformation than after the radial expansion and plastic deformation. In an exemplary embodiment, the predetermined portion of the tubular assembly has a higher ductility prior to the radial expansion and plastic deformation than after the radial expansion and plastic deformation. In an exemplary embodiment, the predetermined portion of the tubular assembly has a lower yield point prior to the radial expansion and plastic deformation than after the radial expansion and plastic deformation. In an exemplary embodiment, the predetermined portion of the tubular assembly has a larger inside diameter after the radial expansion and plastic deformation than the other portion of the tubular assembly. In an exemplary embodiment, the method further includes: positioning another tubular assembly within the preexisting structure in overlapping relation to the tubular assembly; and radially expanding and plastically deforming the other tubular assembly within the preexisting structure; wherein, prior to the radial expansion and plastic deformation of the tubular assembly, a predetermined portion of the other tubular assembly has a lower yield point than another portion of the other tubular assembly. In an exemplary embodiment, the inside diameter of the radially expanded and plastically deformed other portion of the tubular assembly is equal to the inside diameter of the radially expanded and plastically deformed other portion of the other tubular assembly. In an exemplary embodiment, the predetermined portion of the tubular assembly comprises an end portion of the tubular assembly. In an exemplary embodiment, the predetermined portion of the tubular assembly comprises a plurality of predetermined portions of the tubular assembly. In an exemplary embodiment, the predetermined portion of the tubular assembly comprises a plurality of spaced apart predetermined portions of the tubular assembly. In an exemplary embodiment, the other portion of the tubular assembly comprises an end portion of the tubular assembly. In an exemplary embodiment, the other portion of the tubular assembly comprises a plurality of other portions of the tubular assembly. In an exemplary embodiment, the other portion of the tubular assembly comprises a plurality of spaced apart other portions of the tubular assembly. In an exemplary embodiment, the tubular assembly comprises a plurality of tubular members coupled to one another by corresponding tubular couplings. In an exemplary embodiment, the tubular couplings comprise the predetermined portions of the tubular assembly; and wherein the tubular members comprise the other portion of the tubular assembly. In an exemplary embodiment, one or more of the tubular couplings comprise the predetermined portions of the tubular assembly. In an exemplary embodiment, one or more of the tubular members comprise the predetermined portions of the tubular assembly. In an exemplary embodiment, the predetermined portion of the tubular assembly defines one or more openings. In an exemplary embodiment, one or more of the openings comprise slots. In an exemplary embodiment, the anisotropy for the predetermined portion of the tubular assembly is greater than 1. In an exemplary embodiment, the anisotropy for the predetermined portion of the tubular assembly is greater than 1. In an exemplary embodiment, the strain hardening exponent for the predetermined portion of the tubular assembly is greater than 0.12. In an exemplary embodiment, the anisotropy for the predetermined portion of the tubular assembly is greater than 1; and wherein the strain hardening exponent for the predetermined portion of the tubular assembly is greater than 0.12. In an exemplary embodiment, the predetermined portion of the tubular assembly comprises a first steel alloy comprising: 0.065% C, 1.44% Mn, 0.01% P, 0.002% S, 0.24% Si, 0.01% Cu, 0.01% Ni, and 0.02% Cr. In an exemplary embodiment, the yield point of the predetermined portion of the tubular assembly is at most about 46.9 ksi prior to the radial expansion and plastic deformation; and wherein the yield point of the predetermined portion of the tubular assembly is at least about 65.9 ksi after the radial expansion and plastic deformation. In an exemplary embodiment, the yield point of the predetermined portion of the tubular assembly after the radial expansion and plastic deformation is at least about 40% greater than the yield point of the predetermined portion of the tubular assembly prior to the radial expansion and plastic deformation. In an exemplary embodiment, the anisotropy of the predetermined portion of the tubular assembly, prior to the radial expansion and plastic deformation, is about 1.48. In an exemplary embodiment, the predetermined portion of the tubular assembly comprises a second steel alloy comprising: 0.18% C, 1.28% Mn, 0.017% P, 0.004% S, 0.29% Si, 0.01% Cu, 0.01% Ni, and 0.03% Cr. In an exemplary embodiment, the yield point of the predetermined portion of the tubular assembly is at most about 57.8 ksi prior to the radial expansion and plastic deformation; and wherein the yield point of the predetermined portion of the tubular assembly is at least about 74.4 ksi after the radial expansion and plastic deformation. In an exemplary embodiment, the yield point of the predetermined portion of the tubular assembly after the radial expansion and plastic deformation is at least about 28% greater than the yield point of the predetermined portion of the tubular assembly prior to the radial expansion and plastic deformation. In an exemplary embodiment, the anisotropy of the predetermined portion of the tubular assembly, prior to the radial expansion and plastic deformation, is about 1.04. In an exemplary embodiment, the predetermined portion of the tubular assembly comprises a third steel alloy comprising: 0.08% C, 0.82% Mn, 0.006% P, 0.003,% S, 0.30% Si, 0.16% Cu, 0.05% Ni, and 0.05% Cr. In an exemplary embodiment, the anisotropy of the predetermined portion of the tubular assembly, prior to the radial expansion and plastic deformation, is about 1.92. In an exemplary embodiment, the predetermined portion of the tubular assembly comprises a fourth steel alloy comprising: 0.02% C, 1.31% Mn, 0.02% P, 0.001% S, 0.45% Si, 9.1% Ni, and 18.7% Cr. In an exemplary embodiment, the anisotropy of the predetermined portion of the tubular assembly, prior to the radial expansion and plastic deformation, is about 1.34. In an exemplary embodiment, the yield point of the predetermined portion of the tubular assembly is at most about 46.9 ksi prior to the radial expansion and plastic deformation; and wherein the yield point of the predetermined portion of the tubular assembly is at least about 65.9 ksi after the radial expansion and plastic deformation. In an exemplary embodiment, the yield point of the predetermined portion of the tubular assembly after the radial expansion and plastic deformation is at least about 40% greater than the yield point of the predetermined portion of the tubular assembly prior to the radial expansion and plastic deformation. In an exemplary embodiment, the anisotropy of the predetermined portion of the tubular assembly, prior to the radial expansion and plastic deformation, is at least about 1.48. In an exemplary embodiment, the yield point of the predetermined portion of the tubular assembly is at most about 57.8 ksi prior to the radial expansion and plastic deformation; and wherein the yield point of the predetermined portion of the tubular assembly is at least about 74.4 ksi after the radial expansion and plastic deformation. In an exemplary embodiment, the yield point of the predetermined portion of the tubular assembly after the radial expansion and plastic deformation is at least about 28% greater than the yield point of the predetermined portion of the tubular assembly prior to the radial expansion and plastic deformation. In an exemplary embodiment, the anisotropy of the predetermined portion of the tubular assembly, prior to the radial expansion and plastic deformation, is at least about 1.04. In an exemplary embodiment, the anisotropy of the predetermined portion of the tubular assembly, prior to the radial expansion and plastic deformation, is at least about 1.92. In an exemplary embodiment, the anisotropy of the predetermined portion of the tubular assembly, prior to the radial expansion and plastic deformation, is at least about 1.34. In an exemplary embodiment, the anisotropy of the predetermined portion of the tubular assembly, prior to the radial expansion and plastic deformation, ranges from about 1.04 to about 1.92. In an exemplary embodiment, the yield point of the predetermined portion of the tubular assembly, prior to the radial expansion and plastic deformation, ranges from about 47.6 ksi to about 61.7 ksi. In an exemplary embodiment, the expandability coefficient of the predetermined portion of the tubular assembly, prior to the radial expansion and plastic deformation, is greater than 0.12. In an exemplary embodiment, the expandability coefficient of the predetermined portion of the tubular assembly is greater than the expandability coefficient of the other portion of the tubular assembly. In an exemplary embodiment, the tubular assembly comprises a wellbore casing. In an exemplary embodiment, the tubular assembly comprises a pipeline. In an exemplary embodiment, the tubular assembly comprises a structural support.

An expandable tubular assembly has been described that includes a first tubular member; a second tubular member coupled to the first tubular member; a first threaded connection for coupling a portion of the first and second tubular members; a second threaded connection spaced apart from the first threaded connection for coupling another portion of the first and second tubular members; a tubular sleeve coupled to and receiving end portions of the first and second tubular members; and a sealing element positioned between the first and second spaced apart threaded connections for sealing an interface between the first and second tubular member; wherein the sealing element is positioned within an annulus defined between the first and second tubular members; and wherein, prior to a radial expansion and plastic deformation of the assembly, a predetermined portion of the assembly has a lower yield point than another portion of the apparatus. In an exemplary embodiment, the predetermined portion of the assembly has a higher ductility and a lower yield point prior to the radial expansion and plastic deformation than after the radial expansion and plastic deformation. In an exemplary embodiment, the predetermined portion of the assembly has a higher ductility prior to the radial expansion and plastic deformation than after the radial expansion and plastic deformation. In an exemplary embodiment, the predetermined portion of the assembly has a lower yield point prior to the radial expansion and plastic deformation than after the radial expansion and plastic deformation. In an exemplary embodiment, the predetermined portion of the assembly has a larger inside diameter after the radial expansion and plastic deformation than other portions of the tubular assembly. In an exemplary embodiment, the assembly further includes: positioning another assembly within the preexisting structure in overlapping relation to the assembly; and radially expanding and plastically deforming the other assembly within the preexisting structure; wherein, prior to the radial expansion and plastic deformation of the assembly, a predetermined portion of the other assembly has a lower yield point than another portion of the other assembly. In an exemplary embodiment, the inside diameter of the radially expanded and plastically deformed other portion of the assembly is equal to the inside diameter of the radially expanded and plastically deformed other portion of the other assembly. In an exemplary embodiment, the predetermined portion of the assembly comprises an end portion of the assembly. In an exemplary embodiment, the predetermined portion of the assembly comprises a plurality of predetermined portions of the assembly. In an exemplary embodiment, the predetermined portion of the assembly comprises a plurality of spaced apart predetermined portions of the assembly. In an exemplary embodiment, the other portion of the assembly comprises an end portion of the assembly. In an exemplary embodiment, the other portion of the assembly comprises a plurality of other portions of the assembly. In an exemplary embodiment, the other portion of the assembly comprises a plurality of spaced apart other portions of the assembly. In an exemplary embodiment, the assembly comprises a plurality of tubular members coupled to one another by corresponding tubular couplings. In an exemplary embodiment, the tubular couplings comprise the predetermined portions of the assembly; and wherein the tubular members comprise the other portion of the assembly. In an exemplary embodiment, one or more of the tubular couplings comprise the predetermined portions of the assembly. In an exemplary embodiment, one or more of the tubular members comprise the predetermined portions of the assembly. In an exemplary embodiment, the predetermined portion of the assembly defines one or more openings. In an exemplary embodiment, one or more of the openings comprise slots. In an exemplary embodiment, the anisotropy for the predetermined portion of the assembly is greater than 1. In an exemplary embodiment, the anisotropy for the predetermined portion of the assembly is greater than 1. In an exemplary embodiment, the strain hardening exponent for the predetermined portion of the assembly is greater than 0.12. In an exemplary embodiment, the anisotropy for the predetermined portion of the assembly is greater than 1; and wherein the strain hardening exponent for the predetermined portion of the assembly is greater than 0.12. In an exemplary embodiment, the predetermined portion of the assembly comprises a first steel alloy comprising: 0.065% C, 1.44% Mn, 0.01% P, 0.002% S, 0.24% Si, 0.01% Cu, 0.01% Ni, and 0.02% Cr. In an exemplary embodiment, the yield point of the predetermined portion of the assembly is at most about 46.9 ksi prior to the radial expansion and plastic deformation; and wherein the yield point of the predetermined portion of the assembly is at least about 65.9 ksi after the radial expansion and plastic deformation. In an exemplary embodiment, the yield point of the predetermined portion of the assembly after the radial expansion and plastic deformation is at least about 40% greater than the yield point of the predetermined portion of the assembly prior to the radial expansion and plastic deformation. In an exemplary embodiment, the anisotropy of the predetermined portion of the assembly, prior to the radial expansion and plastic deformation, is about 1.48. In an exemplary embodiment, the predetermined portion of the assembly comprises a second steel alloy comprising: 0.18% C, 1.28% Mn, 0.017% P. 0.004% S, 0.29% Si, 0.01% Cu, 0.01% Ni, and 0.03% Cr. In an exemplary embodiment, the yield point of the predetermined portion of the assembly is at most about 57.8 ksi prior to the radial expansion and plastic deformation; and wherein the yield point of the predetermined portion of the assembly is at least about 74.4 ksi after the radial expansion and plastic deformation. In an exemplary embodiment, the yield point of the predetermined portion of the assembly after the radial expansion and plastic deformation is at least about 28% greater than the yield point of the predetermined portion of the assembly prior to the radial expansion and plastic deformation. In an exemplary embodiment, the anisotropy of the predetermined portion of the assembly, prior to the radial expansion and plastic deformation, is about 1.04. In an exemplary embodiment, the predetermined portion of the assembly comprises a third steel alloy comprising: 0.08% C, 0.82% Mn, 0.006% P, 0.003% S, 0.30% Si, 0.16% Cu, 0.05% Ni, and 0.05% Cr. In an exemplary embodiment, the anisotropy of the predetermined portion of the assembly, prior to the radial expansion and plastic deformation, is about 1.92. In an exemplary embodiment, the predetermined portion of the assembly comprises a fourth steel alloy comprising: 0.02% C, 1.31% Mn, 0.02% P. 0.001% S, 0.45% Si, 9.1% Ni, and 18.7% Cr. In an exemplary embodiment, the anisotropy of the predetermined portion of the assembly, prior to the radial expansion and plastic deformation, is about 1.34. In an exemplary embodiment, the yield point of the predetermined portion of the assembly is at most about 46.9 ksi prior to the radial expansion and plastic deformation; and wherein the yield point of the predetermined portion of the assembly is at least about 65.9 ksi after the radial expansion and plastic deformation. In an exemplary embodiment, the yield point of the predetermined portion of the assembly after the radial expansion and plastic deformation is at least about 40% greater than the yield point of the predetermined portion of the assembly prior to the radial expansion and plastic deformation. In an exemplary embodiment, the anisotropy of the predetermined portion of the assembly, prior to the radial expansion and plastic deformation, is at least about 1.48. In an exemplary embodiment, the yield point of the predetermined portion of the assembly is at most about 57.8 ksi prior to the radial expansion and plastic deformation; and wherein the yield point of the predetermined portion of the assembly is at least about 74.4 ksi after the radial expansion and plastic deformation. In an exemplary embodiment, the yield point of the predetermined portion of the assembly after the radial expansion and plastic deformation is at least about 28% greater than the yield point of the predetermined portion of the assembly prior to the radial expansion and plastic deformation. In an exemplary embodiment, the anisotropy of the predetermined portion of the assembly, prior to the radial expansion and plastic deformation, is at least about 1.04. In an exemplary embodiment, the anisotropy of the predetermined portion of the assembly, prior to the radial expansion and plastic deformation, is at least about 1.92. In an exemplary embodiment, the anisotropy of the predetermined portion of the assembly, prior to the radial expansion and plastic deformation, is at least about 1.34. In an exemplary embodiment, the anisotropy of the predetermined portion of the assembly, prior to the radial expansion and plastic deformation, ranges from about 1.04 to about 1.92. In an exemplary embodiment, the yield point of the predetermined portion of the assembly, prior to the radial expansion and plastic deformation, ranges from about 47.6 ksi to about 61.7 ksi. In an exemplary embodiment, the expandability coefficient of the predetermined portion of the assembly, prior to the radial expansion and plastic deformation, is greater than 0.12. In an exemplary embodiment, the expandability coefficient of the predetermined portion of the assembly is greater than the expandability coefficient of the other portion of the assembly. In an exemplary embodiment, the assembly comprises a wellbore casing. In an exemplary embodiment, the assembly comprises a pipeline. In an exemplary embodiment, the assembly comprises a structural support. In an exemplary embodiment, the annulus is at least partially defined by an irregular surface. In an exemplary embodiment, the annulus is at least partially defined by a toothed surface. In an exemplary embodiment, the sealing element comprises an elastomeric material. In an exemplary embodiment, the sealing element comprises a metallic material. In an exemplary embodiment, the sealing element comprises an elastomeric and a metallic material.

A method of joining radially expandable tubular members is provided that includes providing a first tubular member;

providing a second tubular member; providing a sleeve; mounting the sleeve for overlapping and coupling the first and second tubular members; threadably coupling the first and second tubular members at a first location; threadably coupling the first and second tubular members at a second location spaced apart from the first location; sealing an interface between the first and second tubular members between the first and second locations using a compressible sealing element, wherein the first tubular member, second tubular member, sleeve, and the sealing element define a tubular assembly; and radially expanding and plastically deforming the tubular assembly; wherein, prior to the radial expansion and plastic deformation, a predetermined portion of the tubular assembly has a lower yield point than another portion of the tubular assembly. In an exemplary embodiment, the sealing element includes an irregular surface. In an exemplary embodiment, the sealing element includes a toothed surface. In an exemplary embodiment, the sealing element comprises an elastomeric material. In an exemplary embodiment, the sealing element comprises a metallic material. In an exemplary embodiment, the sealing element comprises an elastomeric and a metallic material. In an exemplary embodiment, the predetermined portion of the tubular assembly has a higher ductility and a lower yield point prior to the radial expansion and plastic deformation than after the radial expansion and plastic deformation. In an exemplary embodiment, the predetermined portion of the tubular assembly has a higher ductility prior to the radial expansion and plastic deformation than after the radial expansion and plastic deformation. In an exemplary embodiment, the predetermined portion of the tubular assembly has a lower yield point prior to the radial expansion and plastic deformation than after the radial expansion and plastic deformation. In an exemplary embodiment, the predetermined portion of the tubular assembly has a larger inside diameter after the radial expansion and plastic deformation than the other portion of the tubular assembly. In an exemplary embodiment, the method further includes: positioning another tubular assembly within the preexisting structure in overlapping relation to the tubular assembly; and radially expanding and plastically deforming the other tubular assembly within the preexisting structure; wherein, prior to the radial expansion and plastic deformation of the tubular assembly, a predetermined portion of the other tubular assembly has a lower yield point than another portion of the other tubular assembly. In an exemplary embodiment, the inside diameter of the radially expanded and plastically deformed other portion of the tubular assembly is equal to the inside diameter of the radially expanded and plastically deformed other portion of the other tubular assembly. In an exemplary embodiment, the predetermined portion of the tubular assembly comprises an end portion of the tubular assembly. In an exemplary embodiment, the predetermined portion of the tubular assembly comprises a plurality of predetermined portions of the tubular assembly. In an exemplary embodiment, the predetermined portion of the tubular assembly comprises a plurality of spaced apart predetermined portions of the tubular assembly. In an exemplary embodiment, the other portion of the tubular assembly comprises an end portion of the tubular assembly. In an exemplary embodiment, the other portion of the tubular assembly comprises a plurality of other portions of the tubular assembly. In an exemplary embodiment, the other portion of the tubular assembly comprises a plurality of spaced apart other portions of the tubular assembly. In an exemplary embodiment, the tubular assembly comprises a plurality of tubular members coupled to one another by corresponding tubular couplings. In an exemplary embodiment, the tubular couplings comprise the predetermined portions of the tubular assembly; and wherein the tubular members comprise the other portion of the tubular assembly. In an exemplary embodiment, one or more of the tubular couplings comprise the predetermined portions of the tubular assembly. In an exemplary embodiment, one or more of the tubular members comprise the predetermined portions of the tubular assembly. In an exemplary embodiment, the predetermined portion of the tubular assembly defines one or more openings. In an exemplary embodiment, one or more of the openings comprise slots. In an exemplary embodiment, the anisotropy for the predetermined portion of the tubular assembly is greater than 1. In an exemplary embodiment, the anisotropy for the predetermined portion of the tubular assembly is greater than 1. In an exemplary embodiment, the strain hardening exponent for the predetermined portion of the tubular assembly is greater than 0.12. In an exemplary embodiment, the anisotropy for the predetermined portion of the tubular assembly is greater than 1; and wherein the strain hardening exponent for the predetermined portion of the tubular assembly is greater than 0.12. In an exemplary embodiment, the predetermined portion of the tubular assembly comprises a first steel alloy comprising: 0.065% C, 1.44% Mn, 0.01% P, 0.002% S, 0.24% Si, 0.01% Cu, 0.01% Ni, and 0.02% Cr. In an exemplary embodiment, the yield point of the predetermined portion of the tubular assembly is at most about 46.9 ksi prior to the radial expansion and plastic deformation; and wherein the yield point of the predetermined portion of the tubular assembly is at least about 65.9 ksi after the radial expansion and plastic deformation. In an exemplary embodiment, the yield point of the predetermined portion of the tubular assembly after the radial expansion and plastic deformation is at least about 40% greater than the yield point of the predetermined portion of the tubular assembly prior to the radial expansion and plastic deformation. In an exemplary embodiment, the anisotropy of the predetermined portion of the tubular assembly, prior to the radial expansion and plastic deformation, is about 1.48. In an exemplary embodiment, the predetermined portion of the tubular assembly comprises a second steel alloy comprising: 0.18% C, 1.28% Mn, 0.017% P, 0.004% S, 0.29% Si, 0.01% Cu, 0.01% Ni, and 0.03% Cr. In an exemplary embodiment, the yield point of the predetermined portion of the tubular assembly is at most about 57.8 ksi prior to the radial expansion and plastic deformation; and wherein the yield point of the predetermined portion of the tubular assembly is at least about 74.4 ksi after the radial expansion and plastic deformation. In an exemplary embodiment, the yield point of the predetermined portion of the tubular assembly after the radial expansion and plastic deformation is at least about 28% greater than the yield point of the predetermined portion of the tubular assembly prior to the radial expansion and plastic deformation. In an exemplary embodiment, the anisotropy of the predetermined portion of the tubular assembly, prior to the radial expansion and plastic deformation, is about 1.04. In an exemplary embodiment, the predetermined portion of the tubular assembly comprises a third steel alloy comprising: 0.08% C, 0.82% Mn, 0.006% P, 0.003% S, 0.30% Si, 0.16% Cu, 0.05% Ni, and 0.05% Cr. In an exemplary embodiment, the anisotropy of the predetermined portion of the tubular assembly, prior to the radial expansion and plastic deformation, is about 1.92. In an exemplary embodiment, the predetermined portion of the tubular assembly comprises a fourth steel alloy comprising: 0.02% C, 1.31% Mn, 0.02% P, 0.001% S, 0.45% Si, 9.1% Ni, and 18.7% Cr. In an exemplary embodiment, the anisotropy of the predetermined portion of the tubular assembly, prior to the radial expansion and plastic deformation, is about 1.34. In an exemplary embodiment, the yield point of the predetermined portion of the tubular assembly is at most about 46.9 ksi prior to the radial expansion and plastic deformation; and wherein the yield point of the predetermined portion of the tubular assembly is at least about 65.9 ksi after the radial expansion and plastic deformation. In an exemplary embodiment, the yield point of the predetermined portion of the tubular assembly after the radial expansion and plastic deformation is at least about 40% greater than the yield point of the predetermined portion of the tubular assembly prior to the radial expansion and plastic deformation. In an exemplary embodiment, the anisotropy of the predetermined portion of the tubular assembly, prior to the radial expansion and plastic deformation, is at least about 1.48. In an exemplary embodiment, the yield point of the predetermined portion of the tubular assembly is at most about 57.8 ksi prior to the radial expansion and plastic deformation; and wherein the yield point of the predetermined portion of the tubular assembly is at least about 74.4 ksi after the radial expansion and plastic deformation. In an exemplary embodiment, the yield point of the predetermined portion of the tubular assembly after the radial expansion and plastic deformation is at least about 28% greater than the yield point of the predetermined portion of the tubular assembly prior to the radial expansion and plastic deformation. In an exemplary embodiment, the anisotropy of the predetermined portion of the tubular assembly, prior to the radial expansion and plastic deformation, is at least about 1.04. In an exemplary embodiment, the anisotropy of the predetermined portion of the tubular assembly, prior to the radial expansion and plastic deformation, is at least about 1.92. In an exemplary embodiment, the anisotropy of the predetermined portion of the tubular assembly, prior to the radial expansion and plastic deformation, is at least about 1.34. In an exemplary embodiment, the anisotropy of the predetermined portion of the tubular assembly, prior to the radial expansion and plastic deformation, ranges from about 1.04 to about 1.92. In an exemplary embodiment, the yield point of the predetermined portion of the tubular assembly, prior to the radial expansion and plastic deformation, ranges from about 47.6 ksi to about 61.7 ksi. In an exemplary embodiment, the expandability coefficient of the predetermined portion of the tubular assembly, prior to the radial expansion and plastic deformation, is greater than 0.12. In an exemplary embodiment, the expandability coefficient of the predetermined portion of the tubular assembly is greater than the expandability coefficient of the other portion of the tubular assembly. In an exemplary embodiment, the tubular assembly comprises a wellbore casing. In an exemplary embodiment, the tubular assembly comprises a pipeline. In an exemplary embodiment, the tubular assembly comprises a structural support. In an exemplary embodiment, the sleeve comprises: a plurality of spaced apart tubular sleeves coupled to and receiving end portions of the first and second tubular members. In an exemplary embodiment, the first tubular member comprises a first threaded connection; wherein the second tubular member comprises a second threaded connection; wherein the first and second threaded connections are coupled to one another; wherein at least one of the tubular sleeves is positioned in opposing relation to the first threaded connection; and wherein at least one of the tubular sleeves is positioned in opposing relation to the second threaded connection. In an exemplary embodiment, the first tubular member comprises a first threaded connection; wherein the second tubular member comprises a second threaded connection; wherein the first and second threaded connections are coupled to one another; and wherein at least one of the tubular sleeves is not positioned in opposing relation to the first and second threaded connections. In an exemplary embodiment, the carbon content of the tubular member is less than or equal to 0.12 percent; and wherein the carbon equivalent value for the tubular member is less than 0.21. In an exemplary embodiment, the tubular member comprises a wellbore casing.

An expandable tubular member has been described, wherein the carbon content of the tubular member is greater than 0.12 percent; and wherein the carbon equivalent value for the tubular member is less than 0.36. In an exemplary embodiment, the tubular member comprises a wellbore casing.

A method of selecting tubular members for radial expansion and plastic deformation has been described that includes: selecting a tubular member from a collection of tubular member; determining a carbon content of the selected tubular member; determining a carbon equivalent value for the selected tubular member; and if the carbon content of the selected tubular member is less than or equal to 0.12 percent and the carbon equivalent value for the selected tubular member is less than 0.21, then determining that the selected tubular member is suitable for radial expansion and plastic deformation.

A method of selecting tubular members for radial expansion and plastic deformation has been described that includes: selecting a tubular member from a collection of tubular member; determining a carbon content of the selected tubular member; determining a carbon equivalent value for the selected tubular member; and if the carbon content of the selected tubular member is greater than 0.12 percent and the carbon equivalent value for the selected tubular member is less than 0.36, then determining that the selected tubular member is suitable for radial expansion and plastic deformation.

An expandable tubular member has been described that includes: a tubular body; wherein a yield point of an inner tubular portion of the tubular body is less than a yield point of an outer tubular portion of the tubular body. In an exemplary embodiment, the yield point of the inner tubular portion of the tubular body varies as a function of the radial position within the tubular body. In an exemplary embodiment, the yield point of the inner tubular portion of the tubular body varies in an linear fashion as a function of the radial position within the tubular body. In an exemplary embodiment, the yield point of the inner tubular portion of the tubular body varies in an non-linear fashion as a function of the radial position within the tubular body. In an exemplary embodiment, the yield point of the outer tubular portion of the tubular body varies as a function of the radial position within the tubular body. In an exemplary embodiment, the yield point of the outer tubular portion of the tubular body varies in an linear fashion as a function of the radial position within the tubular body. In an exemplary embodiment, the yield point of the outer tubular portion of the tubular body varies in an non-linear fashion as a function of the radial position within the tubular body. In an exemplary embodiment, the yield point of the inner tubular portion of the tubular body varies as a function of the radial position within the tubular body; and wherein the yield point of the outer tubular portion of the tubular body varies as a function of the radial position within the tubular body. In an exemplary embodiment, the yield point of the inner tubular portion of the tubular body varies in a linear fashion as a function of the radial position within the tubular body; and wherein the yield point of the outer tubular portion of the tubular body varies in a linear fashion as a function of the radial position within the tubular body. In an exemplary embodiment, the yield point of the inner tubular portion of the tubular body varies in a linear fashion as a function of the radial position within the tubular body; and wherein the yield point of the outer tubular portion of the tubular body varies in a non-linear fashion as a function of the radial position within the tubular body. In an exemplary embodiment, the yield point of the inner tubular portion of the tubular body varies in a non-linear fashion as a function of the radial position within the tubular body; and wherein the yield point of the outer tubular portion of the tubular body varies in a linear fashion as a function of the radial position within the tubular body. In an exemplary embodiment, the yield point of the inner tubular portion of the tubular body varies in a non-linear fashion as a function of the radial position within the tubular body; and wherein the yield point of the outer tubular portion of the tubular body varies in a non-linear fashion as a function of the radial position within the tubular body. In an exemplary embodiment, the rate of change of the yield point of the inner tubular portion of the tubular body is different than the rate of change of the yield point of the outer tubular portion of the tubular body. In an exemplary embodiment, the rate of change of the yield point of the inner tubular portion of the tubular body is different than the rate of change of the yield point of the outer tubular portion of the tubular body.

A method of manufacturing an expandable tubular member has been described that includes: providing a tubular member; heat treating the tubular member; and quenching the tubular member; wherein following the quenching, the tubular member comprises a microstructure comprising a hard phase structure and a soft phase structure. In an exemplary embodiment, the provided tubular member comprises, by weight percentage, 0.065% C, 1.44% Mn, 0.01% P, 0.002% S, 0.24% Si, 0.01% Cu, 0.01% Ni, 0.02% Cr, 0.05% V, 0.01% Mo, 0.01% Nb, and 0.01% Ti. In an exemplary embodiment, the provided tubular member comprises, by weight percentage, 0.18% C, 1.28% Mn, 0.017% P, 0.004% S, 0.29% Si, 0.01% Cu, 0.01% Ni, 0.03% Cr, 0.04% V, 0.01% Mo, 0.03% Nb, and 0.01% Ti. In an exemplary embodiment, the provided tubular member comprises, by weight percentage, 0.08% C, 0.82% Mn, 0.006% P, 0.003% S, 0.30% Si, 0.06% Cu, 0.05% Ni, 0.05% Cr, 0.03% V, 0.03% Mo, 0.01% Nb, and 0.01% Ti. In an exemplary embodiment, the provided tubular member comprises a microstructure comprising one or more of the following: martensite, pearlite, vanadium carbide, nickel carbide, or titanium carbide. In an exemplary embodiment, the provided tubular member comprises a microstructure comprising one or more of the following: pearlite or pearlite striation. In an exemplary embodiment, the provided tubular member comprises a microstructure comprising one or more of the following: grain pearlite, widmanstatten martensite, vanadium carbide, nickel carbide, or titanium carbide. In an exemplary embodiment, the heat treating comprises heating the provided tubular member for about 10 minutes at 790° C. In an exemplary embodiment, the quenching comprises quenching the heat treated tubular member in water. In an exemplary embodiment, following the quenching, the tubular member comprises a microstructure comprising one or more of the following: ferrite, grain pearlite, or martensite. In an exemplary embodiment, following the quenching, the tubular member comprises a microstructure comprising one or more of the following: ferrite, martensite, or bainite. In an exemplary embodiment, following the quenching, the tubular member comprises a microstructure comprising one or more of the following: bainite, pearlite, or ferrite. In an exemplary embodiment, following the quenching, the tubular member comprises a yield strength of about 67 ksi and a tensile strength of about 95 ksi. In an exemplary embodiment, following the quenching, the tubular member comprises a yield strength of about 82 ksi and a tensile strength of about 130 ksi. In an exemplary embodiment, following the quenching, the tubular member comprises a yield strength of about 60 ksi and a tensile strength of about 97 ksi. In an exemplary embodiment, the method further includes: positioning the quenched tubular member within a preexisting structure; and radially expanding and plastically deforming the tubular member within the preexisting structure.

A method of radially expanding a tubular assembly has been described that includes radially expanding and plastically deforming a lower portion of the tubular assembly by pressurizing the interior of the lower portion of the tubular assembly; and then, radially expanding and plastically deforming the remaining portion of the tubular assembly by contacting the interior of the tubular assembly with an expansion device. In an exemplary embodiment, the expansion device is an adjustable expansion device. In an exemplary embodiment, the expansion device is a hydroforming expansion device. In an exemplary embodiment, the expansion device is a rotary expansion device. In an exemplary embodiment, the lower portion of the tubular assembly has a higher ductility and a lower yield point prior to the radial expansion and plastic deformation than after the radial expansion and plastic deformation. In an exemplary embodiment, the remaining portion of the tubular assembly has a higher ductility and a lower yield point prior to the radial expansion and plastic deformation than after the radial expansion and plastic deformation. In an exemplary embodiment, the lower portion of the tubular assembly includes a shoe defining a valveable passage.

A system for radially expanding a tubular assembly has been described that includes means for radially expanding and plastically deforming a lower portion of the tubular assembly by pressurizing the interior of the lower portion of the tubular assembly; and then, means for radially expanding and plastically deforming the remaining portion of the tubular assembly by contacting the interior of the tubular assembly with an expansion device. In an exemplary embodiment, the lower portion of the tubular assembly has a higher ductility and a lower yield point prior to the radial expansion and plastic deformation than after the radial expansion and plastic deformation. In an exemplary embodiment, the remaining portion of the tubular assembly has a higher ductility and a lower yield point prior to the radial expansion and plastic deformation than after the radial expansion and plastic deformation.

A method of repairing a tubular assembly has been described that includes positioning a tubular patch within the tubular assembly; and radially expanding and plastically deforming a tubular patch into engagement with the tubular assembly by pressurizing the interior of the tubular patch. In an exemplary embodiment, the tubular patch has a higher ductility and a lower yield point prior to the radial expansion and plastic deformation than after the radial expansion and plastic deformation.

A system for repairing a tubular assembly has been described that includes means for positioning a tubular patch within the tubular assembly; and means for radially expanding and plastically deforming a tubular patch into engagement with the tubular assembly by pressurizing the interior of the tubular patch. In an exemplary embodiment, the tubular patch has a higher ductility and a lower yield point prior to the radial expansion and plastic deformation than after the radial expansion and plastic deformation.

A method of radially expanding a tubular member has been described that includes accumulating a supply of pressurized fluid; and controllably injecting the pressurized fluid into the interior of the tubular member. In an exemplary embodiment, accumulating the supply of pressurized fluid includes: monitoring the operating pressure of the accumulated fluid; and if the operating pressure of the accumulated fluid is less than a predetermined amount, injecting pressurized fluid into the accumulated fluid. In an exemplary embodiment, controllably injecting the pressurized fluid into the interior of the tubular member includes: monitoring the operating condition of the tubular member; and if the tubular member has been radial expanded, releasing the pressurized fluid from the interior of the tubular member.

A system for radially expanding a tubular member has been described that includes means for accumulating a supply of pressurized fluid; and means for controllably injecting the pressurized fluid into the interior of the tubular member. In an exemplary embodiment, means for accumulating the supply of pressurized fluid includes: means for monitoring the operating pressure of the accumulated fluid; and if the operating pressure of the accumulated fluid is less than a predetermined amount, means for injecting pressurized fluid into the accumulated fluid. In an exemplary embodiment, means for controllably injecting the pressurized fluid into the interior of the tubular member includes: means for monitoring the operating condition of the tubular member; and if the tubular member has been radial expanded, means for releasing the pressurized fluid from the interior of the tubular member.

An apparatus for radially expanding a tubular member has been described that includes a fluid reservoir; a pump for pumping fluids out of the fluid reservoir; an accumulator for receiving and accumulating the fluids pumped from the reservoir; a flow control valve for controllably releasing the fluids accumulated within the reservoir; and an expansion element for engaging the interior of the tubular member to define a pressure chamber within the tubular member and receiving the released accumulated fluids into the pressure chamber.

An apparatus for radially expanding a tubular member has been described that includes an expandable tubular member; a locking device positioned within the expandable tubular member releasably coupled to the expandable tubular member; a tubular support member positioned within the expandable tubular member coupled to the locking device; and an adjustable expansion device positioned within the expandable tubular member coupled to the tubular support member; wherein at least a portion of the expandable tubular member has a higher ductility and a lower yield point prior to the radial expansion and plastic deformation than after the radial expansion and plastic deformation. In an exemplary embodiment, the apparatus further includes: means for transmitting torque between the expandable tubular member and the tubular support member. In an exemplary embodiment, the apparatus further includes: means for sealing the interface between the expandable tubular member and the tubular support member. In an exemplary embodiment, the apparatus further includes: another tubular support member received within the tubular support member releasably coupled to the expandable tubular member. In an exemplary embodiment, the apparatus further includes: means for transmitting torque between the expandable tubular member and the other tubular support member. In an exemplary embodiment, the apparatus further includes: means for transmitting torque between the other tubular support member and the tubular support member. In an exemplary embodiment, the apparatus further includes: means for sealing the interface between the other tubular support member and the tubular support member. In an exemplary embodiment, the apparatus further includes: means for sealing the interface between the expandable tubular member and the tubular support member. In an exemplary embodiment, the apparatus further includes: means for sensing the operating pressure within the other tubular support member. In an exemplary embodiment, the apparatus further includes: means for pressurizing the interior of the other tubular support member. In an exemplary embodiment, further includes: means for limiting axial displacement of the other tubular support member relative to the tubular support member. In an exemplary embodiment, the apparatus further includes: a tubular liner coupled to an end of the expandable tubular member. In an exemplary embodiment, the apparatus further includes: a tubular liner coupled to an end of the expandable tubular member.

An apparatus for radially expanding a tubular member has been described that includes: an expandable tubular member; a locking device positioned within the expandable tubular member releasably coupled to the expandable tubular member; a tubular support member positioned within the expandable tubular member coupled to the locking device; an adjustable expansion device positioned within the expandable tubular member coupled to the tubular support member; means for transmitting torque between the expandable tubular member and the tubular support member; means for sealing the interface between the expandable tubular member and the tubular support member; another tubular support member received within the tubular support member releasably coupled to the expandable tubular member; means for transmitting torque between the expandable tubular member and the other tubular support member; means for transmitting torque between the other tubular support member and the tubular support member; means for sealing the interface between the other tubular support member and the tubular support member; means for sealing the interface between the expandable tubular member and the tubular support member; means for sensing the operating pressure within the other tubular support member; means for pressurizing the interior of the other tubular support member; means for limiting axial displacement of the other tubular support member relative to the tubular support member; and a tubular liner coupled to an end of the expandable tubular member; wherein at least a portion of the expandable tubular member has a higher ductility and a lower yield point prior to the radial expansion and plastic deformation than after the radial expansion and plastic deformation.

A method for radially expanding a tubular member has been described that includes positioning a tubular member and an adjustable expansion device within a preexisting structure; radially expanding and plastically deforming at least a portion of the tubular member by pressurizing an interior portion of the tubular member; increasing the size of the adjustable expansion device; and radially expanding and plastically deforming another portion of the tubular member by displacing the adjustable expansion device relative to the tubular member. In an exemplary embodiment, the method further includes sensing an operating pressure within the tubular member. In an exemplary embodiment, wherein radially expanding and plastically deforming at least a portion of the tubular member by pressurizing an interior portion of the tubular member includes: injecting fluidic material into the tubular member; sensing the operating pressure of the injected fluidic material; and if the operating pressure of the injected fluidic material exceeds a predetermined value, permitting the fluidic material to enter a pressure chamber defined within the tubular member. In an exemplary embodiment, at least a portion of the tubular member has a higher ductility and a lower yield point prior to the radial expansion and plastic deformation than after the radial expansion and plastic deformation. In an exemplary embodiment, the portion of the tubular member comprises the pressurized portion of the tubular member.

A system for radially expanding a tubular member has been described that includes means for positioning a tubular member and an adjustable expansion device within a preexisting structure; means for radially expanding and plastically deforming at least a portion of the tubular member by pressurizing an interior portion of the tubular member; means for increasing the size of the adjustable expansion device; and means for radially expanding and plastically deforming another portion of the tubular member by displacing the adjustable expansion device relative to the tubular member. In an exemplary embodiment, the system further includes: sensing an operating pressure within the tubular member. In an exemplary embodiment, radially expanding and plastically deforming at least a portion of the tubular member by pressurizing an interior portion of the tubular member includes: injecting fluidic material into the tubular member; sensing the operating pressure of the injected fluidic material; and if the operating pressure of the injected fluidic material exceeds a predetermined value, permitting the fluidic material to enter a pressure chamber defined within the tubular member. In an exemplary embodiment, at least a portion of the tubular member has a higher ductility and a lower yield point prior to the radial expansion and plastic deformation than after the radial expansion and plastic deformation. In an exemplary embodiment, the portion of the tubular member includes the pressurized portion of the tubular member.

A method of radially expanding and plastically deforming an expandable tubular member has been described that includes limiting the amount of radial expansion of the expandable tubular member. In an exemplary embodiment, limiting the amount of radial expansion of the expandable tubular member includes: coupling another tubular member to the expandable tubular member that limits the amount of the radial expansion of the expandable tubular member. In an exemplary embodiment, the other tubular member defines one or more slots. In an exemplary embodiment, the other tubular member has a higher ductility and a lower yield point prior to the radial expansion and plastic deformation than after the radial expansion and plastic deformation.

An apparatus for radially expanding a tubular member has been described that includes an expandable tubular member; an expansion device coupled to the expandable tubular member for radially expanding and plastically deforming the expandable tubular member; and an tubular expansion limiter coupled to the expandable tubular member for limiting the degree to which the expandable tubular member may be radially expanded and plastically deformed. In an exemplary embodiment, the tubular expansion limiter includes a tubular member that defines one or more slots. In an exemplary embodiment, the tubular expansion limiter comprises a tubular member that has a higher ductility and a lower yield point prior to the radial expansion and plastic deformation than after the radial expansion and plastic deformation. In an exemplary embodiment, the apparatus further includes: a locking device positioned within the expandable tubular member releasably coupled to the expandable tubular member; a tubular support member positioned within the expandable tubular member coupled to the locking device and the expansion device. In an exemplary embodiment, at least a portion of the expandable tubular member has a higher ductility and a lower yield point prior to the radial expansion and plastic deformation than after the radial expansion and plastic deformation. In an exemplary embodiment, the apparatus further includes: means for transmitting torque between the expandable tubular member and the tubular support member. In an exemplary embodiment, the apparatus further includes: means for sealing the interface between the expandable tubular member and the tubular support member. In an exemplary embodiment, the apparatus further includes means for sealing the interface between the expandable tubular member and the tubular support member. In an exemplary embodiment, the apparatus further includes: means for sensing the operating pressure within the tubular support member. In an exemplary embodiment, the apparatus further includes: means for pressurizing the interior of the tubular support member.

An apparatus for radially expanding a tubular member has been described that includes: an expandable tubular member; an expansion device coupled to the expandable tubular member for radially expanding and plastically deforming the expandable tubular member; an tubular expansion limiter coupled to the expandable tubular member for limiting the degree to which the expandable tubular member may be radially expanded and plastically deformed; a locking device positioned within the expandable tubular member releasably coupled to the expandable tubular member; a tubular support member positioned within the expandable tubular member coupled to the locking device and the expansion device; means for transmitting torque between the expandable tubular member and the tubular support member; means for sealing the interface between the expandable tubular member and the tubular support member; means for sensing the operating pressure within the tubular support member; and means for pressurizing the interior of the tubular support member; wherein at least a portion of the expandable tubular member has a higher ductility and a lower yield point prior to the radial expansion and plastic deformation than after the radial expansion and plastic deformation.

A method for radially expanding a tubular member has been described that includes positioning a tubular member and an adjustable expansion device within a preexisting structure; radially expanding and plastically deforming at least a portion of the tubular member by pressurizing an interior portion of the tubular member; limiting the extent to which the portion of the tubular member is radially expanded and plastically deformed by pressurizing the interior of the tubular member; increasing the size of the adjustable expansion device; and radially expanding and plastically deforming another portion of the tubular member by displacing the adjustable expansion device relative to the tubular member. In an exemplary embodiment, the method further includes sensing an operating pressure within the tubular member. In an exemplary embodiment, radially expanding and plastically deforming at least a portion of the tubular member by pressurizing an interior portion of the tubular member includes: injecting fluidic material into the tubular member; sensing the operating pressure of the injected fluidic material; and if the operating pressure of the injected fluidic material exceeds a predetermined value, permitting the fluidic material to enter a pressure chamber defined within the tubular member. In an exemplary embodiment, at least a portion of the tubular member has a higher ductility and a lower yield point prior to the radial expansion and plastic deformation than after the radial expansion and plastic deformation. In an exemplary embodiment, limiting the extent to which the portion of the tubular member is radially expanded and plastically deformed by pressurizing the interior of the tubular member includes: applying a force to the exterior of the tubular member. In an exemplary embodiment, applying a force to the exterior of the tubular member includes: applying a variable force to the exterior of the tubular member.

A system for radially expanding a tubular member has been described that includes means for positioning a tubular member and an adjustable expansion device within a preexisting structure; means for radially expanding and plastically deforming at least a portion of the tubular member by pressurizing an interior portion of the tubular member; means for limiting the extent to which the portion of the tubular member is radially expanded and plastically deformed by pressurizing the interior of the tubular member; means for increasing the size of the adjustable expansion device; and means for radially expanding and plastically deforming another portion of the tubular member by displacing the adjustable expansion device relative to the tubular member. In an exemplary embodiment, the method further includes: means for sensing an operating pressure within the tubular member. In an exemplary embodiment, means for radially expanding and plastically deforming at least a portion of the tubular member by pressurizing an interior portion of the tubular member includes: means for injecting fluidic material into the tubular member; means for sensing the operating pressure of the injected fluidic material; and if the operating pressure of the injected fluidic material exceeds a predetermined value, means for permitting the fluidic material to enter a pressure chamber defined within the tubular member. In an exemplary embodiment, at least a portion of the tubular member has a higher ductility and a lower yield point prior to the radial expansion and plastic deformation than after the radial expansion and plastic deformation. In an exemplary embodiment, means for limiting the extent to which the portion of the tubular member is radially expanded and plastically deformed by pressurizing the interior of the tubular member includes: means for applying a force to the exterior of the tubular member. In an exemplary embodiment, wherein means for applying a force to the exterior of the tubular member includes: means for applying a variable force to the exterior of the tubular member.

It is understood that variations may be made in the foregoing without departing from the scope of the invention. For example, the teachings of the present illustrative embodiments may be used to provide a wellbore casing, a pipeline, or a structural support. Furthermore, the elements and teachings of the various illustrative embodiments may be combined in whole or in part in some or all of the illustrative embodiments. In addition, one or more of the elements and teachings of the various illustrative embodiments may be omitted, at least in part, and/or combined, at least in part, with one or more of the other elements and teachings of the various illustrative embodiments.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

What is claimed is:

1. An apparatus, comprising:

an expandable tubular assembly; and an expansion device coupled to the expandable tubular assembly;

wherein a predetermined portion of the expandable tubular assembly has a lower yield point than another portion of the expandable tubular assembly;

wherein the predetermined portion of the expandable tubular assembly comprises a bottom end portion of the expandable tubular assembly;

wherein a yield point of an inner tubular portion of at least a portion of the tubular assembly is less than a yield point of an outer tubular portion of the portion of the tubular assembly; and wherein the yield point of the inner tubular portion of the tubular body varies as a function of the radial position within the tubular body.

2. The apparatus of claim 1, wherein the yield point of the inner tubular portion of the tubular body varies in a fashion comprising one of the following:

a linear fashion as a function of the radial position within the tubular body; and a non-linear fashion as a function of the radial position within the tubular body.

3. An apparatus, comprising:

an expandable tubular assembly; and an expansion device coupled to the expandable tubular assembly;

wherein a predetermined portion of the expandable tubular assembly has a lower yield point than another portion of the expandable tubular assembly;

wherein the predetermined portion of the expandable tubular assembly comprises a bottom end portion of the expandable tubular assembly;

wherein a yield point of an inner tubular portion of at least a portion of the tubular assembly is less than a yield point of an outer tubular portion of the portion of the tubular assembly; and wherein the yield point of the outer tubular portion of the tubular body varies as a function of the radial position within the tubular body.

4. The apparatus of claim 3, wherein the yield point of the outer tubular portion of the tubular body varies in a fashion comprising one of the following:

a linear fashion as a function of the radial position within the tubular body; and a non-linear fashion as a function of the radial position within the tubular body.

5. An apparatus, comprising:

an expandable tubular assembly; and an expansion device coupled to the expandable tubular assembly;

wherein a predetermined portion of the expandable tubular assembly has a lower yield point than another portion of the expandable tubular assembly;

wherein the predetermined portion of the expandable tubular assembly comprises a bottom end portion of the expandable tubular assembly;

wherein a yield point of an inner tubular portion of at least a portion of the tubular assembly is less than a yield point of an outer tubular portion of the portion of the tubular assembly; and wherein the yield point of the inner tubular portion of the tubular body varies as a function of the radial position within the tubular body; and wherein the yield point of the outer tubular portion of the tubular body varies as a function of the radial position within the tubular body.

6. The apparatus of claim 5, wherein the yield point of the inner tubular portion of the tubular body varies in a fashion comprising one of the following:

a linear fashion as a function of the radial position within the tubular body; and a non-linear fashion as a function of the radial position within the tubular body;

and wherein the yield point of the outer tubular portion of the tubular body varies in a fashion comprising one of the following:

a linear fashion as a function of the radial position within the tubular body; and a non-linear fashion as a function of the radial position within the tubular body.

7. The apparatus of claim 5, wherein the rate of change of the yield point of the inner tubular portion of the tubular body is different than the rate of change of the yield point of the outer tubular portion of the tubular body.

8. An apparatus, comprising:

an expandable tubular assembly; and an expansion device coupled to the expandable tubular assembly;

wherein a predetermined portion of the expandable tubular assembly has a lower yield point than another portion of the expandable tubular assembly; and wherein the predetermined portion of the expandable tubular assembly comprises a bottom end portion of the expandable tubular assembly; and wherein at least a portion of the tubular assembly comprises a microstructure comprising a hard phase structure and a soft phase structure.

9. The apparatus of claim 8, wherein prior to the radial expansion and plastic deformation, at least a portion of the tubular assembly comprises a microstructure comprising a transitional phase structure.

10. The apparatus of claim 8, wherein the hard phase structure comprises martensite.

11. The apparatus of claim 8, wherein the soft phase structure comprises ferrite.

12. The apparatus of claim 8, wherein the transitional phase structure comprises retained austentite.

13. The apparatus of claim 8, wherein the hard phase structure comprises martensite; wherein the soft phase structure comprises ferrite; and wherein the transitional phase structure comprises retained austentite.

14. The apparatus of claim 8, wherein the portion of the tubular assembly comprises one or more of the following combinations, by weight percentage:

about 0.1% C, about 1.2% Mn, and about 0.3% Si;

0.065% C, 1.44% Mn, 0.01% P, 0.002% S, 0.24% Si, 0.01% Cu, 0.01% Ni, 0.02% Cr, 0.05% V, 0.01% Mo, 0.01% Nb, and 0.01% Ti;

0.18% C, 1.28% Mn, 0.017% P, 0.004% S, 0.29% Si, 0.01% Cu, 0.01% Ni, 0.03% Cr, 0.04% V, 0.01% Mo, 0.03% Nb, and 0.01% Ti; and 0.08% C, 0.82% Mn, 0.006% P, 0.003% S, 0.30% Si, 0.06% Cu, 0.05% Ni, 0.05% Cr, 0.03% V, 0.03% Mo, 0.01% Nb, and 0.01% Ti.

15. The apparatus of claim 8, wherein the portion of the tubular assembly comprises one or more of the following:

a microstructure comprising one or more of the following: martensite, pearlite, vanadium carbide, nickel carbide, or titanium carbide;

a microstructure comprising one or more of the following: pearlite or pearlite striation;

a microstructure comprising one or more of the following: grain pearlite, widmanstatten martensite, vanadium carbide, nickel carbide, or titanium carbide;

a microstructure comprising one or more of the following: ferrite, grain pearlite, or martensite;

a microstructure comprising one or more of the following: ferrite, martensite, or bainite; and a microstructure comprising one or more of the following: bainite, pearlite, or ferrite.

16. The apparatus of claim 8, wherein the portion of the tubular assembly comprises a set of mechanical properties comprising one of the following combinations:

a yield strength of about 67 ksi and a tensile strength of about 95 ksi;

a yield strength of about 82 ksi and a tensile strength of about 130 ksi; and a yield strength of about 60 ksi and a tensile strength of about 97 ksi.

* * * * *